United States Patent [19]

Rush

[11] 4,361,300

[45] Nov. 30, 1982

[54] VEHICLE TRAIN ROUTING APPARATUS AND METHOD

[75] Inventor: Donald L. Rush, Penn Hills, Pa.

[73] Assignee: Westinghouse Electric Corp., Pittsburgh, Pa.

[21] Appl. No.: 195,261

[22] Filed: Oct. 8, 1980

[51] Int. Cl.[3] ..... B61L 27/04

[52] U.S. Cl. ..... 246/5; 246/187 C; 340/23; 340/47; 364/436

[58] Field of Search ..... 340/23, 24, 47; 364/436, 447, 443; 246/5, 182 B, 187 B, 187 C

[56] References Cited

U.S. PATENT DOCUMENTS

| | | | |
|---|---|---|---|
| 3,639,754 | 2/1972 | Kovalcik et al. | 246/182 B |
| 3,895,584 | 7/1975 | Paddison | 104/88 |
| 3,976,272 | 8/1976 | Murray et al. | 246/5 |
| 4,007,897 | 2/1977 | Auer, Jr. | 246/187 B |
| 4,023,753 | 5/1977 | Dobler | 246/5 |

OTHER PUBLICATIONS

"BART: Controls are Well Along", *Railway Signaling and Communications*, pp. 27–38.

"Sao Paulo Metro E-W Line Innovations", *Conference Record of 12th Annual IEEE Industrial Apps. Society*, pp. 1105–1109.

*Conference Record of 28th IEEE Vehicular Technology Group*, Mar. 1978, pp. 1–10.

Barpal, I. S. et al., "The Sao Paulo Metro Automated Transit System, Rapid Transit Conf.", Am. Public Transit Assoc., Jun. 1978.

*Primary Examiner*—Glen R. Swann, III

*Attorney, Agent, or Firm*—R. G. Brodahl

[57] ABSTRACT

The movement route of a vehicle operative with a roadway track having a plurality of stations and control signal gates is selected from a storage table of predetermined available routes in accordance with the known track plan and in relation to each station. When the vehicle arrives at each of the stations, the desired available route is established to the next station in relation to occupied track signal blocks, the known direction of train movement and switch gates cleared to permit vehicle travel to that next station. The available route to the next station is cleared in time so the vehicle will not have to slow down or stop in front of a switch gate. In addition the spacing of vehicle trains is regulated in relation to the plurality of stations.

16 Claims, 83 Drawing Figures

GATE PB INPUTS

| | |
|---|---|
| GPBIN | |
| | |

PRIOR ART

FIG.15A

GATE PB PAST VALUES

| | |
|---|---|
| GPBPV | |
| | |

PRIOR ART

FIG. 15B

GATE PB CHANGES

| | |
|---|---|
| GPBCHG | |
| | |

PRIOR ART

FIG. 15C

GATE PB WENT TO 1

| | |
|---|---|
| GPBTO1 | |
| | |

PRIOR ART

FIG. 15D

GATE PB WENT TO 0

| | |
|---|---|
| GPBTOZ | |
| | |

PRIOR ART

FIG. 15E

GATE INDICATION WENT TO 1

| | |
|---|---|
| GKTO1 | |
| | |

PRIOR ART

FIG.15F

MANUAL SETUP REQUEST BITS

| | |
|---|---|
| PBSET | |
| | |

PRIOR ART

FIG. 15G

MANUAL CANCEL REQUEST BITS

| | |
|---|---|
| PBCAN | |
| | |

PRIOR ART

FIG. 15H

GATE ENTRANCE NUMBERS

| | |
|---|---|
| POBNT | :102 |
| | :100 |
| | :200 |
| | • |
| | • |
| | • |
| | :222 |
| | :124 |
| | SPARE |
| | SPARE |

PRIOR ART

FIG.15I

EXIT TRACK CIRCUITS

| | |
|---|---|
| TKO | 12 TK |
| | 35 TK |
| | • |
| | • |
| | • |
| | 28 TK |
| | 3 TK |

PRIOR ART

FIG.15J

| | | | | | |
|---|---|---|---|---|---|
| CKT 1 | 0 | 0 | E | 2 | 1 NLP |
| | 0 | 0 | F | 2 | 1 RLP |
| | 0 | 0 | C | 1 | X1B RR |
| CKT 2 | 0 | 0 | E | 4 | 3 NLP |
| | ⋮ | | | | |
| | 0 | 0 | D | 7 | X7 DRR |
| CKT 13 | 0 | 0 | 0 | 0 | |

FIG. 22I
PRIOR ART

| | | | | | |
|---|---|---|---|---|---|
| AR1 | 0 | B | 2 | 4 | 3 TLK |
| | 0 | B | 2 | 5 | 4 TLK |
| | 0 | B | 2 | 6 | 5A TLK |
| | 0 | B | 2 | 7 | 5B TLK |
| | 0 | B | 2 | 8 | 6 TLK |
| | 0 | B | 2 | 9 | 7 TLK |
| | 0 | B | 2 | A | 8 TLK |
| | 0 | B | 2 | B | 9 TLK |
| | 0 | B | 2 | C | 10 TLK |
| | 0 | B | 2 | D | 11 TLK |
| | 0 | B | 2 | E | 12 TLK |
| | 0 | B | A | 6 | MODE 30 |
| | 0 | 8 | 7 | 2 | 1 PB REV |
| | 0 | 8 | 7 | 4 | 3 PB REV |
| AR2 | 0 | B | 2 | 4 | 3 TLK |
| | ⋮ | | | | |
| | 0 | 8 | 7 | 5 | 4 PB REV |
| AR 39 | 0 | 0 | 0 | 0 | |

FIG. 22J
PRIOR ART

| | | | | | |
|---|---|---|---|---|---|
| SR1 | 0 | 0 | E | 2 | 1 NLP |
| | 0 | 0 | E | 4 | 3 NLP |
| | 8 | 8 | A | 2 | 1N |
| | 8 | 8 | A | 4 | 3N |
| | 0 | 5 | 6 | 4 | 3 LK |
| | 0 | 5 | 6 | 5 | 4 LK |
| | 0 | 5 | 6 | 6 | 5A LK |
| | 0 | 5 | 6 | 7 | 5B LK |
| | 0 | 5 | 6 | 8 | 6 LK |
| | 0 | 5 | 6 | 9 | 7 LK |
| | 0 | 5 | 6 | A | 8 LK |
| | 0 | 5 | 6 | B | 9 LK |
| | 0 | 5 | 6 | C | 10 LK |
| | 0 | 5 | 6 | D | 11 LK |
| | 0 | 5 | 6 | E | 12 LK |
| | 0 | 0 | C | 1 | |
| SR2 | 0 | 0 | F | 2 | |
| | ⋮ | | | | |
| | 0 | 0 | C | 3 | X1D RR |
| SR 39 | 0 | 0 | 0 | 0 | |

FIG. 22K
PRIOR ART

| | | | | | |
|---|---|---|---|---|---|
| TKCAN | 0 | 8 | C | 4 | 3 TK |
| | 0 | 8 | C | 5 | 4 TK |
| | 0 | 8 | C | F | 13 TK |
| | ⋮ | | | | |
| | 0 | 8 | F | 9 | 47 TK |
| | 0 | 8 | F | C | 50 TK |

FIG. 22L
PRIOR ART

| | | | | | |
|---|---|---|---|---|---|
| PRIOR | 0 | 1 | 0 | 2 | EXIT |
| | 0 | 1 | 0 | 8 | FIRST |
| | 0 | 1 | 0 | 6 | SECOND |
| | ⋮ | | | | |
| | 0 | 2 | 1 | 6 | FIRST |
| | 0 | 1 | 1 | 6 | SECOND |

FIG. 22M
PRIOR ART

| | |
|---|---|
| GKIN | GATE INPUTS |
| GKPV | GATE PAST VALUES |
| GKCHG | GATE CHANGES |
| GKTOI | GATE CLEARED |
| GKTOZ | GATE CLOSED |

FIG.41A
PRIOR ART

| | |
|---|---|
| SWIN | SWITCH INPUTS |
| SWPV | SWITCH OUTPUTS |
| SWCHG | SWITCH CHANGES |
| SWTOI | SWITCH WENT TO I |
| SWTOZ | SWITCH WENT TOO |

FIG.41B
PRIOR ART

| | |
|---|---|
| GPBIN | GATE PB INPUTS |
| GPBPV | GATE PV PAST VALUES |
| GPBCHG | GATE PB CHANGES |
| GPBTOI | GATE PB TURNED ON |
| GPBTOZ | GATE PB TURNED OFF |
| PBSET | MANUAL ROUTE SETUP |
| PBCAN | MANUAL ROUTE CANCEL |

FIG.41E
PRIOR ART

| | |
|---|---|
| TKIN | TRACK CIRCUIT INPUTS |
| TKPV | TRACK CIRCUIT PAST VALUES |
| TKCHG | TRACK CIRCUIT CHANGES |
| TKTOI | TRACK CKT BECAME OCCUPIED |
| TKTOZ | TRACK CKT BECAME UNOCCUPIED |

FIG.41C PRIOR ART

| | |
|---|---|
| SWLK | SWITCH LOCKOUTS(PB) |
| TSLK | TRIPSTOP LOCKOUTS |
| LK | SOFTWARE LOCKOUTS |
| TLK | TKIN ORED WITH LK |
| STALK | STATION LOCKOUTS |

FIG.41D
PRIOR ART

| | | | | |
|---|---|---|---|---|
| NGSTAT | 5 | 0 | C | 0 |
| NTSTAT | 5 | 0 | C | 1 |
| NASTAT | 5 | 0 | C | 2 |
| NBSTAT | 5 | 0 | C | 3 |
| NCSTAT | 5 | 0 | C | 4 |
| NDSTAT | 5 | 0 | C | 5 |
| NYSTAT | 5 | 0 | C | 6 |
| NSSTAT | 5 | 0 | C | 7 |
| SGSTAT | 5 | 0 | C | 8 |
| STSTAT | 5 | 0 | C | 9 |
| SASTAT | 5 | 0 | C | A |
| SBSTAT | 5 | 0 | C | B |
| SCSTAT | 5 | 0 | C | C |
| SDSTAT | 5 | 0 | C | D |
| SYSTAT | 5 | 0 | C | E |
| SSSTAT | 5 | 0 | C | F |

FIG.41F
PRIOR ART

| | | | | |
|---|---|---|---|---|
| BITO | 0 | 0 | 0 | 1 |
| | 0 | 0 | 0 | 2 |
| | 0 | 0 | 0 | 4 |
| | 0 | 0 | 0 | 8 |
| | 0 | 0 | 1 | 0 |
| | 0 | 0 | 2 | 0 |
| | 0 | 0 | 4 | 0 |
| | 0 | 0 | 8 | 0 |
| | 0 | 1 | 0 | 0 |
| | 0 | 2 | 0 | 0 |
| | 0 | 4 | 0 | 0 |
| | 0 | 8 | 0 | 0 |
| | 1 | 0 | 0 | 0 |
| | 2 | 0 | 0 | 0 |
| | 4 | 0 | 0 | 0 |
| | 8 | 0 | 0 | 0 |

FIG.41G
PRIOR ART

| | | | | |
|---|---|---|---|---|
| NBITO | F | F | F | E |
| | F | F | F | D |
| | F | F | F | B |
| | F | F | F | 7 |
| | F | F | E | F |
| | F | F | D | F |
| | F | F | B | F |
| | F | F | 7 | F |
| | F | E | F | F |
| | F | D | F | F |
| | F | B | F | F |
| | F | 7 | F | F |
| | E | F | F | F |
| | D | F | F | F |
| | B | F | F | F |
| | 7 | F | F | F |

FIG.41H
PRIOR ART

| F | E | D | C | B | A | 9 | 8 | 7 | 6 | 5 | 4 | 3 | 2 | 1 | 0 |
|---|---|---|---|---|---|---|---|---|---|---|---|---|---|---|---|
| NO MODE N TRACK | NO MODE S TRACK | • • • | • • • | • • • | 33 • • • SPEC N BY | 30''' • • • SPEC LOOP | 30'' • • • SPEC LOOP | 30' • • • SPEC LOOP | 30 • • • NOR LOOP | 31 • • • ALT N BY | 32 • • • ALT S BY | 20 • • • N BY | 10 • • • S BY | 22 • • • N SHUTTLE | 12 • • • S SHUTTLE |

10 - SOUTH SHUTTLE - ONE TRAIN
12 - NORTH SHUTTLE - ONE TRAIN
20 - SOUTH BYPASS SHUTTLE - TWO TRAINS
22 - NORTH BYPASS SHUTTLE - TWO TRAINS
30 - NORMAL LOOP - TM AT NG, SD
30' - SPECIAL LOOP - TM AT SG, SD
31 - ALTERNATE NORTH BYPASS - TM AT SG, SD
32 - ALTERNATE SOUTH BYPASS - TM AT NG, SD
33 - SPECIAL ALTERNATE NORTH BYPASS - TM AT NG, SD
33'' - SPECIAL LOOP - TM AT NG, SS
33''' - SPECIAL LOOP - TM AT SG, SS

FIG. 44

| F | E | D | C | B | A | 9 | 8 | 7 | 6 | 5 | 4 | 3 | 2 | 1 | 0 |
|---|---|---|---|---|---|---|---|---|---|---|---|---|---|---|---|
| RUN THRU FLAG | ROUTE CLEAR FLAG | HDWAY COMP FLAG | DWELL COMP FLAG | | DIR | ROUTE WAS SELECTED FLAG | NEXT STA DET FLAG | DIR DET FLAG | DWELL STARTED FLAG | DOOR OPEN FLAG | HTDO SET | STA OCC FLAG | EXIT COMP FLAG | IN COMP FLAG | ENT COMP FLAG |

STATION STATUS WORD (1 PER STATION-16)

BIT

0 STATIC ENTRY LOGIC COMPLETE FLAG
1 IN STATION LOGIC COMPLETE FLAG
2 STATION EXIT LOGIC COMPLETE FLAG
3 STATION IS OCCUPIED FLAG
4 HOLD TRAIN DOORS OPEN IS SET
5 DOORS HAVE OPEN FLAG
6 DWELL TIME HAS STARTED FLAG
7 DIRECTION TO NEXT STATION HAS BEEN DETFLAG
8 NEXT STATION HAS BEEN DETERMINED FLAG
9 ROUTE HAS BEEN SELECTED FLAG
A DIRECTION OF TRAVEL
B
C DWELL COMPLETE FLAG
D HEADWAY COMPLETE FLAG
E ROUTE IS CLEARED FLAG
F RUNTHRU WAS ON AT APPROACH BLOCK FLAG

FIG. 45 PRIOR ART

VEHICLE TRAIN ROUTING APPARATUS AND METHOD

CROSS REFERENCE TO RELATED APPLICATION

The present application is related to a patent application Ser. No. 195,279 that was filed concurrently herewith by D. L. Rush and entitled "Vehicle Train Tracking Apparatus and Method", which is assigned to the same assignee and the disclosure of which is incorporated herein by reference.

BACKGROUND OF THE INVENTION

It is known in the prior art to provide an identification system on a train to enable the routing of that train moving along a roadway track. For example it is known for vehicle trains, such as operative with the BART system in San Francisco as described in an article published in December 1967 in Railway Signaling and Communications at pages 18 to 23, in an article published in March 1970 in Westinghouse Engineer at pages 51 to 54 and in an article published in September 1972 in Westinghouse Engineer at pages 145 to 151, to include a train identification system on every train that provides an identification to each station when the given train enters that station. It is known for vehicle trains, such as operative with the Seattle-Tacoma International Airport as described in an article published in January 1971 in Westinghouse Engineer at pages 8 to 14, to include a radio carried by every train to actively provide an identification to each station entered by that train.

The following publications relate to the equipment provided for the Atlanta Airport.

(1.) Atlanta Airport Automated Guideway Transit System by John Kapala for the ASCE Convention in Atlanta, Ga., Oct. 23-25, 1979.

(2.) Recent Applications of Microprocessor Technology To People Mover Systems by M. P. McDonald et al. for the IEEE Vehicular Technology Group Conference in Chicago, Ill., Mar. 28, 1979.

(3.) Atlanta Airport People Mover by T. C. Selis in the Conference Record of the IEEE Vehicular Technology Group Conference in Denver, Colo., Mar. 24, 1978.

SUMMARY OF THE INVENTION

The present invention is to be first applied to control vehicle trains in relation to the guideway transit system supplied for the Atlanta Hartsfield International Airport.

The present invention relates to determining the movement route of a vehicle train along a roadway track system from a location in relation to any station to any other station, where a route is found to be available depending upon operator inputs, the mode of operation and commands such as store and dispatch. A table of every available route in relation to each station and the known track plan is provided initially in a memory table. When a train arrives at a station, this table is used to establish the desired available route in relation to occupied track circuit signal blocks, the direction of train movement and gates cleared for the train to travel in relation to switches in the track system.

BRIEF DESCRIPTION OF THE DRAWINGS

FIGS. 15A to 15M show prior art manual routing program tables;

FIGS. 22A-22M show the prior art automatic routine program tables;

FIGS. 41A and 41H show prior art ETC program tables;

FIG. 44 shows the mode flag word in accordance with the present invention; and FIG. 45 shows a prior art station status word.

GENERAL OPERATIVE DESCRIPTION OF THE TRAIN TRACKING PROGRAM

The function of the train routing control is to route the trains around the system by establishing the desired available route for each train on the system from a presently occupied station to the next station, and to provide protection lockouts to prevent another train from requesting the same route or conflict with the movement of any other train, on a station-to-station basis.

For each of the stations in the track system, the present routing control has three separate operations, the first being the station entry logic which includes all logic necessary to process a train into a station. It is complete when a train runs through the station or when the train doors open. The second operation is the in-station logic, which involves next station determination and the route selection. It is completed when the route to the next station is selected. The last operation is the station exit logic, where functions are done to check the train out of a station when the heading and dwell time have elapsed, such as, closing the doors and sending information to the next station that the train has started and its train number.

In order to route trains around the system, the direction of travel must be known at the time a station becomes occupied. This direction for each track circuit is established by the above cross-referenced vehicle train tracking apparatus and method.

There is a gate signal in front of every switch for each direction of travel through that switch. Identification numbers are assigned to each gate signal, and these numbers are used to establish the desired routes. Exit and entrance tables are set up in relation to each gate signal location and are used to determine the route in relation to that gate signal. Each route has an associated information table which includes all physical conditions that have to be satisfied before a train is routed from that gate. When a route for a given gate signal number is found and stored, a check is made for other routes with the same entrance number and a determination is made to see which of these are available. If two exits are the same, there are two available routes and the priority routine is utilized to establish the desired one of these route for the train.

The train routing program is executed once each cycle for each occupied station to establish a desired route for the train that occupies that station.

DESCRIPTION OF A PREFERRED EMBODIMENT

Figure 1:
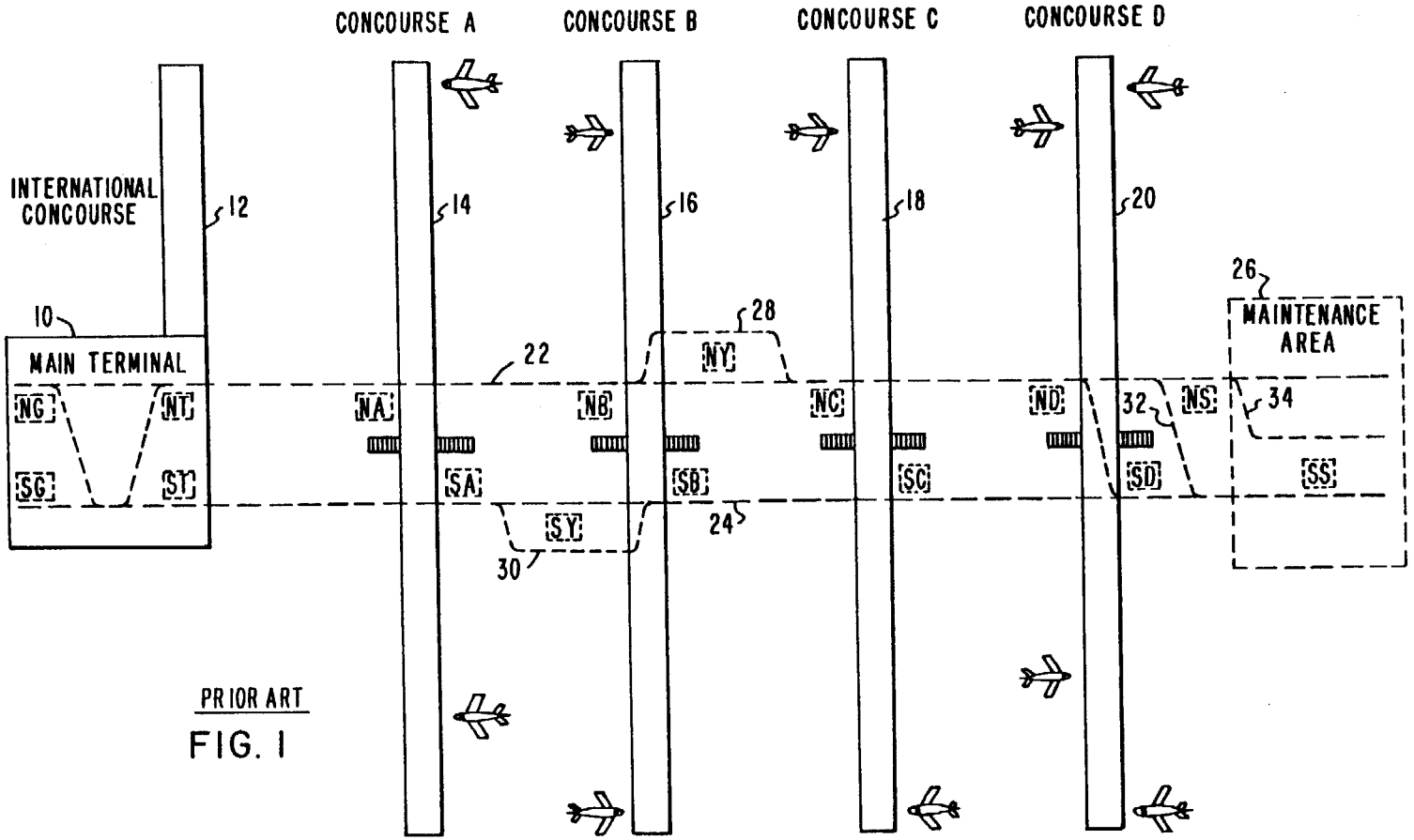
PRIOR ART FIG. 1
FIG. 1 shows a prior art physical arrangement of a typical track system.

FIG. 1 shows a prior art physical arrangement diagram of the new international airport complex now under construction in Atlanta, Ga. The main terminal 10 is at the west end. The international terminal 12 is north of the main terminal 10. Toward the each are four long narrow concourses 14, 16, 18 and 20 for the planes to load and unload passengers. Underground and running through the center from the terminal building 10 all the way up through concourse 20 is an underground transit system, including a first track 22 and a second track 24. To the east of concourse 20 is an underground maintenance area 26, which is large enough to store and repair transit cars. Normally, the passengers will come into the parking lots on either side of the main terminal 10 and go inside to the ticketing area, where they will obtain tickets and check baggage before going down to the lower area where the transit system is located to carry them to the proper concourse for catching an airplane. Coming back from one of the concourses, passengers ride an escalator down to the transit system and catch the next train for riding to the baggage area to pick up baggage and go up into the main terminal and leave.

The normal direction movement of the vehicle trains is counterclockwise. A typical train will start at station NG on the north track 22, and cross over through the switches to the south track 24 before stopping at south ticketing ST. The train then moves through stations SA, SB, SC and SD. At this point the train will reverse and cross over through the switches to the north track 22, stopping at stations ND, NC, NB and NA. The system can be set up to skip north ticketing NT and go to the baggage station NG. That is the normal mode of operation. It is desired that this system keep running regardless of most breakdowns or the like, so the computer control provides various backup modes of operation. Instead of using the turn back point in north baggage station NG, the train can go to south baggage station SG. On the east end, instead of using the south track station SD, the train can use south spur station SS, which is a pseudo station in the maintenance area 26 to the east of south track station SD, in case there is a switch problem on the crossover between the stations SD and ND. If there is a train broken down on either one of the north track 22 or the south track 24, there can be provided a shuttle mode, where a given train will go back and forth down each individual track 22 or 24 in shuttle fashion between any two or more stations on that track. For operation on off peak hours, one track can be shut down for maintenance and two trains can run on the other track using the bypass 28 for north track 22 and the bypass 30 for south track 24 to pass. There are twelve regular stations and four pseudo stations SY, NY, SS and NS. The pseudo stations are treated in the routing program like a regular station, except the doors can't open for a train stopped in a pseudo station. The pseudo station NY is located on the north bypass leg 28, station SY is in the south bypass leg 30, station SS is in the south spur on the south track 24 and station NS is in the north storage area which lies to the east of station ND between the two switches 32 and 34.

Figure 2:
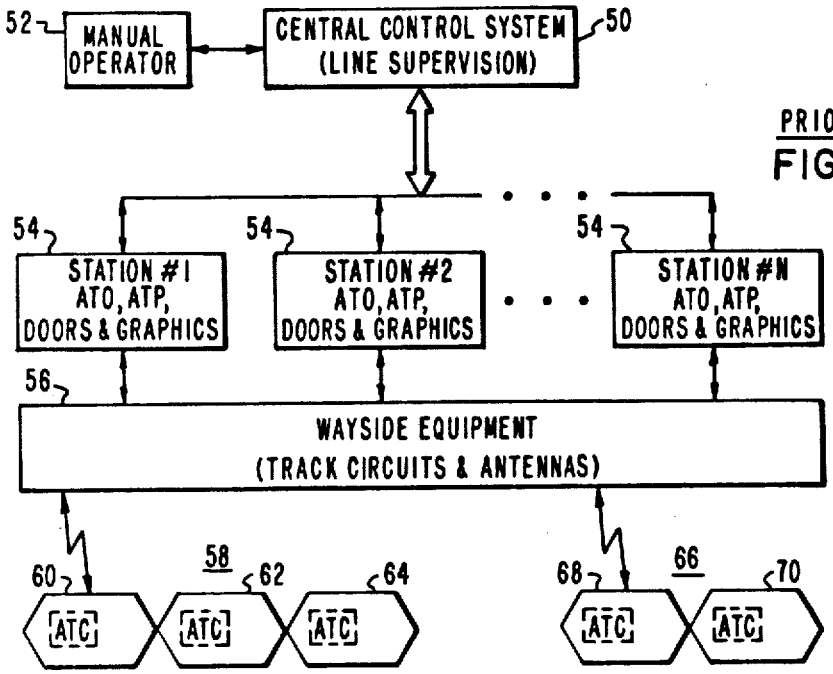
PRIOR ART FIG. 2
FIG. 2 shows a schematic block diagram of a prior art vehicle train control apparatus.

In FIG. 2 there is shown a prior art central control system 50, which can be located in a headquarters building and receives information about the transit system and individual vehicle train operation, and from a system manual operator 52 in relation to the desired performance of the individual vehicle trains. The central control system 50 supervises the schedule, spacing and routing of the individual trains. The equipment in the stations 54 is provided to operate with the central control system 50 as desired for any particular transit system. The wayside equipment 56 including track signal block circuits and associated antenna for speed command, door control and program stop control signals is located along the vehicle track roadway and is provided to convey information in relation to passenger vehicle trains travelling along the roadway track. A first illustrative train 58 is shown including three vehicle cars 60, 62 and 64 and a second train 66 including two vehicle cars 68 and 70. Each vehicle car includes an automatic train operation ATO and automatic train protection ATP apparatus to make up the automatic train control ATC apparatus. The automatic train control ATC apparatus includes the program stop receiver module, the speed code receiver module, the vital interlock board and power supplies and all the modules required to interface with the other equipment carried by the train vehicle, and in accordance with the more detailed description set forth in the above-referenced publications.

Figure 4:
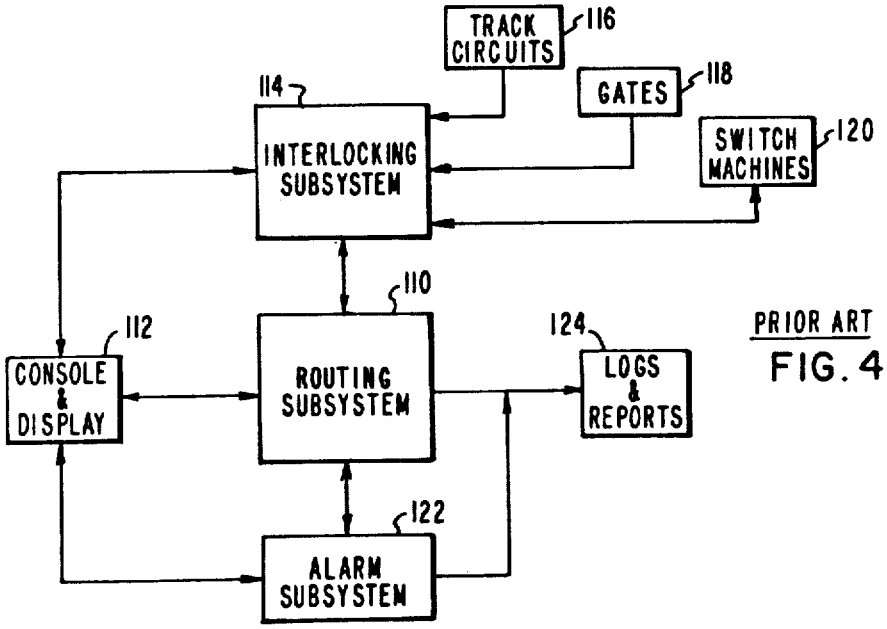
PRIOR ART FIG. 4
FIG. 4 shows the signal flow of a typical prior art routing apparatus.

The interlocking subsystem 114 shown in FIG. 4 is a well-known apparatus that has been in operation for many years on rail transit systems. The function of interlocking is to prevent a train accident. The interlocking subsystem 114 is failsafe in operation and is constructed using failsafe relay logic. When a track circuit becomes occupied, a certain series of relays operates to block out another train from entering that track circuit. A failsafe signal transmitter and receiver operates with each track circuit to provide occupancy information which goes into the relay interlocking and is processed there, and the direction signal information results from it to indicate what direction the train is going over an area of track. The direction information is generated from interlocking based on the gate request, checking the occupancy of every track circuit in that area; checking opposing routes and switch positions, and so forth. If everything agrees, the gate clears, and the direction of traffic is set up, which direction of traffic is used to lock out opposing train moves.

Figure 3A:
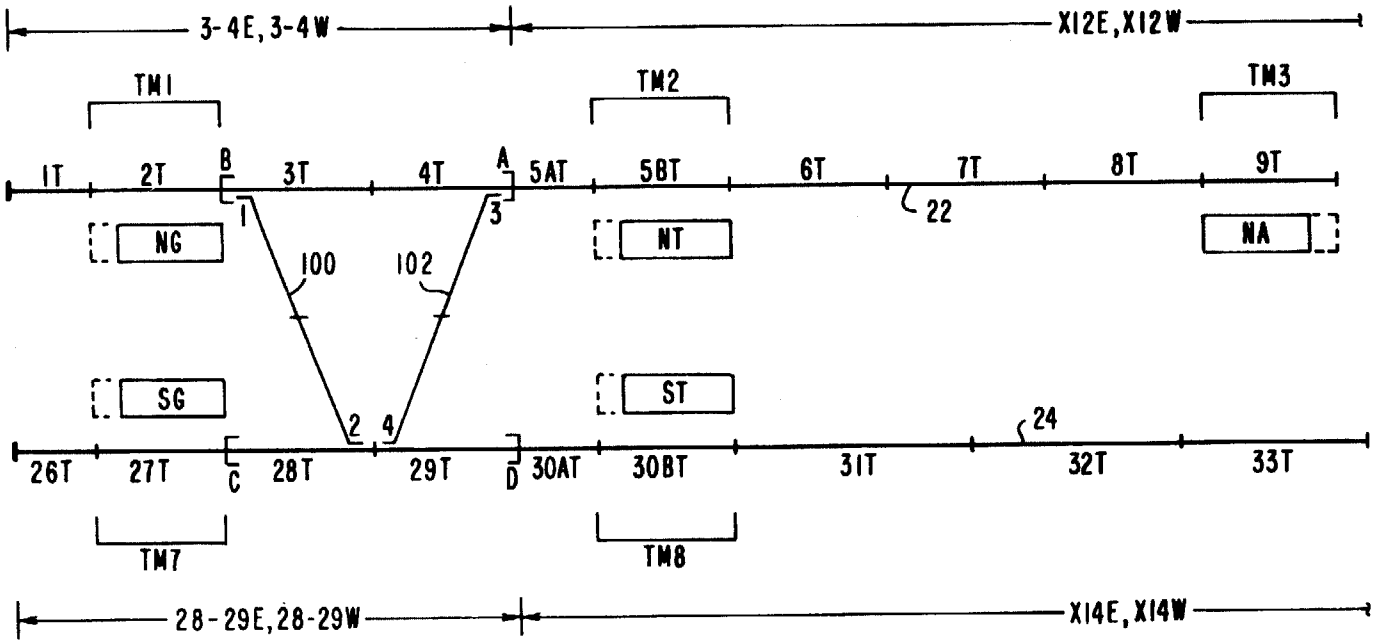
PRIOR ART FIG. 3A
FIGS. 3A, 3B and 3C show an illustrative track plan for the prior art track system of FIG. 1.
Figure 3B:
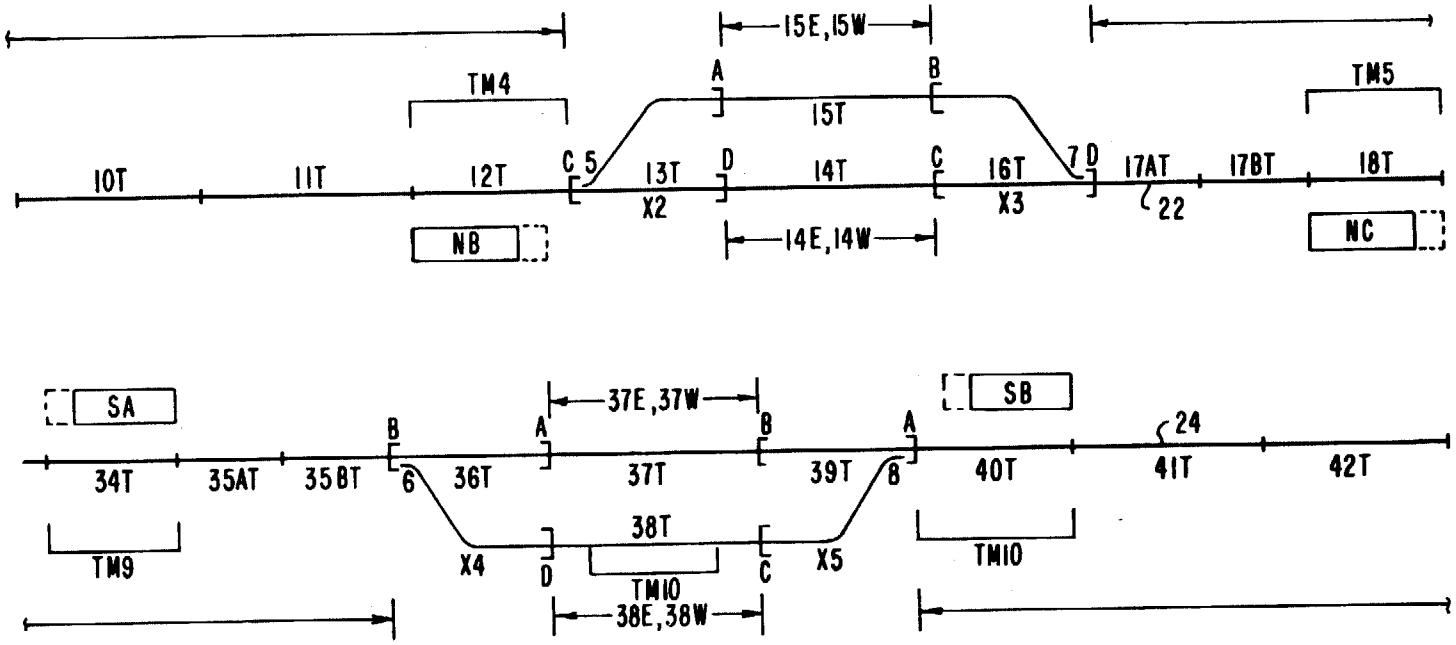
PRIOR ART FIG. 3B
Figure 3C:
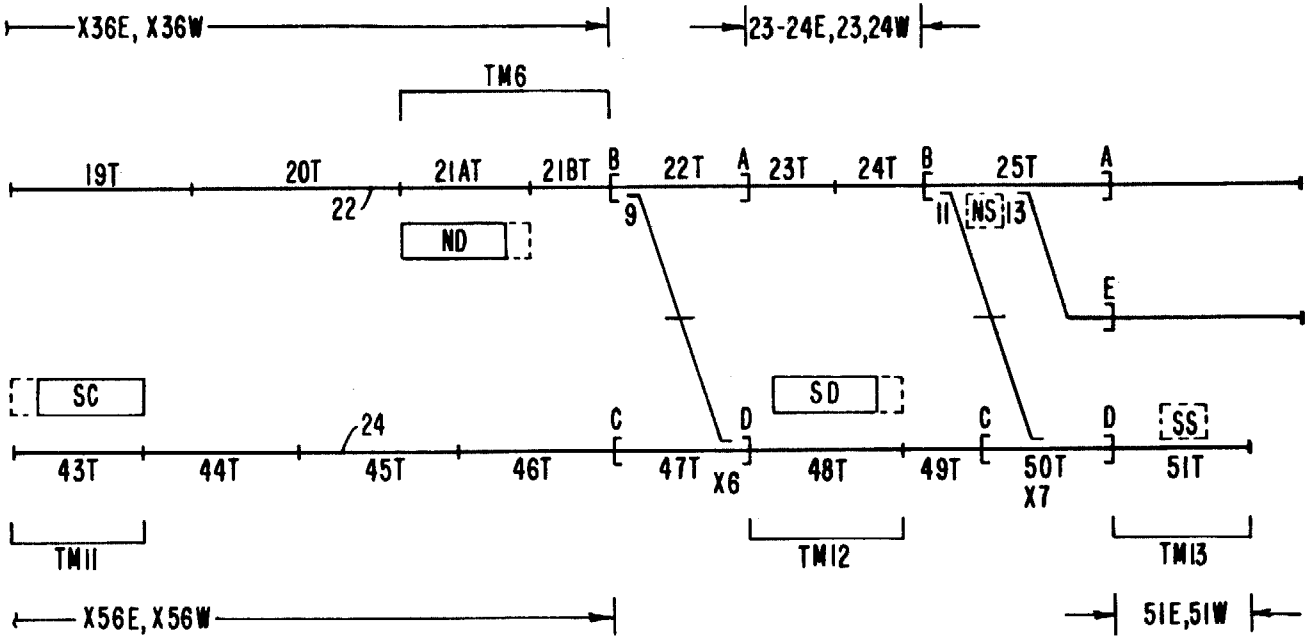
PRIOR ART FIG. 3C

The track system shown in FIGS. 3A, 3B and 3C has about 50 track circuits, and about 30 of them are covered by direction input bits as shown in FIGS. 3A, 3B and 3C. This specific version of interlocking has been in use for several years at the Sao Paulo switching yard in Sao Paulo, Brazil.

FIGS. 3A, 3B and 3C show an illustrative prior art track plan for the airport complex shown in FIG. 1. It is the layout of all the track circuits, switches and other equipment required to safely run the vehicle train system. The physical track includes the first track 22 and the second track 24, where the trains run. The rectangle boxes NG, SG, NT, ST, NA, SA, NB, SB, NC, SC, ND and SD represent the passenger stations, with the dotted area of the end representing space provided for expansion. Along each track, there are cross marks dividing the track into track circuit signal blocks 1T, 2T, 3T, and so forth. The track circuit 1T is to the left of station NG. The track circuit 2T encloses the station NG. Crossovers 100 and 102 are provided to the right of stations NG and SG, with each having two switch machines as required to move a section of track for passing a train from one track to the other track. The small brackets around each of switches and labeled A, B, C and D are gates or traffic signals. The direction of traffic is always into the face of the bracket. Every switch has a traffic signal or gate in front of it to inform the train when it is permissible to move through the switch. The small numbers 1, 2, 3 and 4 refer to the adjacent switch. Above and below the tracks are longer parallel brackets labeled TM followed by a number, and these are terminal zones; the trains are allowed to turn around in these zones, for example if a train enters a terminal zone going west it can reverse direction in that same zone and exit going east. These are train direction turn around locations. Above and below the track layout are direction signal areas that are used in the direction routine, such as 3–4E and 3–4W; if the E direction bit is a one, the train is going east, and if the W direction bit is a one, the train is going west. These direction bits are used to construct the DIR table, shown in FIG. 16B.

FIG. 4 shows the train routing signal flow of the present invention. The center block 110 shows the routing subsystem, which includes the programmed digital computer, the inputs and outpus to the computer and the several program routines and subroutines. At the left is the console and display 112. Information from the console 112 to the routing programs within the routing subsystem 110 are such things as train numbers and car numbers within each train so the routing subsystem can follow each of the trains around the track and determine when they arrive in stations. This routing subsystem 110 is different from those of the prior art, since there is no on board indentification or ID system. Once the train is put on the track system shown in FIG. 3 the tracking subsystem keeps track of which train it is and what cars are in the train. On the display portion of the console 112, there are facilities to display the train number, car number for any train on the system, by requesting this information with the proper pushbuttons and switches on the operator's console. The interlocking subsystem 114 checks to see if it is safe to allow the train to make a move, and provides for the vehicle safety of the system. The information required for the interlocking subsystem 114 includes the track circuit information, the gate status and the switch positions and is operative with the track circuits 116, the gates 118 and the switch machines 120.

The routing subsystem 110 requests actions from the interlocking subsystem 114 to allow the routing subsystem 110 to route each train around the track system. A primary input is from each station in regard to when the station becomes occupied or becomes unoccupied; these are two signals that the routing subsystem 110 uses to request a route for a train.

The information from the routing subsystem 110 is used to provide an alarm to the alarm subsystem 122, if a train does not open its doors or is late in arriving at the next station. The routing subsystem 110, when an alarm occurs, provides a message which is logged in the computer and is printed out on a typyewriter in the logs and reports 124, where it is entered into the daily log generated from this information. The routing subsystem 110 provides routes for each train on this track system from the time it enters until it leaves the track system.

Figure 5:
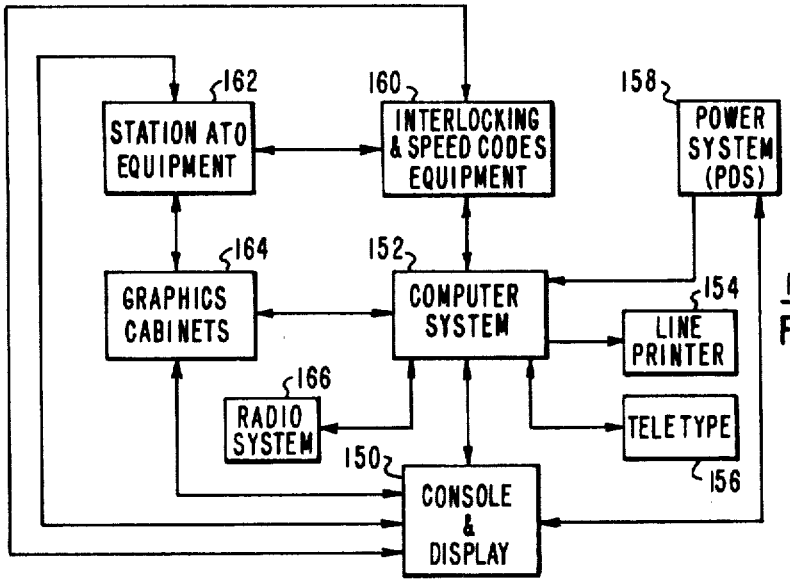
PRIOR ART FIG. 5
FIG. 5 shows a prior art central control computer system block diagram, for controlling vehicle trains.

FIG. 5 shows a prior art block diagram of the central control computer system 50 shown in FIG. 2. A console and display 150 is included, the operator inputs go into this console, with the status of the train system being shown on the display portion. The computer system 152 is described in more detail in relation to FIG. 6. The computer system 152 includes memory, input and output devices and the power supply. To the right of the computer block, the line printer 154 is used to print the reports and the teletype 156 is used to log all alarms and manual inputs, as they occur to provide a real time printout. The power system 158 controls the actual track power to the entire system, and includes relays and the inputs that go into the computer system 152 and to the console and display 150. The control of the power system 158 does not go through the computer, but is hard wired directly to the console and display, with the status of the system going through the computer to provide information for the printout. The interlocking and speed control equipment 160 is well known and had been provided in many train control systems to establish where each train is going, when it is going and how fast it is going to go. The station ATO equipment 162 is not associated with interlocking, and includes the non-vital relays associated with some of the control and part of the graphics. A graphics cabinet 164 is a relay cabinet which controls the graphics for signs at each of the stations. The radio system 166 can be a standard system which receives and transmits messages both data and voice to and from each of the cars on the system.

Figure 6:
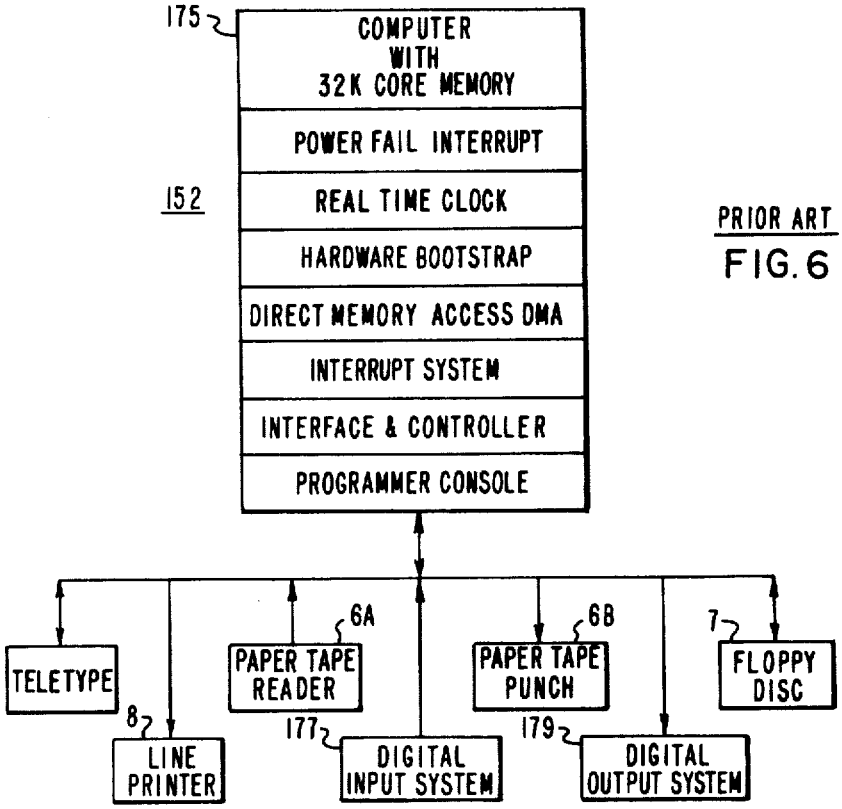
PRIOR ART FIG. 6
FIG. 6 shows a prior art control computer system block diagram for controlling vehicle trains.

In FIG. 6 there is shown a prior art computer system 152 suitable for use with the present invention. A standard digital computer 175 can be purchased in the open market, for this purpose such as the LSI 2–20 from Computer Automation. It is a minicomputer provided with 32 K core memory. The selected options include a power fail interrupt that senses when the power drops below some certain level and provides orderly shutdown, a real time clock, a hardware boostrap loader in case it is desired to load a new program, a direct memory access channel to allow high speed data transfer, an interrupt system and various interfaces and controllers. The provided peripherals include a teletype, a paper tape reader, a paper tape punch, a floppy disc for program storage, and a line printer. The digital input and digital output systems are available from Computer Automation and convey information to and from the rest of the system.

Figure 7:
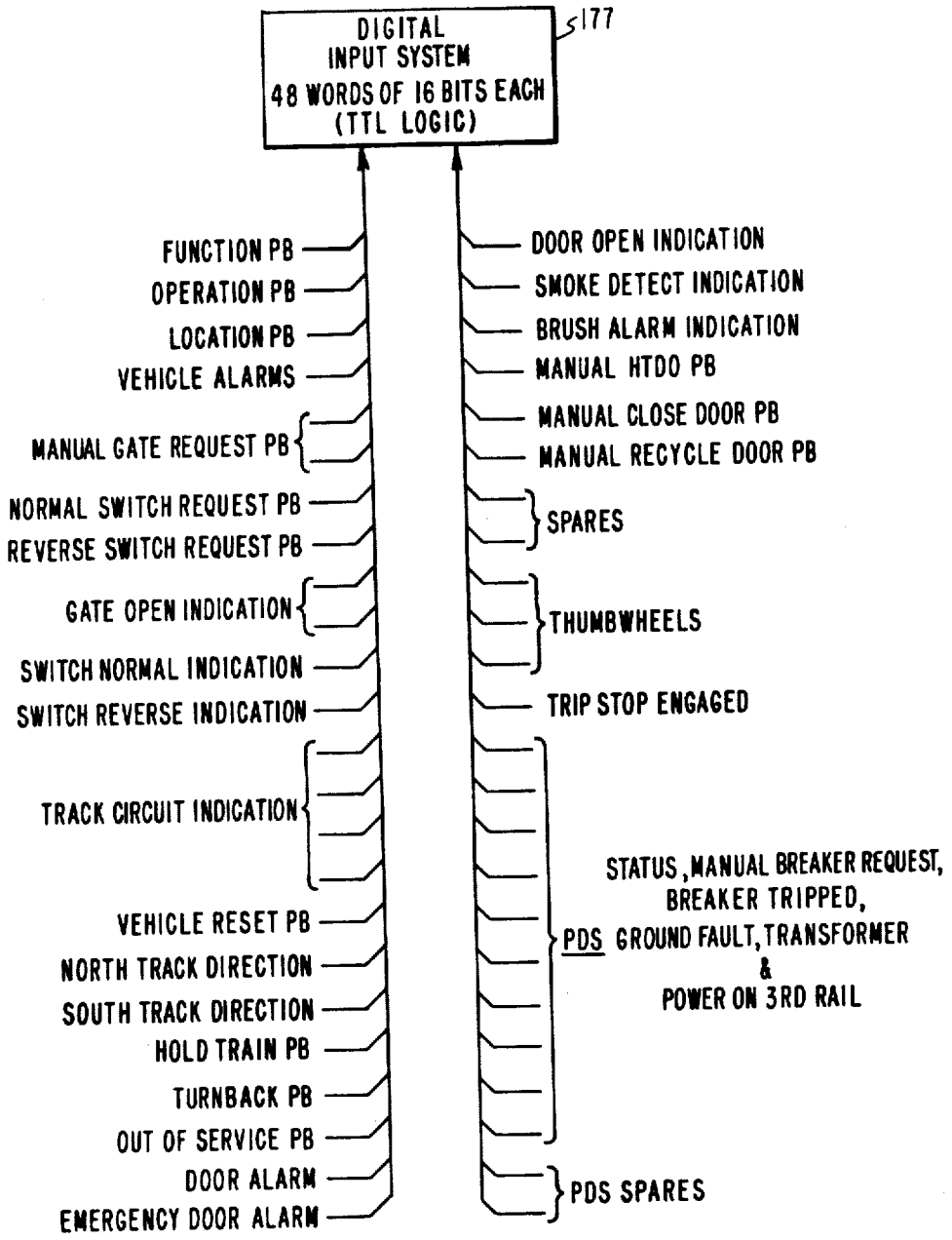
FIG. 7 PRIOR ART
FIG. 7 shows the typical digital input signals of the control computer system of FIG. 6.

FIG. 7 shows a suitable prior art digital input signal system 177, and each of the illustrated signals represents 16 input bits. The first line on the left is the function pushbuttons, which are on the operator's console. The second line contains the operation pushbutton inputs, which come from the operator's console. The third line is the location pushbuttons which correspond with the twelve stations and for pseudo stations shown in FIG. 1. The name for each line describes the particular inputs.

Figure 8:
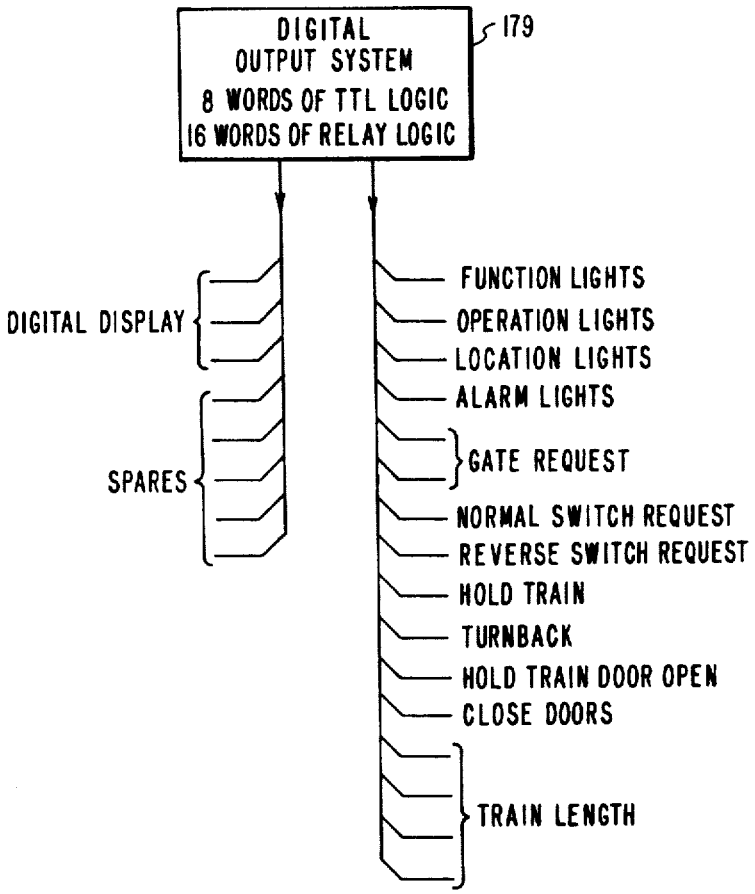
FIG. 8 PRIOR ART
FIG. 8 shows the typical digital output signals of the control computer system of FIG. 6.

FIG. 8 shows a suitable prior art digital output signal system 179. There are two types of outputs on this system, TTL logic, which is used to drive the digital displays and relay contacts when there is a need for more power. Each of these output signals represents 16 bits of information. The name of each line describes the associated outputs.

Figure 9:
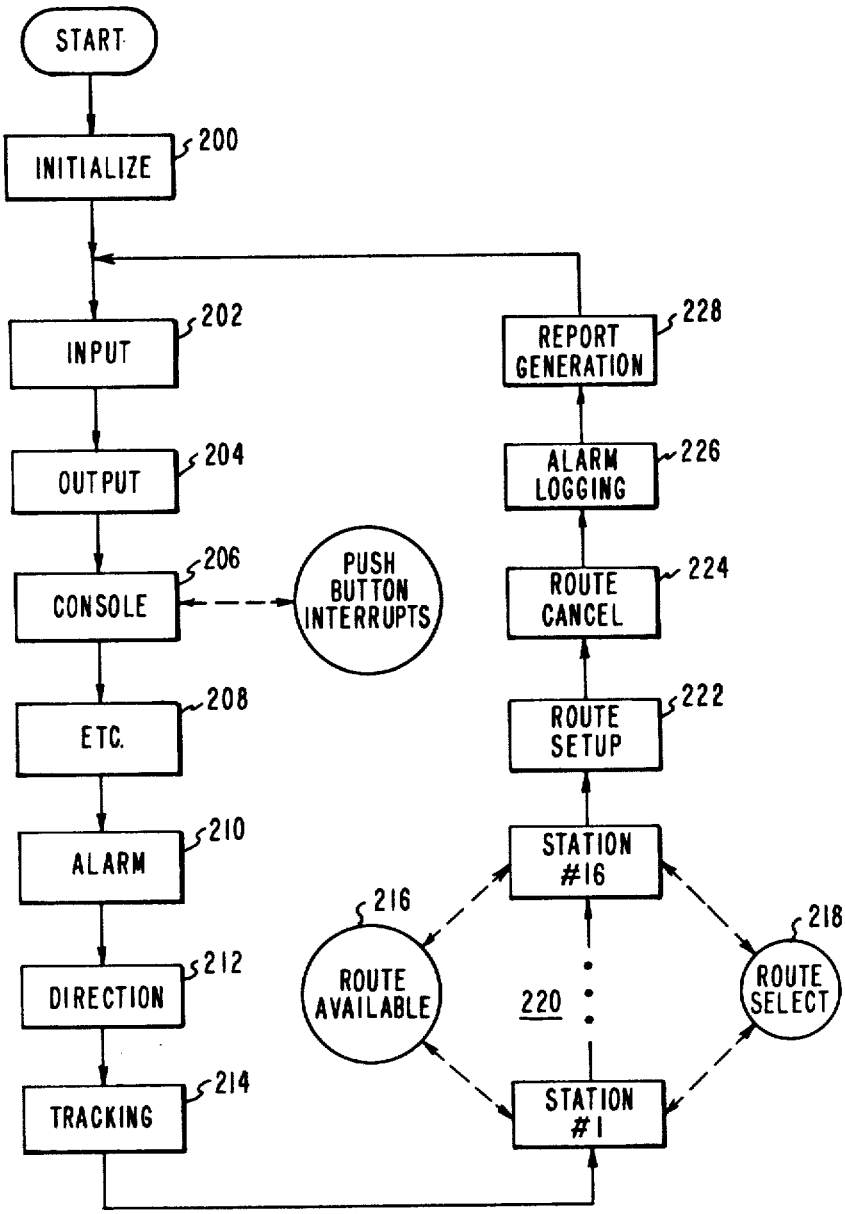
FIG. 9 PRIOR ART
FIG. 9 shows the sequential operations of a typical routing control system.

FIG. 9 shows the representation of a typical control program, with the sequence of the different sections of the programming. The train control program in general uses a plurality of different routines most of which are per se prior state of the art logic. The first block 200 is initialization, which operates when power is lost or starting over for any other reason. The input routine 202 inputs the signals shown in FIG. 7 through TTL inputs as shown on these diagrams. They are input once each program cycle so that every routine within the program is using the same information. The output routine 204 is used to provide every desired output as shown in FIG. 8 each program cycle. The console routine 206 is a well-known routine to process the information from the operator to the computer, and vice versa; it handles all the pushbuttons, all thumbwheel switches, the digital displays, and so forth, and stores in memory whatever information is required for other sections of the program.

The ETC routine 208 takes inputs that were input from a previous routine and checks the values against previous values for the inputs respectively to see if any changes have occurred. It builds up a series of tables, a past value table, a change table, a went-to-one table, and a went-to-zero table. The routine 208 takes the input table and exclusive ORS that value with the past values. Any one is a change of state. There is a need to know which direction that change of state was, so comparing each change of state with the present values, establishes that it went to one which means the track circuit just became occupied, and it is stored in the went-to-one table. There is a need to know when indications clear so the routine 208 compares the changes with the past value, a one establishes that the bit just disappeared and went to zero. The table handling routine in the routine 208 does the same thing for track circuits, switch positions, gate indications, and pushbuttons; the alarm routine 210 uses this information. The alarm program 210 provides an alarm when switches don't move in time, gates don't clear in time, doors don't open in time, trains don't leave the station, trains don't arrive at a station, or trains run through a station. The tracking program comprises the direction routine 212 and the tracking routine 214. The next 16 blocks on this flowchart are the station programs 220 to be described in relation to FIGS. 23 to 41, which includes a route available subroutine 216 and a route select subroutine 218. Following the station program 220 is the route setup routine 222 which is a software interlocking type program which requests that any of the routes selected in the previous 16 stations are set up. It does this by requesting switch positions, monitoring the switch positions, and then requesting gates and locking out all opposing routes. The route setup routine 222 will be subsequently described. Next is the route cancel routine 224. Once a route is set up it will remain until manually cancelled or until a train takes the route, which is then canceled, track circuit by track circuit, as the train goes through, to provide a more or less equivalent operation to the well-known sectional release in the prior art hardware interlocking apparatus. The alarm logging 226 and report generation 228 are strictly the logging in memory of any alarm condition or operator action. This information is stored until it generates a report once a day such as at midnight.

MANUAL ROUTING PROGRAM

The manual routing program is shown in FIGS. 10 to 15 and has two primary functions, both initiated by the console operator using the gate request pushbuttons. When the pushbutton is pressed, a gate request is made to open one of the gates shown in FIG. 3 and the manual routing program sets up the route from that gate over the switch positions in effect at the time. When the pushbutton is released, a gate cancel is made in relation to that gate and the manual routing program cancels the route from that gate. The automatic routing program shown in FIGS. 16 to 22 must know all routes which have been manually set up in order to prevent requesting an opposing or conflicting route. The manual routing program shown in FIGS. 10 to 15 fulfills this requirement by setting up all manually requested routes and setting the software lockouts for those routes.

Figure 10:
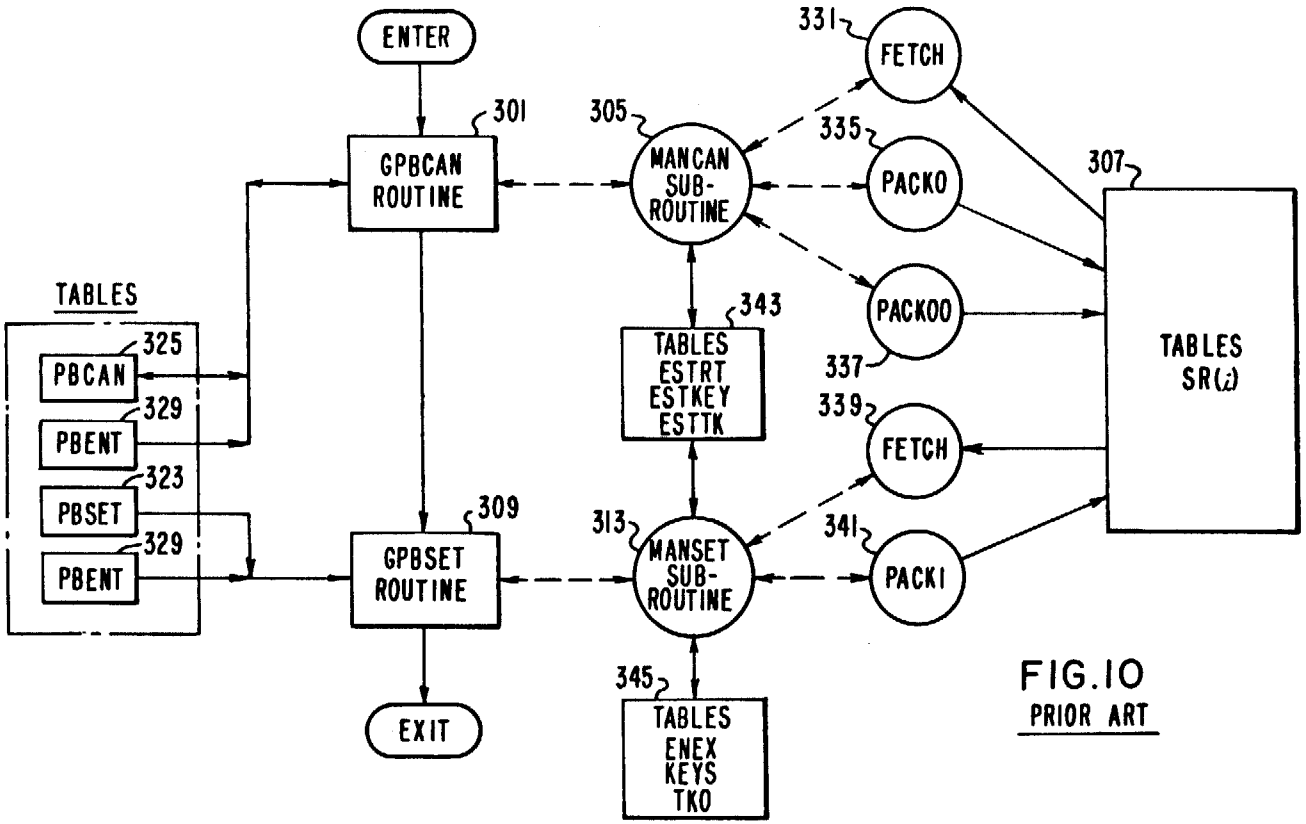
FIG. 10 PRIOR ART
FIG. 10 shows prior art manual routing program routines and subroutines.

Two routines and two subroutines in conjunction with the fetch and pack subroutines and tables comprise the manual routing program shown in FIG. 10.

| | | |
|---|---|---|
| a. | GPBCAN | Cancel Pushbutton Processing Routine |
| b. | GPBSET | Set Up Pushbutton Processing Routine |
| c. | MANCAN | Manual Cancel Subroutine |
| d. | MANSET | Manual Set Up Subroutine |

The manual routing program allows the operator to set up and cancel routes from the console while the system is in the automatic mode of operation.

The cancel pushbutton processing routine 301 checks the PBCAN table once each program cycle. A route must be cancelled for each pushbutton indication which just went to zero. The manual cancel subroutine 305 is called once for each gate required, and uses the automatic routing tables 307 to cancel the route. The $SR_i$ tables are used to set zeros for switch position requests, gate requests, and lockouts.

The manual cancel PB processing routine 301 performs two major functions. In monitors the inputs from the gate cancel request table PBCAN 325, which contains the bits that require a route to be cancelled and acts as a bookkeeping routine for the manual cancel function. The PBCAN table 325 is processed through a software shift register to determine the bias of bits which are set. This bias is used on the PBENT table 329 to determine the entrance number associated with the pushbutton requesting a route cancel.

Each time a bit is detected by the shift register, the entrance number is located and stored in MCAN. The manual cancel subroutine 305 is then called to actually cancel the route. Each gate PB is checked each program cycle and every change from the one state to the zero state causes the associated route to be cancelled. When all bits in the PBCAN table 325 have been satisfied, control is transferred to the manual setup PB processing routine 309, which sets up manually requested routes.

The manual route cancel subroutine 305 is used to actually cancel a route which has been manually requested by the operator resetting the gate request pushbutton on the control console. The following items are zeroed or cancelled:

1. Lockouts
2. Switch position requests
3. Gate request
4. Route in ESTRT table
5. MSET, manual setup request.

The route entrance number found in MCAN is compared to the established route entrance in ESTRT 343 until a match is found. The keywords in ESTKEY 343 are then used to locate the proper setup information table (SR (i)) 307. The information words are used in conjunction with the PACKO 335 and PACKOO 337 subroutines to cancel the lockouts, switch requests and the gate request for the route. The route is then taken out of the established route table 343, ESTRT, ESTKEY and ESTTK. Finally MCAN is compared to MSET. If equal, MSET is set to zero.

The setup pushbutton processing routine 309 checks the gate indications went to one table once each program cycle. When a gate clears, its associated pushbutton input is checked. If the pushbutton is on, the route from that gate is setup over the switch positions in effect at the time. The manual setup subroutine 313 is called once for each route that is to be set up. The $SR_i$ tables 307 are used to determine which route is required and to set up the route.

The manual setup PB processing routine 309 is a bookkeeping routine which processes the PBSET table 323 and sets up routes as required. A manual route is required to be set up whenever a gate clears and the associated gate request PB on the console is pressed. The program acts after the fact. A route has actually been set up manually before the program is aware of it. This routine then sets up the same route and remembers it. Thus, the rest of the program is now aware that the route exists.

The PBSET table 323 is put through a software shift register to determine the relative position in the table for each bit in the one state. This bias is used to locate the gate entrance number from the PBENT table 329. The entrance number is stored in MSET and the MANSET subroutine 313 called to actually set up the route. One route is set up for each bit in the PBSET table 323 that is set. When finished, control is transferred back to the main control program.

The manual route setup subroutine 313 sets up the route that has been manually established by the operator pressing a gate request pushbutton on the control console. The entrance number of the route is stored in MSET. Since more than one route may have the same entrance point, this routine must determine which route from the entrance number is actually involved.

The entrance number is compared with the ENEX table 345 entrances until a match is found. The associated keywords in the KEYS table 345 tell where the route setup information table is located. The switch position words in the info table are checked to see if all switches in the route are in the requested positions. If any of the switches is not in position, this route is not the one desired. The ENEX table comparison is continued until another match is obtained and the new route info table located. Once again the switch positions are checked. This process is continued until a route with the MSET entrance number and all switches in the correct position is located. This route is the one to be set up by this subroutine, the ENEX, KEYS, and TKO pointers are all pointing to this route information.

Using the route information table; the switch request bits, the lockout bits and the gate request bits are set using the PACK1 subroutine 341. An open slot is located in the established route table (ESTRT) and the new route information is stored in ESTRT, ESTKEY and ESTTK. Now the rest of the program has the knowledge that the route exists. MSET is zeroed and control returned to the manual setup PB processing routine 309.

The manual routing program is based on tables including logic equations in those tables, with a small control routine that uses the tables. Table 323 is the PBSET table, and for each bit set in this table it is desired to set up a route. Table 325 is the PBCAN table, and for each bit set in table 325 it is desired to cancel a route. Table 329 is the PBENT table, which is the pushbutton entrance table, and for each one of the gate pushbuttons on the operator's console there is an associated route, so each gate has one entry number in this table. The table 323, the PBSET table, and table 329 and the PB entrance table, are operative with the manual pushbutton setup routine 309. The subroutine 331 is the fetch routine, which checks a given location in memory to see if a bit is set or not. The subroutine 335 is PACKO, it sets a specified bit to zero. The subroutine 337 is PACKOO, it sets two bits to zero. The subroutine 339 fetch routine is the same as subroutine 331. The subroutine 341 PACK1 sets a bit in a specified location in memory. The tables 343 ESTRT , ESTKEY and ESTTK are used by the subroutine MANCAN 305 and MANSET 313. The ESTRT table is a double word table, with the first word being the entrance location number and the second the exit location number. Assume a train is going from station north-baggage to station north-ticketing, which are adjacent. North-baggage has a number such as 100 and north-ticketing has a number such as 102, so this table would have the entrance number 100 and the exit number 102. The ESTKEY table is the keyword table, which is also a double word table, the first word contains the location in memory where the logic table pertaining to that route is stored; for example, there is a table for route 100 to 102 and it is located in memory location 1,000 and there are ten words in it. The second word in the keyword table tells the number of words in the table. The table ESTTK contains the location of the exit track circuit in the route, which is used to cancel that route. Each cycle the program checks the exit track circuit, and when it becomes occupied, the program cancels out all five of the associated numbers that are in the ESTRT table. Tables 345 are three individual tables, with the first one being the ENEX table. This table is a double word table, containing the entrance and the exit numbers of every possible route on the system.

These routes are based on a gate-to-gate arrangement, with each route reaching from one gate to another gate. The KEYS table contains the keywords for the setup table. There is one pair of words associated with each entrance and exit, indicating where an information table is located in memory and the number of words in the table. The TKO table, contains the exit track circuit for each route. The information from these tables is stored in table 343 after the route is set up. The table 307 is the $SR_i$ table, where i is the number of routes provided in the track system. There is one SR table for every route. Each word in each SR table points to one bit of information; the information in the word is the bit location in memory.

Figure 11:
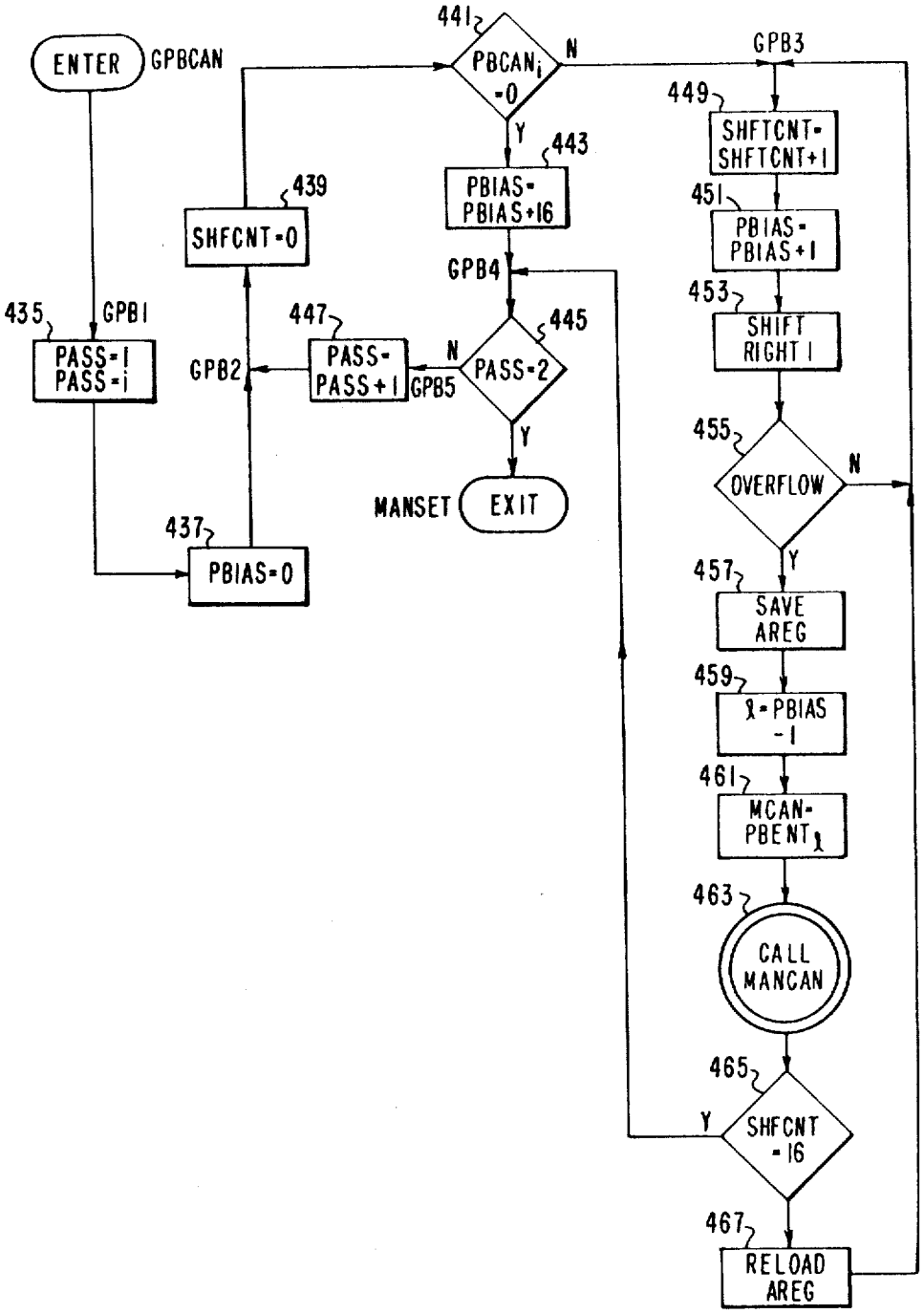
FIG.11 PRIOR ART
FIG. 11 shows a prior art manual cancel pushbutton routine.

FIG. 11 shows the gate pushbutton manual cancel processing routine. The PBSET table is used to set up the routes, and gets processed in the manual setup routine shown in FIG. 14. Step 435 sets the pass flag. Since there are two word tables, this routine is executed twice. PASS is set equal to one which is equal to the index i. Step 437 sets PBIAS to zero, which is the bit bias in the input table. The routine takes the PBCAN words and shifts them through a software table. Each word in the table has sixteen possible bits in it so the PB entrance table has thirty-two numbers in it. The program is looking for a bit to be set, so it is necessary to shift until the program detects a bit. The P bias is used to go down into the entry table the number of shifts the program has made. At step 439 the shift counter is set to zero, which bit shift counter counts the shifts made until the word is complete. Step 441 checks to see if the first word of the PB cancel table is zero. If it is zero, go to 443 and add 16 to the bias, because there are sixteen bits in a word. At step 445 check to see if pass is equal to two. If the answer is Yes, the program is finished because it has processed both words. The first time it will be one. So at step 447 increment pass, and go back to set the shift counter equal to zero at step 439. Check to see at step 441 if there are any bits set in the second word of the cancel table. If a bit is set, from step 441 we go over to step 449. Increment the shift counter and at step 451 increment the bias, now the two counters are in position for this bit. At step 453 shift the word right one position and at step 445 check for an overflow. If there was an overflow the bit was set, and if there was not, it wasn't set. If there was no bit set the program goes back to increment the shift counter at step 449 and to increment the bias at step 451 and shift right at step 453. Taking the Yes case at step 455, there was an overflow. In step 457 save the contents of A register, since there may be another bit in the word. In step 459 the index L is set equal to PBIAS minus one, because at step 451 PBIAS was incremented before the bit was checked, so the counter is one count ahead of itself. This index is added to the location of the PB entrance table, to index into the PBENT table the proper distance and get the desired entrance number. At step 463 call the manual cancel routine shown in FIG. 12, which will cancel the route with that entrance number. At step 465 check the shift counter to see if it is equal to 16. If it is, the program is finished with this word go to step 445 and check if pass is equal to two. If it is, this is the second word and the program is finished. If it was not finished, do the second word. At step 465 if the shift counter was not sixteen, there may be more bits in the word so at step 467 reload what was stored at step 457. Go back up to step 449 and continue the process until the program is finished. This is a bookkeeping routine.

Figure 13:
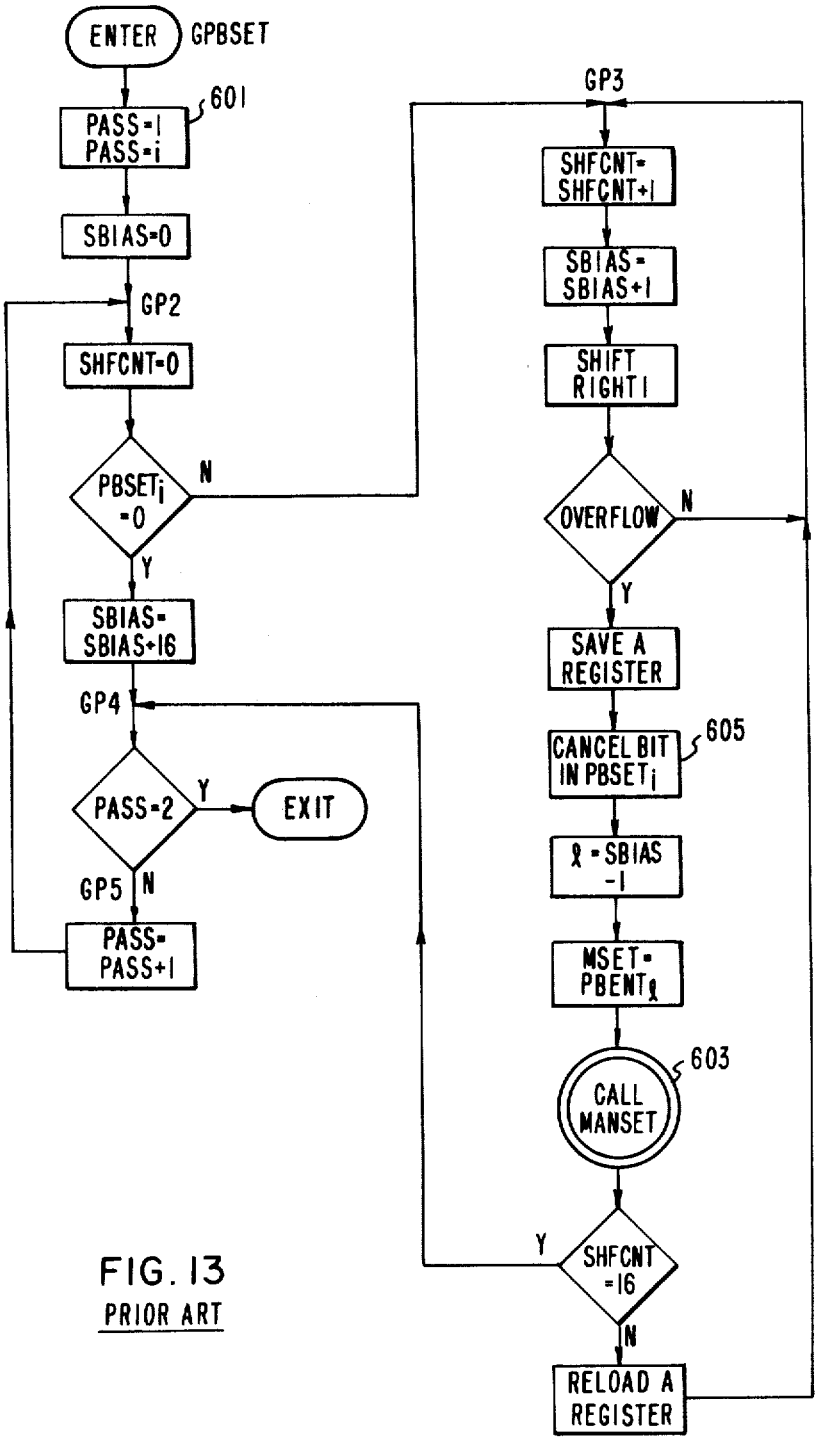
FIG. 13 PRIOR ART
FIG. 13 shows a prior art manual setup pushbutton routine.
Figure 14:
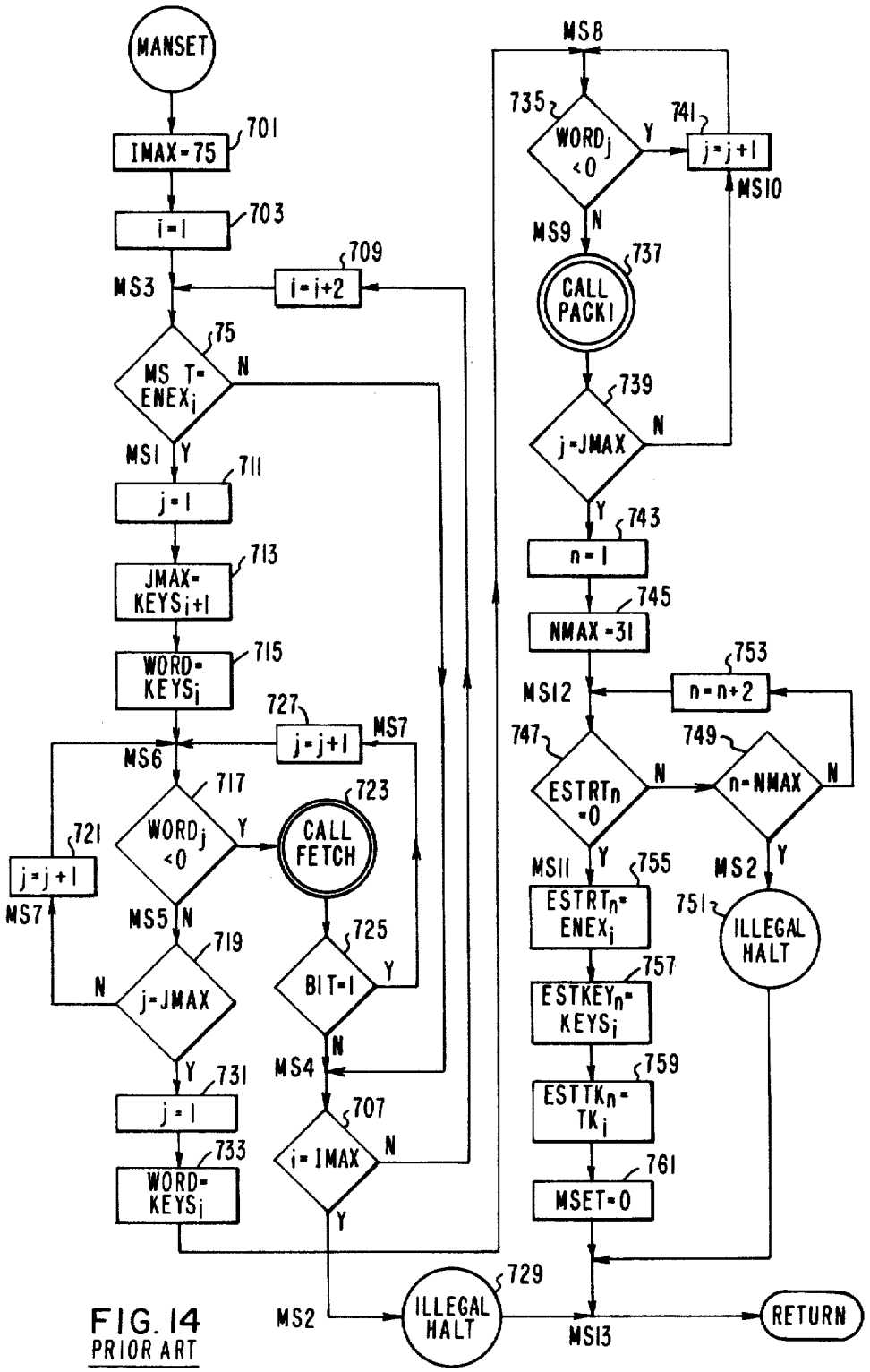
FIG. 14 PRIOR ART
FIG. 14 shows a prior art manual route setup routine.
Figure 15K:
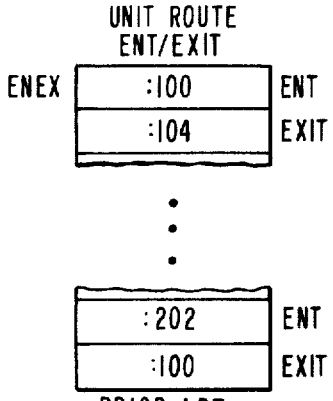
PRIOR ART FIG. 15K
Figure 15L:
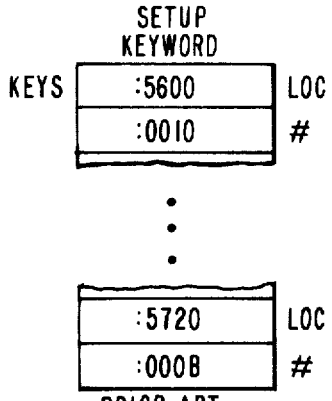
PRIOR ART FIG. 15L
Figure 15M:
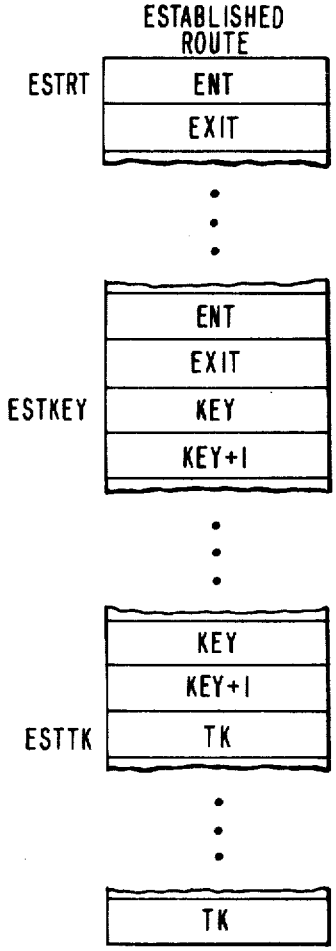
PRIOR ART FIG. 15M

FIG. 13 is substantially identical to FIG. 11. The two routines are the same, except for checking to see which routes will be set up rather than cancelled. At step 603 of FIG. 13 the subroutine MANSET shown in FIG. 14 is called to set up routes rather than the subroutine MANCAN at step 463 of FIG. 11 to cancel the routes. Also step 605 of FIG. 13 cancels the bit being processed out of the set table, because it takes several passes through the program to set up a route.

Figure 12:
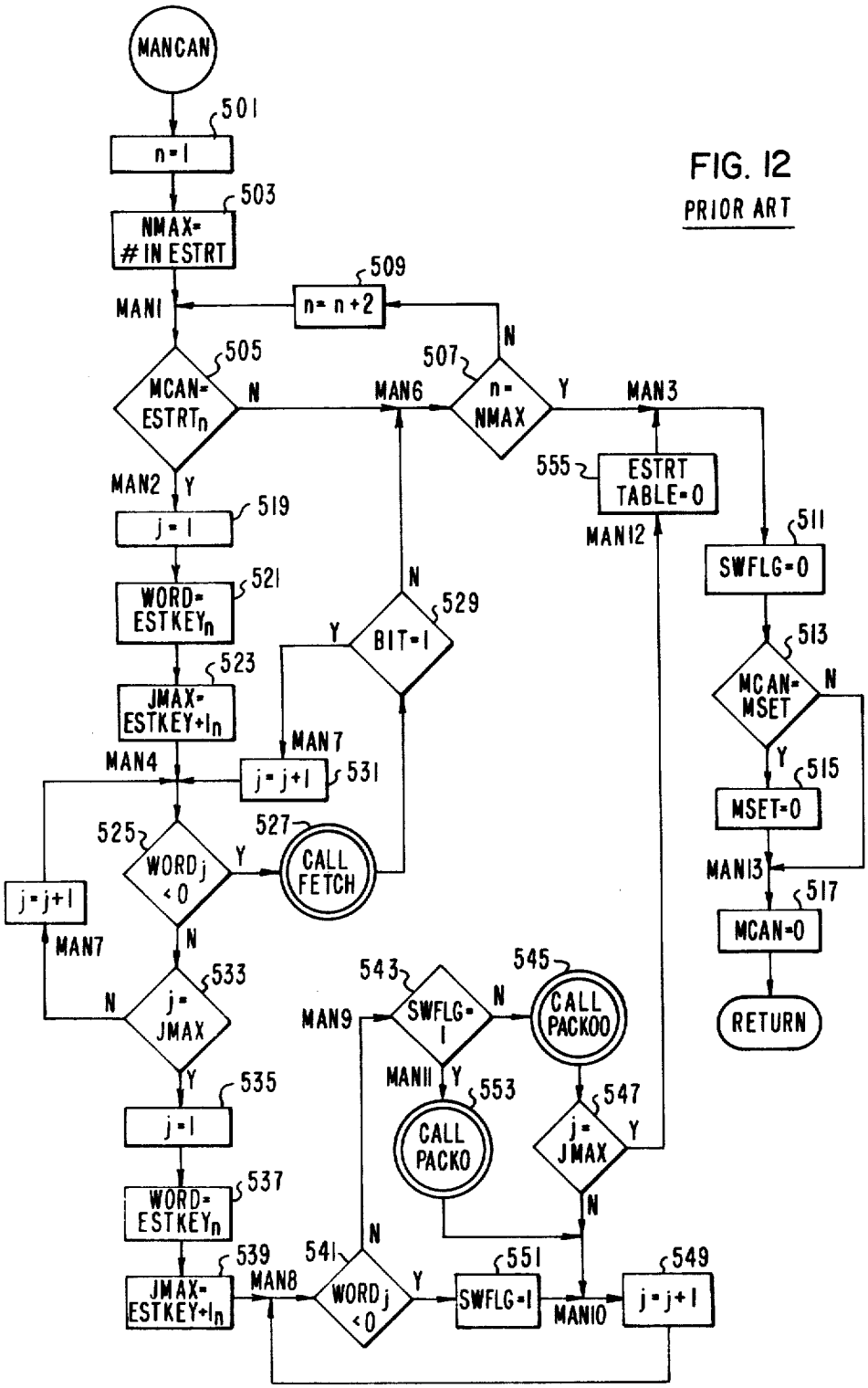
FIG. 12 PRIOR ART
FIG. 12 shows a prior art manual route cancel routine.

FIG. 12 shows the manual cancel subroutine that is called at step 463 of FIG. 11. At step 501 set index register N equal one. At step 503 NMAX is set equal to the number of words in the ESTRT table 343. At step 505 a check is made to see if MCAN, the entrance number, is equal to the ESTRT table entrance number. If No, go to step 507 to see is N equal to NMAX and the operation finished. If the answer is No go to step 509 which sets N equal to N+2, since this is a double word table and the search is made on every other word. At step 505 a check is made to see if the entrance number equals the number now being found in the entrance table. If the answer is NO, go to step 507 and if N equals NMAX, go to step 511 and set SWFLG equal to zero and check at step 513 if MCAN equals MSET. MCAN is the number of the route to be manually cancelled. MSET is the number of a route in the process of being set up, so MCAN and MSET can be equal. At step 515 set MSET to zero. At step 517 set MCAN to zero and return. At step 505, when the entrance is found go to step 519 and set a new J index equal to one. This index is for the SR table, the individual route table. Step 521 sets WORD equal to ESTKEY sub N. The notation WORD means the location of a desired word/bit combination in that SR table. Step 523 sets JMAX equal to KEYWORD plus 1. Step 525 asks is WORD J less than zero. An indication word is negative and is less than zero. In an effort to determine which route is to be cancelled step 525 checks the switch positions and if every switch position in that route table is in the correct position, that is the route that is set up. In step 525 if the word is negative, which means it is a switch position indication, call the FETCH routine at step 527. Upon return check at step 529 to see if the bit was equal to one. If the answer is No, that is not the desired route so go to step 507 to see if the table is finished and continue the search loop. Assume the first switch position was correct, so go to step 531 and increment the index J by one to check the second word in the table. At step 525 is the second word negative and if the answer is Yes, call the FETCH routine at step 527 and see if the bit is one at step 529. If it is, go back to step 531 and check the next word. If there were just two switches in this route, the operation is finished since all the switches were in position so this is the route to be cancelled so in step 533 check is J equal to JMAX. The answer in this case would be No because the only words less than zero are switch positions and in a table that has 20 locations in it, only 2 or 3 will go to the step 527 because all the others are control words. The loop is finished with the whole table when J equals the maximum number. This is the route to be cancelled. In step 535 reset the table index to one. In step 537 get the address of the first word. At step 539 do the same thing that was done up in step 523, set the number of words in the table, and go to step 541 and establish if this word is less than zero. If the answer is Yes, again it means it is negative and therefore is a switch indication. If not, go to step 543 and check is the switch flag equal to one. There is a series of numbers in the $SR_i$ table which start off with positive numbers, then negative and back to positive. The first ones are switch requests, the next ones are switch indications and the next ones are lockouts. This switch flag tells which half of the table is being worked on. On first coming into the table the switch flag is going to be zero as it was set at step 511. For a new table, at step 541 the word J is not less than zero because it is started positive, so go to step 543 and check if the switch flag is equal to one. Again, the answer is No, go to step 545 and call PACKOO. For a switch machine there are two possible requests, a normal request and a reverse request, and arbitrarily it is desired to cancel both. The routine PACKOO sets both requests to zero. Step 547 checks if the operation is finished. If the answer is No, go to step 549 and increment the counter and go back to step 541 to check is the word J less than zero. It is probably going to still be No, since most routes have a couple of switches. Go to step 543 to check the flag equal to zero and go to step 545 and set zeros for the normal and reverse requests. At step 547 check if the operation is finished. If the answer is No go to step 549 and increment the counter again. At step 541, assume this time it is negative, the table is down to the indication words, so go to step 551 and set the switch flag equal to one. Go to step 549 to increment the counter. In the loop at step 541 check if the word is less than zero. If the answer is Yes, set the flag equal to one at step 551. It was already one, but set it again. Go to step 549 and get the next word. At step 541 check is it less than zero. Assume the answer is No, because now the search is below the indications. Go up to step 543 to see if SWFLG is set. The answer is Yes, because it was set in step 551. At step 553 call PACKO. Setting the flag at step 551 shows the operation is below the indication words in the table. Above the indications two zeros are set, in the indications nothing is set, and below the indications one zero is set. When the table is finished in step 555 the route in the ESTRT table is set equal to zero. At step 511 the switch flag is set equal to zero so the right sequence is followed the next time a route needs to be cancelled.

In FIG. 14 the program is similar to that shown in FIG. 12, and is the manual setup routine. This time instead of cancelling a route the program shown in FIG. 14 is going to set up a route.

At step 701 IMAX is set equal to 75, which is the number of routes in the transit system. Step 703 sets the index I equal to one. Step 705 checks if the entrance number MSET is equal to the first entrance location in the entrance/exit table. If the answer is No, this route is not the route to be set up. Step 707 checks if the table is finished. Go to step 709 and increase the index by 2 because this is a double word table. Go back to step 705 for each answer No continue around the lopp just described until the entrance is found. Go to step 711 and set up the same index loop similar to FIG. 12, by setting the J counter to one. Step 713 sets JMAX equal to the contents of KEYWORD plus 1, since this is a double keyword. Step 715 sets WORD equal to the contents of keyword. Step 717 checks if word is negative, by determining if it is less than zero. It should not be, since the table starts with positive words. Go to step 719 and check if the table is finished. The answer should be No, so go to step 721 and increase j, come around to step 717 and check if WORD is negative. At step 717 the first time a negative is found go to step 723 and call the FETCH routine to see if the switch was in position. If the switch is in position, at step 725 go to step 727 and increase the table index and continue. If the switch was not in position in step 725 this is not the route of interest. Go to step 707 and check if the entrance/exit table is finished. The answer should be No, so go to step 709 and get the next entrance and go through the loop gain. Eventually, the route will be found, if not step 729 is provided for the computer to come to a halt. From step 725, each Yes shows a switch in position, an increase of the index J at step 727 and check at step 717 if the new word is less than zero. For each No, go through the steps 719, 721 and 717 until getting to the bottom of the table. Then go to step 731 and once again reload the index and at step 733 reload WORD. The route is known that is to be set up. At step 735 check if WORD is less than zero. The answer is going to be no. So in step 737 call the PACK1 subroutine. The upper numbers in the table are switch position requests. Step 739 checks if the table is finished and the answer should be No. Go to step 741 and increment the index to get the next word. For each switch request step 737 operates once and then goes to step 741 to increment the index until all requests are finished. For each lockout step 737 will operate to set the lockout. When step 739 is complete the lockouts are set, the gate requests are set and the switch positions are set. It is now necessary to store this route in the ESTRT table, the established route table. At step 743 set the index N equal to one. At step 745 set NMAX equal to 31, which NMAX is the number of locations in the established route table minus one. In step 747 check if the first location in the established route table is equal to zero. The routes are not stored sequentially, they are simply stored in the first open slot. So step 747 checks if the first location in the table is zero, and the answer is probably No. So go to step 749 and check if the table is finished. The table is sized so it will hold every possible route so there should be no way to ever get to step 751. If it does, something has gone wrong and there is an illegal halt there. Again step 751 will be removed after checkout is completed.

In step 749 there is only one legal path, to step 753 to increase the index N by 2. Go back to step 747 and check is this location empty, and if the answer is No, make another loop. Eventually an empty slot is found in this table and the new route is stored in it. After finding an empty slot in the table, step 755 sets $ESTRT_n = ENEX_i$. The program was working on an I loop over the ENEX table, and the program was working on the N loop in the ESTRT table so step 755 takes the ENEX entry that was found earlier and stores it into the open slot of the ESTRT. The same thing is done in step 757 for the keyword and the same thing is done in step 759 for the exit track circuits. In step 761 set MSET equal to zero and the program operation is finished.

AUTOMATIC ROUTING PROGRAM

The automatic routing program performs four primary functions.

a. Checks if a route is available.
b. Selects the best path.
c. Requests the route from interlocking.
d. Cancels the route as the train takes it.

The several routines, subroutines, and tables shown in FIGS. 16 to 22 comprise this program. First, the program will be described functionally and then the path through the routines will be described. All routing is done on a station to station basis. At each station, the next station is determined and the route needed to get to the next station is established. Routes are automatically cancelled track circuit by track circuit as the train moves across them from station to station. Since the program must request all routes from the failsafe interlocking system, it is important to system operation that no route is requested which cannot be granted. To insure this function, the program has essentially been designed as a software interlocking system. The same conditions are checked by the program that are checked by the hardware interlocking system. This assures that no route is requested unless it is available.

Figure 16:
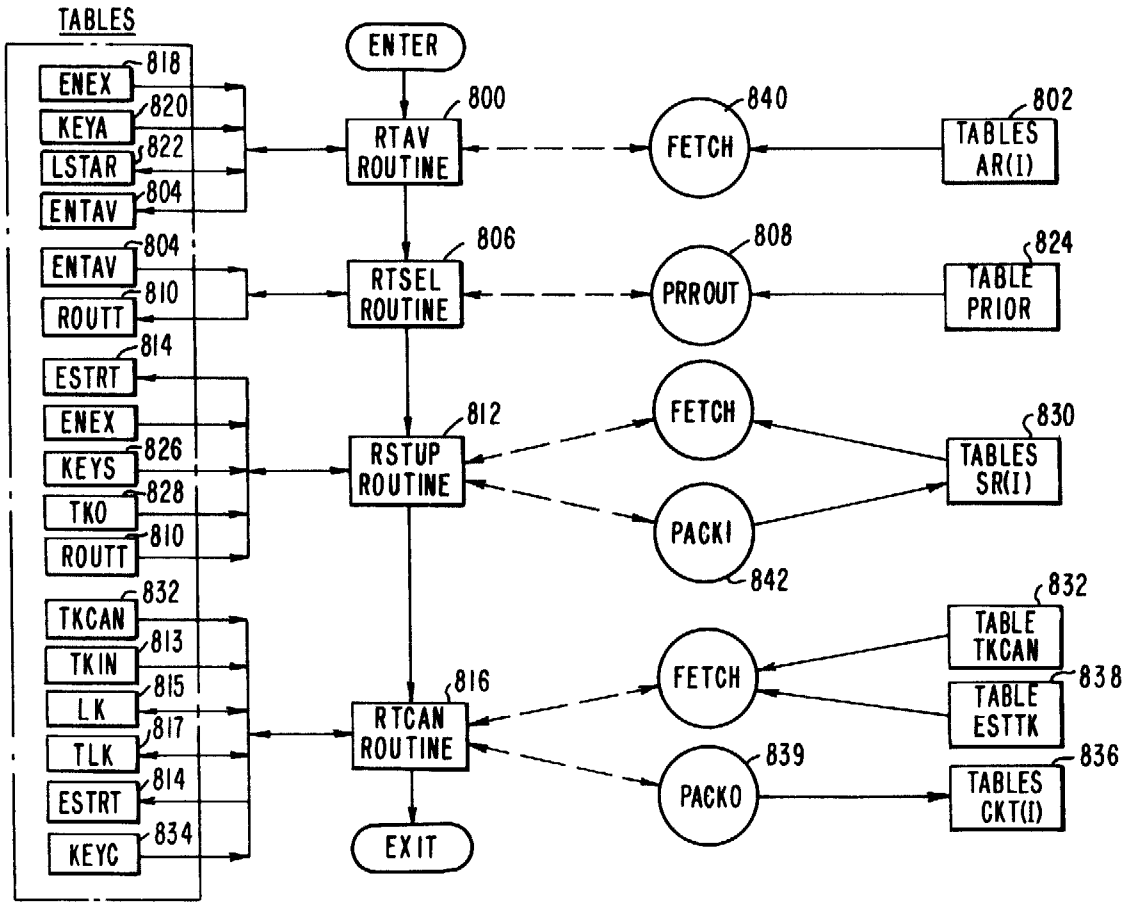
FIG. 16 PRIOR ART
FIG. 16 shows a prior art automatic routing program routine.

The route available subroutine 800 shown in FIG. 16 performs all the checks necessary to determine whether a route is available. All routes do not have the same checks as others. Some have many of the same type of checks. The items to be checked for each individual route are contained in the available route tables (ARi) 802. Each word in each table is for one check. If every one of the checks in a route table passes, the route is available. Items checked are the following:

a. Track circuit occupied.
b. Track circuit software locked out.
c. Switch pushbutton in wrong position.
d. Wrong mode of operation.
e. By-pass mode flags set.
f. Trip stop in wrong position.
g. Station lockout set.

When a route passes all of its checks, it is available and is stored in the ENTAV table 804. It is possible that there is more than one path between the two stations. This is true for the by-passes and on the east end of the system. The route select routine 806 and the priority route subroutine 808 along with the associated priority table 824 are used to select the best path from one station to the next station.

The ENTAV table 804 contains every route available from the particular station used as the entry point. The route select routine 806 builds a route from the exit, forward to the entrance. The station exit number is compared to the routes in the available route table 804. If none compare, there is no route available from the entrance to the exit point desired. If the exit number appears in the ENTAV table 804 more than once, there is more than one path between the entrance and exit. The priority route subroutine 808 is then used to select the route with the highest priority. The route is stored in the ROUTT table 810.

After the route has been selected, the route setup routine 812 requests all switch positions and gates from the hardware interlocking. A specific sequence of events is performed.

a. Request the switch positions.
b. Wait until the switches are in the requested position.
c. Set the software lockouts.
d. Request the gates to the route.

The route setup routine 812 sets up every route that has previously been stored in the ROUTT table 810 by the route select subroutine 812. When the gate for the route clears, the route is taken out of the ROUTT table 810 and stored in the established route table (ESTRT) 814. The routes remain in this table until they are cancelled.

The route cancel routine 816 automatically cancels routes as they are taken by a train. Five separate functions are included in the route cancel routine 816.

1. Switch position requests and route requests are cancelled track circuit by track circuit as a train takes a route using the TKCAN table 832.
2. The route is cancelled from the Established Route Table (ESTRT) 814 when the exit track circuit 838 for the route becomes occupied.
3. Software lockouts LK 815 are TLK 817 cancelled when the associated track circuit becomes occupied. This function is done in the ETC Routine.
4. Switch position requests are cancelled when the switch position request pushbuttons are released.
5. Gate requests are cancelled when the gate request pushbuttons are released.

After a train takes the route, everything is in its quiescent state and ready for a new route to be setup as required by the train movement in the track system.

Figure 17:
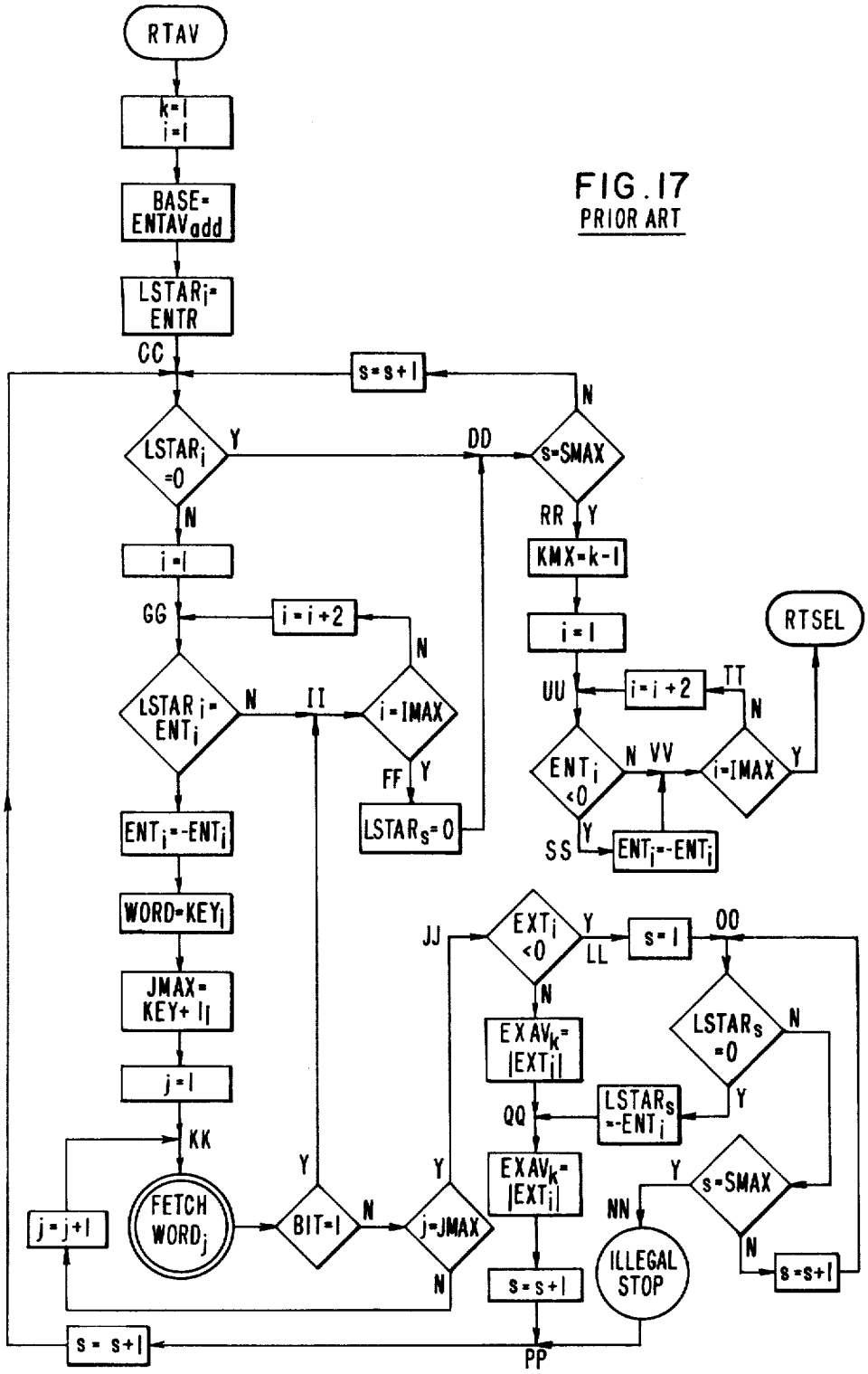
FIG. 17 PRIOR ART
FIG. 17 shows a prior art route available routine.

The route available subroutine 800 shown in FIG. 17 is called by the in station logic routine whenever a route is needed in order to get to the next station. This routine determines all possible routes from the selected entrance. Routes are unavailable because of through route limits, occupancy, opposing routes, conflicting routes, bypass flags, manual switch PBS, manual gate PBs, trip stops or incorrect mode. Each unit route has an associated entrance/exit table (ENEX) 818 location, a keyword table (KEYA) 820 location and a unit route information table 802. The entrance/exit table 818 is a double word table, the first word contains the entrance number and the second word contains the exit number. The exit word is negative when through routing is allowed and positive otherwise. The keyword table 810 is double word table. The first word contains the memory address of the unit route information table 802 and the second word contains the number of words in the information table 802. The unit route information table 802 contains the conditions that have to be met before the unit route is available. The LSTAR table 822 is an intermediate table which contains all unsatisfied entrances. An unsatisfied entrance is one which has not been checked with all of its associated exits.

The unit route information tables 802 contain the conditions that must be met for the route to be available; switch pushbutton requests for switches in the incorrect position, track circuit occupancy or lockouts which have been ORed together or incorrect mode. The program checks the bit position specified in each word in the information table 802. If the bit is zero, that condition is correct and the program goes to the next word. If the bit is a one, the route is not available. If each bit is zero, when the last word is checked, the unit route is available.

The program takes the initial entrance from the LSTAR table 822. The entrance is compared to the ENEX table 818. When a match is found, the same relative position is located in the KEYA table 820. This table contains the address and word count for the unit route information table. The entrance is set negative in the ENEX table 818 so it will not be used again and the unit route info table is used to see if the route is available. If not, the ENEX table 818 is searched for a different exit with the same entrance number. if no other exit exists, the entrance number is removed from the LSTAR table 822. If a different exit does exist, that route is checked for availability. This process continues until all exits from the given entrance are checked. Then the LSTAR table 822 is searched for a new entrance and the process repeated. When the LSTAR table 822 is zero, the search is complete. If a unit route is available, the exit is checked to see if through routing is permitted. If the exit is negative, the exit becomes the entrance for the next route and is stored in the LSTAR table 822. This process is continued until all unit routes which are available have been determined and stored in the ENTAV table 804. All entrances in the ENEX table 818 which had been set negative are set positive. The number of entries in the ENTAV table 804 is stored in KMX for use by other routines.

The available unit route table 804 is a working table containing the entrance and exit numbers for each unit route available from a given entrance. As conditions change the number of available routes tends to change. This table is loaded by the available route routine 800 when an entrance has been selected by the next station routine. The table is eliminated when the route has been selected by the route select routine 806. When an exit is selected, it is compared with the second location of this double word table to see if the exit is available. If it is, the route is selected and the table zeroed.

Figure 18:
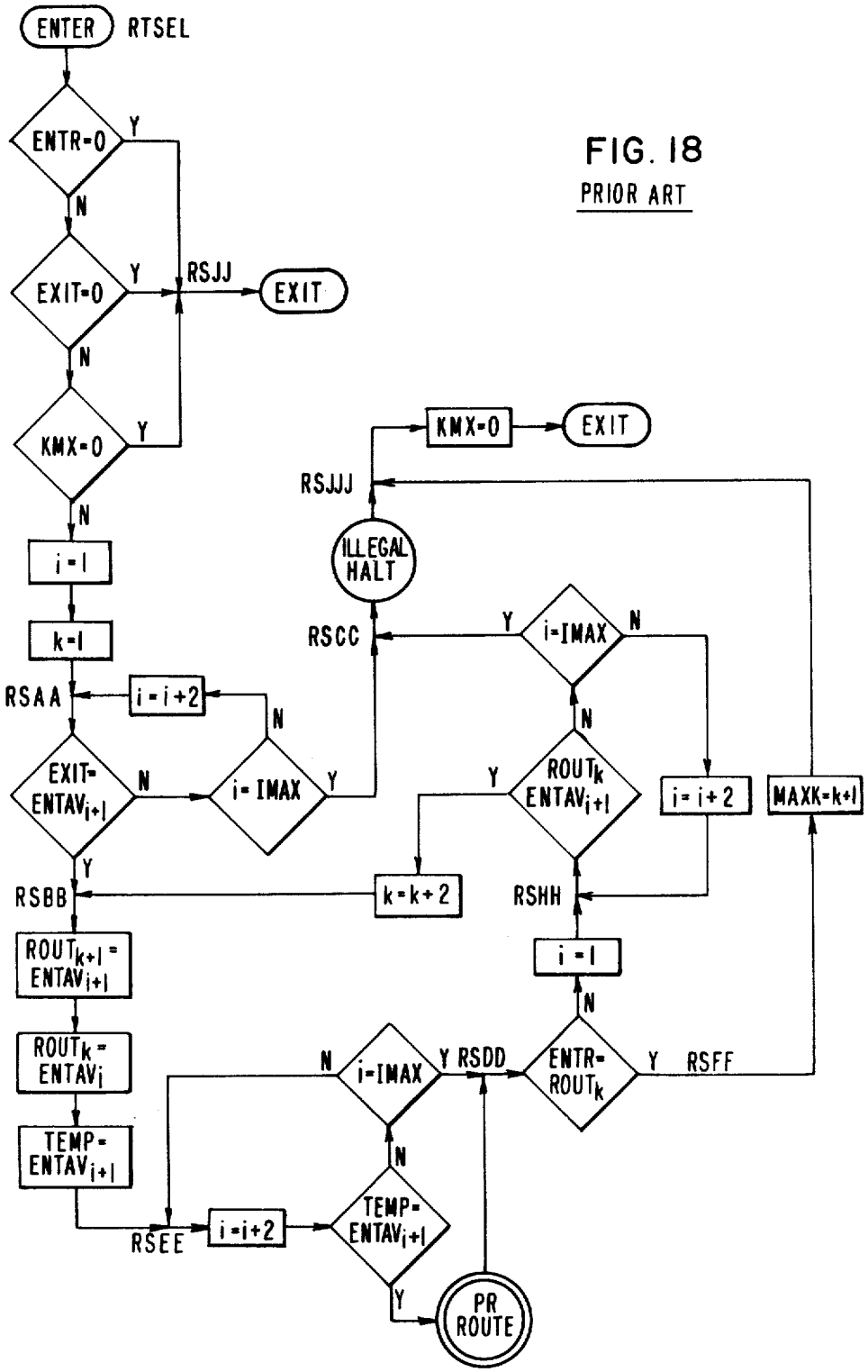
FIG. 18 PRIOR ART
FIG. 18 shows a prior art route select routine.

The route selection subroutine 806 shown in FIG. 18 selects the best path from the entrance station to the exit station. This route consists of unit routes extending from the entrance to the exit, which were in the available route table (ENTAV) 804. If more than one path is available, the priority route subroutine 808 determines the final path by utilizing the priority table 824 which lists the preferred path to each exit. The RTSEL subroutine 806 is called by the station logic program and executed if an entrance, an exit and unit routes in ENTAV 804 are present. The priority route subroutine 808 is executed anytime there are two or more paths from the entrance to the exit. The information required for this routine is: an entrance, an exit, all available unit routes stored in ENTAV 804 and the number of available unit routes (KMX). The information determined by the routine is a through route consisting of one or more unit routes stored in the proper station route table (ROUTT) 810 and the number of unit routes stored in MAXK.

The route is selected in the following manner. The station exit number is compaed to the exits of each unit route in ENTAV 804. If more than one unit route has the same exit number, the priority routine 808 determines which unit route to choose. The entrance of this unit route is compared to the station entrance. If they are the same, the route is complete. If they are not the same, the unit route entrance becomes the exit of some other unit route. This new exit is compared to the exits in ENTAV 804 as before. The process continues until the station entrance is reached. Each unit is stored in the proper station ROUTT table 810 as it is selected. When the last route is stored, the number of unit routes in the through route is stored in MAXK.

Figure 19:
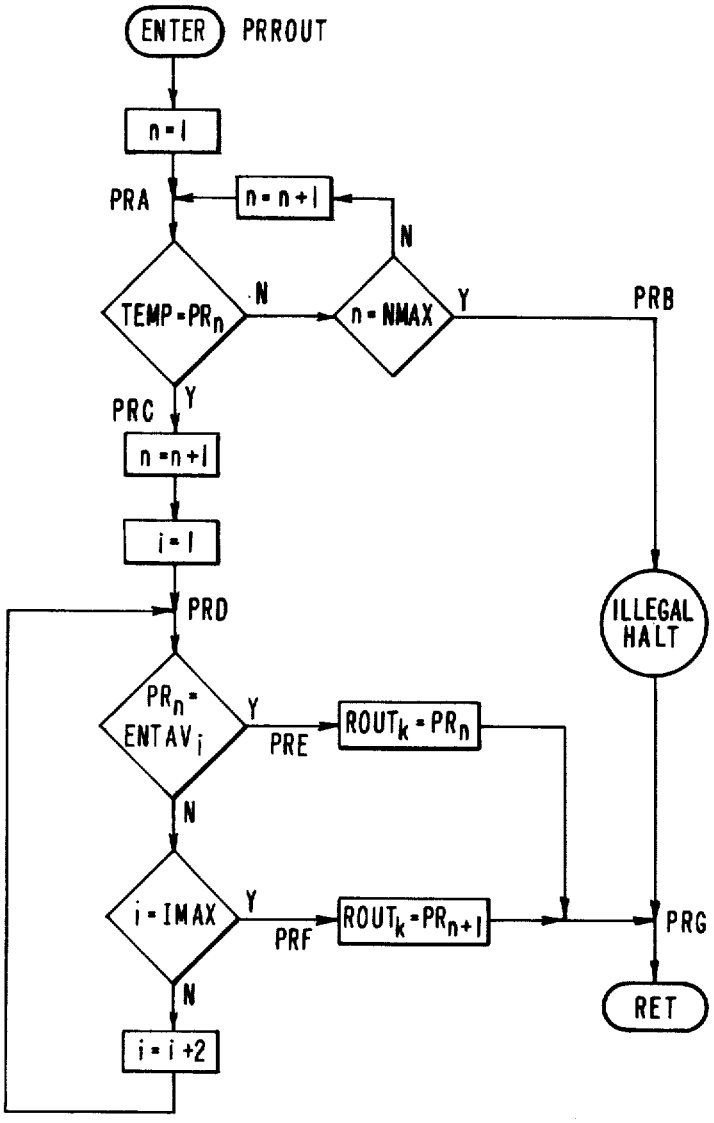
FIG. 19 PRIOR ART
FIG. 19 shows a prior art priority route routine.

The priority route subroutine 808 shown in FIG. 19 is executed whenever the route selection routine 806 determines that more than one path is available from the station entrance to the station exit of the route being requested. The subroutine finds the proper exit in the PRIOR table 824 and then checks the route numbers below the exit in the PRIOR table 824 to see if they are available. The first route in the table which is available has a higher priority than any of the routes below it.

The priority of routes can be changed by changing the order of the number in the table 824. All priorities were chosen arbitrarily and can be changed if desired.

Figure 20A:
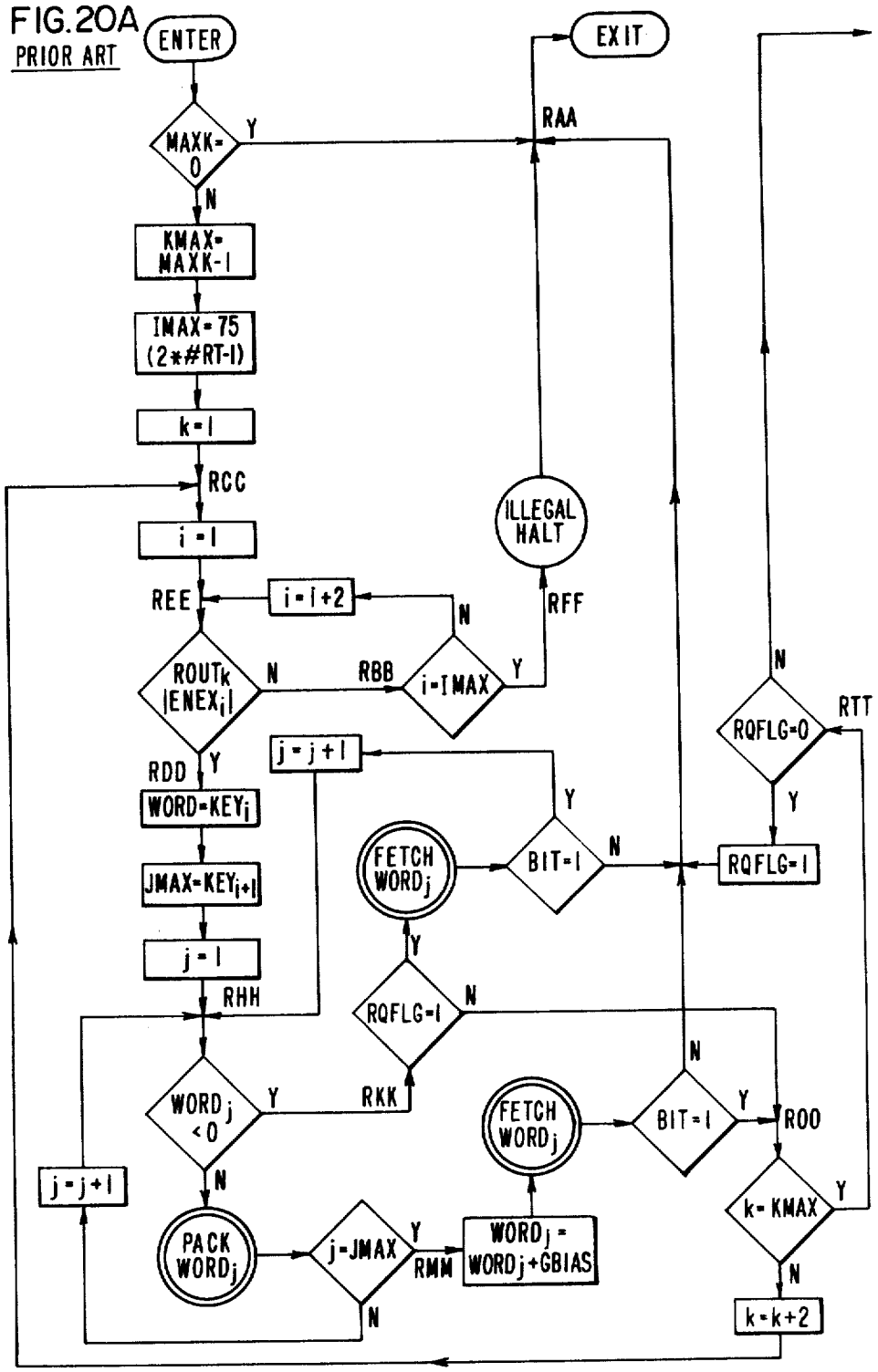
FIG. 20A PRIOR ART
FIGS. 20A and 20B show a prior art route setup routine.
Figure 20B:
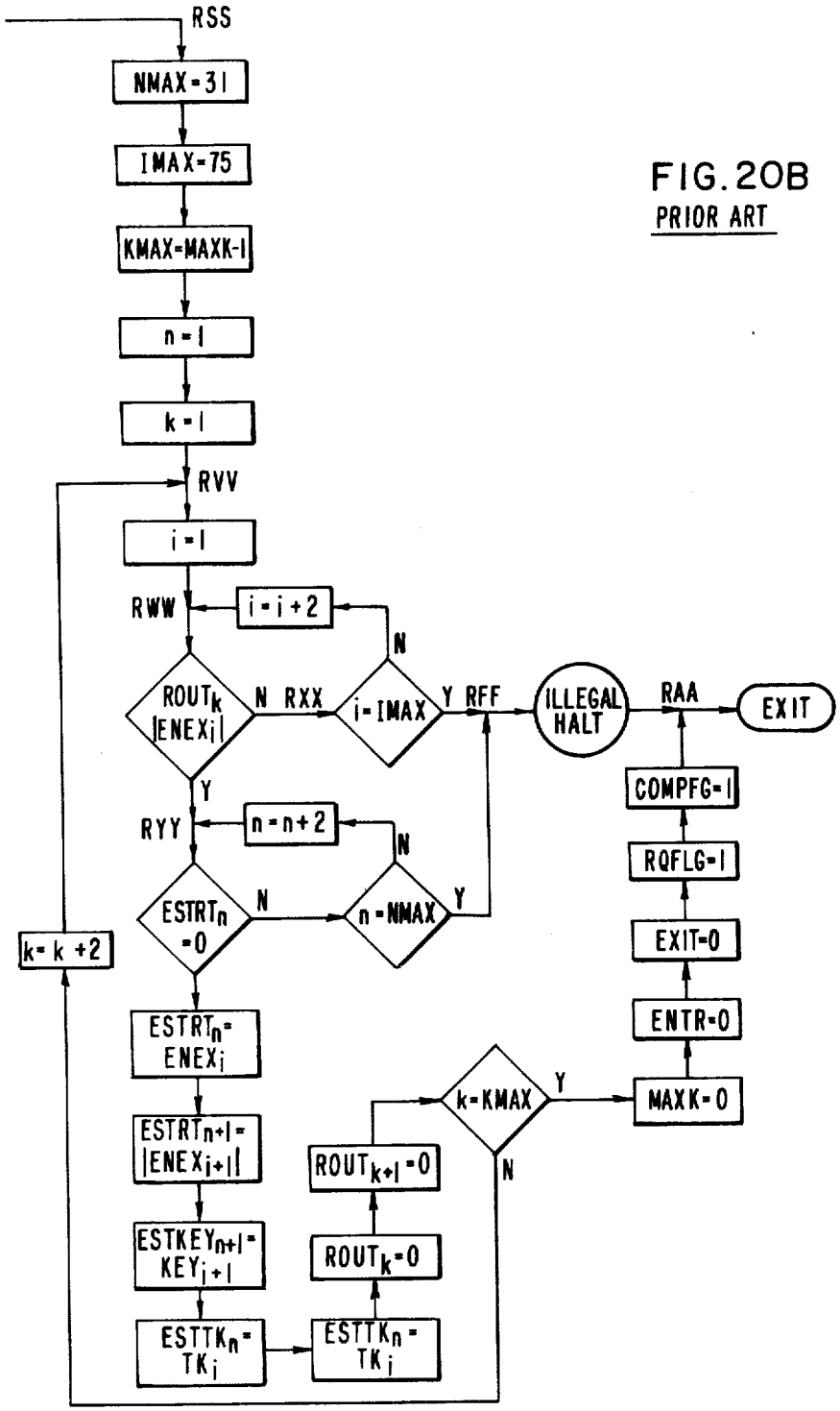
FIG. 20B PRIOR ART

The route setup subroutine 812 shown in FIGS. 20A and 20B sets up the through routes determined by the route select subroutine 806. The information required by the routine is the number of unit routes to be set up (MAXK) and the entrance and exit number for each route which is stored in the ROUTT table 810. If MAXK has a number of routes to be set up, the routine is executed, otherwise control is transferred back to the setup control routine. Each unit route has an associated slot in the entrance/exit table (ENEX) 818, the keyword table (KEYS) 826, the exit track circuit table (TKO) 828 and a unit route setup information table ($SR_i$) 830. The unit route setup info table 830 contains in order: the switch position requests for all switches in the unit route, switch position indications for each of the switches, lockouts for all conflicting routes, and the route request for the gate to the route.

The first unit route from ROUTT 810 is compared with ENEX 818, when a match is made, the same relative position in KEYS 826 gives the location and number of words of information in the setup info table. All switch position requests for the route are sent to interlocking. A through route is set up in reverse from the exit to the entrance. When all the switch positions in the last unit route agree with their requests, the lockouts are set and the route request sent. When the signal clears, the program goes to the next unit route. This process continues until the entire route is set up. At this time the route information; entrances, exits, key, key+1 and TK are moved to the established route table (ESTRT) 814. The ROUTT table 810 is zeroed and flags reset, and the route logic is complete.

Figure 21:
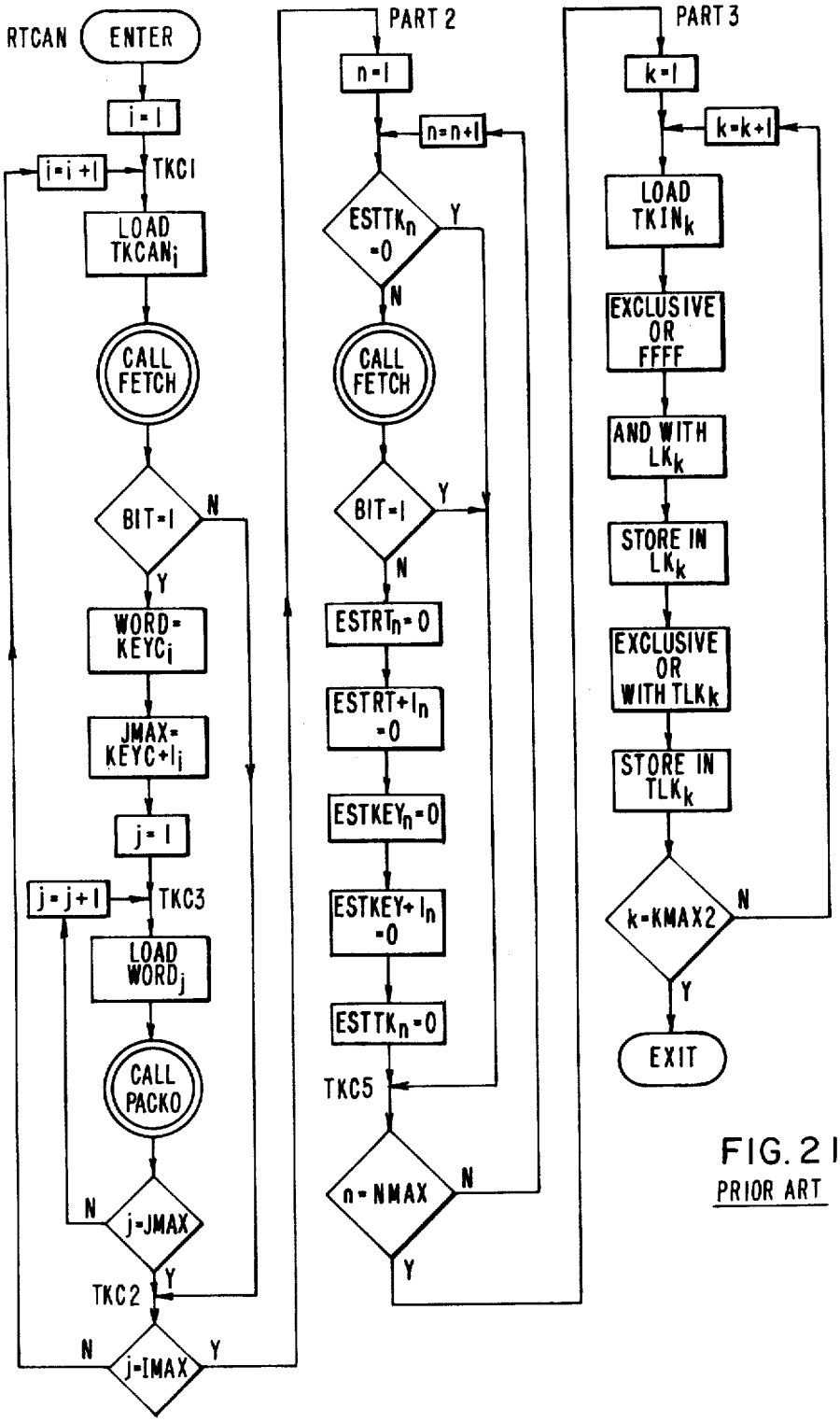
FIG. 21 PRIOR ART
FIG. 21 shows a prior art route cancel routine.
Figure 22A:
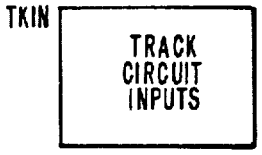
FIG.22A PRIOR ART
Figure 22B:
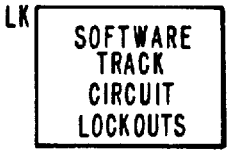
FIG.22B PRIOR ART
Figure 22C:
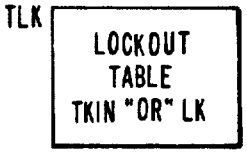
FIG.22C PRIOR ART
Figure 22D:
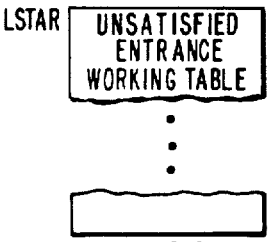
FIG.22D PRIOR ART
Figure 22E:
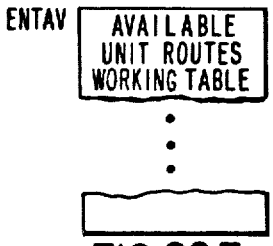
FIG.22E PRIOR ART
Figure 22F:
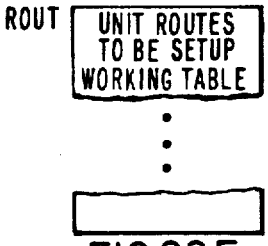
FIG.22F PRIOR ART
Figure 22G:
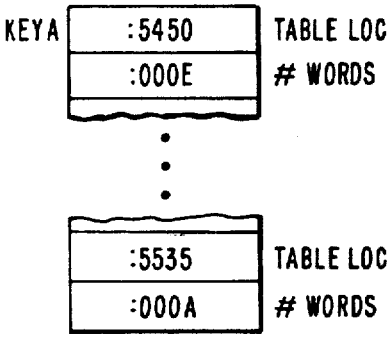
FIG.22G PRIOR ART
Figure 22H:
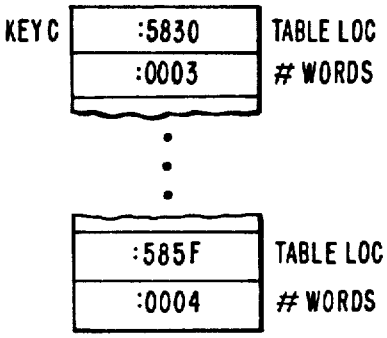
FIG.22H PRIOR ART

The route cancel routine 816 shown in FIG. 21 performs automatic route cancel functions as a train takes a route. The routine 816 contains three sections. The first part cancels route requests and switch position requests whenever the track circuit in which they are located becomes occupied. This section of program uses three tables; TKCAN 832 is a table of all track circuits which contain a switch or a gate, KEYC 834 is a double word table containing the location of each cancel track circuit information table and the number of words of information in each, CKT(i) 836 contains one information table for each cancel track circuit. These tables contain the word/bit location of the request bits to be cancelled. The program searches the TKCAN table 832 for occupancies. Each time it finds one, the KEYC table 834 is used to locate the cancel information table 836 associated with the track circuit. Each word in the info table contains the bit location to be reset. The PACKO subroutine 839 is used to cancel the bit. The second pard of the routine 816 removes routes from the established route table (ESTRT) 814 whenever the last track circuit in the route becomes occupied. This is done by searching the exit track circuit (ESTTK) table 838. Whenever an occupancy is found, the route containing that exit track circuit is removed from the table.

The third part of the routine resets software lockouts as track circuits become occupied. Since the software lockouts LK 815 are ORed with the occupancies TKIN 813 to form the lockout table, the software bits may be removed when occupied, and the actual occupancy bits will cause the route to be locked out. The function of this routine is to cancel out a route, section by section, as a train progresses down the route. When the last track circuit in the route becomes occupied, the route is removed from storage.

The unit route entrance/exit table 818 is a double word table. The first location contains the entrance number of the unit route. The second location contains the exit number for the unit route. If the exit word is negative, throughrouting is allowed and the exit number becomes the entrance number for the next unit route.

The available unit route keyword table 820 tells the program where the unit route information table is located in memory. This table is a double word table. The first word contains the memory location of the info table. The second word contains the number of information words. The information in the keyword table 820 is generated by the assembler from label names on the first word of each information table 802. Each unit route information table 802 contains one label. The assembler assigns the label address of the individual information table to the first word in the keyword table 820. The address of the given information table 802 is subtracted from the address of the following information table to give the number of words in the table. This number is stored in the second word of the keyword table 820.

The unit route setup keyword table 826 tells the program where the unit route information table is located in memory. This table is a double word table. The first word contains the memory location of the info table. The second word contains the number of info words in the table. The information in the keyword table 826 is generated by the assembler from label names on the first word of each information table.

The unit route exit track circuit table 828 contains the input word location and bit position for each unit route track circuit. This table is used by the auto cancel routine 816 to cancel a unit route when the last track circuit in the route becomes occupied.

The unit route availability tables 802 are all used by the FETCH subroutine 840 called by the route available routine 800. Each word in these tables describes a specific bit location in memory. The right hand hex character contains the bit position in the word. The two center digits contain the memory location of the word. These tables are in fact logic equations. Each word contains one condition. All conditions must be satisfied before the route is available.

The unit route setup tables 830 are used by the FETCH 840 and PACK subroutines 839 and 842 called by the setup and cancel routines. Each word describes a bit location in memory and contains a flag to tell the program whether to set, reset or check the status of the bit. The left hand hex digit is an 8 if the word is a switch position indication, otherwise it is a 0 and the word is a control word.

The SR(I) tables 830 are divided into three sections, switch position requests, switch position indications, and lockouts and route request. The last word in each unit route table 830 contains the route request for the route. The words in the first section are positive, the second section negative, and the third section positive. This allows the program to keep track of which operation is required.

A route is cancelled using the same tables 830. The first section of the table contains switch position requests. These requests are cancelled using the PACK0 subroutine 839. The second section of the table is ignored because it is used for indications only. The third section contains lockouts and the route request. These bits are cancelled using the PACK0 subroutine 839.

The track circuit table (TKCAN) 832 is used by the automatic cancel routine 816 to determine when a track circuit which contains switches or gates becomes occupied. When the circuit becomes occupied the switch position requests and the route request are set to zero.

The cancel keyword table (KEYC) 834 tells the program where the auto cancel track circuit information table 836 is located in memory. The KEYC table is a double word table. The first word contains the memory location of the info table. The second word contains the number of info words in the table.

The track circuit cancel information tables CKT(I) 836 are used by the PACK0 subroutine 839 which is called by the auto cancel routine 816. Each word in these tables describes a specific bit location in memory.

FIGS. 17, 18, 19, 21A, 20B and 21 are all prior art routing program flow charts and FIG. 22 shows the tables used by the routing routines. These figures will not be described block by block because they are prior art. A brief description of the figures will be given.

FIG. 17 shows the prior art Route Available Routine flow chart. This routine performs a software interlocking function of determining whether a route is available or not. This routine is called by the In Station Logic Routine, FIG. 23, 1402, whenever a route to the next station is required. The AR(I) tables, FIG. 22, are used to determine whether the route is available or not. Each route has an associated Available Route (AR) table. The table contains one word for each condition which may cause the route to be unavailable. If none of the conditions specified in the AR(I) table exist, the route is available for use by the Station Program. When this routine returns to the Station Program, all available routes have been stored in the ENTAV table.

FIG. 18 shows the prior art Route Select Routine flow chart. This routine selects the path from one station to the next station from available routes stored in the ENTAV table. This routine is called by the In Station Logic Routine, FIG. 23, 1402, whenever the Route Available Routine has returned with available routes stored in the ENTAV table. The route selected by this routine is stored in the proper station ROUT table. If more than one path is available, the preferred route is chosen by the Priority Route Subroutine, FIG. 19.

FIG. 19 shows the prior art Priority Route Subroutine flow chart. This subroutine is called by the Route Select Routine whenever more than one path is available between stations. A Priority table PRIOR is used to determine the path with the highest priority. When the best path has been determined this routine returns to the Route Select Routine.

FIGS. 20A and 20B show the prior art Route Setup Routine flow chart. This routine requests the routes, which have been selected by the Route Select Routine and stored in the individual station ROUT tables, from the hardware interlocking equipment. This routine is executed once each program cycle for each station that has a route pending. Switch position requests are sent to interlocking. Switches are then monitored until they are in the requested positions. Route lockouts are set and the route request is sent to interlocking. The gate is monitored until it clears. The route is then removed from the ROUT table and stored in the ESTRT table where it remains until cancelled.

FIG. 21 shows the prior art Route Cancel Routine flow chart. This routine cancels a route as the train goes through the route on a track circuit by track circuit biases. This routine is executed once each program cycle. Whenever a track circuit which contains a switch or gate becomes occupied, the switch position requests and gate requests are set to zero. When the last track circuit in the route becomes occupied, the route is removed from the ESTRT table. The lockouts are cancelled whenever the track circuits associated with the lockouts become occupied.

FIG. 22 shows the prior art tables used by the routing routines, FIGS. 17–21. These tables have been described in the FIG. 16 description.

STATION LOGIC PROGRAM

Figure 23:
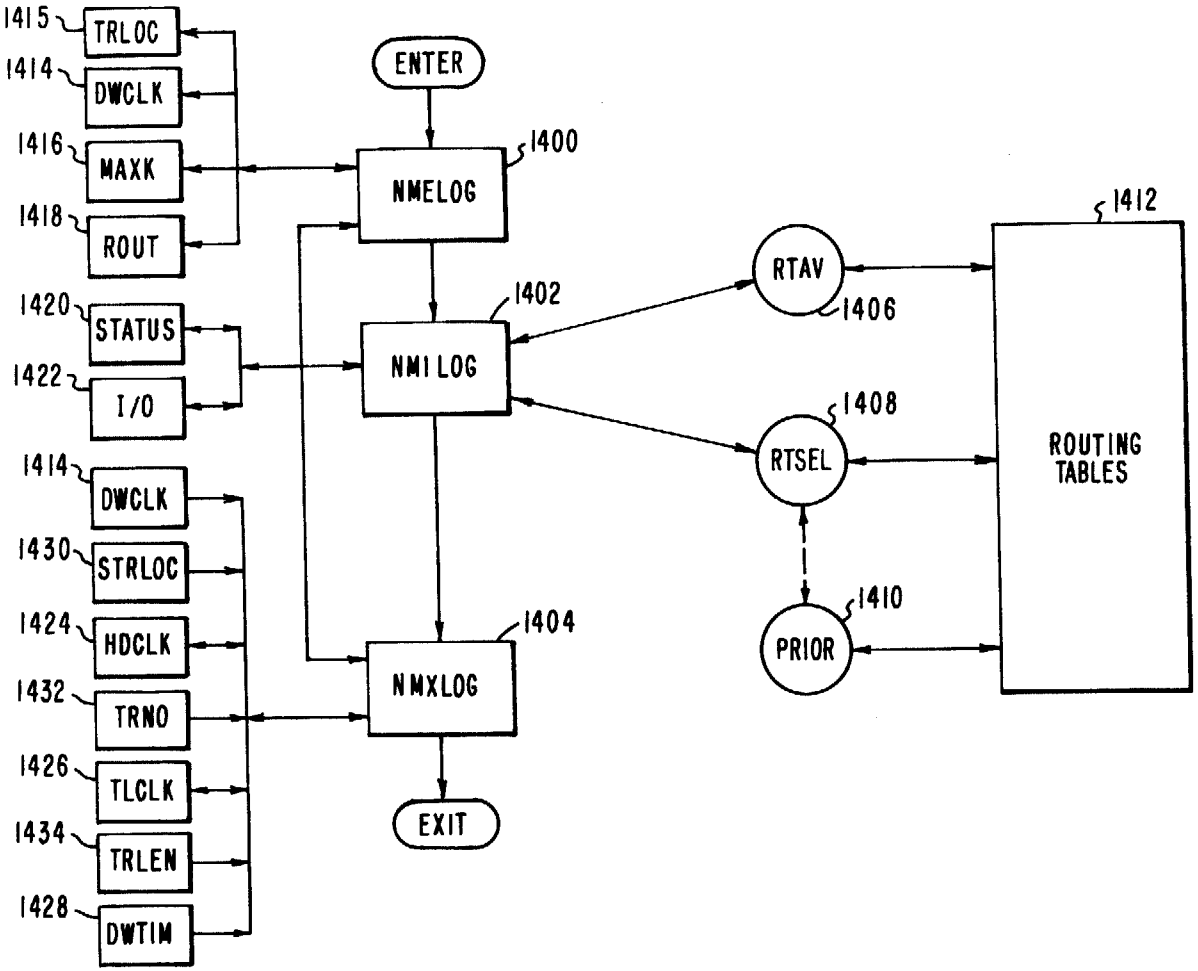
FIG. 23 shows the station logic program in accordance with the present invention.

The station logic program of the present invention shown in FIG. 23 consists of three routines:

a. Station Entry Routine shown in FIG. 24 b. In Station Routine shown in FIG. 25 c. Station Exit Routine shown in FIG. 26.

Each of the stations and pseudo stations has these three routines plus associated tables. Only one set of flowcharts is provided since it is believed that each station program in view of the disclosures of FIGS. 23 to 26 would be obvious to persons skilled in this art to provide additional station programs by routinely modifying the disclosed station program to fit the necessary conditions for another particular station. Some stations have run-throughs and some do not. Some stations have approach blocks from both directions, while some have them from one direction only. Some stations have turnbacks from one side, some have turnbacks from both sides, and the pseudo stations don't have turnbacks with the exception of South Spur. Trains may be stored in certain stations and not others. Trains may be dispatched from those stations where they may be stored. Routes are required between some stations and not required between others. All these variables are taken care of in the individual station logic routines.

The station logic program shown in FIG. 23 performs all the necessary functions to check a train through a station. The primary function is to determine the next station and to clear a route, if required, to that next station in time so that the train will not have to slow down or stop in front of a gate that has not cleared. A secondary function is to regulate the spacing of the trains on the system. Dwell times, headways, and available paths to stations are some of the conditions that are used for the spacing function.

Two different series of operations are required, depending on whether or not a run-through is in effect. For the run-through case at least one approach track circuit on each side of a station is used for a reference point where the status of the out of service pushbutton on the operator's console is checked. If on, the program proceeds to set up a route to the next station. This allows time for the route to clear before the train gets to the gate. At the time the station track circuit becomes occupied, the train is checked out of the station by starting the headway and train late clocks and sending the train length and train number to the next station. The run-through alarm flag and the no depart to alarm flag are set for the next station. The run-time to the next station is determined and stored in the RUNTIM table.

For the station stop case, the program checks the train into the station when the station track circuit becomes occupied. The program then waits until the doors open. At this time a computer requested hold train with doors open HTDO output is set, and the dwell time clock is started.

While the train is waiting for the dwell time to elapse, the program determines the next station. This involves a desired direction of travel, where the train is located, out-of-service pushbuttons, turnback pushbuttons, and mode of operation. As soon as the next station is determined, a route is selected to that station if one is available. This route is then established by hardware interlocking.

When the route is selected, the train is now ready to be checked out of the station if all conditions permit. Several things must be satisfied; the dwell time must have expired, the headway time must have elapsed, the track to the next station must be clear of traffic, manual hold, HTDO, and recycle doors pushbuttons must not be on, and the gate for the route must be clear. When all these conditions are met, the train is checked out of the station. The close door command is sent, the HTDO output bit is reset, the headway clock is started, the train length sent to the next station, the train number is sent to the next station, the run time is sent to the next station, the run-through alarm flag for the next station is set, the no depart to alarm flag is set and the train late timer for the next station is started. The train leaves the station and the station program is finished until the next train arrives.

The station entry logic program checks a train into a station or through a station if it is going to run through it. The in-station logic program performs all the functions that are required while the train is in a station during the provided dwell time to set up the route for the train to travel to the next station. The station exit logic program checks the train out of the station and sets up the next station for the train. Each of these programs is operationally related to the train positional space on the system rather than time. There are 16 stations in the track system shown in FIG. 3, and includes 12 real stations with passenger doors and four pseudo stations. The pseudo stations are in the two bypasses, at the north storage area and in the south spur. The program does not know the difference between a pseudo station and a real station.

In FIG. 23, there is shown the overall station logic program block diagram of the present invention, including the above three program routines, the station entry routine 1400, the in station routine 1402, and the station exit routine 1404. The in station routine 1402 is involved with the routing functions. Whenever a route is required to the next station the route available subroutine 1406 is called. In addition there is called the route select subroutine 1408. If a route is available the route select subroutine 1408 actually selects a particular path that the train will travel. If there is more than one path available, the route select routine 1408 has to call the priority routing routine 1410. The station entry routine 1400 operates with the dwell clock table 1414 which provides one second clocks used to determine the dwell time a train will be in the station. At the time the doors open the dwell clock is started for the station and counts continuously. The station exit routine 1404 will check to see how long the train has been in the station and after the desired dwell time has elapsed will release the train. The MAXK table 1416 contains the number of routes that are to be set up from the station. Due to the addressing structure on the Computer Automation machine 175 shown in FIG. 6 indirect address pointers are required, so the station entry routine 1400 sets up the indirect pointer for the address of this table 1416. The route table 1418 is a table in memory which contains the numbers of the entrances and the exits from a given station. The in station logic routine 1402 sets up the ROUT table address pointers for the rest of the routines to use. The station status word table 1420 has one word for each station. Each of the 16 bits in the word (FIG. 45) has one piece of information about the status of the program operation concerning that station. For example, when a train comes into a station the status word is zero, when the station track circuit becomes occupied a one bit in this word is set. As soon as the station is occupied, the station entry routine 1400 starts looking for the doors to open and goes into a holding pattern. When the doors open, the door open bit is set in the status word 1420. This word is continuously processed until the last bit is set indicating that the station exit logic is complete and the program now bypasses the station logic program until the status word is cleared. The station exit routine 1404 utilizes the dwell clocks 1414. The clock was set by the station entry routine 1400 and is checked in the exit routine 1404, to see if the dwell time has elapsed. The headway clocks 1424 are another set of clock used to determine train separation, derived by taking the run time plus the dwell time and dividing it by the number of trains on the system. The headway clock 1424 is set to zero when the train leaves a station. The next train has to wait the desired headway time before it is allowed to leave that station. The train late clock 1426 is used for alarms; this clock is set to zero when the previous station exit routine is complete. The alarm programs check to see if certain events have occurred. The first check is, has the station block became unoccupied? If within 30 seconds the occupancy does not go away, an alarm is given. If the doors do not open at the next station within a set period of time an alarm is generated. The dwell time table 1428 provides dwell times adjustable by the operator from the console, each station is individually selectable. The table 1428 contains the number that the operator has entered. The STRLOC table 1430 contains the TRLOC location for the particular station. The TRLOC table was described in the tracking program covered by the above-referenced related patent application. It contains the train number of the train in each track circuit. The TRNO table 1432 is the train number table and contains the numbers of the trains on the track system. The TRLEN table 1434 is a train length table and contains the number of cars that are in each train. These two tables are used by the station exit routine 1404 because the train length is required to be sent ahead to the next station so the passengers know which doors are going to open. The station exit routine 1404 takes the train number from the STRLOC table 1430, uses the train number to get the relative position in the TRNO table 1432 and from the same relative position in the TRLEN table 1434 determines the length, and then sends the length to the next station graphics to operate the correct number of signs over the doors.

The station routine entry NMELOG shown in FIG. 24 performs the functions required to check a train into a station. There is one program for each of the stations. An approach track circuit on each side of each station is used as a detection point, where it is determined whether a station run-through is in effect. If a run-through is in effect, a flag is set and control transferred to the in station routine shown in FIG. 25. Otherwise, the train is checked into the station and when the doors open, the dwell clock is started, a computer HTDO is set and control is transferred to the in station routine.

When the routine is entered, the station entry complete flag is checked to see whether the entry logic is complete. If not, the station occupied flag is checked to see if a train has been checked into the station. If the flag is set, the program checks, once per cycle, to see if the doors have opened. When the doors open, the computer HTDO outut bit is set, the station HTDO flag is set, the door open flag is set, the dwell time clock is started, the dwell start flag is set, the entry complete flag is set and the program jumps to the in station routine. If the station occupied flag was not set, the approach track circuits on each side of the station are checked for occupancy. If either of them becomes occupied, the direction of travel is checked to see if the train is coming into the station. If the train is not coming into the station nothing is done. If the train is traveling toward the station, the station out of service pushbutton is checked. If off, nothing is done. If a run-through is in effect, the run-through flag is set, the entry complete flag is set and control transferred to the in station routine. If no approach track circuit is occupied, or if the trains in them are leaving the station, the station track circuit is monitored for occupancy. As soon as it becomes occupied, the station occupied flag is set. A special case is invoked if a train is being stored in a station that has doors, such as at North and South Baggage. When the dwell timer is started, a check is made to see if the train is to be stored in the station. If not, the normal path is taken. If it is to be stored, the normal dwell time is used to maintain the open door period and then the doors are closed. The logic then ignores the train until a dispatch train command is issued by the operator.

Figure 24A:
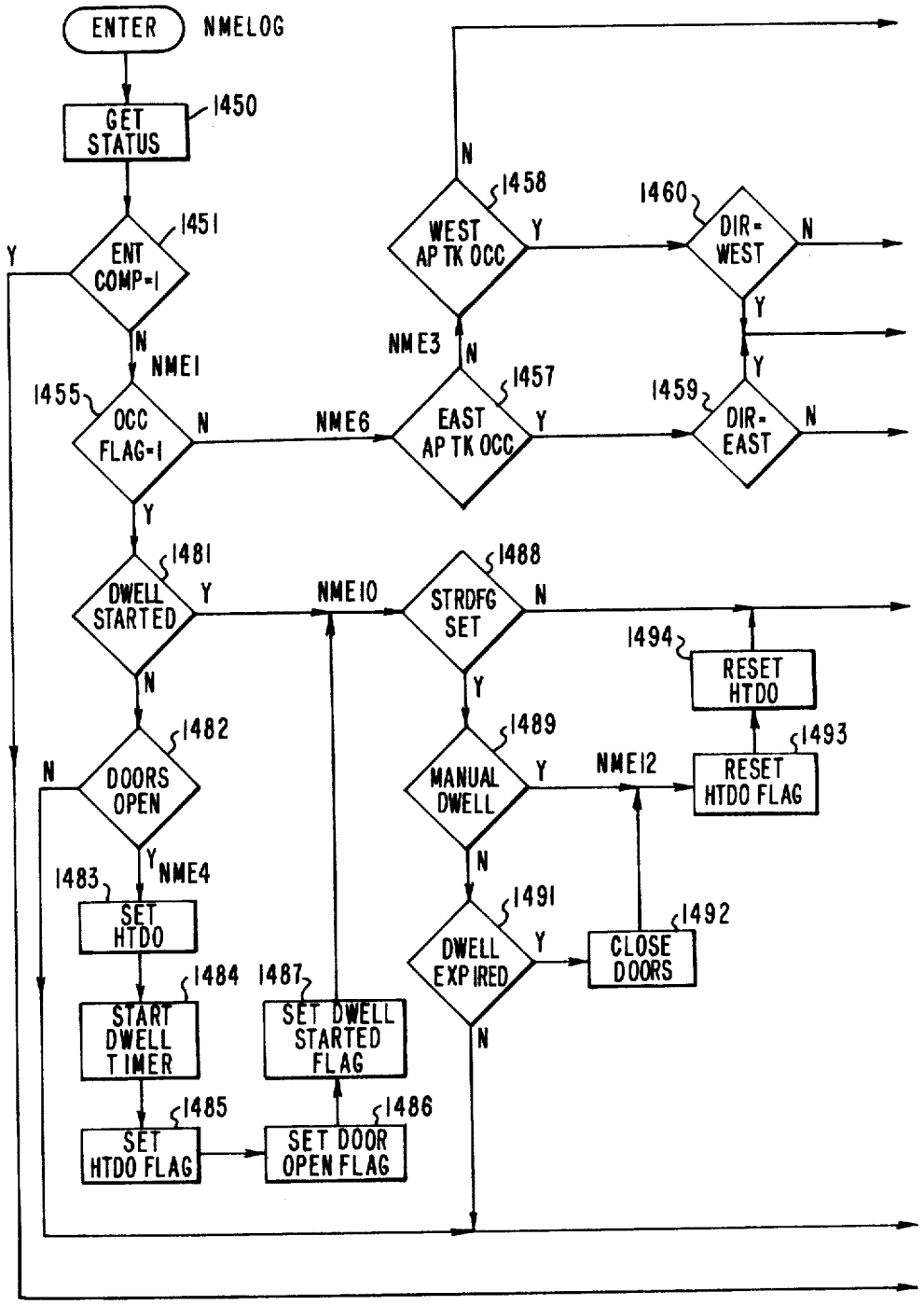
FIGS. 24A and 24B show the station entry logic routine of the present invention.
Figure 24B:
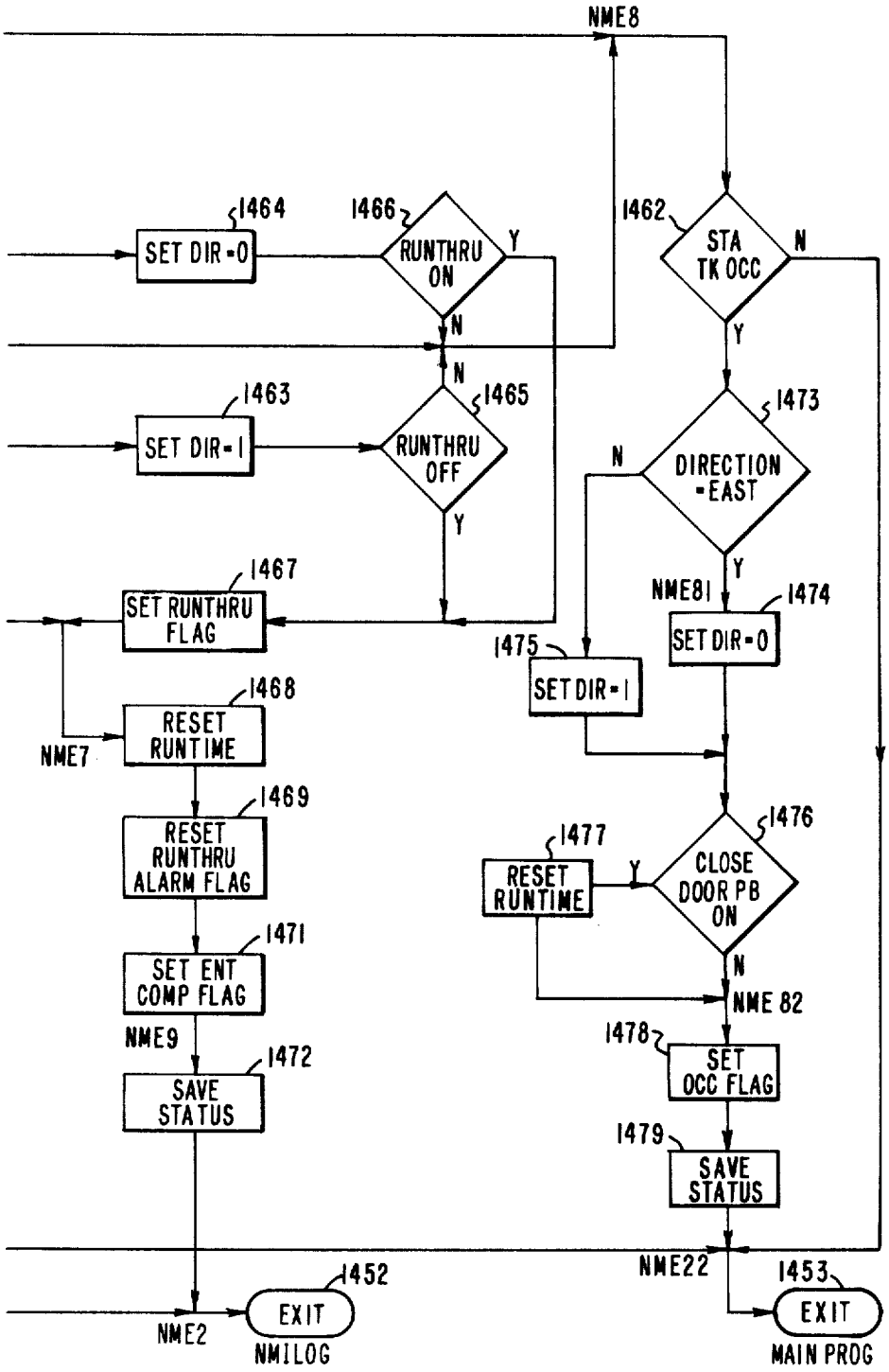

FIGS. 24A and 24B show the station entry logic for a typical station. At step 1450 get the status word, which has 16 individual bits to denote the status of the processing of the train through a station. In step 1451 check if the entry logic is complete. If yes, this routine is finished, go straight to exit 1452 which goes to the in station logic shown in FIG. 25 as compared to the exit 1453 which goes back to the main program shown in FIG. 9. From step 1451 if the answer is no, go to step 1455 and check if the occupancy flag is equal to 1. If no, go to step 1457 and check if the east approach track circuit is occupied. Step 1458 checks if the west approach track circuit is occupied. At step 1457 if Yes, check at step 1459 what direction the train is going. The train could be leaving the station rather than coming into it, so if the east approach circuit is occupied at step 1457 then check is the direction east at step 1459, and if the answer is yes the routine is not involved because this is the approach circuit on the east and the train is moving east so it is not coming into this station. The same type of checks are made using steps 1458 and 1460 to check if the west approach track circuit is occupied and is the direction west. Again, if the answer is No, the train is not coming into the station, so go to step 1462. If in either step 1459 or 1460 the train was coming into the station, it is desired to set direction flag bits. At step 1459 is the direction equal east, if No, at step 1463 set the direction flag equal to 1, because the train is going west. At step 1460 is the direction west, if No, go to step 1464 and set the direction flag equal to 0. Steps 1465 and 1466 check if the operator's run-through button has been pressed, and if the answer is no, go to step 1462 and mark time. In both cases if the run-through button is on, go to step 1467 and set the run-through flag bit in the status word. Go to step 1468 and reset the run time, which run time was set in the run time table at the previous station in relation to checking whether there is a train late alarm. Since the train is not going to stop at this station there is no need for an alarm. In step 1469 reset the run-through alarm flag. In this particular case the train is going to run through the station so the alarm is disabled. In step 1471 set the entry logic complete flag to avoid going through this routine again. In step 1472 save the status word, so it is available again next cycle, and go to the exit 1542, the entry logic is complete. If there is no run-through in effect at steps 1465 and 1466, if the train is going in the wrong direction, or if the approach blocks were not occupied, go to step 1462 to check if the station track circuit is occupied. If the answer is No, go to the exit 1453, this is the mark time exit. In the next cycle at step 1462 check is it occupied, when Yes, go to step 1473. The series of steps 1473, 1474 are to determine the direction and to set it for the rest of the routines. Step 1473 checks if the direction is east, if Yes go to step 1474 to set direction equal to 0 and if No go to step 1475 to set the direction equal to 1. At step 1476 check if the closed door pushbutton is on. If on, the doors will not open. If yes, go to step 1477 and reset the run time, so there will not be an alarm because the door failed to open within a certain period of time. At step 1478 set the occupancy flag bit in the status word, at step 1479 save the status word and go to exit 1453. This exit is to the main program in FIG. 9 because this program logic is not finished.

At step 1455 check if the occupancy flag equal to 1, and assume the answer is Yes. At step 1481 check if the dwell timer has been started, the answer is no, because the doors haven't opened. Step 1482 checks are the doors open yet. The answer is going to be No, since the doors are not open yet. Go to exit 1453 and mark time. When the doors open, at step 1482 go to step 1483 and set the HTDO bit. Go to step 1484 and start the dwell timer. At step 1485 set the hold train doors open flag, it is set is to monitor progress. Go to step 1486 and set the door open flag in the station status word. At step 1487 set the dwell started flag, which is also in the station status word. Now go to step 1488 and check if the stored train flag is set, which means the train is stored in the station. If it has been stored, it is going to sit there until dispatched. For the normal case, the flag is not set, so go to step 1468 and go out through the path to exit 1452 which was described before. If the stored train flag was set, go to step 1489 and check the manual dwell time. There are both manual dwells and automatic dwells in this system. If the operator has failed to enter a dwell time for a station, there is a dwell clock inside the logic cabinets for each of the stations. If there is a manual dwell time, the computer has no idea when the clock is going to expire. Assume the control is not in manual, go to step 1491 and check if the dwell has expired. If it has not expired, go to the exit 1453 and mark time until it does expire. Then go to step 1492 and close the doors. Go to step 1493 and reset the hold train door flag, and go to step 1494 and reset the actual hold train doors open command. Then go to step 1468 and complete the logic.

Back at step 1489 check the manual dwell, if the operation is in manual dwell there is no need to check the dwell time or close the doors, because they will be closed by the manual dwell clock. From step 1489 go to step 1493 and reset the two flags and go to exit 1452. This is the only case when a dwell time is checked in the station entry logic. When a train is stored in the station, it will stay there until it gets a dispatch command. However, if the train is being stored in the station, it is desired to come into the station, perform the normal dwell so the people can get out and then shut the doors and leave it there.

Figure 25:
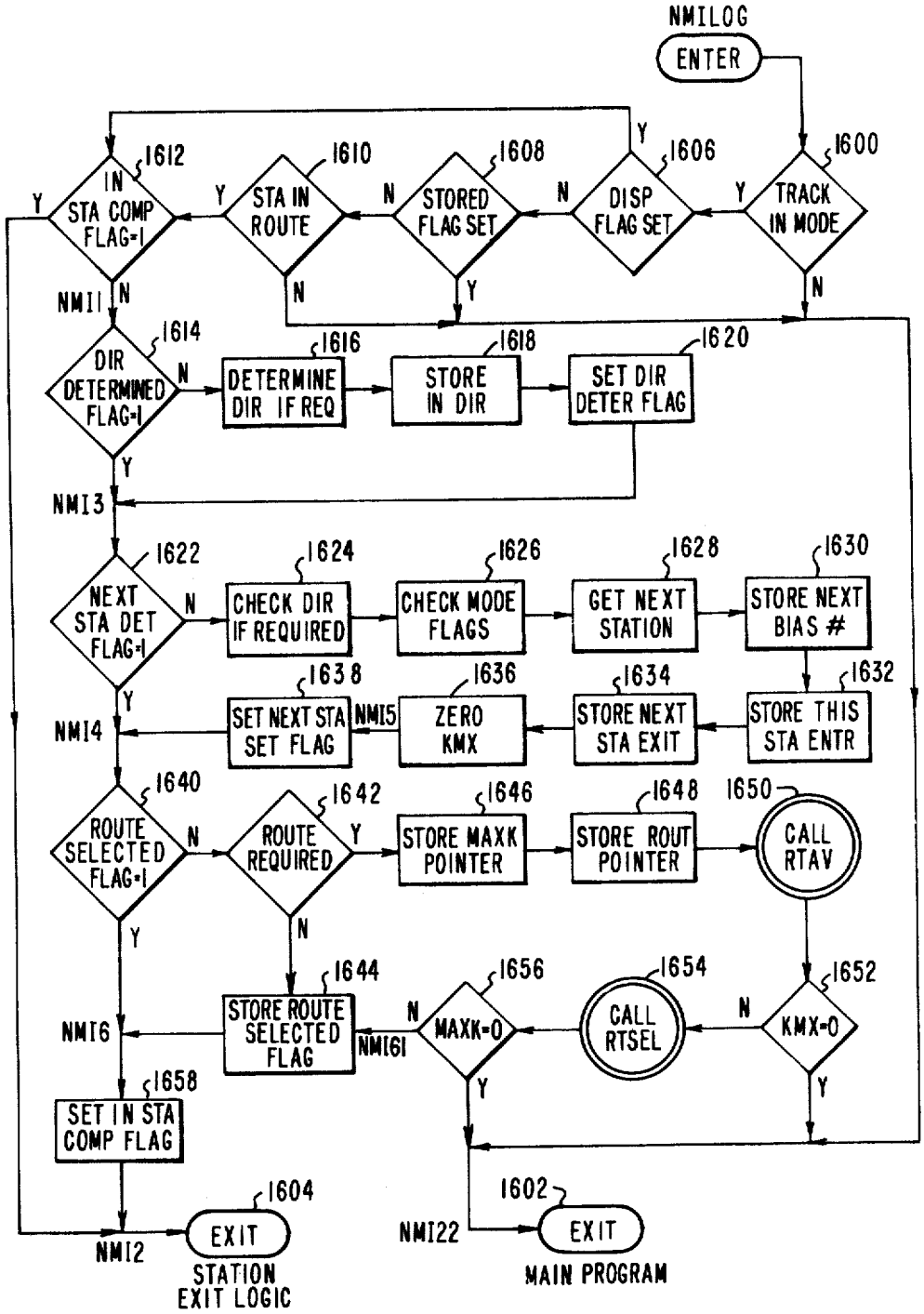
FIG. 25 shows the in station logic routine of the present invention.

The function of the in station routine NMILOG shown in FIG. 25 is to clear a route to the next station during the dwell time of a train in the station or while the station is being run through. The direction of travel is determined. The next station is determined. The routine then calls the route available and route select subroutines. Control is then transferred to the station exit routine.

The in station routine performs all functions required to set up a route to the next station. An integral part of this routine is to determine the direction of travel and the next station in the route. When the routine is entered, the MODE flag is checked to see if any mode of operation is in effect, if not this routine is bypassed. Next, the dispatch flag is checked to see if a train in this station is to be dispatched. Then the INROUT word is checked to see if the station is in the route. If yes, the in station complete flag is checked to see if the in station logic has been completed. If not, the direction of travel is determined based on gate status, traffic indications and turnback pushbuttons inputs. The DIR flag is then set.

The next station is then determined from the direction of travel, mode of operation and present station location. The next station ENTR and EXIT numbers are stored for use by the routing routines. The proper status flags are then set.

The route selected flag is checked to see if a route has already been selected. If not, the flag is set for those stations which do not require a route to be set up to get to the next station. If a route is required, the pointers for the ROUTT table and MAXK table are stored for use by the routing program. The route available routine is now called. A check is made of KMX, the number of available routes, to see if any routes are available to the next station. If not, this routine is exited and another try is made the next program cycle. If available unit routes were found, the route select routine is called to select the path to the next station. MAXK is checked to see if a route was actually selected. If it was, the route selected flag and the in station complete flag are set and control transferred to the station exit routine. If no route was selected, the program will attempt to find a route the next program cycle.

FIG. 25 is the in-station logic, which does all functions required while the train is in the station. The routine operates as soon as the station entry logic shown in FIG. 24 is complete, a train is in the station with its doors open a run-through is in progress or the train has been stored previously. At step 1600, check if this track in one of the operating modes. If the occupied station is on the south track, the routine will check the south track bit, and if the station is on the north track, the routine will check the north track bit. If the answer is no, this track is not in an operating mode, the routine goes to step 1602 and exits. This routine has two different exits just like the previous one. The exit number 1602 is a mark-time exit, and goes back to the main program. Exit number 1604 is only used when this in-station logic is complete, and from that point it goes to the exit logic program in FIG. 26. If this track is in an operating mode, go to step 1606, and check if a train is being dispatched. If the answer is no go to step 1608 to check if the stored flag is set. This flag would be set when a train has been stored in the station. Step 1610 checks if this station is in the route. If this station is not in the route, go to exit 1602 and wait. At step 1610, if the station is in the route, check in step 1612 to see if the in-station logic flag is complete. If the answer is no, go to step 1614 to determine if the direction-determined flag has been set. If the flag is not set, at step 1616 determine the direction by checking the DIR table. At step 1618 store that direction bit in the DIR flag bit. At step 1620 set the flag that indicates the direction has been determined so the program will not go through the check again. At step 1622, which is the same place that the program would have gone if the flag was already set to one, check to see if the next station has been determined flag is set. At step 1624 check the direction if required. For end point stations this check is not needed because the train can only go one direction. Step 1626 checks the mode flags, this involves the mode flag word shown in FIG. 44 to see which of these specific bits is set to find out where the train should go. As a result of the direction that the train is going as determined in step 1624, the mode that the train is operating in determined in step 1626, go to step 1628 and determine what the next station is. Step 1624 checks if there is a turnback in effect and if that button is pressed, the train leaves in the direction it entered. Step 1630 stores the bias pointer for the next station. The selection of the next station in step 1628 includes selecting a bias for that station. At step 1632 store the entrance number into a location called ENTR. In step 1634 store the next station exit number. This provides a route definition such as 100 to 108 and is used by the route available routine. Step 1636 zeros KMX, which is the number of routes that are available from the entrance. Step 1638 sets the next station determined flag to prevent going through this loop again. Step 1640 determines if the route selected flag has been set. Step 1642 checks if a route is required. There are several stations with no gates between them and the next station and no route is required. If no route is required, go to step 1644 to store the route selected flag. If a route is required, go to step 1646 to set up pointers for the tables that store this information. For each individual station the routes are stored and then at the completion of all 16 stations, the set up control program sets up all routes. The steps 1646 and 1648 set up addresses as to where this invention is to be stored. Step 1650 is the call to the route available subroutine, which determines whether there are routes available by going through the proper tables. When the program returns, step 1652 checks does KMX=0, with KMX being the number of routes that are found. If KMX is 0, there is no route available, and the program goes to the exit 1602 and marks time until next cycle through the program. When a route becomes available, go to step 1654 to call the route select subroutine. There are routes available and now the program selects the route including any priority that is required. Step 1656 checks if MAXK is equal to zero, if the routine found a route from the entrance to the exit, it will not be 0. If the answer is yes, mark time by going to step 1602. From step 1656 as soon as there is a route available, there is a number in MAXK, which number is the number of unit routes. In step 1656 when a route is found, go to step 1644 to set the route selected flag. Go to step 1658 to set the in-station complete flag, and exit at step 1604 to go to the station-exit logic.

Figure 26:
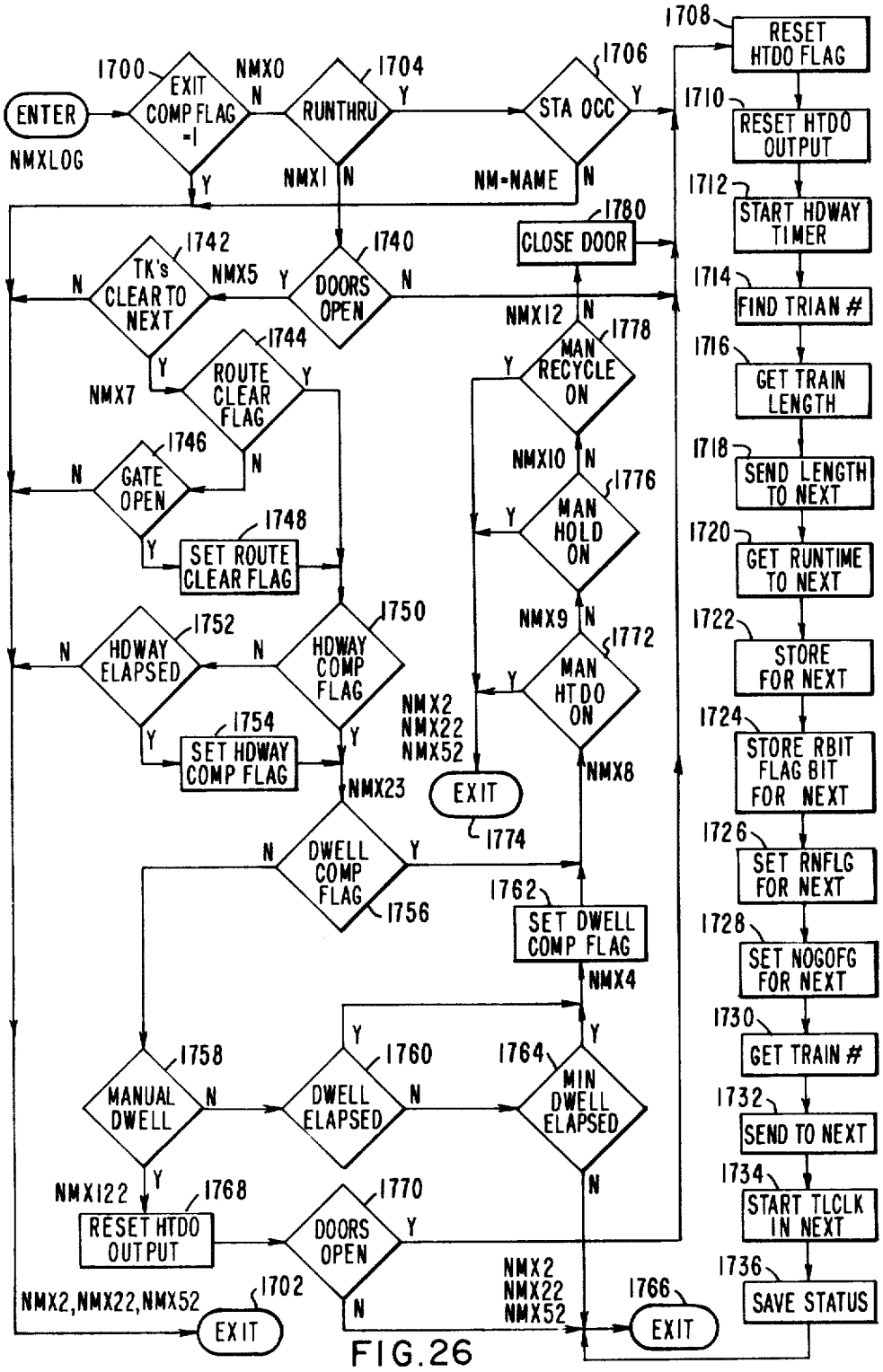
FIG. 26 shows the station exit logic routine of the present invention.

The function of the station exit routine NMXLOG shown in FIG. 26 is to check a train out of a station after the dwell time and heading time have elapsed, the track is clear to the next station, a gate is clear, and no manual over-rides are in effect. The train late timer for the next station is started, the train length is sent to the next station, the train number is stored for the next station, the run-through and no depart to alarm flags for the next station are set, and the run time to the next station is determined and stored in the RUNTIM table. In the run-through case, the only functions performed are the train late timer and train length for the next station sent and the alarm flags are set.

The station exit routine performs all functions required to check a train out of a station. Two separate cases are involved, a normal station stop and a station run-through. When the routine is entered, the station exit complete flag is checked to see if the station exit logic has been completed. If not, the run-through flag is checked to see if a run-through is in progress. If yes, the station block occupancy is checked to see if the train is present. The program marks time until the station block becomes occupied. This is necessary because the train length and other information must be determined and sent to the next station. The STRLOC table contains the TRLOC table address for each of the station track circuits. When the station track circuits become occupied, the STRLOC table is used to determine the TRLOC table location for the given station. The train number is then obtained from the TRLOC table. This train number is then compared to the TRNO table which contains the train number of all trains on the system. The TRNO table bias is then used to determine the train length from the train length table, TRLEN. This train length is sent to the next station to be used in the graphics logic. The headway timer in the present station and train late timer in the next station are started. The station exit complete flag is set and the routine is complete. If no run-through is in effect, the normal check out of the station sequence will be executed. First, the headway complete flag is checked. If not set, the program monitors the headway clock until it equals the headway time. When the headway time has elapsed, the headway complete flag is set. Next, the dwell complete flag is checked. If not set, the program compares the dwell time in effect with the dwell time clock until they are equal. When the desired dwell time has elapsed, the dwell complete flag is set. At this point it is time to release the train if conditions permit. The occupancies between the present station and the next station are checked to ensure no train is present. A train cannot be released from a station until it has a clear track into the next station. When the track is clear, the route cleared flag is checked. If not set, the program monitors the gate for the route until it clears. The route cleared flag is then set. Three manual pushbuttons must now be checked: manual hold train with doors open, HTDO; manual hold, hold; and manual recycle doors, RCYCLE. If any of these pushbuttons is pressed, the program marks time. When all three of these pushbuttons are off, the train is checked out of the station.

The door close signal is sent, the HTDO bit is reset, the headway timer started, the train length sent to the next station, the train late timer in the next station is started, the run time to the next station is obtained from the ERUN or WRUN tables and stored in the RUNTIM table slot for the next station. This value is used to determine the no arrive at alarm. The no depart to alarm reset bit is stored in the RBIT table, the run-through and no depart to alarm flags are set for the next station, and the station exit complete flag is set.

FIG. 26 shows the station-exit logic, which routine checks the train out of the station and sends whatever information is required ahead to the next station.

Step 1700 checks if the exit logic is complete, and if it is, goes to step 1702 and the program is finished. If it is not, step 1704 checks if there is a run-through in effect at this station. If there is a run-through in effect, the train is not going to stop but still requires the sending of information ahead to the next station. Assume a run-through, go to step 1706 and check if the station is occupied, until the station becomes occupied, the program does not know which train it is. If the station is not occupied, go to exit 1702 and mark time. At step 1706 the program will wait until the station track circuit becomes occupied, and then look into the tables and find out which train it is and get the train length and number. When the station becomes occupied, go to step 1708 and check out of the station. The program goes through the steps from 1708 to 1736, which is the check-out list covering things required at the time the train is leaving. At step 1704, when there is no run-through, go to step 1740 to check if the doors on this train are open. The doors are supposed to be open at the time this routine executes because the train is performing a dwell, so under the normal case, the doors will be open. However, the operator has a button on the console to close the doors, and the operator can close the doors when the train is in the station. If the doors are closed, the train is going to leave, go straight to step 1708 and check the train out. If the doors are still open, go to step 1742 to check if the track is clear to the next station. A train cannot leave a station unless the path is clear all the way up to and including the next station. If the answer is no, go into a holding pattern to the exit 1702. If the answer is is yes, check at step 1744 if the route-clear flag is set. If this flag is not set, go to step 1746 to check if the gate is open, and if it is not, go to step 1702 and wait. If it is open, set the flag at step 1748 and go to step 1750 to check if the headway-complete flag is set. If not, go to step 1752 and check to see if the desired headway has elapsed yet. If the answer is no, go to step 1702 and wait. If yes, go to step 1754 to set the headway-complete flag. Step 1756 checks if the dwell-complete flag is set, if not, go to step 1758 and check if the dwell is manual. If manual, there is no control over it. If no, go to step 1760 and check if the dwell time has elapsed. If the answer is yes, go up to step 1762 and set the dwell-complete flag to 1. If the answer is no, go to step 1764 to check if the minimum dwell time has elapsed. If the answer is no, exit to 1776 and wait. If the answer is yes, set the dwell-complete flag at step 1762. At step 1758, if the manual dwell time is on, the program has no control of the doors, so go to step 1768 and reset the hold train doors open output bit that was set when the doors opened. At step 1770 check if the doors are open and if they are go to step 1766 and wait. If the doors are closed go to step 1708 and go through the checkout sequence. Back to step 1762, continue the checks at step 1772 to determine if the manual hold train doors open pushbutton is on. If the answer is yes, exit at step 1774. If not, check at step 1776 to see if the manual hold button is on. If it is on go to exit 1774. If it is off, go to step 1778 to check if the manual recycle doors pushbotton is on. Again, if it is on, the program goes to exit 1774. If it is off, close the doors at step 1780. Go to step 1708 to reset the hold train doors open flag in the status word. At step 1710 reset the hold train doors open output. At step 1712 start the headway timer. Step 1714 finds the train number from the TRNO table. Using the train number, go into the train length table at step 1716 to find the train length, and then send the train length to the next station at step 1718 to light graphic signals over the doors to tell the people in the next station how many cars are coming, and therefore how many doors will be opening. Step 1720 gets the run time to the next station, and it is stored in step 1722 for the next station. In step 1724 store the RBIT flag for the next station, which relates to the station bias number, and this bit is used to reset the alarm flags in the next station. Step 1726 sets the run flag for the next station to indicate a train is leaving this station, start timing to see if it arrives there on time. Step 1726 arms the alarm. Step 1728 sets the no-go flag alarm for the next station.

Step 1730 gest the train number from the TRNO table and step 1732 sends the train number to the next station. Step 1734 starts the train late clock in the next station. This clock is used to determine the train late alarms. Step 1736 saves the status word for use in the next program cycle.

The STRLOC table 1430 contains the train location table (TRLOC) 1415 addresses for the station track circuits. The station bias number is used to determine the table position of the TRLOC address. The station versus train location table address table 1430 of FIG. 23 is used to determine the train number of a train that is occupying the station track circuit.

The station status word (STATUS) table 1420 contains one word of flags for each of the stations. Each bit in these words is an individual flag denoting the status of some function involved in the station logic routines.

The station bias number is used to determine the location in the table of the word correlated with the particular station.

The MAXKT table is used to store the number of unit routes to be set up between the present station and the next station. This table contains one word for each station. The proper location is obtained by using the station bias number. The number of routes (MAXK) to be set up is stored in the table by the route select routine. When the route clears, the route setup routine zeros out the MAXKT table location for the proper station.

The ROUTT table contains the entrance number and exit number of each route which is required in order to reach the next station. Four words are provided for each station, which allows room for two routes, the maximum number of routes between stations.

The ROUTT table is used to store routes which are to be set up by the route setup routine. This table is a double word table, the first word contains the entrance number and the second word contains the exit number of each unit route which is to be set up. The proper station information is obtained by using the station bias number multiplied by four as a table bias. The unit routes to be set up are stored in the ROUTT table by the route select routine. When the route clears, the route setup routine zeros out the ROUTT table entries for the proper station.

The MINDW table contains the minimum dwell time for each of the individual stations. These dwell times will be used if the headway time has already elapsed. This table contains one word for each station. The proper location is obtained by using the station basis number.

The DWTIM table contains the dwell times in effect for the individual stations. Each station has one dwell time word in this table. The station dwell time table is used to store the dwell time in effect at each station. The proper location is obtained using the station bias number. Dwell times are entered into this table by the console input routines as a result of operator actions at the control console. Information in this table is used by the station exit routine to determine when to close the doors and release the train from the station.

Figure 27:
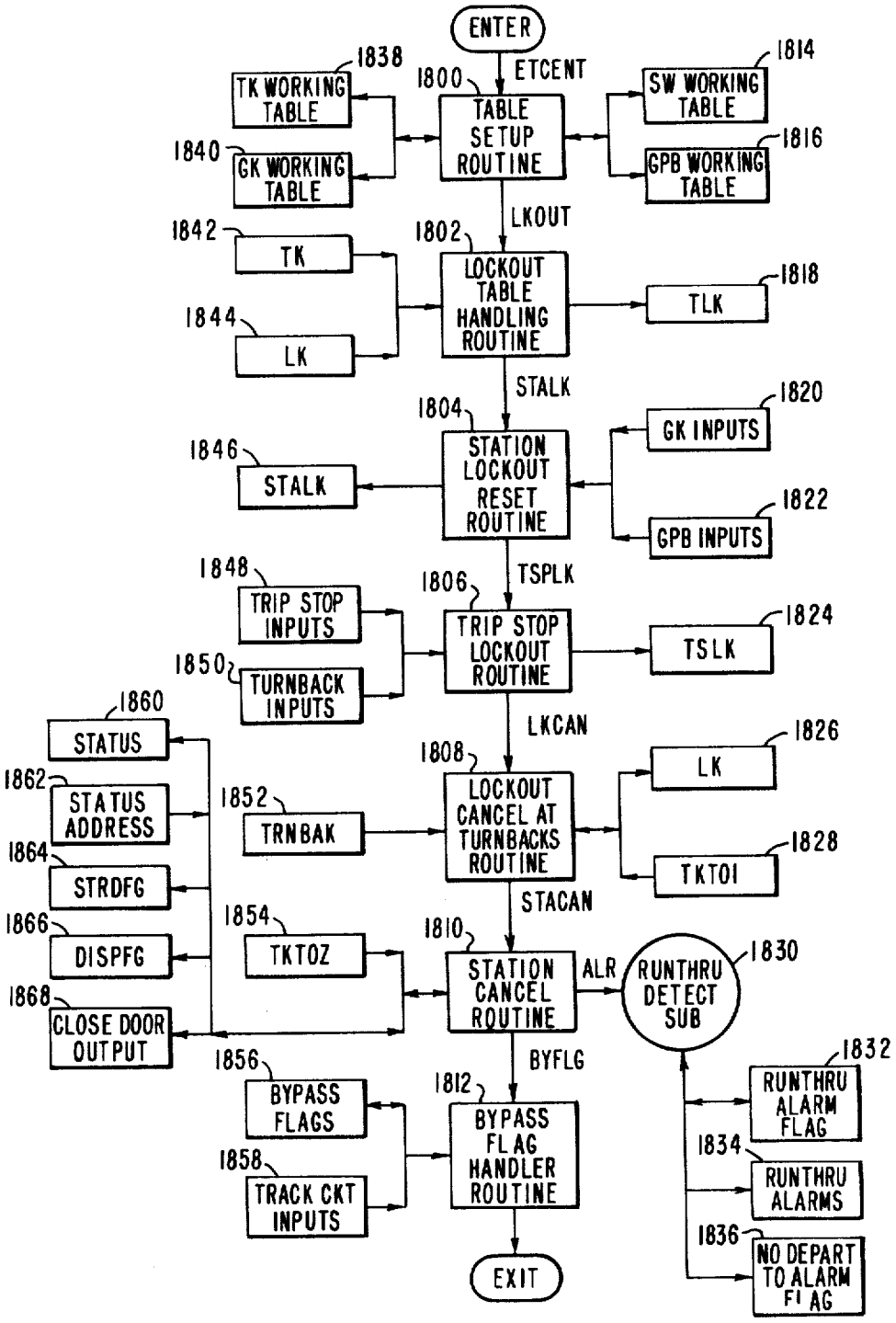
FIG. 27 shows the ETC program routine.

The ETC Program shown in FIG. 27 consists of these routines:

a. Working Table Setup Routine 1800
b. Lockout Table Handler Routine 1802
c. Station Lockout Reset Routine 1804
d. Tripstop Lockout Handler Routine 1806
e. Turnback Lockout Cancel Routine 1808
f. Station Cancel Routine 1810
g. Run-Through Detect Subroutine 1830
h. Bypass Flag Handler Routine 1812

This program is the first of the train control programs to be executed in the program cycle. The functions involved as either special or provide information for several of the train routines. The first routine, Working Table Setup 1800, establishes the input working tables for the rest of the routines. It is important that the same information is being used by all programs during a given program cycle. The information the programs require is, in general, the present status of the input, whether a change of state has occurred, and which direction the change was made, from 0 to 1 or 1 to 0. To obtain this information, the program starts with the input word. The input is exclusive OR'd with the past value (the input word last cycle) to give the change of status bits. The word containing the changed bits is stored into the proper change table. The word of changed bits is logically AND'd with the input word to give the bits which have changed to the one state from the zero state. This word is stored in the Went to 1 table. The changes are then AND'd with the past value word to give the bits which have changed to zero state from the one state. This word is stored in the Went to 0 table. Finally, the input word is stored into the past value word for use in the next program cycle. This process is done for each word required for the following input functions:

a. Track Circuit Indications 1838
b. Gate Indications 1840
c. Switch Position Indications 1814
d. Gate Request Pushbuttons 1816

The second routine, Lockout Table Handler 1802, constructs the software interlocking lockout table. Routes are made not available by software lockout bits which act like track circuit occupancies. The track circuit input table (TK) 1842 is used to reset bits in the lockout table (LK) 1844. At this time, the track circuit indication itself is used to lockout routes. The LK table and the TK tables are "OR'd" together to form the software interlocking lockout table (TLK) 1818. The third routine, Station Lockout Reset 1804, clears the proper station lockout bits based on the clearing of certain gates. The station lockouts are used to keep two routes from being requested by two different stations or pseudo stations over the same piece of track at the same time. This routine cancels a station lockout when the gate clears for the other station indicating that no conflict now exists. The fourth routine, Trip Stop Lockout Handler 1806, sets the trip stop lockout bits based on the positions of the trip stops themselves and the turnback station at the east end of the system. If South D is not a turnback, routing is allowed over the trip stop into South Spur. The fifth routine, Turnback Lockout Cancel 1808, resets the proper software lockout bits beyond a given station when the trains turn back at their station. Normally the train would reset these bits as the route was taken, however, with the turnback set the train will never traverse the complete route, and the lockouts must be reset by other means. The sixth routine, Station Cancel 1810, resets the station status words, the station status words, the close door output bits, and train stored and train dispatch flags whenever the station track circuit becomes unoccupied. This cancel function is performed whether the train is being operated manually or automatically. It prepares the program for the next entry of a train into a station. This routine monitors the station bits in the track circuit went to zero (TKTOZ) table 1854. When one of the station blocks goes to zero, that station cancel function is performed. Different stations have different items cancelled. All stations have status words. No pseudo stations have doors. Six stations have train storage facilities. All functions present in a particular station are cancelled. The items to be cancelled are:

a. Station Status Words
b. Close Door Output bit
c. Stored Train Flag
d. Dispatch Train Flag
e. Run-through Alarm Flag
f. No Depart to Alarm Flag The seventh routine, Run-through Detect Subroutine 1830, is used to reset the run-through alarm flag 1832 and the no depart to alarm flag 1836 whenever a station is bypassed. This will prevent the alarm messages from being generated falsely. If the run-through is in effect, the alarm flag bits are reset. The eighth routine, Bypass Flag Handler 1812, sets and resets the bypass flags. These flags are used in the routing program to set up the bypass shuttle operation. They cause one train to be held in either the bypass or station until the other train is in the proper position for a bypass operation to take place. This is required because of possible different run times over each half of the track.

Four Bypass Flags are used:

| | |
|---|---|
| NST - | Holds a train in the north bypass pseudo station. |
| SST - | Holds the train in the south bypass pseudo station. |
| NBY - | Holds a train in north B station. |
| SBY - | Holds a train in south B station. |

Figure 28A:
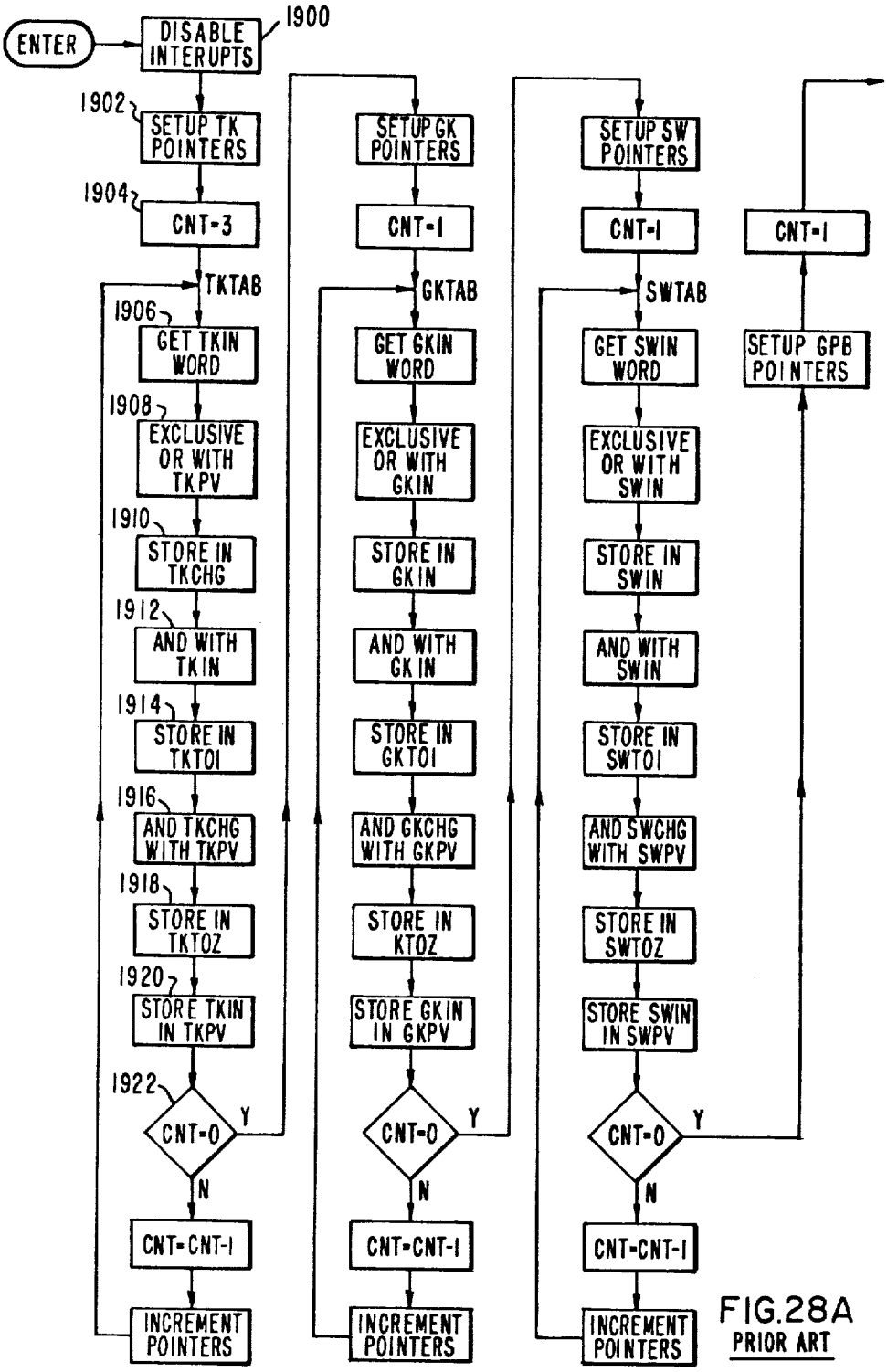
FIG.28A PRIOR ART
FIGS. 28A and 28B show a prior art ETC program table setup for automatic routing.
Figure 28B:
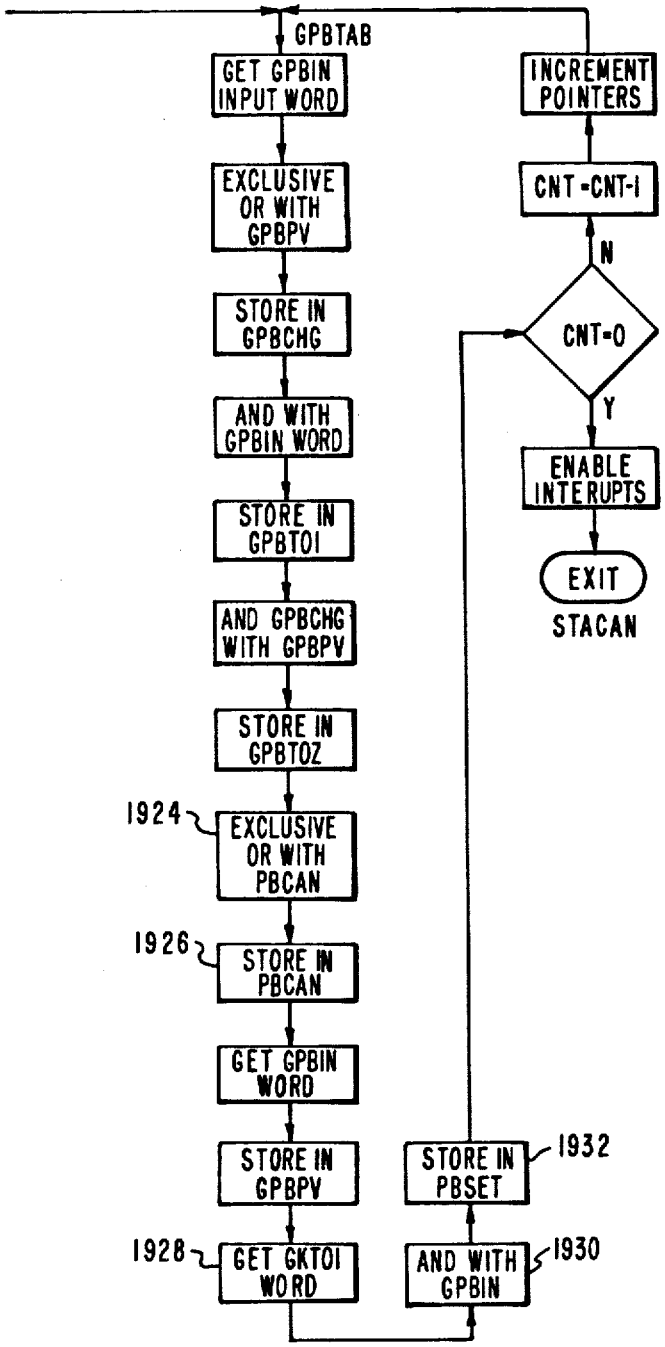
FIG. 28B PRIOR ART

In FIG. 28, the ETC table setup routine is shown. At step 1900 the interrupts are disabled. The first column, starting at the second step 1902 is similar to the second column which is similar to the third column and with a little bit of rearranging, it is similar to the fourth column. This is the routine that sets up the went to one and went to zero tables that were previously discussed. At step 1902, set up the address pointers for storing this table information. At step 1904 set up the counter with the number of words minus one, because zero is a legitimate count. For the track circuit inputs, which is the left hand column, there are four words, so set the counter equal to three, the other three tables have two words. At step 1906, get the input word and at step 1908 exclusive OR it with the past value and at step 1910 store in the change table. Take the changes, AND them at step 1912 with the inputs, and store at step 1914 in the went to one table. Get the changes again, at step 1916 AND with the past values, and at step 1918 store in the went to zero table. At step 1920 the present input is stored in the past value table for the next cycle. At step 1922 check the count to see if the routine is finished. If yes, go to the next section of the routine, and if not, increment and through the routine again. The gate pushbutton tables routine includes additional steps. Steps 1924 and 1926 are used for the pushbutton cancel function and to develop the PB cancel table. Steps 1928, 1930 and 1932 take the went to one words, then AND's with the gate pushbutton inputs to develop the PBSET table.

Figure 29:
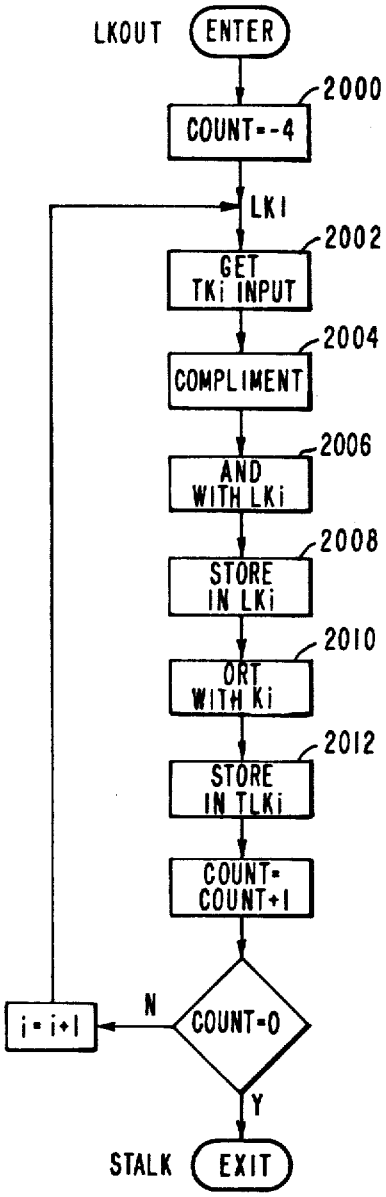
FIG. 29 PRIOR ART
FIG. 29 shows a prior art lockout table handling routine.

The LKOUT routine shown in FIG. 29 constructs the software interlocking lockout table (TLK). The TLK table is derived from the track circuit input table (TK) and the software lockout table (LK). The lockout table handling routine is used to construct the software interlocking table (TLK) as track circuits become occupied or unoccupied and as routes are cleared and cancelled. The track circuit input table (TK) is used to reset the software lockout table (LK). This is possible because a track circuit occupancy makes a route unavailable. The TK table is AND'd with LK table. Then the TK table is OR'd with the LK table and the result is stored in the TLK table. This lock outs any track circuit which is occupied or has a software lockout bit set.

FIG. 29 shows the lockout table handling routine that was previously discussed. At step 2000 set the counter, get the track circuit inputs at step 2002, at step 2004 compliment them, AND with the software lockouts at step 2006 to cancel out of the table every track circuit input that is present. At step 2008 store them back into the software table, and at step 2010, OR that value with the track circuit input. At step 1012 store the track circuit lockouts in the TLK table.

Figure 30:
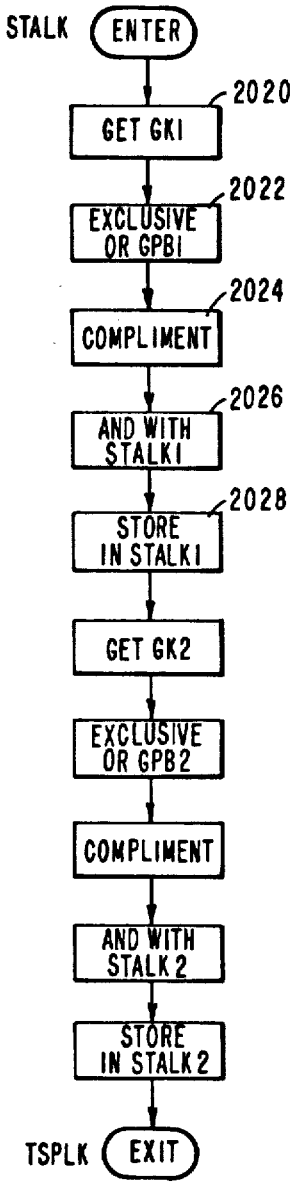
FIG. 30 shows the station lockout reset routine in accordance with the present invention.

The STALK routine shown in FIG. 30 resets the station lockout bits which were set in the station logic program. These lockout bits are used to prevent two stations from requesting a route over the same area at the same time. The station lockout bits are reset based on the clearing of gates. This routine resets the station lockout bits when gates clear or when gate pushbutton requests have been made by the console operator. The gate indication words are OR'd with the gate pushbutton input words. The result is AND'd with the station lockout words.

FIG. 30 shows the station lockout reset routine to the station lockout bits. At step 2020 get the gate input, and exclusive OR it with the gate pushbutton input at step 2022. At step 2024 complement the result, then AND that with the lockout at step 2026 and store in the table at step 2028. This is done for both words of lockout such that if either the pushbutton or the gate indication clears, this zeros the bit out of the lockout order.

Figure 31:
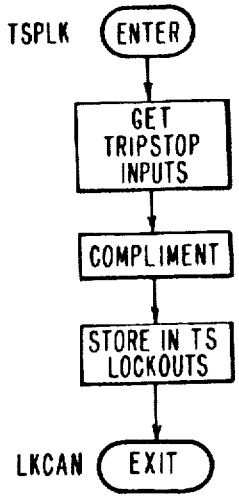
FIG. 31 shows the trip stop lockout routine in accordance with the present invention.

The TSPLK routine shown in FIG. 31 sets the resets the trip stop lockout bits as required by the status of the system. If the stops are in the raised position, routes are not allowed across them.

The lockouts are used by the route available routine to prohibit running a train over a trip stop in the up position. The trip stop input word is complemented and stored in the lockout word.

Figure 33:
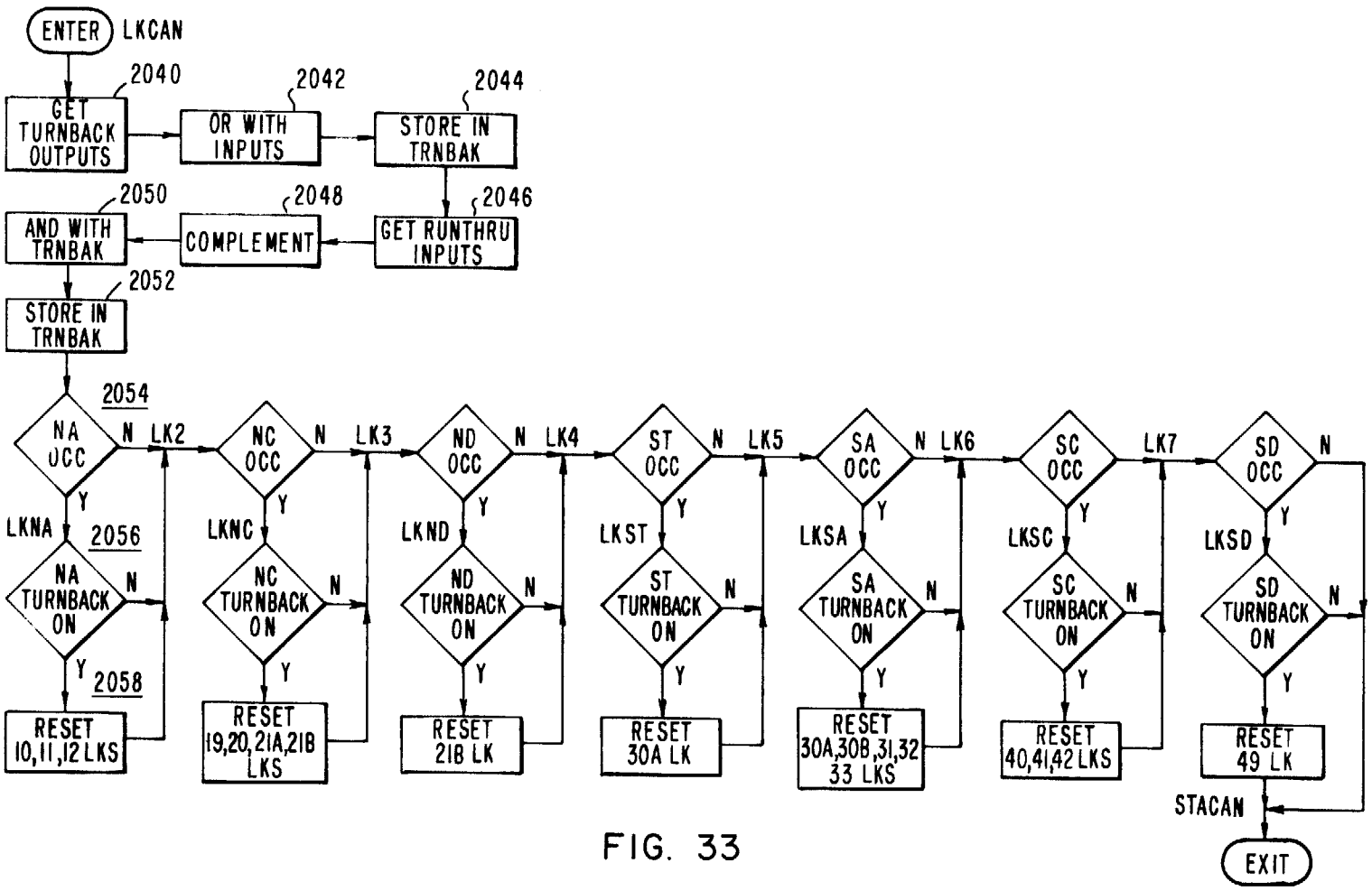
FIG. 33 shows the lockout cancel in turnback in accordance with the present invention.

The LKCAN routine shown in FIG. 33 cancels the lockout bits in the LK table that the train does not cancel when it turns back in the middle of a route. All lockout bits from the station involved to the end of the route are reset.

In FIG. 33 there is shown the lockout cancel in turnback routine, which operates when a train turns around at a station in the middle of a route, and it becomes necessary to cancel the lockouts beyond that station. At step 2040 get the turnback output buts, which are generated by the computer or console pushbuttons, depending on the mode. At step 2042, the turnback input, which is generated from a pushbutton on the operator's console, is OR'd together with the turnback output, and at step 2044 stored into the TRNBAK table. At step 2046 get the run-through inputs, complement them at step 2046, at step 2050 and with the TRNBAK table to cancel the bits out of the table and store the result in TRNBAK table At step 2052. This TRNBAK table is now used throughout the program when a turnback is used. In horizontal line 2054 are set forth the names of the particular stations in the track system shown in FIG. 3 that can have a train turnback in the middle of a route North A is the first one, North C, North D, and so forth. The first check is if the station is occupied, and if not, there is nothing to do, and the program goes to next station and continues the test. Each station will be checked once during each cycle, and if it is occupied, in line 2056 a check is made to see if the station turnback pushbutton is on. If the pushbutton is not on, there is nothing more to do, so go to the next station. In line 2058 are predetermined lockout bits that are reset in relation to each station in line 2054 which was occupied and had its turnback PB on.

Figure 34A:
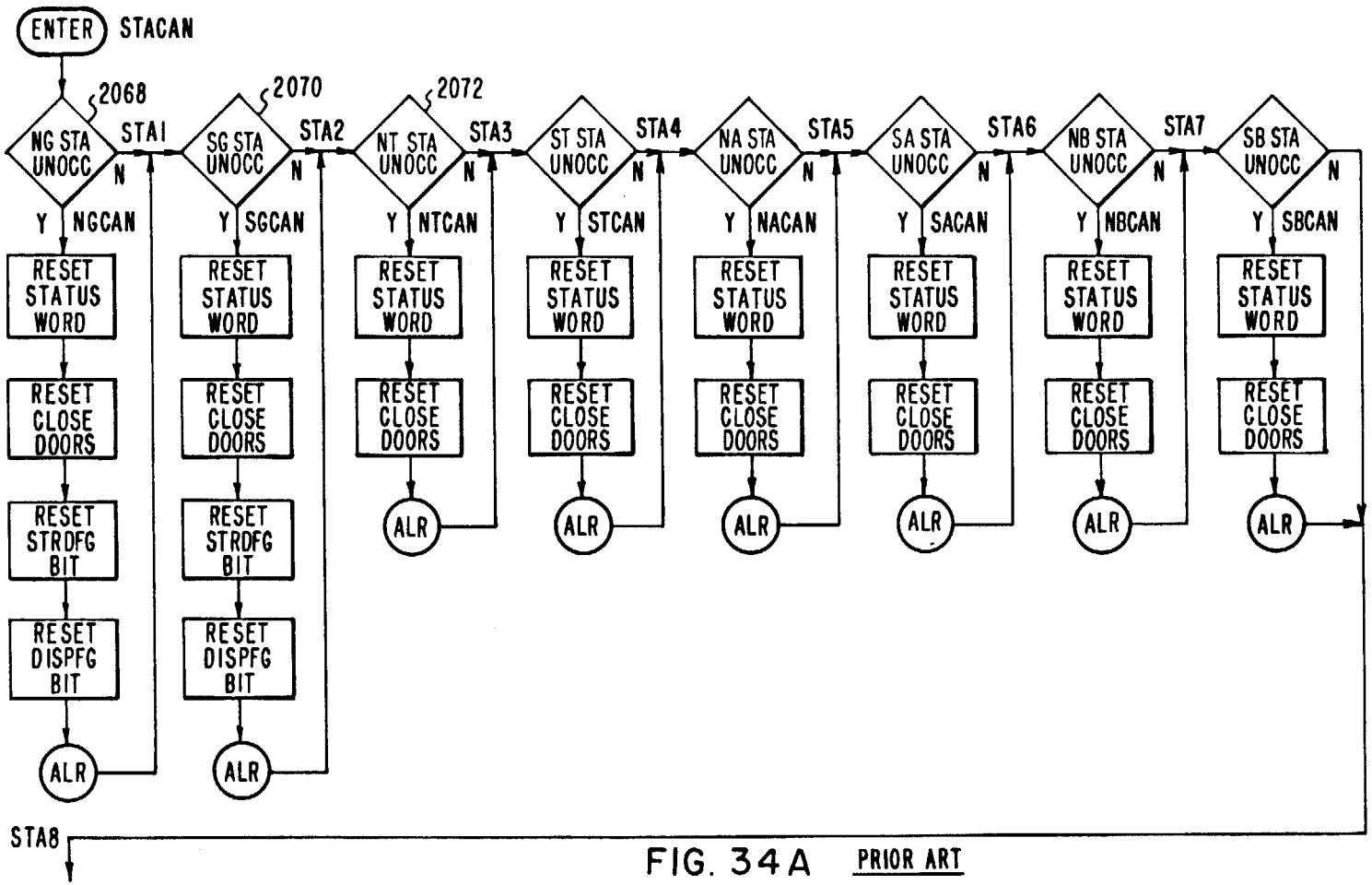
FIG. 34A PRIOR ART
FIGS. 34A and 34B a prior ETC program station cancel routine.
Figure 34B:
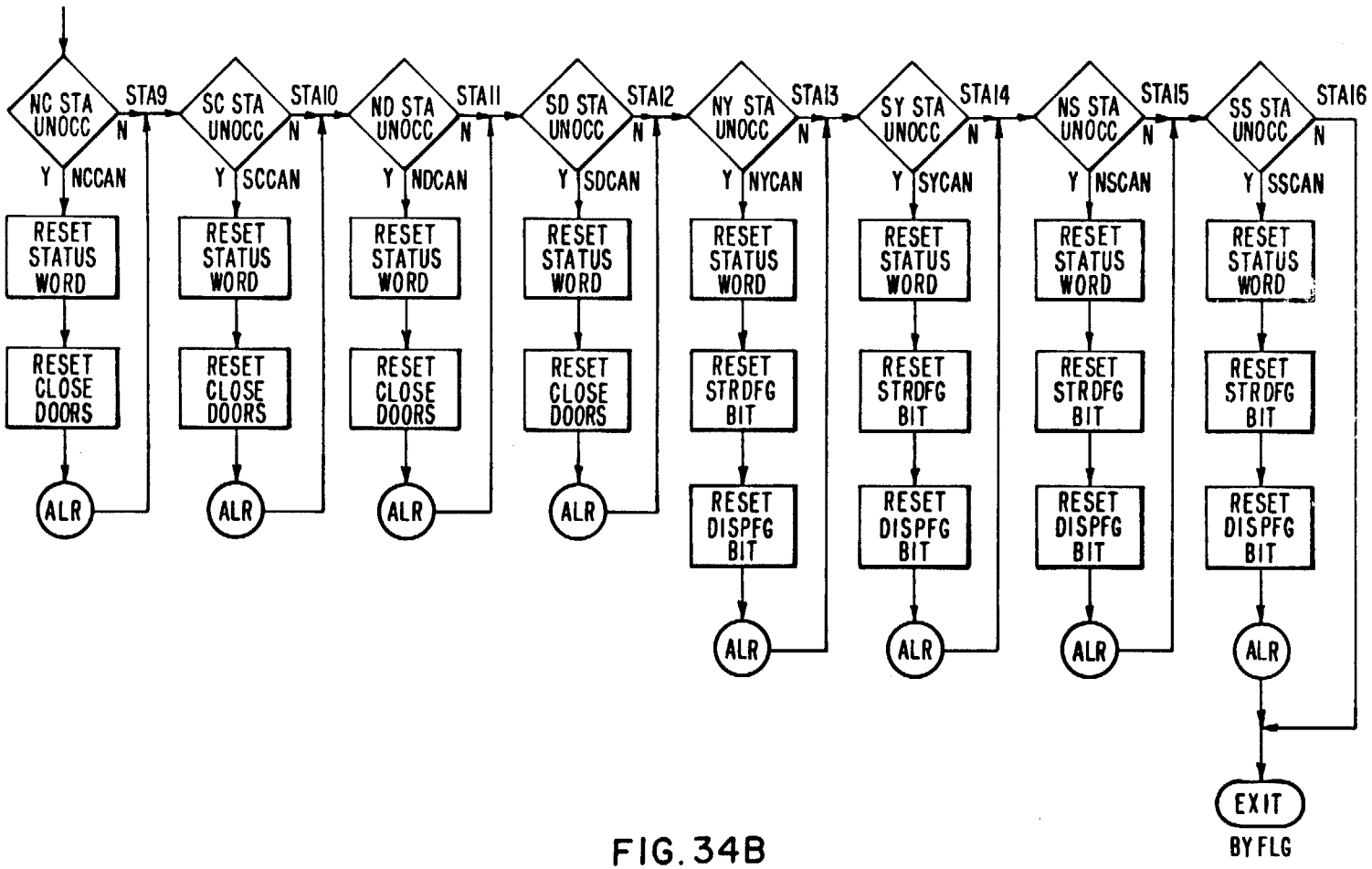
FIG. 34B PRIOR ART

The STACAN routine shown in FIG. 34 performs the functions required to reset the station logic whenever a train departs from a station.

The different stations have different things to cancel when becoming unoccupied. The first station checked, in column 2068 is North Baggage to see if the station just became unoccupied. This is determined by using the TK went to zero table. When it becomes unoccupied, North Baggage requires a reset of the status word, close doors output, the store flag and the dispatch flag. The next station in column 2070 is South Baggage, and it has the same things to reset. The next station is North Ticketing in column 2072, the only things that are required to be reset are the status word and the closed doors. Each succeeding column is for a different station and under it are the things that have to be reset.

Figure 32:
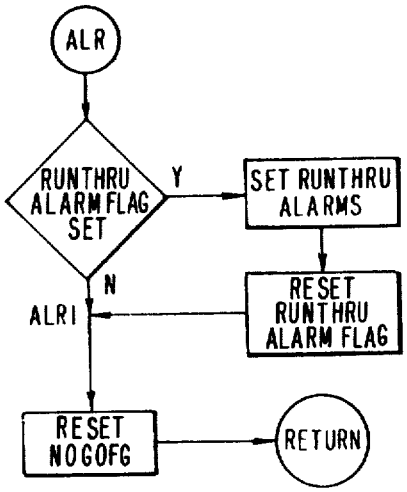
FIG. 32 shows the run through detect subroutine in accordance with the present invention.

The ALR subroutine shown in FIG. 32 detects whether a station run-through has occurred. If it has, the run-through alarm bit is set provided that the run-through alarm flag had been previously set. The run-through alarm flag for the next station is set and the run-through alarm flag for the present station is reset. The no depart to flag for the next station is set.

Figure 35A:
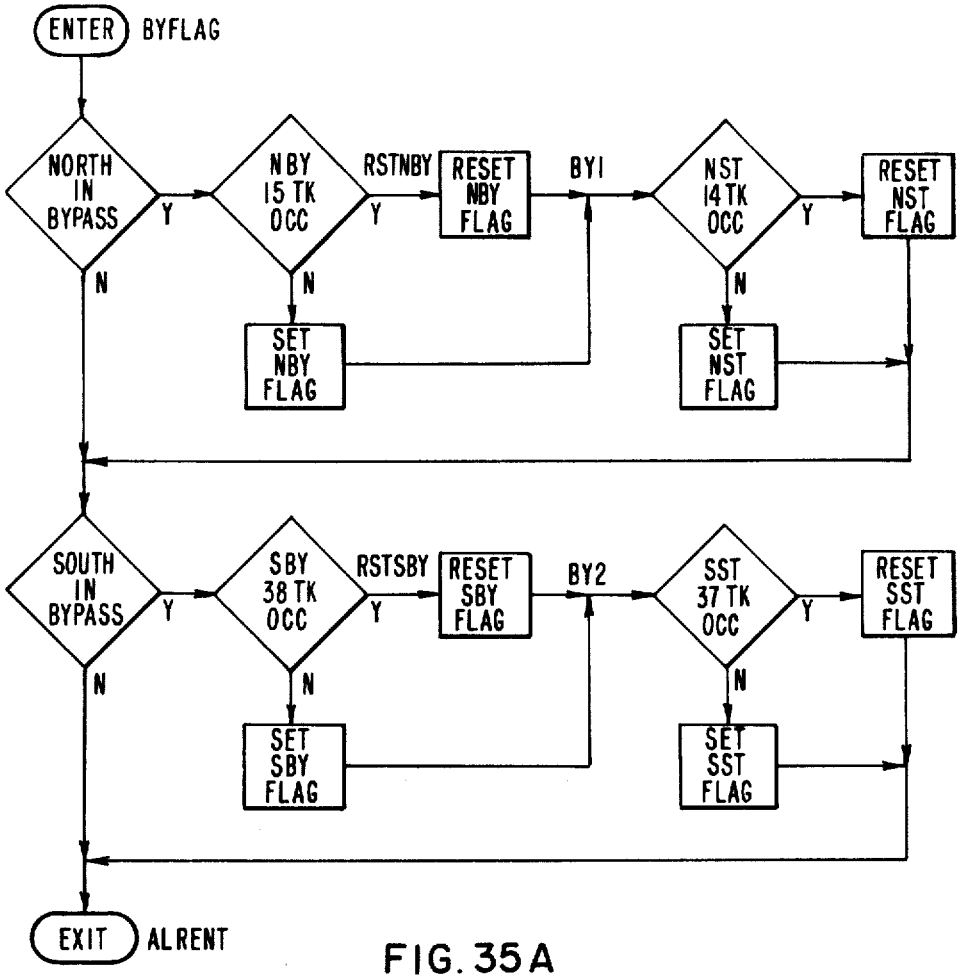
FIGS. 35A and 35B show the bypass flag handler routine in accordance with the present invention.
Figure 35B:
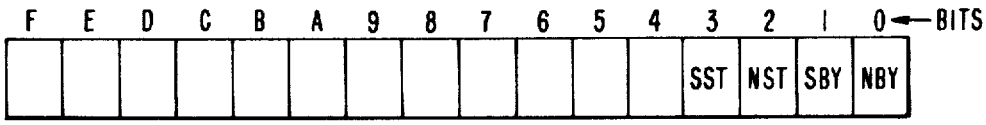

The BYFLAG routine shown in FIG. 35 sets and resets the four bypass flags, NBY, SBY, NST, SST, as required depending on mode of operation, as track circuits becoming occupied and unoccupied.

Figure 36:
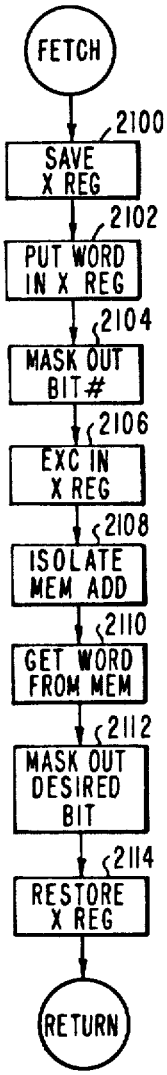
FIG.36 PRIOR ART
FIG. 36 shows a prior art FETCH subroutine.

These flags are used in the automatic routine program to inhibit routes unless the trains are in proper position to perform a bypass operation. NBY and SBY inhibit routes into the bypass tracks. NST and SST inhibit routes into the straight through tracks. Whenever one of the four bypass flag track circuits becomes occupied, the respective flag is reset.

a. 14T resets NST
b. 15T resets NBY
c. 37T resets SST
d. 38T resets SBY The flags are set only if the particular track is operating in bypass mode. The flags are set as follows:

a. North track in bypass, 14T unocc, set NST
b. North track in bypass, 15T unocc, set NBY
c. South track in bypass, 37T unocc, set SST
d. South track in bypass, 38T unocc, set SBY FIG. 36 shows the fetch subroutine, which determines the status of a bit specified in WORD. This word has a right-hand digit that contains the bit position and the left-hand three digits contain the location in the memory. At step 2100 save the X register, and at step 2102 put WORD in the X register. At step 2104 mask out the bit number to save the four low bits and in step 2106 exchange with the X register, to take WORD out of the X register and put WORD back in the A register and put the bit position into the X register. At step 2108 isolate the memory address by masking out the digit that has the bit position. At step 2110 go get the specified word out of memory. Step 2112 masks out the desired bit and leaves it in the A register. At step 2114 restore the X register and then return to the calling program. If the bit was not present, the A register will contain zero, and if the bit was present, that particular bit is in the A register.

Figure 37:
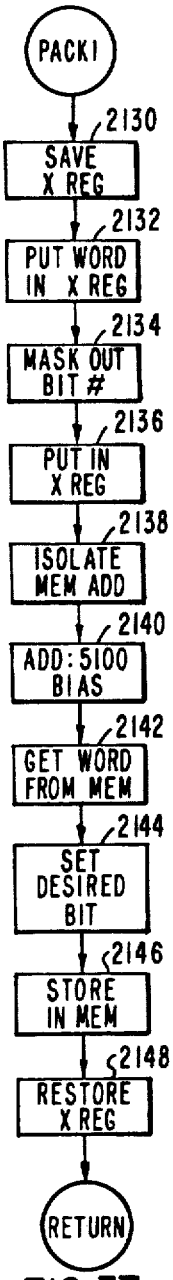
FIG.37 PRIOR ART
FIG. 37 shows a prior art PACK1 routine.
Figure 38:
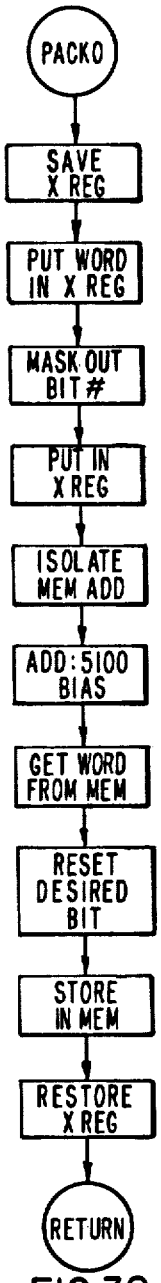
FIG.38 PRIOR ART
FIG. 38 shows a prior art PACK0 routine.
Figure 39:
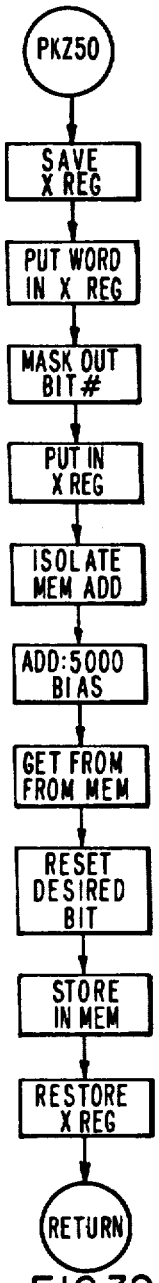
FIG.39 PRIOR ART
FIG. 39 shows a prior art PKZ50 routine.

FIGS. 37, 38, 39, 40 show similar pack routines. FIG. 37 is PACK 1 routine which sets the bit specified in WORD to a one. FIG. 38 is called pack zero, which sets the bit specified in WORD to a zero. FIG. 39 is called pack Z50, and resets the bit specified in WORD to a zero. The difference in these is the FIG. 39 pack zero routine zeros a bit out in page 50 which is addressed as 5000, and the FIG. 38 pack $\phi$ operates to zero a bit out in page 51 which is the 5100 address. For each of FIGS. 37, 38 and 38, in step 2130 save the X register. In step 2132 put WORD in the X register. In step 2134 mask out the bit position number and in step 2136 store the bit position in the X register. In step 2138 get the contents of the memory address, and at step 2140 in FIG. 37 and FIG. 38 add the bias of 5100, at FIG. 39 add a bias of 5000, to obtain the right page of memory for this operation. Step 2142 gets the word out of memory. Step 2144 is a little different, in FIG. 37, it sets the bit and in FIG. 38 and FIG. 39 it resets the bit. Step 2146 stores the word back in the memory, and step 2148 restores the registers and then returns.

Figure 40:
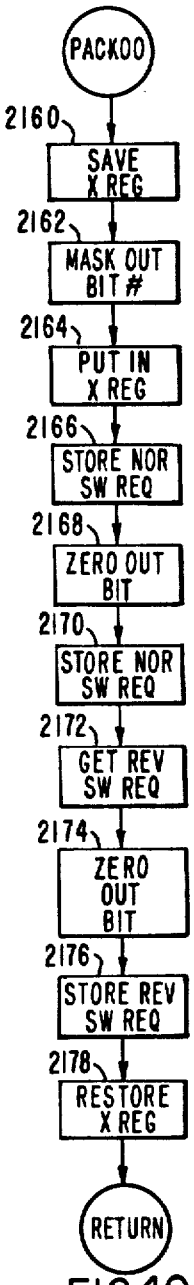
FIG.40 PRIOR ART
FIG. 40 shows a prior art PACK00 routine.

FIG. 40 is the PACK $\phi\phi$ routine, which is used to cancel switch positions. Each switch position has a request normal bit and a request reverse bit, and the program cancels them both. In step 2160 save the X register. In step 2162 mask out the bit. In step 2164 store it in the register. In step 2166 get the normal switch request word. In step 2168 zero out the bit. In step 2170 store the normal switch request. In step 2172 get the switch reverse word and in step 2174 zero it out. In step 2176 store it away, and in step 2178 restore the X register and exit.

FIG. 41 shows the ETC program tables that were discussed in relation to the ETC program of FIG. 27. Table A includes the gate working tables, which are five two-word tables, the first is the gate inputs, the second is the gate past values, the third is the gate changes, fourth is the went to one; and fifth is the one went to zero. Table B includes the similar five tables for switch inputs. Table C includes the similar tables for the track circuits. Table D is the similar tables for the gate pushbuttons, and has two additional tables. They are the PB set and the PB can. For the PB set, the went to one and the previous value is OR'd into the word. For the PB cancel the went to zero and the previous value are OR'd into the word. Table E is the lockout tables, including the pushbutton switch lockouts, the software lockout, the software lockouts OR'd with the track circuit inputs, and the station lockouts. Table F is the status word address table, each one of the stations has a status word, and this table tells the program where those 16 words are stored. Table G is the bit table, a 16-word table, each word containing one bit. The bit table is used in the fetch and pack routines to set or detect a bit. Table H is the complement of the bit table, so it is the not-bit table, having 16 words and it contains all bits but one. The not-bit table is used by the pack $\phi$ routines to reset bits.

The established route table (ESTRT) shown in FIG. 10 contains five words of information about every established unit route under three labels, ESTRT, ESTKEY and ESTTK. This information is used to cancel a route that has been set up. This table is used to store unit route information for all established routes. The table contains five words of information about every route under three labels.

| | |
|---|---|
| ESTRT | unit route entrance |
| ESTRT +1 | unit route exit |
| ESTKEY | location of setup table |
| ESTKEY +1 | number of words in table |
| ESTTK | exit track circuit, word-bit |

This table is constructed by the route setup routine and zeroed by the cancel routines. As soon as a route being set up clears, the information is stored in the table. The program stores a unit route's information in the first open slot in the ESTRT table. Therefore, no particular order is possible for a through route. The ESTRT table contains a group of independent unit routes, each route that is set up. Routes are cancelled from the ESTRT table automatically when a train takes the route or from a manual PB cancel request from the control console.

The tracking control system disclosed in the above-referenced patent application concerns the direction signals, and the way information tables are set up to keep track of them and which way they are going. These direction signals come from any one of hardware interlocking, gates clearing or a station turnback. The present routing control system determines the operation of trains from any one station to any other station on the track system that actually has a path between them depending on the operator pushbuttons that are set on the console, the mode of operation that the train is running in, and any extra commands that are put in such as store and dispatch. Routing is getting a train to any station from any station depending upon conditions by sorting out information that is available from interlocking. For each station there is established in a table a list of available routes, by identifying every possible route and putting them in a permanent table. When a train comes to that station and is going in a known certain direction, a check is made as to what route is available. A selection is made of the most desirable from among predetermined available routes. Every route has predetermined operation conditions that must be satisfied, such as the track circuits occupied, the train going the wrong direction to oppose a signal cleared against it or the train running an uncleared signal and so forth in accordance with the general interlocking rules that are well known.

Figure 42:
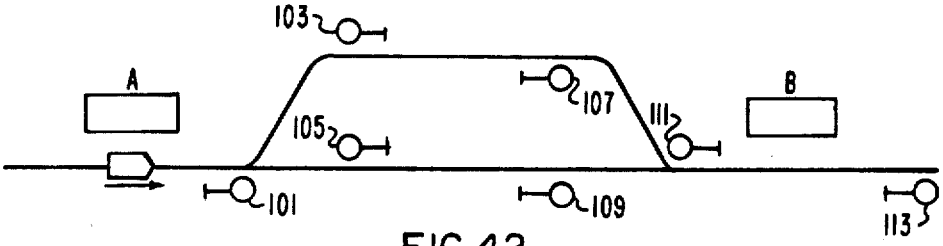
FIG. 42 PRIOR ART
FIG. 42 shows a prior art interlocking track plan section.

For the illustration shown in FIG. 42, assume the train wants to go from point A to point B. There are two paths and only two, and these routes are set up based on actual signals shown at 101, 103, 105, 107, 111 and 113. The signals 101, 107 and 109 are pointing in the direction from station A to station B. The first thing is to assign all of the signal gates the identification numbers, as shown in FIG. 42. Then, using the entrance 101 a search is made in the entrance/exit tables until the entrance 101 is found. Then somewhere in the AR(I) tables there is a route 101 to 109, with several conditions. If every one of those conditions is satisfied, the route is available. Then check for the next point 109 for the route in the direction from 109 to 113, which is part of the route from 101 to 113. The route of interest is from 101 to 109. When route 101 to 109 is found to be available, then take the exit which is 109 and make it the entrance for the next route, so find 109 to 113 and see if it is available, this gives two routes in the table, namely, routes 101 to 109 and 109 to 113. Now check to see if there are any other routes that have 101 as an entrance. The answer is yes, since route 101 to 107 is in the entrance/exit table. A check is made to see if 101 to 107 is available, and if so, then take 107 and make that the new entrance and check if 107 to 113 is available. If the answer is yes, in the available route table, ENTAV, there are four routes. Now go through ENTAV and see if there are two exits in that table that are the same, and if the answer is yes, that means there is more than one path. There is no way to have two numbers the same unless the train can get there from two paths. Go to the priority routine and select which one is the first choice. In all cases the straight through route is the preferred route.

A check is first made that a route is available and then the priority check is made to determine the best route, then the route is set up, by requesting the route from interlocking. If it is safe to throw the necessary switches and give clear the required gate, interlocking actually sets up the route.

Figure 43:
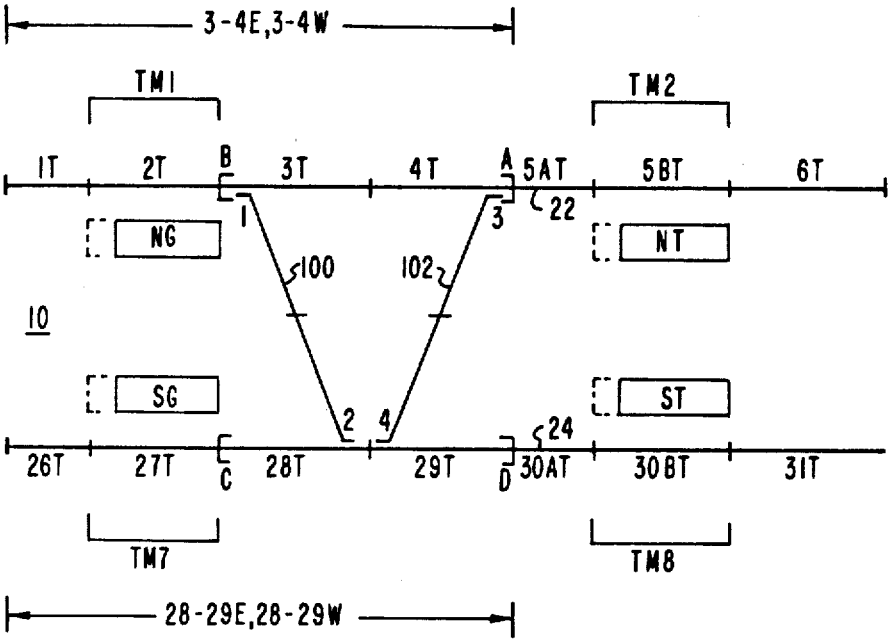
FIG. 43 PRIOR ART
FIG. 43 shows a prior art section of the track plan.

In FIG. 43 there is shown the track arrangement including the North ticketing station NT, the North baggage station NG, and the South ticketing station ST, and assume the trains are running in normal mode. Train B is in North baggage when a second train A arrives at North ticketing. A third train C is stored in South baggage SG, which is not on the route until the operator wants to dispatch it.

An arbitrary sequence can be set up here to control the movement of the trains. For example, train B will go out of station NG first and then train A will go into station NG from station NT and last will be train C that is dispatched from station SG. This sequence is arbitrary, any order can be selected. When the train in one of these three stations NT, NG and ST requests a route, a station lockout operates to lock out the other two stations so their trains cannot make any request. In response to a train requesting a route, the software lockouts are set up after the check is made to see if a route is available. When one of these trains requests a route, a lockout is provided in relation to the other two trains, and then as the gate clears these lockouts are eliminated.

When a train pulls into a station, and the doors start to open, the train requests a route to the next station. The first thing is to determine what the next station is, and then go through the available tables to determine if a desired route is available. If the answer is yes, the train then locks out all other trains in the area without looking to see if there are any other trains there. This lockout is in relation to anyplace where two or more stations can request a route over the same area. Once a train sets the route up then the track circuit software lockouts are set and no other train can travel that same route until the first train enters and leaves the station and then the lockouts are clear.

There are two tables provided for established routes. As soon as the route is set up all the lockouts are set, and then the route information is stored in the ESTRT table which is the established table. This table includes the route entrance, the exit, the keyword, the keyword plus one and the exit track circuit. Assume, as shown in FIG. 43, a route is desired from station NG to station ST. The station NG is in track circuit 2T. The station NT is in track circuit 5BT. On the south track the first station is SG in track circuit 27T, the switch 2 is in 28T, the switch 4 is in track circuit 29T and the station ST is in track circuit 30BT.

When gate B clears, software lockouts are set for track circuits 3T, 28T, 29T, 30AT and 30BT. In the ESTRT table, the entrance is 100, the exit is 204, the keyword location is some number, the number of words of information is some number, and the exit track circuit for the route is 30BT. The train starts to move. The first thing that happens when the train leaves the station NG is that the track circuit number 3T becomes occupied. Switch 1 is in track circuit 3. The gate B is in track circuit 3T. There is a lockout set for track circuit 3, so the program goes into the lockout table and cancels out the 3T lockout. The switch 1 request is canceled because it is in track circuit 3T and the gate B request is canceled because it is in 3T. The train moves down into track circuit number 28T and cancels the 28T lockout and cancels the switch 2 request because number 2 switch is in 28T. The train moves into track circuit 29T and cancels the 29T lockout and cancels the switch 4 request in track circuit 29T. The train then moves into the next track circuit 30AT, and cancels the 30AT lockout.

The train moves into the 30BT, and cancels the lockout in 30BT. In the ESTRT table, every program cycle a check is made of the exit track circuit occupancy, and as soon as 30BT exit track circuit becomes occupied, the program cancels all five of those locations in the established route table and all traces of the train in the track circuits 2T, 3T, 28T, 29T, 30AT and 30BT are gone. So based on a track circuit by track circuit movement the route is sectionally released, but the route from station NG to station ST which would permit a different train to travel this route does not clear until the last track circuit in that particular route is occupied.

In the station programs doors open in the point in time when the routes are requested and checked. All the available routes are set aside in their individual ROUT tables, which are the individual route tables. After all the station programs are finished, all 16 stations have been processed, control is transferred to the setup program. The setup control program looks at the first station and determines if there are any routes to be set up. If the answer is yes, the routes are set up, and if the answer is no or after the route is done, the program goes to each station in sequence. The next program operation is the cancel routine which cancels a route as the train goes through the route.

FIG. 44 shows the MODE word, which is one word in memory and the specific bits show what mode the system is operating in. These bits are determined by the operator's console, where the operator selects pushbuttons and thumb wheel switches. Each bit represents one particular route. Two special bits, bits E and F, are set up to specify no mode for a particular track. Bit F indicates there is no mode on the north track and bit E indicates no mode on the south track.

FIG. 45 shows the station STATUS word. There is one word for each station. The bits in the word are set as predetermined events occur. The information is used to sequence a train through the station. The word is reset when the station becomes unoccupied.

GENERAL DESCRIPTION OF INSTRUCTION PROGRAM LISTING

In Apendix A there is included an instruction program listing that has been prepared to control a process operation, such as a transit passenger vehicle in accordance with the here-disclosed control system and method. The instruction program listing is written in the assembly language of the Computer Automation LS12-20 computer system. Many of these computer systems have already been supplied to customers, including customer instruction books and descriptive documentation to explain to persons skilled in this art the operation of the hardware logic and the executive software of this digital computer system. This instruction program listing is included to provide an illustration of one suitable embodiment of the present control system and method that has actually been prepared. This instruction program listing at the present time is a more or less development program and has not been extensively debugged through the course of practical operation of vehicles on a transit system. It is well known by persons skilled in this art that real time process control application programs may contain some bugs or minor errors, and it is within the skill of such persons and takes varying periods of actual operation time to identify and correct the more critical of these bugs.

A person skilled in the art of writing computer instruction program listings, particularly for an invention such as the present transit vehicle control system must generally go through the following determinative steps:

Step One-Study the transit vehicle operation to be controlled, and then establish the desired control system and method concepts.

Step Two-Develop an understanding of the control system logic analysis, regarding both hardware and software.

Step Three-Prepare the system flow charts and/or the more detailed programmer's flow charts.

Step Four-Prepare the actual computer instruction program listings from the programmer's flow charts.

The instruction program listings included in the Appendix were prepared in relation to the programmer's flow charts.

The manual routing program listing is operative in accordance with the program routines and subroutines illustrated in FIG. 10.

The automatic routing program listing is operative in accordance with the program routines and subroutines illustrated in FIG. 16.

The station logic programs listing is operative in accordance with the program routines and subroutines illustrated in FIG. 23.

The ETC program listing is operative in accordance with the program routine illustrated in FIG. 27.

In relation to the typical routing control system sequential operations shown in FIG. 9, the ETC program would be the operation shown in block 208. The station logic programs illustrate an improvement of the blocks 216, 218, 220, 222 and 224. The other blocks 200, 202, 204, 206, 210, 226 and 228 are believed to be within the routine skill of this art to implement in accordance with the system description here provided. An improvement of blocks 212 and 214 is illustrated in the above cross-referenced related patent application.

```
0002                    *
0003                    *
0004                    *                MANUAL ROUTING PROGRAM
0005                    *
0006                    *
0007                    *        THIS PROGRAM SETS UP AND CANCELS ROUTES
0008                    *        AS A RESULT OF OPERATOR ACTIONS USING
0009                    *        THE GATE PUSHBUTTONS ON THE CONSOLE.
0010                    *
0011                    *        A ROUTE IS SET UP WHEN A GATE CLEARS
0012                    *        AND ITS PB IS SET.
0013                    *
0014                    *        A ROUTE IS CANCELLED WHEN THE PB IS RESET
```

```
0015                    *
0016                    *
0017                    *        THE FOLLOWING ROUTINES ARE USED:
0018                    *
0019                    *        GPBCAN   MANUAL CANCEL PB PROCESSING
0020                    *        GPBSET   MANUAL SET UP PB PROCESSING
0021                    *
0022                    *
0023                    *        THE FOLLOWING SUBROUTINES ARE USED:
0024                    *
0025                    *        MANCAN   MANUAL ROUTE CANCEL
0026                    *        MANSET   MANUAL ROUTE SETUP
0027                    *        PACK0    PACK 0 IN BIT
0028                    *        PACK1    PACK 1 IN BIT
0029                    *        PACK00   PACK 0 IN TWO WORDS
0030                    *        PCKZ50   PACK 0 IN PBSET/PBCAN
0031                    *        FETCH    GET STATUS OF BIT
0032                    *
0033                    *
0034                    *        THE FOLLOWING TABLES ARE USED:
0035                    *
0036                    *        PBSET    PB SET UP BITS
0037                    *        PBCAN    PB CANCEL BITS
0038                    *        PBENT    PB ENTRANCE NUMBERS
0039                    *
0040                    *        ENEX     ENTRANCE/EXIT
0041                    *        KEYS     SETUP KEYWORDS
0042                    *        TKO      EXIT TRACK CIRCUIT
0043                    *        SR(I)    SETUP INFORMATION TABLES
0044                    *
0045                    *        ESTRT    ESTABLISHED ROUTE ENT/EXIT
0046                    *        ESTKEY   ESTABLISHED ROUTE KEY
0047                    *        ESTTK    ESTABLISHED ROUTE EXIT TK
0049                    *
0050                    *
0051                    *                MANUAL CANCEL PB PROCESSING
0052                    *
0053                    *      THE PBCAN TABLES ARE CHECKED TO SEE
0054                    *      IF A MANUAL ROUTE CANCEL HAS BEEN
0055                    *      REQUESTED BY THE OPERATOR.
0056                    *
0057                    *      A CANCEL HAS BEEN REQUESTED WHEN-
0058                    *      EVER THE GATE REQUEST PUSHBUTTON
0059                    *      INPUT GOES FROM ON TO OFF.
0060                    *
0061                    *        PBSET    MANUAL ROUTE SETUP
0062                    *        PBCAN    MANUAL ROUTE CANCEL
0063                    *        GKT01    GATE WENT TO 1
0064                    *        PBENT    GATE ENTRANCE NUMBERS
0065                    *
0066  2500                      ABS     :2500
0067                    *
0068  2500 0800        GPBCAN ENT
0069  2501 0110               ZAR
0070  2502 9AE7 25EA          STA     PASS      PASS = 0
0071  2503 9AE5 25E9          STA     PBIAS     PBIAS = 0
0072  2504 B2EE 25F3          LDA     APBCAN
0073  2505 9A25 252B          STA     CANLOC    PBCAN ADDRESS POINTER
0074  2506 0110        GPB2   ZAR
0075  2507 9AE3 25EB          STA     SHFCNT    SHIFT COUNTER = 0
0076  2508 B322 252B          LDA     *CANLOC
0077  2509 310A 2514          JAN     GPB3      FIRST WORD = 0?
0078  250A B2DE 25E9          LDA     PBIAS     YES, ADD 16 TO BIAS
0079  250B 0810               AAI     16
0080  250C 9ADC 25E9          STA     PBIAS
0081  250D B2DC 25EA   GPB4   LDA     PASS      2ND PASS DONE?
0082  250E 2102 2511          JAZ     GPB5      NO, DO 2ND
```

```
0083  250F F300 2510          JMP    *GPB41   YES, GO TO MANUAL SETUP
0084                   *
0085  2510 2668        GPB41  DATA   GPBSET
0086                   *
0087  2511 DAD8 25EA   GPB5   IMS    PASS
0088  2512 DA18 252B          IMS    CANLOC   2ND WORD ADDRESS
0089  2513 F60D 2506          JMP    GPB2
0090  2514 DAD6 25EB   GPB3   IMS    SHFCNT   WORD NOT 0, INC COUNT
0091  2515 DAD3 25E9          IMS    PBIAS    INC BIAS
0092  2516 13D0               LRA    1        CHECK BIT
0093  2517 9AD5 25ED          STA    TEMP
0094  2518 320C 2525          JOR    GPB6     = 0, GET NEXT BIT
0095  2519 B2D9 25F3          LDA    APBCAN   RESET
0096  251A 1353               LLA    4        CANCEL BIT
0097  251B 00D0               DAR
0098  251C 8ACC 25E9          ADD    PBIAS    IN THE
0099  251D FBDC 25FA          CALL   *PACKPB  CANCEL TABLE OF PBS
0100  251E B2CA 25E9          LDA    PBIAS    GET ENTRANCE NO.
0101  251F 00D0               DAR
0102  2520 8AD3 25F4          ADD    APBENT
0103  2521 9AD7 25F9          STA    MANLOC   POINTER IN PBENT TABLE
0104  2522 B3D6 25F9          LDA    *MANLOC
0105  2523 9AC3 25E7          STA    MCAN
0106  2524 FA07 2520          CALL   MANCAN   GO CANCEL ROUTE
0107  2525 B2C5 25EB   GPB6   LDA    SHFCNT
0108  2526 0D10               SAI    16
0109  2527 215A 250D          JMZ    GPB4     YES
0110  2528 B2C4 25ED          LDA    TEMP     NO, RELOAD AREG
0111  2529 F615 2514          JMP    GPB3     GO CHECK NEXT BIT
0112                   *
0113                   *
0114  252A F72A 2500   GPBRET RTN    GPBCAN
0115  252B 0000        CANLOC DATA   0        PBCAN POINTER
0117                   *
0118                   *
0119                   *                MANUAL ROUTE CANCEL SUBROUTINE
0120                   *
0121                   *        THIS SUBROUTINE CANCELS A ROUTE
0122                   *           1. LOCKOUTS
0123                   *           2. SWITCH REQUESTS
0124                   *           3. GATE REQUESTS
0125                   *           4. ESTRT TABLE
0126                   *           5. MSET, ROUTE BEING SETUP
0127                   *
0128                   *        ENTER WITH ENTRANCE IN MCAN
0129                   *
0130                   *
0131  252C 0800        MANCAN ENT
0132  252D 0250               ARP
0133  252E 9AB3 25E2          STA    R        ROUT INDEX
0134  252F 9AA2 25D2          STA    I        ENEX INDEX
0135  2530 9ABD 25EE          STA    N        ESTRT TABLE
0136  2531 B2A6 25D8          LDA    AENEX    ENEX TABLE POINTERS
0137  2532 9AA0 25D3          STA    IBASE    ENT
0138  2533 0150               IAR
0139  2534 9A9F 25D4          STA    IBASE+1
0140  2535 B2A3 25D9          LDA    AKEYS
0141  2536 9A9E 25D5          STA    JBASE    KEY
0142  2537 0150               IAR
0143  2538 9A9D 25D6          STA    JBASE+1
0144  2539 B2A0 25DA          LDA    ATKO
0145  253A 9A9C 25D7          STA    KBASE    TK
0146  253B B2B3 25EF          LDA    AESTRT   AESTRT TABLE POINTERS
0147  253C 9A9E 25DB          STA    NBASE    ENT
0148  253D 0150               IAR
0149  253E 9A9D 25DC          STA    NBASE+1  EXIT
0150  253F B2B0 25F0          LDA    ASTKEY
```

```
2540 9A9C 25DD          STA    OBASE     KEY
2541 0150               IAR
2542 9A9B 25DE          STA    OBASE+1   KEY+1
2543 B2AD 25F1          LDA    AESTTK
2544 9A9A 25DF          STA    PBASE     TK
2545 B29D 25E3          LDA    AROUT     ROUT TABLE POINTERS
2546 9A99 25E0          STA    RBASE     ENT
2547 0150               IAR
2548 9A98 25E1          STA    RBASE+1   EXIT
2549 B29D 25E7   M1     LDA    MCAN      MCAN = ENT
254A 9395 25E0          SUB    *RBASE
254B 210B 2557          JAZ    M3        YES
254C B295 25E2   M2     LDA    R         NO. ROUT DONE?
254D 0D3F               SAI    63
254E 3101 2550          JAN    M21       NO
254F F240 2590          JMP    MANO      YES
2550 DA91 25E2   M21    IMS    R         INC POINTERS
2551 DA90 25E2          IMS    R
2552 DA8D 25E0          IMS    RBASE
2553 DA8C 25E0          IMS    RBASE
2554 DA8C 25F1          IMS    RBASE+1
2555 DA8B 25E1          IMS    RBASE+1
2556 F60D 2549          JMP    M1
2557 B388 25E0   M3     LDA    *RBASE    FOUND IN ROUT
2558 937A 25D3          SUB    *IBASE    ENTX ENT = ROUT ENT
2559 3104 255E          JAN    M31       NO
255A B379 25D4          LDA    *IBASE+1  YES. CHECK EXIT
255B 829F 25FB          AND    POSNO
255C 9384 25E1          SUB    *RBASE+1
255D 2110 256E          JAZ    M4        YES. ROUT FOUND
255E B273 25D2   M31    LDA    I         NO. TABLE DONE
255F 0D4B               SAI    75
2560 3101 2562          JAN    M32       NO
2561 F22C 258E          JMP    M7        YES. ILLEGAL
2562 DA6F 25D2   M32    IMS    I         NO. INC I POINTERS
2563 DA6E 25D2          IMS    I
2564 DA6E 25D3          IMS    IBASE
2565 DA6D 25D3          IMS    IBASE
2566 DA6D 25D4          IMS    IBASE+1
2567 DA6C 25D4          IMS    IBASE+1
2568 DA6C 25D5          IMS    JBASE
2569 DA6B 25D5          IMS    JBASE
256A DA6B 25D6          IMS    JBASE+1
256B DA6A 25D6          IMS    JBASE+1
256C DA6A 25D7          IMS    KBASE
256D F616 2557          JMP    M3        CHECK NEXT ROUT
256E B36C 25DB   M4     LDA    *NBASE    ESTRT SLOT OPEN?
256F 2110 2580          JAZ    M5        YES. GO STORE
2570 B27D 25EE          LDA    N         NO. TABLE FULL?
2571 0D1F               SAI    31
2572 3101 2574          JAN    M6        NO
2573 F21A 258E          JMP    M7        YES. ILLEGAL
2574 DA79 25EE   M6     IMS    N         NO. INC POINTERS
2575 DA78 25EE          IMS    N
2576 DA64 25DB          IMS    NBASE
2577 DA63 25DB          IMS    NBASE
2578 DA63 25DC          IMS    NBASE+1
2579 DA62 25DC          IMS    NBASE+1
257A DA62 25DD          IMS    OBASE
257B DA61 25DD          IMS    OBASE
257C DA61 25DE          IMS    OBASE+1
257D DA60 25DE          IMS    OBASE+1
257E DA60 25DF          IMS    PBASE
257F F611 256E          JMP    M4
2580 B352 25D3   M5     LDA    *IBASE    STORE ROUT IN ESTRT
2581 9B59 25DB          STA    *NBASE    ENT
2582 B351 25D4          LDA    *IBASE+1
2583 9B58 25DC          STA    *NBASE+1  EXIT
```

```
0219  2584 B350 25D5          LDA    *JBASE
0220  2585 9B57 25DD          STA    *OBASE    KEY
0221  2586 B34F 25D6          LDA    *JBASE+1
0222  2587 9B56 25DE          STA    *OBASE+1  KEY+1
0223  2588 B34E 25D7          LDA    *KBASE
0224  2589 9B55 25DF          STA    *PBASE    TK
0225  258A 0110               ZAR
0226  258B 9B54 25E0          STA    *RBASE
0227  258C 9B54 25E1          STA    *RBASE+1
0228  258D F202 2590          JMP    MAN0
0229  258E 0800        M7     HLT               ****** ILLEGAL HALT
0230  258F F200 2590          JMP    MAN0
0231  2590 0350        MAN0   ARP               SET UP POINTERS
0232  2591 9A5C 25EE          STA    N         FOR N = 1
0233  2592 B25C 25EF          LDA    RESTRT
0234  2593 9A47 25DB          STA    NBASE
0235  2594 0150               IAR
0236  2595 9A46 25DC          STA    NBASE+1
0237  2596 B259 25F0          LDA    ASTKEY
0238  2597 9A45 25DD          STA    OBASE
0239  2598 0150               IAR
0240  2599 9A44 25DE          STA    OBASE+1
0241  259A B256 25F1          LDA    RESTTK
0242  259B 9A43 25DF          STA    PBASE
0243  259C B24A 25E7   MAN1   LDA    MCAN      MCAN = ROUTE ENT ?
0244  259D 933D 25DB          SUB    *NBASE
0245  259E 210F 25AE          JAZ    MAN2      YES
0246  259F B24E 25EE   MAN6   LDA    N         NO, TABLE DONE ?
0247  25A0 0D1F               SAI    31
0248  25A1 212D 25CF          JAZ    MAN3      YES, GO ZERO AND EXIT
0249  25A2 DA4B 25EE          IMS    N         NO, INC POINTERS
0250  25A3 DA4A 25EE          IMS    N
0251  25A4 DA36 25DB          IMS    NBASE
0252  25A5 DA35 25DB          IMS    NBASE
0253  25A6 DA35 25DC          IMS    NBASE+1
0254  25A7 DA34 25DC          IMS    NBASE+1
0255  25A8 DA34 25DD          IMS    OBASE
0256  25A9 DA33 25DD          IMS    OBASE
0257  25AA DA33 25DE          IMS    OBASE+1
0258  25AB DA32 25DE          IMS    OBASE+1
0259  25AC DA32 25DF          IMS    PBASE
0260  25AD F611 259C          JMP    MAN1      GO GET NEXT ESTRT ENT
0261  25AE 0350        MAN2   ARP               YES, THIS IS THE ROUTE
0262  25AF 9A34 25E4          STA    J         TO BE CANCELLED
0263  25B0 B32C 25DD          LDA    *OBASE
0264  25B1 9A34 25E6          STA    WORD      TABLE ADDRESS POINTER
0265  25B2 B32B 25DE          LDA    *OBASE+1
0266  25B3 9A31 25E5          STA    JMAX      # OF WORDS
0267  25B4 B331 25E6   MAN8   LDA    *WORD     WORD NEG. ?
0268  25B5 3085 25BB          JAP    MAN9      NO, CONTROL WORD
0269  25B6 0350               ARP              YES, INDICATION WORD
0270  25B7 9A34 25EC          STA    SWFLG     SW REQ DONE FLAG
0271  25B8 DA2B 25E4   MAN10  IMS    J         INC POINTERS
0272  25B9 DA2C 25E6          IMS    WORD
0273  25BA F606 25B4          JMP    MAN8      GET NEXT WORD
0274  25BB B230 25EC   MAN9   LDA    SWFLG     SWITCHES CANCELLED?
0275  25BC 00D0               DAR
0276  25BD 2106 25D4          JAZ    MAN11     YES
0277  25BE B327 25E6          LDA    *WORD     NO, CANCEL SW REQ
0278  25BF FB37 25F7          CALL   *APK00
0279  25C0 B223 25E4   MAN13  LDA    J
0280  25C1 9223 25E5          SUB    JMAX      TABLE DONE ?
0281  25C2 2104 25C7          JAZ    MAN12     YES
0282  25C3 F608 25B8          JMP    MAN10     NO, GO GET NEXT
0283  25C4 B321 25E6   MAN11  LDA    *WORD
0284  25C5 FB30 25F6          CALL   *APACK0   ZERO LK AND GATE REQ
```

```
0285  25C6 F606 25C0          JMP    MAN12    GO GET NEXT
0286  25C7 0110        MAN12  ZAR
0287  25C8 9812 25DB          STA    *NBASE   ZERO ESTRT TABLE
0288  25C9 9812 25DC          STA    *NBASE+1
0289  25CA 9812 25DD          STA    *OBASE
0290  25CB 9812 25DE          STA    *OBASE+1
0291  25CC 9812 25DF          STA    *PBASE
0292  25CD 9A1E 25FC          STA    SWFLG
0293  25CE F62F 259F          JMP    MAN6
0294  25CF 9A1C 25FC  MAN3    STA    SWFLG    ZERO SW FLAG
0295  25D0 9A16 2567          STA    MCAN     ZERO MANUAL CANCEL ENT
0296  25D1 F7A5 252C          RTN    MANCAN
0298  25D2 0000        I      DATA   0        INDEX ON ENEX TABLES
0299                   *
0300  25D3 0000        IBASE  DATA   0        ENT POINTER
0301  25D4 0000               DATA   0        EXIT POINTER
0302  25D5 0000        JBASE  DATA   0        KEY POINTER
0303  25D6 0000               DATA   0        KEY+1 POINTER
0304  25D7 0000        KBASE  DATA   0        TK POINTER
0305                   *
0306  25D8 5300        AENEX  DATA   :5300    TABLE ADDRESSES
0307  25D9 5300        AKEYS  DATA   :5300    X
0308  25DA 5420        ATKO   DATA   :5420    X
0309                   *
0310  25DB 0000        NBASE  DATA   0        ESTRT POINTERS
0311  25DC 0000               DATA   0        ESTRT+1
0312  25DD 0000        OBASE  DATA   0        ESTKEY
0313  25DE 0000               DATA   0        ESTKEY+1
0314  25DF 0000        PBASE  DATA   0        ESTTK
0315  25E0 0000        RBASE  DATA   0        ROUT POINTERS
0316  25E1 0000               DATA   0
0317                   *
0318  25E2 0000        R      DATA   0        INDEX ON ROUT TABLE
0319  25E3 5880        AROUT  DATA   :5880    ROUT ADDRESS
0320  25E4 0000        J      DATA   0        INDEX ON INFO TABLE
0321  25E5 0000        JMAX   DATA   0        # OF WORDS IN TABLE
0322  25E6 0000        WORD   DATA   0        INFO WORD LOCATION
0323                   *
0324  25E7 0000        MCAN   DATA   0        MANUAL CANCEL
0325  25E8 0000        MSET   DATA   0        MANUAL SETUP
0326  25E9 0000        PBIAS  DATA   0        PB ENT TABLE BIAS
0327  25EA 0000        PASS   DATA   0        INDEX ON PBCAN TABLE
0328  25EB 0000        SHFCNT DATA   0        BIT COUNT IN WORD
0329  25EC 0000        SWFLG  DATA   0        SW REQ HAVE BEEN SENT
0330  25ED 0000        TEMP   DATA   0        TEMP SAVE AREG
0331  25EE 0000        N      DATA   0        INDEX ON ESTRT TABLE
0332                   *
0333  25EF 5880        AESTRT DATA   :5880    ENT/EXIT
0334  25F0 58A0        ASTKEY DATA   :58A0    KEY/KEY+1
0335  25F1 58C0        AESTTK DATA   :58C0    TK
0336                   *
0337  25F2 5048        APBSET DATA   :5048    GATE PB SETUP TABLE
0338  25F3 504A        APBCAN DATA   :504A    GATE PB CANCEL TABLE
0339  25F4 2692        APBENT DATA   PBENT    TABLE OF ENTRANCES
0340                   *
0341  25F5 5900        AFETCH DATA   :5900    FETCH SUBROUTINE
0342  25F6 5920        APACK0 DATA   :5920    PACK 0 SUBROUTINE
0343  25F7 5930        APK00  DATA   :5930    PACK TWO 05 SUBROUTINE
0344  25F8 5910        APACK  DATA   :5910    PACK 1 SUBROUTINE
0345                   *
0346  25F9 0000        MANLOC DATA   0        PBENT POINTER
0347  25FA 26B2        PACKPB DATA   PCK250   PACK 0 IN PAGE 50
0348  25FB 7FFF        POSNO  DATA   :7FFF
0350                   *
0351                   *
0352                   *          MANUAL ROUTE SETUP SUBROUTINE
0353                   *
```

```
0354                    *        THIS SUBROUTINE DETERMINES WHICH ROUTE
0355                    *        HAS BEEN MANUALLY SETUP AND THEN SETS
0356                    *        IT UP SO THE PROGRAM IS AWARE OF IT
0357                    *
0358                    *        A ROUTE HAS BEEN MANUALLY SETUP WHEN
0359                    *        A GATE CLEARS AND ITS ASSOCIATED PP
0360                    *        IS IN THE PRESSED STATE
0361                    *
0362                    *        TABLES USED:
0363                    *
0364                    *          ENEX      UNIT ROUTE ENTRANCE
0365                    *          KEYS      SETUP KEYWORDS
0366                    *          TKO       EXIT TRACK CIRCUIT
0367                    *
0368                    *          ESTRT     ESTABLISHED ROUTE ENT/EXIT
0369                    *          ESTKEY    KEYWORDS
0370                    *          ESTTK     EXIT TRACK CIRCUIT
0371                    *
0372                    *
0373                    *
0374  25FC 0800         MANSET ENT
0375  25FD 0350                ARP              INITIALIZE POINTERS
0376  25FE 9E20 25D2          STA    I         I = 1
0377  25FF B627 25D8          LDA    AENEX
0378  2600 9E2D 25D3          STA    IBASE     ENTRANCE POINTER
0379  2601 0150               IAR
0380  2602 9E2E 25D4          STA    IBASE+1   EXIT POINTER
0381  2603 B62A 25D9          LDA    AKEYS
0382  2604 9E2F 25D5          STA    JBASE     KEY POINTER
0383  2605 0150               IAR
0384  2606 9E30 25D6          STA    JBASE+1   KEY + 1 POINTER
0385  2607 B62D 25DA          LDA    ATKO
0386  2608 9E31 25D7          STA    KBASE     TK POINTER
0387  2609 B736 25D3  MS3     LDA    *IBASE
0388  260A 9622 25E8          SUB    MSET      ENTRANCE = MSET ?
0389  260B 2110 261C          JAZ    MS1       YES, GO CHECK ROUTE
0390  260C B63A 25D2  MS4     LDA    I         NO, TABLE DONE ?
0391  260D 0D4B               SAI    75
0392  260E 3101 2610          JAN    MS41      NO
0393  260F F253 2663          JMP    MS2       YES, ILLEGAL
0394  2610 DE3E 25D2  MS41    IMS    I         NO, INC POINTERS
0395  2611 DE3F 25D2          IMS    I
0396  2612 DE3F 25D3          IMS    IBASE     ENT
0397  2613 DE40 25D3          IMS    IBASE
0398  2614 DE40 25D4          IMS    IBASE+1   EXIT
0399  2615 DE41 25D4          IMS    IBASE+1
0400  2616 DE41 25D5          IMS    JBASE     KEY
0401  2617 DE42 25D5          IMS    JBASE
0402  2618 DE42 25D6          IMS    JBASE+1   KEY+1
0403  2619 DE43 25D6          IMS    JBASE+1
0404  261A DE43 25D7          IMS    KBASE     TK
0405  261B F612 2609          JMP    MS3       GET NEXT UNIT ROUTE
0406  261C 0350       MS1     ARP
0407  261D 9E39 25E4          STA    J
0408  261E B748 25D6          LDA    *JBASE+1
0409  261F 9E3A 25E5          STA    JMAX      NO. OF WORDS
0410  2620 B74B 25D5          LDA    *JBASE
0411  2621 9E3B 25E6          STA    WORD      INFO TABLE ADDRESS
0412  2622 B73C 25E6  MS6     LDA    *WORD     INFO WORD
0413  2623 3085 2629          JAP    MS5       NOT INDICATION WORD
0414  2624 FF2F 25F5          CALL   *AFETCH   CHECK IF SW IN POS.
0415  2625 2159 260C          JAZ    MS4       NO, RETURN
0416  2626 DE42 25E4  MS7     IMS    J         YES, CHECK NEXT SW POS
0417  2627 DE41 25E6          IMS    WORD
0418  2628 F606 2622          JMP    MS6
0419  2629 B645 25E4  MS5     LDA    J
0420  262A 9645 25E5          SUB    JMAX      INFO TABLE DONE ?
```

```
0421  262B 3145 2626          JAN    MS7       NO, GET NEXT WORD
0422  262C 0350               ARP              YES, THIS IS THE ROUTE
0423  262D 9E49 25E4          STA    J         J = 1
0424  262E B759 25D5          LDA    *JBASE    RESTORE
0425  262F 9E49 25E6          STA    WORD      INFO TABLE ADDRESS
0426  2630 B74A 25E6  MS8     LDA    *WORD
0427  2631 3083 2635          JAP    MS9       INDICATION WORD
0428  2632 DE4E 25E4  MS10    IMS    J         CONTROL WORD
0429  2633 DE4D 25E6          IMS    WORD
0430  2634 F604 2630          JMP    MS8
0431  2635 FF3D 25F8  MS9     CALL   *APACK    SET BIT
0432  2636 B652 25E4          LDA    J
0433  2637 9652 25E5          SUB    JMAX      TABLE DONE ?
0434  2638 3146 2632          JAN    MS10      NO, GET NEXT WORD
0435  2639 0350               ARP              YES, PUT WORD IN ESTRT
0436  263A 9E4C 25EE          STA    N         FIRST, SET UP POINTERS
0437  263B B64C 25EF          LDA    AESTRT
0438  263C 9E61 25DB          STA    NBASE     ENT
0439  263D 0150               IAR
0440  263E 9E62 25DC          STA    NBASE+1   EXIT
0441  263F B64F 25F0          LDA    ASTKEY
0442  2640 9E63 25DD          STA    OBASE     KEY
0443  2641 0150               IAR
0444  2642 9E64 25DE          STA    OBASE+1   KEY+1
0445  2643 B652 25F1          LDA    AESTTK
0446  2644 9E65 25DF          STA    PBASE     TK
0447  2645 B76A 25DB  MS12    LDA    *NBASE    FIND SPOT IN TABLE
0448  2646 210F 2656          JAZ    MS11      FOUND
0449  2647 B659 25EE          LDA    N
0450  2648 0D1F               SAI    31
0451  2649 2119 2663          JAZ    MS2       YES, ILLEGAL
0452  264A DE5C 25EE          IMS    N         NO, TRY NEXT SLOT
0453  264B DE5D 25EE          IMS    N         INC POINTERS
0454  264C DE71 25DB          IMS    NBASE     ENT
0455  264D DE72 25DB          IMS    NBASE
0456  264E DE72 25DC          IMS    NBASE+1   EXIT
0457  264F DE73 25DC          IMS    NBASE+1
0458  2650 DE73 25DD          IMS    OBASE     KEY
0459  2651 DE74 25DD          IMS    OBASE
0460  2652 DE74 25DE          IMS    OBASE+1   KEY+1
0461  2653 DE75 25DE          IMS    OBASE+1
0462  2654 DE75 25DF          IMS    PBASE     TK
0463  2655 F610 2645          JMP    MS12
0464  2656 B783 25D3  MS11    LDA    *IBASE    STORE ROUTE IN ESTRT
0465  2657 9F7C 25DB          STA    *NBASE    ENT
0466  2658 B784 25D4          LDA    *IBASE+1
0467  2659 9F7D 25DC          STA    *NBASE+1  EXIT
0468  265A B785 25D5          LDA    *JBASE
0469  265B 9F7E 25DD          STA    *OBASE    KEY
0470  265C B786 25D6          LDA    *JBASE+1
0471  265D 9F7F 25DE          STA    *OBASE+1  KEY+1
0472  265E B787 25D7          LDA    *KBASE
0473  265F 9F80 25DF          STA    *PBASE    TK
0474  2660 0110               ZAR
0475  2661 9E79 25E8          STA    MSET
0476  2662 F766 25FC  MS13    RTN    MANSET    RETURN
0477  2663 0800       MS2     HLT              ILLEGAL HALT
0478  2664 F602 2662          JMP    MS13
0479                  *
0480                  *
0481  2665 0000       SBIAS   DATA   0         PBENT BIAS
0482  2666 0000       TEMPS   DATA   0         TEMP AREG
0483  2667 0000       SETLOC  DATA   0         POINTER FOR PBSET TABLE
0485                  *
0486                  *
0487                  *                MANUAL SETUP PB PROCESSING
0488                  *
```

```
0489                        *        THE GATE INDICATION INPUTS ARE CHECKED TO SEE
0490                        *        WHEN A GATE CLEARS. THE ASSOCIATED PB IS THEN
0491                        *        CHECKED TO SEE IF IT IS ON. IF BOTH CONDITIONS
0492                        *        ARE TRUE, THE MANUAL ROUTE IS SET UP. THE OFF
0493                        *        INFO BITS ARE IN THE PBSET TABLE
0494                        *
0495                        *
0496                        *        TABLES USED.
0497                        *
0498                        *          PBSET    BITS TO DETERMINE ROUTE TO SET UP
0499                        *          PBENT    GATE ENTRANCE NUMBER TABLE
0500                        *
0501                        *
0502                        *        SUBROUTINE USED:
0503                        *
0504                        *          MANSET   MANUAL ROUTE SET UP
0505                        *
0506                        *
0507  2668 0000            GPBSET NOP
0508  2669 0110                   ZAR
0509  266A 9E80 25EA              STA    PASS      FIRST PASS
0510  266B 9E06 2665              STA    SBIAS
0511  266C B67A 25F2              LDA    APBSET
0512  266D 9E06 2667              STA    SETLOC    PBSET ADDRESS POINTER
0513  266E 0110            GP2    ZAR
0514  266F 9E84 25EB              STA    SHFCNT    SHIFT COUNTER = 0
0515  2670 B709 2667              LDA    *SETLOC   FIRST WORD = 0 ?
0516  2671 310A 267C              JAN    GP3       NO
0517  2672 B60D 2665              LDA    SBIAS     YES, ADD 16 TO BIAS
0518  2673 0B10                   AAI    16
0519  2674 9E0F 2665              STA    SBIAS
0520  2675 B68B 25EA       GP4    LDA    PASS      2ND PASS COMPLETE ?
0521  2676 2102 2679              JAZ    GP5       NO, DO 2ND PASS
0522  2677 F300 2678              JMP    *OUT      ****************
0523                        *
0524  2678 252A            OUT    DATA   GPBRET
0525                        *
0526  2679 DE8F 25EA       GP5    IMS    PASS
0527  267A DE13 2667              IMS    SETLOC    2ND WORD ADDRESS
0528  267B F60D 266E              JMP    GP2
0529  267C DE91 25EB       GP3    IMS    SHFCNT    WORD NOT 0, INC COUNT
0530  267D DE18 2665              IMS    SBIAS     INC BIAS
0531  267E 13D0                   LRA    1         CHECK BIT
0532  267F 9E19 2666              STA    TEMPS
0533  2680 320C 268D              JOR    GP6       = 0, GET NEXT BIT
0534  2681 B68F 25F2              LDA    APBSET    RESET BIT
0535  2682 1353                   LLA    4         IN PBSET TABLE
0536  2683 00D0                   DAR
0537  2684 8E1F 2665              ADD    SBIAS
0538  2685 FF8B 25FA              CALL   *PACKPB
0539  2686 B621 2665              LDA    SBIAS     GET ENT NUMBER
0540  2687 00D0                   DAR
0541  2688 8E94 25F4              ADD    APBENT
0542  2689 9E90 25F9              STA    MANLOC    POINTER FOR PBENT TABLE
0543  268A B791 25F9              LDA    *MANLOC
0544  268B 9EA3 25E8              STA    MSET
0545  268C FE90 25FC              CALL   MANSET    GO SET UP ROUTE
0546  268D B6A2 25EB       GP6    LDA    SHFCNT
0547  268E 0D10                   SAI    16        WORD DONE ?
0548  268F 215A 2675              JAZ    GP4       YES
0549  2690 B62A 2666              LDA    TEMPS     NO, CHECK NEXT BIT
0550  2691 F615 267C              JMP    GP3       GO CHECK NEXT BIT
0552                        *
0553                        *
0554                        *              PUSHBUTTON ENTRANCE TABLE
0555                        *
```

```
0556                    *        THIS TABLE CONTAINS THE ENTRANCE NUMBERS FO
0557                    *        EACH OF THE MANUAL DATA REQUEST PUSHBUTTONS
0558                    *        ON THE CONTROL CONSOLE. THESE ENTRANCES ARE
0559                    *        USED TO MANUALLY SET UP AND CANCEL REQUESTS
0560                    *
0561                    *
0562  2692 0102         PBENT   DATA    :102     GX1A
0563  2693 0100                 DATA    :100     GX1B
0564  2694 0200                 DATA    :200     GX1C
0565  2695 0202                 DATA    :202     GX1D
0566  2696 0106                 DATA    :106     GX2A
0567  2697 0104                 DATA    :104     GX2C
0568  2698 0108                 DATA    :108     GX2D
0569  2699 0110                 DATA    :110     GX3B
0570  269A 0112                 DATA    :112     GX3C
0571  269B 0114                 DATA    :114     GX3D
0572  269C 0206                 DATA    :206     GX4A
0573  269D 0204                 DATA    :204     GX4B
0574  269E 0208                 DATA    :208     GX4D
0575  269F 0214                 DATA    :214     GX5A
0576  26A0 0210                 DATA    :210     GX5B
0577  26A1 0212                 DATA    :212     GX5C
0578  26A2 0118                 DATA    :118     GX6A
0579  26A3 0116                 DATA    :116     GX6B
0580  26A4 0216                 DATA    :216     GX6C
0581  26A5 0218                 DATA    :218     GX6D
0582  26A6 0122                 DATA    :122     GX7A
0583  26A7 0120                 DATA    :120     GX7B
0584  26A8 0220                 DATA    :220     GX7C
0585  26A9 0222                 DATA    :222     GX7D
0586  26AA 0124                 DATA    :124     GX7E
0587  26AB 0000                 DATA    0        SPARE
0588  26AC 0000                 DATA    0        SPARE
0589  26AD 0000                 DATA    0        SPARE
0590  26AE 0000                 DATA    0        SPARE
0591  26AF 0000                 DATA    0        SPARE
0592  26B0 0000                 DATA    0        SPARE
0593  26B1 0000                 DATA    0        SPARE
0595                    *
0596                    *
0597                    *                PACK 0 IN PAGE 50
0598                    *
0599                    *        ENTER WITH WORD/BIT IN AREG
0600                    *        PACKS 0 IN BIT IN PAGE 50
0601                    *
0602                    *
0603  26B2 0900         PCKZ50 ENT
0604  26B3 9A0C 26C0            STA     XSV      SAVE XREG
0605  26B4 0048                 TAX
0606  26B5 820D 26C3            AND     NIBU     GET BIT NO.
0607  26B6 0428                 EAX              PUT IN X
0608  26B7 820A 26C2            AND     WRDMSK   7FF0
0609  26B8 10D3                 ARA     4
0610  26B9 8A0A 26C4            ADD     FIVET    BIAS = 5000
0611  26BA 9A06 26C1            STA     GWORD    INFO ADDRESS POINTER
0612  26BB B305 26C1            LDA     *GWORD   GET INFO WORD
0613  26BC 8460 0060            AND     @NBIT0   ZERO OUT BIT
0614  26BD 9B03 26C1            STA     *GWORD   STORE
0615  26BE E201 26C0            LDX     XSV      RESTORE X
0616  26BF F70D 26B2            RTN     *PCKZ50
0617                    *
0618                    *
0619  26C0 0000         XSV     DATA    0        TEMP STORE X
0620  26C1 0000         GWORD   DATA    0        POINTER
0621  26C2 7FF0         WRDMSK  DATA    :7FF0    ADDRESS MASK
0622  26C3 000F         NIBU    DATA    :000F    BIT MASK
0623  26C4 5000         FIVET   DATA    :5000
```

```
0060        NBIT0  EQU     :60
                   *
                   *
                   *
5820                ABS     :5820    SUBROUTINE CALL FOR EXCLA
5820 2500           DATA    GPBCAN   MANUAL ROUTING ROUTINE
                    END

ERRORS
WARNING
                   *
                   *
                   *              AUTOMATIC ROUTING PROGRAM
                   *
                   *
                   *          THIS PROGRAM PERFORMS FOUR FUNCTIONS
                   *
                   *          1. CHECKS IF A ROUTE IS AVAILABLE
                   *          2. SELECTS THE BEST PATH
                   *          3. REQUESTS THE ROUTE FROM INTERLOCKING
                   *          4. CANCELS THE ROUTE AS TRAIN ACCEPTS IT
                   *
                   *          THESE ROUTINES ARE USED:
                   *
                   *          1. RTAV    ROUTE AVAILABLE
                   *          2. RTSEL   ROUTE SELECT
                   *          3. RSTUP   ROUTE SETUP
                   *          4. RTCAN   ROUTE CANCEL
                   *          5. RTCON   ROUTE SETUP CONTROL
                   *
                   *          THESE SUBROUTINES ARE USED:
                   *
                   *          PRROUT  PRIORITY ROUTING
                   *          FETCH   CHECK BIT STATUS
                   *          PACK1   SET BIT IN WORD
                   *          PACK0   PACK 0 IN BIT
                   *          PACK00  PACK 0 IN TWO WORDS
                   *
                   *          THESE TABLES ARE USED:
                   *
                   *          ENEX    UNIT ROUTE ENT/EXITS
                   *          KEYA    AVAIL KEYWORDS
                   *          KEYS    SETUP KEYWORDS
                   *          TKO     EXIT TRACK CIRCUITS
                   *          AR(N)   AVAIL INFO TABLES
                   *          SR(N)   SETUP INFO TABLES
                   *          PRIOR   PRIORITY TABLE
                   *          ROUT    IND ROUTES TO BE SETUP
                   *          ENTAV   IND ROUTES AVAILABLE
                   *          ESTRT   ROUTES THAT ARE SETUP
                   *          LSTAR   UNSATISFIED ENTRANCES
                   *          TKCAN   CANCEL TRACK CIRCUITS
                   *          KEYC    CANCEL KEYWORDS
                   *          CKT(I)  CANCEL INFO TABLES
                   *          MAXKT   # OF ROUTES BY STATION
                   *          ROFLGT  SW REQ HAVE BEEN SENT
                   *          ROUTT   ROUTE TABLE ADDRESSES
                   *
                   *
                   *
                   *                 ROUTE AVAILABLE ROUTINE
                   *
                   *
                   *          THIS ROUTINE LOCATES ALL POSSIBLE
                   *          EXITS FROM A GIVEN STATION BY DET-
                   *          ERMINING WHETHER THE INDIVIDUAL
                   *          ROUTES ARE AVAILABLE AND WHETHER
```

```
0060                    *          THROUGH ROUTING IS ALLOWED.
0061                    *
0062                    *
0063                    *          ALL AVAILABLE ROUTES ARE STORED
0064                    *          IN A TEMPORARY TABLE CALLED ENTAV
0065                    *          TO BE USED BY THE ROUTE SELECT
0066                    *          ROUTINE.
0067                    *
0068                    *
0069  2700                       ABS     :2700
0070                    *
0071                    *
0072  2700 0000         RTAV     ENT
0073  2701 0350                  ARP                 INITIALIZE POINTERS
0074  2702 9AA6 27A9             STA     K           K = 1
0075  2703 9AA6 27AA             STA     S           S = 1
0076  2704 B28B 2790             LDA     AENTAV      POINTER FOR ROUTE
0077  2705 9AAE 27B4             STA     KBASE       AVAIL ENTRANCE
0078  2706 0150                  IAR
0079  2707 9AAD 27B5             STA     KBASE+1     EXIT
0080  2708 B288 2791             LDA     ALSTAR
0081  2709 9AA9 27B3             STA     SBASE       POINTER FOR LSTAR
0082  270A B087 00B7             LDA     ENTR
0083  270B 3101 270D             JAN     CC1
0084  270C F27F 278C             JMP     RAAA
0085  270D 9BA5 27B3  CC1        STA     *SBASE      PUT ENT INTO LSTAR
0086  270E B3A4 27B3  CC         LDA     *SBASE      LOOK FOR UNSAT ENT
0087  270F 211C 272C             JAZ     DD          NO. GET NEXT LOC
0088  2710 0350                  ARP
0089  2711 9A95 27A7             STA     I           I = 1
0090  2712 B27B 278E             LDA     AENEX       ENT/EXIT TABLE
0091  2713 9A9B 27AF             STA     IBASE       ENT POINTER
0092  2714 0150                  IAR
0093  2715 9A9A 27B0             STA     IBASE+1     EXIT POINTER
0094  2716 B278 278F             LDA     AKEYA       KEYWORD TABLE
0095  2717 9A99 27B1             STA     LBASE       INFO MEM LOC
0096  2718 0150                  IAR
0097  2719 9A98 27B2             STA     LBASE+1     NO. OF WORDS
0098  271A B398 27B3  GG         LDA     *SBASE      COMPARE UNSAT ENT
0099  271B 9393 27AF             SUB     *IBASE      WITH ENT/EXIT TABLE
0100  271C 2116 2733             JAZ     EE
0101  271D B289 27A7  II         LDA     I           NO. TABLE COMPLETE?
0102  271E 0D4B                  SAI     75
0103  271F 210B 272B             JAZ     FF          YES
0104  2720 DA86 27A7             IMS     I           NO. GET NEXT ENTRANCE
0105  2721 DA85 27A7             IMS     I
0106  2722 DA8C 27AF             IMS     IBASE
0107  2723 DA8B 27AF             IMS     IBASE
0108  2724 DA8B 27B0             IMS     IBASE+1
0109  2725 DA8A 27B0             IMS     IBASE+1
0110  2726 DA9A 27B1             IMS     LBASE
0111  2727 DA89 27B1             IMS     LBASE
0112  2728 DA89 27B2             IMS     LBASE+1
0113  2729 DA88 27B2             IMS     LBASE+1
0114  272A F610 271A             JMP     GG
0115  272B 9B87 27B3  FF         STA     *SBASE      NO MORE ROUTES
0116  272C B27D 27AA  DD         LDA     S           LSTAR TABLE DONE?
0117  272D 9280 27AE             SUB     SMAX
0118  272E 3101 2730             JAN     DD1
0119  272F F247 2777             JMP     RR          YES
0120  2730 DA79 27AA  DD1        IMS     S           NO. GET NEXT ENT
0121  2731 DA81 27B3             IMS     SBASE
0122  2732 F624 270E             JMP     CC
0123  2733 B37B 27AF  EE         LDA     *IBASE      SET ENTRANCE NEGATIVE
0124  2734 A281 27B6             IOR     SIGN
0125  2735 9B79 27AF             STA     *IBASE
0126  2736 B37A 27B1             LDA     *LBASE      SET INFO TABLE POINT
```

```
0127  2737 9A80 27B8        STA   WORD      INFO MEM LOC
0128  2738 B379 27B2        LDA   *IBASE+1
0129  2739 9A72 27AC        STA   JMAX      NO. OF INFO WORDS
0130  273A 0350             ARP
0131  273B 9A6C 27A8        STA   J         J = 1 WORD COUNTER
0132  273C B37B 27B8        LDA   *WORD     FIRST WORD IN TABLE
0133  273D FB54 2792        CALL  *AFETCH   GATE OPEN?
0134  273E 3103 2742        JAN   KK2       YES
0135  273F DA78 27B8  KK1   IMS   WORD      NO. NORMAL PATH
0136  2740 DA67 27A8        IMS   J
0137  2741 F208 274A        JMP   KK
0138  2742 B375 27B8  KK2   LDA   *WORD     GATE INDICATION
0139  2743 3082 2746        JAP   KK3       USE TABLE 1
0140  2744 806F 006F        AND   NBIT0+F   MAKE POSITIVE
0141  2745 0B20             AAI   :20       SECOND TABLE
0142  2746 8A46 278D  KK3   ADD   M3C0      GKLK BIAS
0143  2747 FB4A 2792        CALL  *AFETCH   IS LOCKOUT SET?
0144  2748 210A 2753        JAZ   JJ        NO. AVAILABLE
0145  2749 F62C 271D        JMP   II        YES, NOT AVAILABLE
0146  274A B36D 27B8  KK    LDA   *WORD
0147  274B FB46 2792        CALL  *AFETCH   GO CHECK BIT
0148  274C 316F 271D        JAN   II        NOT AVAILABLE
0149  274D B25A 27A8  HH    LDA   J         TABLE DONE?
0150  274E 925D 27AC        SUB   JMAX
0151  274F 2103 2753        JAZ   JJ        YES
0152  2750 DA57 27A8        IMS   J         NO. CHECK NEXT WORD
0153  2751 DA66 27B8        IMS   WORD
0154  2752 F608 274A        JMP   KK
0155  2753 B35C 27B0  JJ    LDA   *IBASE+1 ROUTE IS AVAILABLE
0156  2754 208F 2764        JAM   LL        THRU ROUTE IS OK
0157  2755 9B5F 27B5        STA   *KBASE+1 NOT ALLOWED, STORE EXIT
0158  2756 B358 27AF  QQ    LDA   *IBASE
0159  2757 820F 27B7        AND   POSNO
0160  2758 9B5B 27B4        STA   *KBASE    STORE ENT
0161  2759 DA4F 27A9        IMS   K         INC POINTERS FOR
0162  275A DA4E 27A9        IMS   K         ROUTE TABLE
0163  275B DA58 27B4        IMS   KBASE
0164  275C DA57 27B4        IMS   KBASE
0165  275D DA57 27B5        IMS   KBASE+1
0166  275E DA56 27B5        IMS   KBASE+1
0167  275F 0350       PP    ARP             LSTAR INDEX
0168  2760 9A49 27AA        STA   S         S = 1
0169  2761 B22F 2791        LDA   ALSTAR    SET UP POINTER
0170  2762 9A50 27B3        STA   SBASE
0171  2763 F655 270E        JMP   CC
0172  2764 0350       LL    ARP             FIND SLOT IN LSTAR
0173  2765 9A44 27AA        STA   S         RESET INDEX
0174  2766 B22A 2791        LDA   ALSTAR
0175  2767 9A4B 27B3        STA   SBASE
0176  2768 B34A 27B3  QQ    LDA   *SBASE
0177  2769 2108 2772        JAZ   MM        FOUND
0178  276A B23F 27AA        LDA   S         KEEP LOOKING
0179  276B 9242 27AE        SUB   SMAX
0180  276C 2103 2770        JAZ   NN        TABLE FULL
0181  276D DA3C 27AA        IMS   S         INC TABLE
0182  276E DA44 27B3        IMS   SBASE
0183  276F F607 2768        JMP   QQ
0184  2770 0800       NN    HLT             ******* ILLEGAL HALT
0185  2771 F612 275F        JMP   PP
0186  2772 B33D 27B0  MM    LDA   *IBASE+1 GET EXIT
0187  2773 8243 27B7        AND   POSNO     MAKE POSITIVE
0188  2774 9B3E 27B3        STA   *SBASE    STORE AS NEXT ENT
0189  2775 9B3F 27B5        STA   *KBASE+1 STORE IN ENTAV
0190  2776 F620 2756        JMP   QQ
0191  2777 B231 27A9  RR    LDA   K
0192  2778 00D0             DAR
0193  2779 9A33 27AD        STA   KMX       NO. OF AVAIL ROUTES
```

```
277A 0350                ARP
277B 9A2B 27A7           STA    I          I = 1
277C B211 278E           LDA    AENEX      SET ENTS POSITIVE
277D 9A31 27AF           STA    IBASE
277E B230 27AF   UU      LDA    *IBASE     GET ENT
277F 2089 2789           JAM    SS
2780 B226 27A7   VV      LDA    I
2781 0D4B                SAI    75         FINISHED?
2782 3101 2784           JAN    TT         NO
2783 F208 278C           JMP    RAAA
2784 DA22 27A7   TT      IMS    I          NO. GET NEXT ENT
2785 DA21 27A7           IMS    I
2786 DA28 27AF           IMS    IBASE
2787 DA27 27AF           IMS    IBASE
2788 F60A 277E           JMP    UU
2789 822D 27B7   SS      AND    POSNO
278A 9B24 27AF           STA    *IBASE     POSITIVE ENT
278B F60B 2780           JMP    VV
                 *
278C F78C 2700   RAAA    RTN    RTAV       **************
                 *
278D 03C0        M3C0    DATA   :03C0      BIAS FOR GRLK
     0060        NBIT0   EQU    :60
     000F        F       EQU    15
                 *
2785 5300        AENEX   DATA   ENEX       INDIRECT POINTERS
278F 5260        AKEYA   DATA   KEYA       TO TABLES
2790 279D        AENTAV  DATA   ENTAV
2791 2793        ALSTAR  DATA   LSTAR
2792 5900        AFETCH  DATA   :5900
                 *
                 *
     00B7        ENTR    EQU    :B7        ENTRANCE POINTER
     00B8        EXIT    EQU    :B8        EXIT POINTER
                 *
     5300        ENEX    EQU    :5300      ENEX TABLE ADDRESS
     5260        KEYA    EQU    :5260      AVAIL KEYWORDS
     53C0        KEYS    EQU    :53C0      SETUP KEYWORDS
     5420        TKO     EQU    :5420      EXIT TRACK CIRCUIT
                 *
                 *
                 *
                 *                UNSATISFIED ENTRANCE TABLE
                 *
                 *          THIS TABLE CONTAINS INTERMEDIATE
                 *         EXIT NUMBERS WHICH WILL BE USED
                 *         AS NEW ENTRANCE NUMBERS FOR NEW
                 *         ROUTES WHEN THROUGH ROUTING IS
                 *         ALLOWED.
                 *
                 *
2793 0000        LSTAR   DATA   0          ENTRANCE
2794 0000                DATA   0
2795 0000                DATA   0
2796 0000                DATA   0
2797 0000                DATA   0
2798 0000                DATA   0
2799 0000                DATA   0
279A 0000                DATA   0
279B 0000                DATA   0
279C 0000                DATA   0
                 *
                 *
                 *                AVAILABLE UNIT ROUTE TABLE
                 *
                 *
                 *          THIS TABLE CONTAINS ALL THE AVAILABLE
```

```
0263                    *          ROUTES ON THE SYSTEM. STARTING FROM
0264                    *          A GIVEN ENTRANCE. THIS TABLE IS BUILT
0265                    *          BY THE ROUTE AVAILABLE ROUTINE AND
0266                    *          USED BY THE ROUTE SELECT ROUTINE.
0267                    *
0268                    *
0269                    *
0270  279D 0000         ENTRV   DATA   0        ENTRANCE
0271  279E 0000                 DATA   0        EXIT
0272  279F 0000                 DATA   0
0273  27A0 0000                 DATA   0
0274  27A1 0000                 DATA   0
0275  27A2 0000                 DATA   0
0276  27A3 0000                 DATA   0
0277  27A4 0000                 DATA   0
0278  27A5 0000                 DATA   0        ENTRANCE
0279  27A6 0000                 DATA   0        EXIT
0280                    *
0281                    *
0282  27A7 0000         I       DATA   0        INDEX ON EN/EX TABLE
0283  27A8 0000         J       DATA   0        INDEX ON INFO TABLE
0284  27A9 0000         K       DATA   0        INDEX ON ENTRV TABLE
0285  27AA 0000         S       DATA   0        INDEX ON LSTAR TABLE
0286                    *
0287  27AB 0000         IMAX    DATA   0        2*NO. IN ROUT-1
0288  27AC 0000         JMAX    DATA   0        NO. OF WORDS OF INFO
0289  27AD 0000         KMX     DATA   0        2*#OF AVAIL RTS - 1
0290  27AE 000A         SMAX    DATA   10       SIZE OF LSTAR TABLE
0291                    *
0292  27AF 0000         IBASE   DATA   0        ENEX      TABLE POINTERS
0293  27B0 0000                 DATA   0        ENEX+1
0294  27B1 0000         LBASE   DATA   0        KEYA
0295  27B2 0000                 DATA   0        KEYA+1
0296  27B3 0000         SBASE   DATA   0        LSTAR
0297  27B4 0000         KBASE   DATA   0        ENTRV  ENT
0298  27B5 0000                 DATA   0        ENTRV  EXIT
0299                    *
0300  27B6 8000         SIGN    DATA   :8000    NEG BIT
0301  27B7 7FFF         POSNO   DATA   :7FFF    POS BITS
0302  27B8 0000         WORD    DATA   0        INDIRECT INFO LOC POINT
0304                    *
0305                    *
0306                    *
0307                    *              ROUTE SELECTION ROUTINE
0308                    *
0309                    *
0310                    *          THIS ROUTINE SELECTS THE PREFERRED ROUTE
0311                    *          FROM A GIVEN EXIT TO A GIVEN ENTRANCE. T-
0312                    *          ROUTE IS STORED IN A TABLE CALLED ROUT.
0313                    *
0314                    *
0315  2800                      RBS     :0800
0316  2800 0800         RTSEL   ENT
0317  2801 B1B9 00B9            LDA     *MAXX
0318  2802 313A 283D            JAN     RSJJ
0319  2803 B0B7 00B7            LDA     ENTR
0320  2804 2138 283D            JAZ     RSJJ      NO ENTRANCE
0321  2805 B0B8 00B8            LDA     EXIT
0322  2806 2136 283D            JAZ     RSJJ      NO EXIT
0323  2807 B55A 27AD            LDA     KMX
0324  2808 2134 283D            JAZ     RSJJ      NO AVAILABLE ROUTE
0325  2809 0350                 ARP                IS EXIT IN ENTRV?
0326  280A 9A53 27A7            STA     J         LOOP COUNTER
0327  280B B53E 27AD            LDA     KMX
0328  280C 0000                 DAR
0329  280D 9557 27AB            STA     IMAX      # ROUTES IN ENTRV
0330  280E B67E 2790            LDA     RENTRV    TABLE POINTER
```

```
0331  280F 0150              IAR
0332  2810 9E61 27AF         STA    IBASE     EXIT POINTER
0333  2811 B762 27AF   RT1   LDA    +IBASE
0334  2812 90B8 00B8         SUB    EXIT
0335  2813 2108 281C         JAZ    RT2       ROUTE EXISTS
0336  2814 B66D 27A7         LDA    I         LOOP DONE?
0337  2815 966A 27AB         SUB    IMAX
0338  2816 2126 283D         JAZ    RSJJ      YES, NO ROUTE
0339  2817 DE68 27AF         IMS    IBASE     NO, INC POINTERS
0340  2818 DE69 27AF         IMS    IBASE
0341  2819 DE72 27A7         IMS    I
0342  281A DE73 27A7         IMS    I
0343  281B F60A 2811         JMP    RT1       TRY NEXT EXIT
0344  281C 0250        RT2   ARP
0345  281D 9E76 27A7         STA    I         I = 1
0346  281E 9E75 27A9         STA    K         K = 1
0347  281F B672 27AD         LDA    KMX
0348  2820 00D0              DAR
0349  2821 9E76 27AB         STA    IMAX      IMAX = NO. OF ROUTES
0350  2822 B692 2790         LDA    AENTAV
0351  2823 9E74 27AF         STA    IBASE     ENTAV ENT POINTER
0352  2824 0150              IAR
0353  2825 9E75 27B0         STA    IBASE+1   ENTAV EXIT POINTER
0354  2826 B0BD 00BD         LDA    ROUT
0355  2827 9E73 27B4         STA    KBASE     ROUT ENT POINTER
0356  2828 0150              IAR
0357  2829 9E74 27B5         STA    KBASE+1   ROUT EXIT POINTER
0358  282A B77A 27B0   RSAA  LDA    *IBASE+1  FIND ROUTE WITH EXIT
0359  282B 90B8 00B8         SUB    EXIT
0360  282C 2111 283E         JAZ    RSBB      FOUND
0361  282D B686 27A7         LDA    I         IS SEARCH COMPLETE?
0362  282E 9683 27AB         SUB    IMAX
0363  282F 2107 2837         JAZ    RSCC      YES
0364  2830 DE89 27A7         IMS    I         NO, INC I POINTERS
0365  2831 DE8A 27A7         IMS    I
0366  2832 DE83 27AF         IMS    IBASE
0367  2833 DE84 27AF         IMS    IBASE
0368  2834 DE84 27B0         IMS    IBASE+1
0369  2835 DE85 27B0         IMS    IBASE+1
0370  2836 F60C 282A         JMP    RSAA      GET NEXT ROUTE
0371  2837 0800        RSCC  HLT               ****** ILLEGAL HALT
0372  2838 F201 283A         JMP    RSJ
0373  2839 99B9 00B9   RSJJJ STA    *MAXK
0374  283A 0110        RSJ   ZAR
0375  283B 98B7 00B7         STA    ENTR
0376  283C 98B8 00B8         STA    EXIT
0377  283D F73D 2800   RSJJ  RTN    RTSEL     RETURN ********
0378  283E B78E 27B0   RSBB  LDA    *IBASE+1  STORE ROUTE IN ROUT
0379  283F 9F8A 27B5         STA    *KBASE+1  EXIT
0380  2840 9A64 28A5         STA    TEMP
0381  2841 B792 27AF         LDA    *IBASE
0382  2842 9F8E 27B4         STA    *KBASE    ENT
0383  2843 B69C 27A7         LDA    I         LOOP COMPLETE?
0384  2844 9699 27AB         SUB    IMAX
0385  2845 210C 2852         JAZ    RSDD      YES
0386  2846 DE9F 27A7   RSEE  IMS    I         NO, INC I POINTERS
0387  2847 DEA0 27A7         IMS    I
0388  2848 DE99 27AF         IMS    IBASE
0389  2849 DE9A 27AF         IMS    IBASE
0390  284A DE9A 27B0         IMS    IBASE+1
0391  284B DE9B 27B0         IMS    IBASE+1
0392  284C B79C 27B0         LDA    *IBASE+1  MULTIPLE EXIT?
0393  284D 9257 28A5         SUB    TEMP
0394  284E 2123 2872         JAZ    PRROUT    YES, DO PRIORITY
0395  284F B6A8 27A7         LDA    I         NO, LOOP COMPLETE?
0396  2850 96A5 27AB         SUB    IMAX
0397  2851 314B 2846         JAN    RSEE      NO, GET NEXT EXIT
```

```
2852 B79E 27B4  RSDD   LDA    *KBASE
2853 90B7 00B7         SUB    ENTR      FINAL UNIT ROUTE?
2854 211A 286F         JAZ    RSFF      YES
2855 0350              ARP              NO. FIND NEXT ROUTE
2856 9EAF 27A7         STA    I         I = 1
2857 B6C7 27B0         LDA    BENTAV    SET I POINTERS
2858 9EA9 27AF         STA    IBASE
2859 0150              IAR
285A 9EAA 27B0         STA    IBASE+1
285B B7AB 27B0  RSHH   LDA    *IBASE+1  LOOK FOR NEXT RT
285C 97A8 27B4         SUB    *KBASE
285D 210A 2868         JAZ    RSII      FOUND
285E B6B7 27A7         LDA    I         TABLE COMPLETE?
285F 96B4 27AB         SUB    IMAX
2860 2169 2837         JAZ    RSCC      YES
2861 DEBA 27A7         IMS    I         NO. INC I POINTERS
2862 DEBB 27A7         IMS    I
2863 DEB4 27AF         IMS    IBASE
2864 DEB5 27AF         IMS    IBASE
2865 DEB5 27B0         IMS    IBASE+1
2866 DEB6 27B0         IMS    IBASE+1
2867 F60C 285B         JMP    RSHH      GET NEXT EXIT
2868 DEBF 27A9  RSII   IMS    K         INC K POINTERS TO
2869 DEC0 27A9         IMS    K         STORE NEW ROUTE
286A DEB6 27B4         IMS    KBASE
286B DEB7 27B4         IMS    KBASE
286C DEB7 27B5         IMS    KBASE+1
286D DEB8 27B5         IMS    KBASE+1
286E F630 283E         JMP    RSBB      GO STORE ROUTE
286F B6C6 27A9  RSFF   LDA    K         SET MAXK FOR SETUP
2870 0150              IAR
2871 F638 2839         JMP    RSJJJ     EXIT
                *
                *
                *
                *                 PRIORITY ROUTE ROUTINE
                *
                *
                *          THIS ROUTINE SELECTS THE PREFERRED PAT-
                *          BETWEEN THE ENTRANCE AND THE EXIT WHEN
                *          MORE THAN ONE PATH EXISTS.
                *
                *
                *
2872 0350       PRROUT ARP
2873 9A2E 28A2         STA    N         N = 1
2874 B22C 28A1         LDA    APRIOR
2875 9A2E 28A4         STA    NBASE     PRIOR TABLE POINTER
2876 B22F 28A5  PRA    LDA    TEMP
2877 932C 28A4         SUB    *NBASE    FIND ROUTE IN PRIOR
2878 210A 2883         JAZ    PRC       FOUND
2879 B228 28A2         LDA    N         TABLE COMPLETE?
287A 9228 28A3         SUB    NMAX
287B 2123 289F         JAZ    PRB       YES
287C DA25 28A2         IMS    N         NO. INC N POINTERS
287D DA24 28A2         IMS    N
287E DA23 28A2         IMS    N
287F DA24 28A4         IMS    NBASE
2880 DA23 28A4         IMS    NBASE
2881 DA22 28A4         IMS    NBASE
2882 F60C 2876         JMP    PRA       CHECK NEXT ENTRY
2883 DA1E 28A2  PRC    IMS    N
2884 DA1F 28A4         IMS    NBASE     SECOND WORD
2885 0350              ARP
2886 9EDF 27A7         STA    I         I = 1
2887 B21E 28A6         LDA    BENTAV    SET J POINTERS
2888 9ED9 27AF         STA    IBASE
```

```
0466  2889 0150              IAR
0467  288A 9EDA 27B0         STA    IBASE+1
0468  288B B318 28A4  PRD    LDA    *NBASE    PR ENT
0469  288C 97DD 27AF         SUB    *IBASE    ENTAV ENT
0470  288D 210A 2898         JAZ    PRE       FIRST CHOICE OK
0471  288E B6E7 27A7         LDA    I         TABLE COMPLETE?
0472  288F 96E4 27AB         SUB    IMAX
0473  2890 210A 289B         JAZ    PRF       YES, USE SECOND CHOICE
0474  2891 DEEA 27A7         IMS    I         INC I POINTERS
0475  2892 DEEB 27A7         IMS    I
0476  2893 DEE4 27AF         IMS    IBASE
0477  2894 DEE5 27AF         IMS    IBASE
0478  2895 DEE5 27B0         IMS    IBASE+1
0479  2896 DEE6 27B0         IMS    IBASE+1
0480  2897 F60C 288B         JMP    PRD       CHECK NEXT ROUTE
0481  2898 B30B 28A4  PRE    LDA    *NBASE    FIRST CHOICE
0482  2899 9FE5 27B4         STA    *KBASE
0483  289A F203 289E         JMP    PRG
0484  289B DA08 28A4  PRF    IMS    NBASE
0485  289C B307 28A4         LDA    *NBASE    SECOND CHOICE
0486  289D 9FE5 27B4         STA    *KBASE
0487  289E F64C 2852  PRG    JMP    RSND      RETURN TO RTSEL
0488  289F 0800       PRB    HLT              ****** ILLEGAL HALT
0489  28A0 F602 289E         JMP    PRG
0490                  *
0491                  *
0492  28A1 28A7       APRIOR DATA   PRIOR
0493                  *
0494  28A2 0000       N      DATA   0         INDEX ON PRIOR TABLE
0495  28A3 000D       NMAX   DATA   13        # IN TABLE + 1
0496  28A4 0000       NBASE  DATA   0         POINTER FOR PRIOR TABLE
0497                  *
0498  28A5 0000       TEMP   DATA   0         TEMP EXIT STORAGE
0499  28A6 279D       BENTAV DATA   ENTAV     ADDRESS POINTER
0500                  *
0501                  *
0502                  *
0503                  *              PRIORITY ROUTE TABLE
0504                  *
0505                  *
0506                  *        THIS TABLE CONTAINS ALL MULTIPLE
0507                  *        ROUTES. EACH ROUTE HAS A TABLE
0508                  *        WITH THE PREFERRED ROUTE FIRST.
0509                  *        THE PRIORITY CAN BE CHANGED BY
0510                  *        CHANGING THE ORDER IN THE TABLE.
0511                  *
0512                  *
0513  28A7 0102       PRIOR  DATA   :0102    EXIT     102
0514  28A8 0108              DATA   :0108    FIRST    108
0515  28A9 0106              DATA   :0106    SECOND   106
0516  28AA 0202              DATA   :0202    EXIT     202
0517  28AB 0206              DATA   :0206    FIRST    206
0518  28AC 0208              DATA   :0208    SECOND   208
0519  28AD 0116              DATA   :0116    EXIT     116
0520  28AE 0112              DATA   :0112    FIRST    112
0521  28AF 0110              DATA   :0110    SECOND   110
0522  28B0 0216              DATA   :0216    EXIT     216
0523  28B1 0210              DATA   :0210    FIRST    210
0524  28B2 0212              DATA   :0212    SECOND   212
0525                  *
0526  28B3 50D0       AMAXKT DATA   :50D0    MAXKT TABLE ADDRESS
0527  28B4 50F0       ARQFLG DATA   :50F0    RQFLG TABLE ADDRESS
0528  28B5 5B80       AROUTT DATA   :5B80    ROUT TABLE ADDRESS
0529  28B6 0000       BIAS   DATA   0
0530  28B7 0000       CNT    DATA   0
0533                  *
0534                  *
```

```
0535                        *        SETUP CONTROL PROGRAM
0536                        *
0537                        *      THIS PROGRAM SEARCHES THE MAXKT TABLE
0538                        *      TO SEE IF ROUTES NEED TO BE SET UP. IF
0539                        *      ONE OR MORE OF THE MAXK LOCATIONS CON-
0540                        *      TAIN A NUMBER OF UNIT ROUTES, THE RSTUP
0541                        *      PROGRAM POINTERS ARE STORED AND THEN
0542                        *      THE RSTUP ROUTINE IS CALLED. EACH OF
0543                        *      THE STATION MAXK LOCATIONS IS CHECKED
0544                        *      ONCE EACH PROGRAM CYCLE
0545                        *
0546                        *
0547  28E8                        ABS    :28E8
0548  28E8 0800             RTCON  ENT
0549  28E9 C710                    LAM    16
0550  28EA 9E33 28B7               STA    CNT       CHECK ALL 15 STATIONS
0551  28EB 0110                    ZAR
0552  28EC 9E36 28B6               STA    BIAS
0553  28ED B221 290F               LDA    ADLCLK
0554  28EE 9A22 2911               STA    DLCLK
0555  28EF B220 2910               LDA    ADLFLG
0556  28F0 9A21 2912               STA    DLFLG
0557  28F1 B63E 28B3               LDA    AMAXKT
0558  28F2 98B9 00B9               STA    MAXK      MAXK POINTER
0559  28F3 B1B9 00B9       RC2     LDA    *MAXK     GET MAXK
0560  28F4 2118 290D               JAZ    RC11      NO ROUTES
0561  28F5 B31C 2912               LDA    *DLFLG    IS TIMER STARTED?
0562  28F6 3103 28FA               JAN    RC4       YES
0563  28F7 9B19 2911               STA    *DLCLK    NO. START TIMER
0564  28F8 0150                    IAR
0565  28F9 9B18 2912               STA    *DLFLG    SET STARTED FLAG
0566  28FA B316 2911       RC4     LDA    *DLCLK    HAS DELAY ELAPSED?
0567  28FB 000A                    SAI    10        # OF .1 SEC DELAYS
0568  28FC 2088 2905               JAM    RC1       NO. WAIT
0569  28FD B649 28B4               LDA    ARQFLG    TABLE ADDRESS
0570  28FE 8E48 28B6               ADD    BIAS
0571  28FF 98BC 00BC               STA    RQFLG     POINTER
0572  2900 B64A 28B6               LDA    BIAS
0573  2901 1051                    ALA    2         MPY BY 4
0574  2902 8E4D 28B5               ADD    AROUTT    TABLE ADDRESS
0575  2903 98BD 00BD               STA    ROUT      POINTER
0576  2904 FA0E 2913               CALL   RSTUP     GO SET UP ROUTE
0577  2905 DE4E 28B7       RC1     IMS    CNT       FINISHED?
0578  2906 F201 2908               JMP    RC3       NO
0579  2907 F71F 28E8               RTN    RTCON     YES
0580  2908 DE52 28B6       RC3     IMS    BIAS      INC POINTERS
0581  2909 D8B9 00B9               IMS    MAXK
0582  290A DA06 2911               IMS    DLCLK
0583  290B DA06 2912               IMS    DLFLG
0584  290C F619 28F3               JMP    RC2
0585  290D 9B04 2912       RC11    STA    *DLFLG    ZERO DELAY FLAG
0586  290E F609 2905               JMP    RC1
0587                        *
0588                        *
0589        00B9            MAXK   EQU    :B9
0590        00BC            RQFLG  EQU    :BC
0591        00BD            ROUT   EQU    :BD
0592  290F 5290             ADLCLK DATA   :5290     .1 SEC CLOCK TABLE ADDR
0593  2910 52A0             ADLFLG DATA   :52A0     TIMER HAS STARTED FLAG
0594  2911 0000             DLCLK  DATA   0
0595  2912 0000             DLFLG  DATA   0
0597                        *
0598                        *
0599                        *
0600                        *                ROUTE SETUP ROUTINE
0601                        *
0602                        *
```

```
0602                    *        THIS ROUTINE SETS UP ROUTES DETERMINED
0604                    *        BY THE ROUTE SELECT ROUTINE. THE FOL-
0605                    *        LOWING SEQUENTIAL OPERATIONS ARE DONE
0606                    *
0607                    *        1. SWITCH POSITION REQUESTS ARE SENT
0608                    *
0609                    *        2. SWITCH POSITIONS ARE MONITORED
0610                    *           UNTIL IN THE REQUESTED POSITIONS.
0611                    *
0612                    *        3. LOCKOUTS ARE SET
0613                    *
0614                    *        4. ROUTE REQUEST IS SENT
0615                    *
0616                    *        5. GATE IS MONITORED UNTIL IT CLEARS
0617                    *
0618                    *        6. ROUTE IS MOVED TO ESTRT TABLE
0619                    *
0620                    *
0621  2913 0800         RSTUP  ENT
0622  2914 B1B9 00B9           LDA    *MAXK
0623  2915 212E 2944           JAZ    RAA      NO ROUTE
0624  2916 00D0                DAR
0625  2917 9AD4 29EC           STA    KMAX1    # OF RTS - 1
0626  2918 0250                ARP
0627  2919 9ACE 29E8           STA    K1       K = 1
0628  291A B0BD 00BD           LDA    ROUT
0629  291B 9AD8 29F4           STA    KBAS     ROUT ENT POINTER
0630  291C 0150                IAR
0631  291D 9AD7 29F5           STA    KBAS+1   ROUT EXIT POINTER
0632  291E 0250         RCC    ARP
0633  291F 9AC6 29E6           STA    I1       I = 1
0634  2920 B2B8 29D9           LDA    AENEX1
0635  2921 9ACC 29EE           STA    IBAS     ENEX ENT POINTER
0636  2922 0150                IAR
0637  2923 9ACB 29EF           STA    IBAS+1   ENEX EXIT POINTER
0638  2924 B2B5 29DA           LDA    AKEYS1
0639  2925 9ACA 29F0           STA    JBAS     SETUP KEY
0640  2926 0150                IAR
0641  2927 9AC9 29F1           STA    JBAS+1   SETUP KEY+1
0642  2928 B3C5 29EE   REE     LDA    *IBAS    COMPARE UNIT ROUTES
0643  2929 92DA 29F4           SUB    *KBAS    IN ROUT AND ENEX
0644  292A 3104 292F           JAN    RBB      ENT  NO MATCH
0645  292B B3C3 29EF           LDA    *IBAS+1
0646  292C 82B4 29E1           AND    POSNO1
0647  292D 93C7 29F5           SUB    *KBAS+1
0648  292E 2118 2947           JAZ    RDD      MATCH
0649  292F B2B6 29E6   RBB     LDA    I1       NO MATCH
0650  2930 92B9 29EA           SUB    IMAX1    I = IMAX?
0651  2931 2135 2967           JAZ    RDD      YES
0652  2932 DAB3 29E6           IMS    I1       NO. INC I POINTERS
0653  2933 DAB2 29E6           IMS    I1
0654  2934 DAB9 29EE           IMS    IBAS
0655  2935 DAB8 29EE           IMS    IBAS
0656  2936 DAB8 29EF           IMS    IBAS+1
0657  2937 DAB7 29EF           IMS    IBAS+1
0658  2938 DAB7 29F0           IMS    JBAS
0659  2939 DAB6 29F0           IMS    JBAS
0660  293A DABC 29F1           IMS    JBAS+1
0661  293B DAB5 29F1           IMS    JBAS+1
0662  293C F614 2928           JMP    REE
0663  293D 0110         RUU    ZAR              ZERO FLAGS
0664  293E 99D9 00B9           STA    *MAXK
0665  293F 9887 00B7           STA    ENTR
0666  2940 98B8 00B8           STA    EXIT
0667  2941 99BC 00BC           STA    *ROFLG
0668  2942 F201 2944           JMP    RAA
```

```
2943 0800        RFF   HLT                 ********* ILLEGAL HALT
2944 0110        RAA   ZAR
2945 9A9E 29E4         STA   REQFG
2946 F733 2913         RTN   RSTUP         ************
2947 B3A8 29F0   RDD   LDA   *JBAS
2948 9A9C 29E5         STA   WORD1         LOC OF INFO TABLE
2949 B3A7 29F1         LDA   *JBAS+1
294A 9AA0 29EB         STA   JMAX1         #OF INFO WORDS
294B 0350              ARP
294C 9A9A 29E7         STA   J1            J = 1
294D B397 29E5   RHH   LDA   *WORD1        GET INFO WORD
294E 208A 2959         JAM   RKK           NEG. INDICATION WORD
294F B294 29E4         LDA   REQFG         REQ WORD?
2950 2112 2963         JAZ   RHH1          YES
2951 B293 29E5         LDA   *WORD1
2952 FB8D 29E0   RHH2  CALL  *APACK1       NO.PUT BIT INTO WORD
2953 B293 29E7   RHH3  LDA   J1
2954 9296 29EB         SUB   JMAX1         TABLE DONE?
2955 2111 2967         JAZ   ROO           YES
2956 DA90 29E7         IMS   J1            NO. INC POINTERS
2957 DA8D 29E5         IMS   WORD1
2958 F60B 294D         JMP   RHH           GET NEXT WORD
2959 0350        RKK   ARP
295A 9A89 29E4         STA   REQFG         SW REQUESTS SENT FLAG
295B B1BC 00BC         LDA   *RQFLG        SW REQ BEEN SENT?
295C 210A 2967         JAZ   ROO           NO
295D B387 29E5         LDA   *WORD1        YES. CHECK IF SW IN POS
295E FB80 29DF         CALL  *FETCHA
295F 215B 2944         JAZ   RAA           NO.RETURN
2960 DA86 29E7         IMS   J1            INC POINTERS
2961 DA83 29E5         IMS   WORD1
2962 F615 294D         JMP   RHH           GET NEXT INFO WORD
2963 B1BC 00BC   RHH1  LDA   *RQFLG        REQ BEEN SENT?
2964 3151 2953         JAN   RHH3          YES
2965 B37F 29E5         LDA   *WORD1        NO
2966 F614 2952         JMP   RHH2
2967 B280 29E8   ROO   LDA   K1
2968 9283 29EC         SUB   KMAX1         ALL ROUTES DONE?
2969 2109 2973         JAZ   RTT           YES
296A DA7D 29E8         IMS   K1            NO. INC K POINTERS
296B DA7C 29E8         IMS   K1
296C DA87 29F4         IMS   KBAS
296D DA86 29F4         IMS   KBAS
296E DA86 29F5         IMS   KBAS+1
296F DA85 29F5         IMS   KBAS+1
2970 0110              ZAR
2971 9A72 29F4         STA   REQFG
2972 F654 291E         JMP   RCC           GET NEXT UNIT ROUTE
2973 B1BC 00BC   RTT   LDA   *RQFLG        FIRST PASS?
2974 3103 2978         JAN   RSS           NO
2975 0350              ARP                 YES. SET FLAG = 1
2976 99BC 00BC         STA   *RQFLG
2977 F633 2944         JMP   RAA           EXIT
2978 B1B9 00B9   RSS   LDA   *MAXK
2979 00D0              DAR
297A 9A71 29EC         STA   KMAX1         # OF UNIT ROUTES
297B 0350              ARP
297C 9A6B 29E8         STA   K1            K = 1
297D 9A6B 29E9         STA   N1            N = 1
297E B0BD 00BD         LDA   ROUT          SET K POINTER
297F 9A74 29F4         STA   KBAS          ROUT ENT
2980 0150              IAR
2981 9A73 29F5         STA   KBAS+1        ROUT EXIT
2982 B259 29DC         LDA   AESTR         SET N POINTERS
2983 9A72 29F6         STA   NBAS          ESTRT ENT
2984 0150              IAR
2985 9A71 29F7         STA   NBAS+1        ESTRT EXIT
```

```
0736  2986 B256 29DD        LDA   AESTKE
0737  2987 9A70 29F8        STA   OBAS     ESTKEY
0738  2988 0150             IAR
0739  2989 9A6F 29F9        STA   OBAS+1   ESTKEY+1
0740  298A B253 29DE        LDA   AESTT
0741  298B 9A6E 29FA        STA   PBAS     ESTTK
0742  298C 0350       RVV   ARP
0743  298D 9A58 29E6        STA   I1       SET I POINTERS
0744  298E B24A 29D9        LDA   AENEX1
0745  298F 9A5E 29EE        STA   IBAS     ENEX ENT
0746  2990 0150             IAR
0747  2991 9A5D 29EF        STA   IBAS+1   ENEX EXIT
0748  2992 B247 29DA        LDA   AKEYS1
0749  2993 9A5C 29F0        STA   JBAS     KEYS
0750  2994 0150             IAR
0751  2995 9A5B 29F1        STA   JBAS+1   KEYS+1
0752  2996 B244 29DB        LDA   ATKO
0753  2997 9A5A 29F2        STA   SBAS     EXIT TK OKT
0754  2998 B355 29EE  RWW   LDA   *IBAS    ENEX ENT = ROUT ENT?
0755  2999 935A 29F4        SUB   *KBAS
0756  299A 3104 299F        JAN   RXX      NO
0757  299B B353 29EF        LDA   *IBAS+1  ENEX EXIT = ROUT EXIT?
0758  299C 8244 29E1        AND   POSN01
0759  299D 9357 29F5        SUB   *KBAS+1
0760  299E 2110 29AF        JAZ   RYY      YES
0761  299F B246 29E6  RXX   LDA   I1       NO. TABLE DONE?
0762  29A0 9249 29EA        SUB   IMAX1
0763  29A1 3101 29A3        JAN   RFFF     NO
0764  29A2 F200 29A3        JMP   RFFF     YES. ILLEGAL **********
0765  29A3 DA42 29E6  RFFF  IMS   I1       NO. INC I POINTERS
0766  29A4 DA41 29E6        IMS   I1
0767  29A5 DA48 29EE        IMS   IBAS
0768  29A6 DA47 29EE        IMS   IBAS
0769  29A7 DA47 29EF        IMS   IBAS+1
0770  29A8 DA46 29EF        IMS   IBAS+1
0771  29A9 DA46 29F0        IMS   JBAS
0772  29AA DA45 29F0        IMS   JBAS
0773  29AB DA45 29F1        IMS   JBAS+1
0774  29AC DA44 29F1        IMS   JBAS+1
0775  29AD DA44 29F2        IMS   SBAS
0776  29AE F616 2998        JMP   RWW
0777  29AF B346 29F6  RYY   LDA   *NBAS    ESTRT TABLE = 0?
0778  29B0 2110 29C1        JAZ   RZZ      YES. GO STORE
0779  29B1 B277 29E9        LDA   N1       NO. TABLE FULL?
0780  29B2 923A 29ED        SUB   NMAX1
0781  29B3 3101 29B5        JAN   RFF1     NO
0782  29B4 F671 2943        JMP   RFF      YES. ILLEGAL
0783  29B5 DA33 29E9  RFF1  IMS   N1       NO. INC N POINTERS
0784  29B6 DA32 29E9        IMS   N1
0785  29B7 DA3E 29F6        IMS   NBAS
0786  29B8 DA3D 29F6        IMS   NBAS
0787  29B9 DA3D 29F7        IMS   NBAS+1
0788  29BA DA3C 29F7        IMS   NBAS+1
0789  29BB DA3C 29F8        IMS   OBAS
0790  29BC DA3B 29F8        IMS   OBAS
0791  29BD DA3B 29F9        IMS   OBAS+1
0792  29BE DA3A 29F9        IMS   OBAS+1
0793  29BF DA3A 29FA        IMS   PBAS
0794  29C0 F611 29AF        JMP   RYY
0795  29C1 B32C 29EE  RZZ   LDA   *IBAS    ENEX ENT
0796  29C2 9B33 29F6        STA   *NBAS    ESTRT ENT
0797  29C3 B32B 29EF        LDA   *IBAS+1  ENEX EXIT
0798  29C4 9B32 29F7        STA   *NBAS+1  ESTRT EXIT
0799  29C5 B32A 29F0        LDA   *JBAS    KEYS
0800  29C6 9B31 29F8        STA   *OBAS    ESTKEY
0801  29C7 B329 29F1        LDA   *JBAS+1  KEYS+1
0802  29C8 9B30 29F9        STA   *OBAS+1  ESTKEY+1
```

```
29C9 B328 29F2          LDA    *SBAS     TKO
29CA 9B2F 29FA          STA    *PBAS     ESTTK
29CB 0110               ZAR              ZERO ROUT TABLE
29CC 9B27 29F4          STA    *KBAS     ENT
29CD 9B27 29F5          STA    *KBAS+1   EXIT
29CE B719 29E8          LDA    K1
29CF 921C 29EC          SUB    KMAX1     ROUT DONE?
29D0 3101 29D2          JAN    RUU1      NO
29D1 F694 293D          JMP    RUU       YES, EXIT
29D2 DA15 29E8  RUU1    IMS    K1        NO, INC K POINTERS
29D3 DA14 29E8          IMS    K1
29D4 DA1F 29F4          IMS    KBAS
29D5 DA1E 29F4          IMS    KBAS
29D6 DA1E 29F5          IMS    KBAS+1
29D7 DA1D 29F5          IMS    KBAS+1
29D8 F64C 298C          JMP    RVV
                *
                *
29D9 5300       AENEX1  DATA   ENEX      ENEX POINTERS
29DA 52C0       AKEYS1  DATA   KEYS
29DB 5420       ATKO    DATA   TKO
                *
29DC 5880       AESTR   DATA   :5880     ESTRT POINTERS
29DD 58A0       AESTKE  DATA   :58A0
29DE 58C0       AESTT   DATA   :58C0
                *
29DF 5900       FETCHA  DATA   :5900
29E0 5910       APACK1  DATA   :5910
                *
29E1 7FFF       POSNO1  DATA   :7FFF     POSITIVE BITS
29E2 0000       COMPFG  DATA   0         ROUTING IS COMPLETE
29E3 07C0       GBIAS   DATA   :07C0     RR TO GK BIAS
29E4 0000       REQFG   DATA   0         SW REQ HAVE BEEN SENT
                *
29E5 0000       WORD1   DATA   0         POINTER TO INFO TABLES
                *
29E6 0000       I1      DATA   0         INDEX ON ENEX,ETC
29E7 0000       J1      DATA   0         INDEX ON INFO TABLES
29E8 0000       K1      DATA   0         INDEX ON ROUT
29E9 0000       N1      DATA   0         INDEX ON ESTRT,ETC
                *
29EA 004B       IMAX1   DATA   75        2 * # OF RT - 1
29EB 0000       JMAX1   DATA   0         NO  OF INFO WORDS
29EC 0000       KMAX1   DATA   0         2 * # OF RT -1 ROUT
29ED 001F       NMAX1   DATA   31        MAX.  # OF RT IN ESTRT
                *
29EE 0000       IBAS    DATA   0         ENT       ENEX TABLE
29EF 0000               DATA   0         EXIT
29F0 0000       JBAS    DATA   0         KEY
29F1 0000               DATA   0         KEY+1
29F2 0000       SBAS    DATA   0         TK
29F3 0000               DATA   0         SPARE
29F4 0000       KBAS    DATA   0         ENT      ROUT TABLE
29F5 0000               DATA   0         EXIT
29F6 0000       NBAS    DATA   0         ENT      ESTRT TABLE
29F7 0000               DATA   0         EXIT
29F8 0000       OBAS    DATA   0         KEY
29F9 0000               DATA   0         KEY+1
29FA 0000       PBAS    DATA   0         TK
29FB 0000               DATA   0         SPARE
                *
                *
                *            ROUTE CANCEL ROUTINE
                *
                *      THIS ROUTINE PERFORMS FIVE FUNCTIONS
                *
                *      1. SWITCH POSITION REQUESTS AND ROUTE
                *         REQUESTS ARE CANCELLED TRACK CIRCUIT
                *         BY TRACK CIRCUIT AS A TRAIN TAKES A
                *         ROUTE.
```

```
0874                        *
0875                        *        2. THE ROUTE IS CANCELLED FROM THE EST-
0876                        *           ABLISHED ROUTE TABLE (ESTRT) WHEN THE
0877                        *           EXIT TRACK CIRCUIT FOR A UNIT ROUTE
0878                        *           BECOMES OCCUPIED.
0879                        *
0880                        *        3. LOCKOUTS ARE CANCELLED WHEN THE ASSOC-
0881                        *           IATED TRACK CIRCUIT BECOMES OCCUPIED.
0882                        *           THIS ROUTINE WAS MOVED TO ETC.
0883                        *
0884                        *        4. SWITCH REQUESTS ARE CANCELLED WHEN
0885                        *           SWITCH PBS ARE PRESSED.
0886                        *
0887                        *        5. GATE REQUESTS ARE CANCELLED WHEN
0888                        *           GATE PBS ARE PRESSED.
0889                        *
0890                        *
0891  2A00                        ABS     :2A00
0892  2A00 0800          RTCAN   ENT
0893  2A01 0350                  ARP
0894  2A02 9A69 2A6C            STA     I2        I = 1
0895  2A03 B270 2A74            LDA     ATKCAN
0896  2A04 9A5F 2A64            STA     BASEI     TKCAN TABLE POINTER
0897  2A05 B26F 2A75            LDA     AKEYC
0898  2A06 9A5E 2A65            STA     BASEI+1   KEY TABLE POINTER
0899  2A07 0150                  IAR
0900  2A08 9A5D 2A66            STA     BASEI+2   KEY+1 POINTER
0901  2A09 B35A 2A64    TKC1    LDA     *BASEI    TK OCC ?
0902  2A0A FB6E 2A79            CALL    *BFETCH
0903  2A0B 210E 2A1A            JAZ     TKC2      NO, GET NEXT TK
0904  2A0C B358 2A65            LDA     *BASEI+1  YES, CANCEL ROUTE
0905  2A0D 9A63 2A71            STA     AWORD     TABLE LOCATION
0906  2A0E B357 2A66            LDA     *BASEI+2
0907  2A0F 9A62 2A72            STA     MAXJ      # OF WORDS
0908  2A10 0350                  ARP
0909  2A11 9A5B 2A6D            STA     J2
0910  2A12 B35E 2A71    TKC3    LDA     *AWORD    WORD/BIT
0911  2A13 FB66 2A7A            CALL    *BPACK0   CANCEL BIT
0912  2A14 B258 2A6D            LDA     J2
0913  2A15 925C 2A72            SUB     MAXJ      ROUTE DONE ?
0914  2A16 2103 2A1A            JAZ     TKC2      YES, CHECK NEXT ROUTE
0915  2A17 DA55 2A6D            IMS     J2        NO, GET NEXT WORD
0916  2A18 DA58 2A71            IMS     AWORD
0917  2A19 F607 2A12            JMP     TKC3
0918  2A1A B251 2A6C    TKC2    LDA     I2
0919  2A1B 9253 2A6F            SUB     NOTK      TK TABLE DONE ?
0920  2A1C 2107 2A24            JAZ     PART2     YES
0921  2A1D DA4E 2A6C            IMS     I2        NO, INC POINTERS
0922  2A1E DA45 2A64            IMS     BASEI
0923  2A1F DA45 2A65            IMS     BASEI+1
0924  2A20 DA44 2A65            IMS     BASEI+1
0925  2A21 DA44 2A66            IMS     BASEI+2
0926  2A22 DA43 2A66            IMS     BASEI+2
0927  2A23 F61A 2A09            JMP     TKC1
0928  2A24 0350          PART2   ARP               INITIALIZE POINTERS
0929  2A25 9A48 2A6E            STA     N2        N = 1
0930  2A26 B24F 2A76            LDA     BESTRT
0931  2A27 9A3F 2A67            STA     BASEN     ESTRT
0932  2A28 0150                  IAR
0933  2A29 9A3E 2A68            STA     BASEN+1
0934  2A2A B24C 2A77            LDA     BSTKEY
0935  2A2B 9A3D 2A69            STA     BASEO     ESTKEY
0936  2A2C 0150                  IAR
0937  2A2D 9A3C 2A6A            STA     BASEO+1
0938  2A2E B249 2A78            LDA     BESTTK
0939  2A2F 9A3B 2A6B            STA     BASEP     ESTTK
0940  2A30 B33A 2A6B    TKC4    LDA     *BASEP
```

```
0941  2A31 2108 2A3A          JAZ    TKC5
0942  2A32 FB46 2A79          CALL   *BFETCH   IS TK OCC ?
0943  2A33 2106 2A3A          JAZ    TKC5      NO, CHECK IF DONE
0944  2A34 0110               ZAR              YES, CANCEL ROUTE
0945  2A35 9B31 2A67          STA    *BASEN
0946  2A36 9B31 2A68          STA    *BASEN+1
0947  2A37 9B31 2A69          STA    *BASEO
0948  2A38 9B31 2A6A          STA    *BASEO+1
0949  2A39 9B31 2A6B          STA    *BASEP
0950  2A3A B233 2A6E  TKC5    LDA    N2       LOOP COMPLETE ?
0951  2A3B 9234 2A70          SUB    MAXN
0952  2A3C 210C 2A49          JAZ    PART4    YES
0953  2A3D DA30 2A6E          IMS    N2       NO, INC POINTERS
0954  2A3E DA2F 2A6E          IMS    N2
0955  2A3F DA27 2A67          IMS    BASEN
0956  2A40 DA26 2A67          IMS    BASEN
0957  2A41 DA26 2A68          IMS    BASEN+1
0958  2A42 DA25 2A68          IMS    BASEN+1
0959  2A43 DA25 2A69          IMS    BASEO
0960  2A44 DA24 2A69          IMS    BASEO
0961  2A45 DA24 2A6A          IMS    BASEO+1
0962  2A46 DA23 2A6A          IMS    BASEO+1
0963  2A47 DA23 2A6B          IMS    BASEP
0964  2A48 F618 2A30          JMP    TKC4     GET NEXT EXIT TK
0966                   *
0967                   *
0968                   *     SWITCH REQUEST CANCEL
0969                   *
0970                   *     THIS ROUTINE CANCELS NLP AND RLP REQUESTS
0971                   *     WHENEVER A SWITCH REQUEST PB IS PRESSED.
0972                   *
0973                   *
0974  2A49 B30B 2A55  PART4  LDA    *NPB     PUT PB WORDS TOGETHER
0975  2A4A A30B 2A56         IOR    *RPB
0976  2A4B 0210               CAR
0977  2A4C 0048               TAX
0978  2A4D 8305 2A53         AND    *NLP     RESET BITS
0979  2A4E 9B04 2A53         STA    *NLP     NEW NLP
0980  2A4F 0030               TXA
0981  2A50 8303 2A54         AND    *RLP     RESET BITS
0982  2A51 9B02 2A54         STA    *RLP     NEW RLP
0983  2A52 F204 2A57         JMP    PART5
0984                   *
0985                   *
0986  2A53 510E        NLP    DATA   :510E    NLP OUTPUT WORD
0987  2A54 510F        RLP    DATA   :510F    RLP OUTPUT WORD
0988  2A55 525C        NPB    DATA   :525C    NOR PB INPUT WORD
0989  2A56 525D        RPB    DATA   :525D    REV PB INPUT WORD
0990                   *
0991                   *        GATE REQUEST CANCEL
0992                   *
0993                   *     THE COMPUTER GATE REQUEST IS CANCELLED
0994                   *     WHEN A GATE REQUEST PB IS PRESSED ON.
0995                   *
0996                   *
0997  2A57 B308 2A60  PART5  LDA    *GPB1    GATE PB WORD 1
0998  2A58 0210               CAR
0999  2A59 8308 2A62         AND    *RR1     RESET REQUEST
1000  2A5A 9B07 2A62         STA    *RR1     NEW RR
1001  2A5B B305 2A61         LDA    *GPB2    GATE PB WORD 2
1002  2A5C 0210               CAR
1003  2A5D 8305 2A63         AND    *RR2     RESET REQUEST
1004  2A5E 9B04 2A63         STA    *RR2     NEW RR
1005  2A5F F75F 2A00         RTN    RTCAN
1006                   *
1007                   *
```

```
2A60 5044        GPB1    DATA    :5044    GATE RQ PB WENT TO 1
2A61 5045        GPB2    DATA    :5045
2A62 510C        RR1     DATA    :510C    COMP GATE REQ OUTPUT
2A63 510D        RR2     DATA    :510D
                 *
                 *
2A64 0000        BASEI   DATA    0        TKCAN TABLE POINTER
2A65 0000                DATA    0        KEYC POINTER
2A66 0000                DATA    0        KEYC+1 POINTER
                 *
2A67 0000        BASEN   DATA    0        ESTRT ENTRANCE POINTER
2A68 0000                DATA    0        EXIT
2A69 0000        BASEU   DATA    0        KEY
2A6A 0000                DATA    0        KEY+1
2A6B 0000        BASEP   DATA    0        TK
                 *
                 *
2A6C 0000        I2      DATA    0        TKCAN TABLE INDEX
2A6D 0000        J2      DATA    0        CAN INFO TABLES
2A6E 0000        N2      DATA    0        ESTRT TABLE
                 *
2A6F 000C        NOTK    DATA    12       # IN TKCAN
2A70 001F        MAXN    DATA    31       # IN ESTRT - 1
                 *
2A71 0000        ANORD   DATA    0        CANCEL INFO TABLES POINTER
2A72 0000        MAXJ    DATA    0        # OF WORDS IN TABLE
                 *
2A73 FFFF        MASK    DATA    :FFFF
                 *
                 *
2A74 5800        ATKCAN  DATA    :5800
2A75 5810        AKEYC   DATA    :5810
                 *
2A76 5880        BESTRT  DATA    :5880
2A77 58A0        BSTKEY  DATA    :58A0
2A78 5800        BESTTK  DATA    :5800
                 *
2A79 5900        BFETCH  DATA    :5900
2A7A 5920        BPACK0  DATA    :5920
                 *
5823                     ABS     :5823    SUBROUTINE CALL FOR EXC A
5823 28E8                DATA    RTCON    ROUTE SETUP ROUTINE
5824 2A00                DATA    RTCAN    ROUTE CANCEL ROUTINE
                 *
                         END

ERRORS
WARNING
                 *
                 *
                 *        STATION LOGIC PROGRAMS  (ONE FOR EACH STATION)
                 *
                 *        THIS PROGRAM PERFORMS ALL NECESSARY LOGIC
                 *        TO PROCESS A TRAIN THROUGH THE STATION.
                 *        IT IS BROKEN DOWN INTO THREE ROUTINES:
                 *
                 *        1.  STATION ENTRY LOGIC
                 *
                 *        2.  IN STATION LOGIC
                 *
                 *        3.  STATION EXIT LOGIC
                 *
                 *        THE STATION ENTRY ROUTINE USES APPROACH
                 *        TRACK CIRCUITS TO SEE IF A RUN THRU IS IN
                 *        EFFECT IN ORDER TO SET UP REQUIRED ROUTES
                 *        IN TIME SO THAT A TRAIN DOESNT STOP AT A
```

```
*        GATE. OTHERWISE A TRAIN IS CHECKED INTO THE
*        STATION AND THE DWELL TIME STARTED WHEN
*        THE DOORS OPEN.
*
*        THE IN STATION ROUTINE DETERMINES THE
*        NEXT STATION AND SELECTS THE ROUTE
*        REQUIRED TO REACH THAT STATION.
*
*        THE STATION EXIT ROUTINE CHECKS THE
*        TRAIN OUT OF THE STATION WHEN: THERE
*        ARE NO MANUAL HOLDS, THE TRACK IS CLEAR
*        TO THE NEXT STATION, THE DWELL TIME HAS
*        EXPIRED, AND THE HEADWAY PERMITS.
*
*
*        THE FOLLOWING ROUTINES ARE USED:
*
*        1.  NMELOG   STATION ENTRY ROUTINE
*
*        2.  NMILOG   IN STATION ROUTINE
*
*        3.  NMXLOG   STATION EXIT ROUTINE
*
*        4.  RTAV     ROUTE AVAILABLE ROUTINE
*
*        5.  RTSEL    ROUTE SELECT ROUTINE
*
*           NM = STATION NAME
*
*        THESE TABLES ARE USED:
*
*        1.  STATUS   STATUS WORDS
*        2.  BIT0     BIT MASK TABLE
*        3.  NBIT0    NOT BIT MASK TABLE
*        4.  MAXKT    MAXK STORAGE TABLE
*        5.  ROUT     ROUTE STORAGE TABLE
*        6.  STRLOC   STATION VS TRLOC TABLE
*        7.  DWCLK    STATION DWELL CLOCKS
*        8.  HDCLK    STATION HEADWAY CLOCKS
*        9.  TLCLK    TRAIN LATE CLOCKS
*       10.  DWTIM    STATION DWELL TIMES
*       11.  TRNO     TRAIN NUMBER TABLE
*       12.  TRLEN    TRAIN LENGTH TABLE
*
*        1.  TKIN     TRACK CIRCUIT INPUTS
*        2.  GKIN     GATE INPUTS
*        3.  HTDO     MAN HTDO PB INPUTS
*        4.  HOLD     MAN HOLD PB INPUTS
*        5.  RCYCL    MAN RECYCLE PB INPUTS
*        6.  CLOSE    CLOSE DOOR OUTPUTS
*        7.  OUTHT    HTDO OUTPUTS
*        8.  DIR      DIRECTION TABLE
*        9.  RNTHR    RUNTHRU PB INPUTS
*       10.  DRIN     DOOR OPEN INPUTS
*
*        1.  ERUN     RUNTIMES TO NEXT EAST STATION
*        2.  WRUN     RUNTIMES TO NEXT WEST STATION
*        3.  RUNTIM   RUNTIME TO STATION
*        4.  LTTRNO   LATE TRAIN # TO NEXT STATION
*        5.  STRTRN   STORE TRAIN
*        NORTH BAGGAGE STATION ENTRY ROUTINE
*
*        THIS ROUTINE PERFORMS THE FUNCTIONS
*        REQUIRED TO CHECK A TRAIN INTO THE
*        STATION OR TO PROVIDE FOR A RUNTHRU.
*        THIS LOGIC IS COMPLETE WHEN A RUN-
*        THRU IS DETECTED OR THE TRAIN DOORS
```

```
0088                        *       OPEN
0089                        *
0090  2B00                            ABS     :2B00
0091  2B00 0B00             NGELOG    ENT
0092  2B01 B24C 2B4E                  LDA     ASTAT     STATUS WORD TABLE ADD
0093  2B02 9B45 0045                  STA     WORD      STATUS WORD POINTER
0094  2B03 B145 0045                  LDA     *WORD     GET STATUS WORD
0095  2B04 0048                       TAX               SAVE
0096  2B05 8050 0050                  AND     BIT0+0    COMP FLAG = 1 ?
0097  2B06 312E 2B35                  JMN     NGE2      YES, EXIT
0098  2B07 0020             NGE1      TXA
0099  2B08 8053 0053                  AND     BIT0+3    STA OCC FLAG = 1 ?
0100  2B09 212D 2B37                  JAZ     NGE6      NO
0101  2B0A 0020                       TXA               YES, DWELL STARTED ?
0102  2B0B 8056 0056                  AND     BIT0+6
0103  2B0C 210E 2B18                  JAN     NGE10     YES, CHECK DWELL TIME
0104  2B0D B041 0041                  LDA     DRIN      NO, DOORS OPEN ?
0105  2B0E 8051 0051                  AND     BIT0+1
0106  2B0F 2126 2B26                  JAZ     NGE22     NO, EXIT
0107  2B10 B07E 2B4F       NGE4      LDA     *AOUTHT   YES
0108  2B11 A051 0051                  IOR     BIT0+1    SET HTDO BIT
0109  2B12 9B30 2B4F                  STA     *AOUTHT   STORE
0110  2B13 0110                       ZAR
0111  2B14 9B30 2B51                  STA     *ADWCLK   START DWELL TIMER
0112  2B15 0020                       TXA
0113  2B16 A054 0054                  IOR     BIT0+4    SET HTDO FLAG
0114  2B17 A055 0055                  IOR     BIT0+5    SET DOOR OPEN FLAG
0115  2B18 A056 0056                  IOR     BIT0+6    SET DWELL START FLAG
0116  2B19 0048                       TAX
0117  2B1A 9945 0045                  STA     *WORD
0118  2B1B B041 0041       NGE10     LDA     STRDFG    STORED TRAIN FLAG SET ?
0119  2B1C 8050 0050                  AND     BIT0+0    NO STA
0120  2B1D 210E 2B20                  JAZ     NGE7      NO, GO SET COMP FLAG
0121  2B1E B334 2B53                  LDA     *ADWTIM
0122  2B1F 2085 2B25                  JAM     NGE12     MANUAL DWELL
0123  2B20 9330 2B51                  SUB     *ADWCLK   DWELL EXPIRED ?
0124  2B21 3094 2B26                  JAP     NGE22     NO, WAIT
0125  2B22 B332 2B55                  LDA     *ACLOSE
0126  2B23 A051 0051                  IOR     BIT0+1    CLOSE DOOR OUTPUT
0127  2B24 9B30 2B55                  STA     *ACLOSE
0128  2B25 0020             NGE12     TXA
0129  2B26 8064 0064                  AND     NBIT0+4   HTDO FLAG
0130  2B27 9945 0045                  STA     *WORD
0131  2B28 0048                       TAX               SAVE
0132  2B29 B07E 2B4F                  LDA     *AOUTHT
0133  2B2A 8051 0051                  AND     NBIT0+1   RESET HTDO OUTPUT
0134  2B2B 9B30 2B4F                  STA     *AOUTHT
0135  2B2C 0110             NGE7      ZAR
0136  2B2D 9B34 2B52                  STA     *ARUNTM   RESET RUNTIME
0137  2B2E B321 2B50                  LDA     *RNFLG
0138  2B2F 8060 0060                  AND     NBIT0+0   RESET RUNTIME ALARM FLAG
0139  2B30 9B1F 2B50                  STA     *RNFLG
0140  2B31 0020                       TXA
0141  2B32 A050 0050       NGE5      IOR     BIT0+0    SET ENT COMP FLAG
0142  2B33 9945 0045       NGE2      STA     *WORD     STORE NEW STATUS
0143  2B34 0048                       TAX               SAVE
0144  2B35 B220 2B40       NGE22     JMP     NGELOG    NEXT ROUTINE
0145  2B36 B210 2B4D       NGE27     JMP     RNGENT    RETURN
0146  2B37 B00C 000C       NGE6      LDA     TKIN+0
0147  2B38 8054 0054                  AND     BIT0+4    CHECK E HP TK = 0?
0148  2B39 2100 2B40                  JAZ     NGE8      NOT OCC
0149  2B3A B080 0080                  LDA     DIP+0     OCC, CHECK DIP
0150  2B3B 8052 0052                  AND     BIT0+2    ST DIP
0151  2B3C 2100 2B40                  JAZ     NGE8      EAST
0152  2B3D B095 0095                  LDA     RNTHRU    NPSL, CHECK RUNTHRU
0153  2B3E 8051 0051                  AND     BIT0+1
0154  2B3F 2120 2B20                  JAN     NGE7      ON
```

```
0155  2B40 B09C 009C  NGE8   LDA    TKIN+0   OFF, CHECK STA OCC
0156  2B41 8053 0053         AND    BIT0+3   2T
0157  2B42 2140 2B36         JAZ    NGE22    NOT OCC
0158  2B43 B09C 009C         LDA    PBCLOS   CLOSE DOOR PB ON ?
0159  2B44 8051 0051         AND    BIT0+1
0160  2B45 2102 2B48         JAZ    NGE81    NO
0161  2B46 0110              ZAR             YES, RESET RUNTIME
0162  2B47 9B0A 2B52         STA    *ARUNTM
0163  2B48 0030       NGE81  TXA             OCC, GET STATUS
0164  2B49 A053 0053         IOR    BIT0+3   SET STA OCC FLAG
0165  2B4A 9945 0045         STA    *WORD
0166  2B4B 0048              TAX
0167  2B4C F616 2B36         JMP    NGE22
0168  2B4D F74D 2B00  ANGENT RTN    NGELOG   RETURN TO MAIN PROG
0169                  *
0170  2B4E 50C0       ASTAT  DATA   :50C0    NG STATION STATUS WORD
0171  2B4F 5112       AOUTHT DATA   :5112    HTDO OUTPUT
0172  2B50 5250       RNFLG  DATA   :5250    RUNTHRU ALARM FLAG WORD
0173  2B51 51C0       ADWCLK DATA   :51C0    DWELL TIME CLOCK
0174  2B52 5230       ARUNTM DATA   :5230    RUNTIME TABLE ADDRESS
0175  2B53 5050       ADWTIM DATA   :5050    DWELL TIME
0176  2B54 5270       AMINDW DATA   :5270    MINIMUM DWELL TIME
0177  2B55 5113       ACLOSE DATA   :5113    CLOSE DOOR OUTPUT
0179                  *
0180                  *
0181                  *      NORTH BAGGAGE IN STATION ROUTINE
0182                  *
0183                  *       THIS ROUTINE PERFORMS THE FUNCTIONS
0184                  *       REQUIRED TO CLEAR A ROUTE TO THE NEXT
0185                  *       STATION. THESE FUNCTIONS ARE DONE
0186                  *       DURING THE NORMAL DWELL TIME OR WHILE
0187                  *       THE STATION IS BEING RUNTHRU. DIRECTION,
0188                  *       NEXT STATION, AND ROUTE SELECTION ARE
0189                  *       THE FUNCTIONS.
0190                  *
0191                  *
0192  2B56 B0BA 00BA  NGILOG LDA    MODE
0193  2B57 20CA 2B4D         JAM    ANGENT   NO MODE, RETURN MAIN PROG
0194  2B58 B049 0049         LDA    DISPFG
0195  2B59 8050 0050         AND    BIT0+0   NG DISPATCH FLAG SET ?
0196  2B5A 3106 2B61         JAN    NGI1     YES, DO ROUTINE
0197  2B5B B041 0041         LDA    STRDFG   NO, CHECK STORED FLAG
0198  2B5C 8050 0050         AND    BIT0+0
0199  2B5D 3150 2B4D         JAN    ANGENT   ON, RETURN MAIN PROG
0200  2B5E B021 0021         LDA    INROUT   STATION IN ROUTE ?
0201  2B5F 8050 0050         AND    BIT0+0
0202  2B60 2153 2B4D         JAZ    ANGENT   NO, RETURN
0203  2B61 0030       NGI1   TXA             GET STATUS WORD
0204  2B62 8051 0051         AND    BIT0+1   IN COMP FLAG = 1 ?
0205  2B63 3135 2B99         JAN    NGI2     YES, EXIT
0206  2B64 0030       NGI3   TXA             GET STATUS
0207  2B65 8058 0058         AND    BIT0+8   NEXT STA DETERMINED ?
0208  2B66 3118 2B7F         JAN    NGI4     YES
0209  2B67 B0BA 00BA         LDA    MODE     NO, CHECK MODE
0210  2B68 82D8 2C41         AND    MMSK     MODE 30, 31 OR 30PP
0211  2B69 3107 2B71         JAN    NGI31    YES, NEXT = ST
0212  2B6A B049 0049         LDA    DISPFG
0213  2B6B 8050 0050         AND    BIT0+0   DISP FLAG ON ?
0214  2B6C 3104 2B71         JAN    NGI31    YES, NEXT=ST
0215  2B6D B2D7 2C45         LDA    NTEXT    NO, NEXT = NT
0216  2B6E 9AC4 2C33         STA    AEXIT    NT = 104
0217  2B6F C601              LAP    1        NTBIAS = 1
0218  2B70 F209 2B7A         JMP    NGI5-1
0219  2B71 B0C0 00C0  NGI31  LDA    STALK    IS EXIT AVAILABLE?
0220  2B72 8228 2B9B         AND    FIVE
0221  2B73 3126 2B9A         JAN    NGI22    NO
0222  2B74 B2D1 2C46         LDA    STEXT    YES
```

```
0223  2B75 9ABD 2C33          STA    AEXIT    ST = 204
0224  2B76 C602               LAP    2
0225  2B77 A0C0 00C0          IOR    STALK    SET NG LK
0226  2B78 98C0 00C0          STA    STALK    SET STA LOCKOUT
0227  2B79 C609               LAP    9        STBIAS = 9
0228  2B7A 9ADC 2C57          STA    NGNEXT   = NEXT STATION
0229  2B7B 0030        NGI5   TXA              GET STATUS
0230  2B7C A058 0058          IOR    BIT0+8   SET NEXT STA FLAG
0231  2B7D 9945 0045          STA    *WORD    STORE NEW STATUS
0232  2B7E 0048               TAX             SAVE
0233  2B7F 0030        NGI4   TXA              GET STATUS
0234  2B80 8059 0059          AND    BIT0+9   ROUTE BEEN SELECTED ?
0235  2B81 3113 2B95          JAN    NGI6     YES
0236  2B82 0110               ZAR             NO, STORE ENTR & EXIT
0237  2B83 984F 004F          STA    KMX
0238  2B84 B2BE 2C43          LDA    NGENT
0239  2B85 98B7 00B7          STA    ENTR     NG = 100
0240  2B86 B2AC 2C33          LDA    AEXIT
0241  2B87 98B8 00B8          STA    EXIT
0242  2B88 B2B3 2C3C          LDA    AMAXK    STORE ROUTE POINTERS
0243  2B89 98B9 00B9          STA    MAXK     TABLE ADDRESS POINTER
0244  2B8A B2B3 2C3E          LDA    AROUT    TABLE ADDRESS
0245  2B8B 98BD 00BD          STA    ROUT     ROUT TABLE POINTER
0246  2B8C B1B9 00B9          LDA    *MAXK    ANY OLD ROUTE ?
0247  2B8D 310C 2B9A          JAN    NGI22    YES, EXIT
0248  2B8E FBB0 2C3F          CALL   *ARTAV
0249  2B8F FBB0 2C40          CALL   *ARTSEL
0250  2B90 B1B9 00B9          LDA    *MAXK    ANY UNIT ROUTES ?
0251  2B91 2108 2B9A          JAZ    NGI22    NO
0252  2B92 0030        NGI61  TXA              YES
0253  2B93 A059 0059          IOR    BIT0+9   SET ROUTE SELECTED FLAG
0254  2B94 0048               TAX             SAVE
0255  2B95 0030        NGI6   TXA              GET STATUS
0256  2B96 A051 0051          IOR    BIT0+1   SET IN COMP FLAG
0257  2B97 9945 0045          STA    *WORD    STORE
0258  2B98 0048               TAX             SAVE
0259  2B99 F202 2B9C  NGI2    JMP    NGXLOG   STATION EXIT LOGIC
0260  2B9A F64D 2B4D  NGI22   JMP    ANGENT   RETURN
0261                  *
0262        00C0      STALK   EQU    :C0      STATION LOCKOUTS
0263  2B9B 0005       FIVE    DATA   5        NT+SG BITS
0265                  *
0266                  *
0267                  *
0268                  *       NORTH BAGGAGE STATION EXIT ROUTINE
0269                  *
0270                  *       THIS ROUTINE PERFORMS THE FUNCTIONS
0271                  *       REQUIRED TO CHECK A TRAIN OUT OF THE
0272                  *       STATION. DWELL TIME, HEADWAYS, NEXT
0273                  *       STATION CLEAR, AND NO MANUAL INT-
0274                  *       ERVENTION ARE THE CONDITIONS.
0275                  *
0276  2B9C 0030       NGXLOG TXA              GET STATUS WORD
0277  2B9D 8052 0052          AND    BIT0+2   COMP FLAG = 1 ?
0278  2B9E 3131 2BD0          JAN    NGX22    YES, EXIT
0279  2B9F B099 0098  NGX1   LDA    DRIN
0280  2BA0 8051 0051          AND    BIT0+1   DOORS OPEN ?
0281  2BA1 213F 2BE1          JAZ    NGX11    NO, BYPASS CHECKS
0282  2BA2 B2B4 2C57  NGX5   LDA    NGNEXT   NEXT STATION ?
0283  2BA3 00D0               DAR
0284  2BA4 2108 2BAD          JAZ    NGX53    NT
0285  2BA5 B08C 008C          LDA    TKIN+0   ST, CHECK TKS
0286  2BA6 82B2 2C59          AND    NGST
0287  2BA7 2101 2BA9          JAZ    NGX51    ST
0288  2BA8 F285 2C2E  NGX52   JMP    NGX2     NOT CLEAR
0289  2BA9 B08E 008E  NGX51   LDA    TKIN+2
0290  2BAA 82AF 2C5A          AND    NGST+1   28,29,30A OR 30BT
```

```
0291  2BAB 3143 2BA8          JAN   NGX52   NOT CLEAR
0292  2BAC F203 2B80          JMP   NGX7    ALL CLEAR
0293  2BAD B08C 008C  NGX53   LDA   TKIN+0  NT. CHECK TKS
0294  2BAE 8BA9 2C58          AND   NGNT    3 4.5A OR SET
0295  2BAF 3147 2BA8          JAN   NGX52   NOT CLEAR
0296  2B80 0030        NGX7   TXA
0297  2B81 805E 005E          AND   BIT0+E  ROUTE CLEAR FLAG = 1 ?
0298  2B82 3107 2BBA          JAN   NGX3    YES
0299  2B83 B088 0088          LDA   GKIN+0  NO. CHECK GATE X1B
0100  2B84 8051 0051          AND   BIT0+1
0101  2B85 2140 2BA8          JAZ   NGX52   X1B NOT CLEAR
0102  2B86 0030               TXA
0103  2B87 805F 005F          IOR   BIT0+F  SET ROUTE CLEARED FLAG
0104  2B88 9945 0045          STA   *WORD
0105  2B89 0048               TAX           SAVE
0106  2BBA 0030        NGX3   TXA           GET STATUS
0107  2B8B 8050 0050          AND   BIT0+D  HEADWAY COMP FLAG = 1 ?
0108  2B8C 3107 2BC4          JAN   NGX23   YES
0109  2B8D B03B 2049          LDA   *AHDCLK
0110  2B8E 90BF 00BF          SUB   HDWAY   HEADWAY ELAPSED ?
0111  2B8F 2007 2BA8          JAM   NGX52   NO. EXIT
0112  2B90 0030        NGX6   TXA
0113  2B91 8050 0050          IOR   BIT0+D  SET HDWAY COMP FLAG
0114  2B92 9945 0045          STA   *WORD   STORE NEW STATUS
0115  2B93 0048               TAX           SAVE
0116  2B94 B049 0049  NGX23   LDA   DISPFG  YES
0117  2B95 8050 0050          AND   BIT0+D  DISPATCH FLAG ON ?
0118  2B96 3108 2BD5          JAN   NGX8    YES. BYPASS TIMERS
0119  2B97 0030               TXA           NO
0120  2B98 8050 0050          AND   BIT0+D  DWELL COMP FLAG = 1 ?
0121  2B99 3108 2BD5          JAN   NGX8    YES
0122  2B9A B077 2B55          LDA   *ADWTIM
0123  2B9B 2044 2BF4          JAM   NGX120  MANUAL DWELL
0124  2B9C 9778 2B54          SUB   *ADWCLK DWELL TIME EXPIRED ?
0125  2B9D 2087 2BD1          JAM   NGX4    YES
0126  2B9E 9778 2B54          SUB   *MINDW  MINIMUM DWELL EXPIRED
0127  2B9F 2081 2BD1          JAM   NGX4    YES
0128  2BA0 F255 2B2E  NGX22   JMP   NGX2    NO. EXIT
0129  2BA1 0030        NGX4   TXA           GET STATUS
0130  2BA2 8050 0050          IOR   BIT0+D  SET DWELL COMP FLAG
0131  2BA3 9945 0045          STA   *WORD   STORE NEW STATUS
0132  2BA4 0048               TAX           SAVE
0133  2BA5 B09B 009B  NGX8    LDA   AHTDO
0134  2BA6 8051 0051          AND   BIT0+1
0135  2BA7 3148 2BA8          JAN   NGX52   MAN HTDO ON  EXIT
0136  2BA8 B09A 009A  NGX9    LDA   AHOLD
0137  2BA9 8051 0051          AND   BIT0+1
0138  2BAA 3177 2BA8          JAN   NGX52   MAN HOLD ON  EXIT
0139  2BAB B09D 009D  NGX10   LDA   ARCYCL
0140  2BAC 8051 0051          AND   BIT0+1  RECYCLE DOORS PS ?
0141  2BAD 3175 2BA8          JAN   NGX52   ON. EXIT
0142  2BAE B789 2B55  NGX12   LDA   *ACLOSE
0143  2BAF A051 0051          IOR   BIT0+1  CLOSE DOOR BIT
0144  2BB0 9B8B 2B55          STA   *ACLOSE
0145  2BB1 0030        NGX11  TXA
0146  2BB2 8064 0064          AND   NBIT0+4 RESET HTDO FLAG
0147  2BB3 9945 0045          STA   *WORD   NEW STATUS
0148  2BB4 0048               TAX           SAVE
0149  2BB5 B796 2B4F          LDA   *AOUTHT
0150  2BB6 8061 0061          AND   NBIT0-1 RESET HTDO OUTPUT
0151  2BB7 9B98 2B4F          STA   *AOUTHT
0152  2BB8 0110        NGX121 ZAP
0153  2BB9 9B5F 2049          STA   *AHDCLK START HEADWAY TIMER
0154  2BBA B750 2047  NGX13   LDA   *ASTRLC STA VS TRLOC
0155  2BBB 9B64 2050          STA   LOCADD  TRLOC POINTER
0156  2BBC B25F 2040          LDA   ATEND   TRAIN NUMBER TABLE-1
0157  2BBD 93BE 00BE          STA   DOG     ZERO PAGE POINTER
```

```
0358  2BEE EA43 2C32          STX    XSAV2
0359  2BEF B360 2C50          LDA    *LOCADD
0360  2BF0 C410               LXP    16
0361  2BF1 CDBE               SCM    DOG       FIND TRAIN # IN TABLE
0362  2BF2 F209 2BFB          JMP    NGX131
0363  2BF3 F20C 2C00          JMP    NGX136
0364  2BF4 B7A5 2B4F  NGX122  LDA    *ROUTHT   RESET HTDO
0365  2BF5 8061 0061          AND    NBIT0+1
0366  2BF6 9FA7 2B4F          STA    *ROUTHT
0367  2BF7 B099 0099          LDA    DRIN      DOORS OPEN ?
0368  2BF8 8061 0061          AND    BIT0+1
0369  2BF9 3169 2BD0          JAN    NGX22     YES. WAIT
0370  2BFA F619 2BE1          JMP    NGX11     NO. CHECK OUT
0371  2BFB 0020       NGX131 TXA               TABLE POINTER
0372  2BFC 8A50 2C4D          ADD    ATRLEN
0373  2BFD 9A51 2C4F          STA    LENGTH
0374  2BFE B350 2C4F          LDA    *LENGTH   TRAIN LENGTH IN A
0375  2BFF 3101 2C01          JAN    NGX135
0376  2C00 0050       NGX136 ARP               HOLD TO 1
0377  2C01 1357       NGX135 LLA    8
0378  2C02 9A2E 2C31          STA    TEMP
0379  2C03 B253 2C57  NGX132 LDA    NGNEXT    NEXT STATION # ?
0380  2C04 0009               SAI    9
0381  2C05 3106 2C0C          JAN    NGX133    NT
0382  2C06 B34E 2C55          LDA    *PSTLEN   ST  TRAIN LENGTH
0383  2C07 8228 2C30          AND    MSK1
0384  2C08 A228 2C31          IOR    TEMP
0385  2C09 9B4B 2C55          STA    *PSTLEN   ST  NEW LENGTH
0386  2C0A B22C 2C37          LDA    NGERUN
0387  2C0B F205 2C11          JMP    NGX134
0388  2C0C B347 2C54  NGX133 LDA    *ANTLEN   TRAIN LEN OUTPUT
0389  2C0D 8222 2C30          AND    MSK1
0390  2C0E A222 2C31          IOR    TEMP
0391  2C0F 9B44 2C54          STA    *ANTLEN   NT NEW LENGTH
0392  2C10 B226 2C37          LDA    NGERUN
0393  2C11 9A26 2C38  NGX134 STA    RUN       RUNTIME TO NEXT STA ADDRESS
0394  2C12 B226 2C39          LDA    ARUN      RUNTIME TABLE ADDRESS
0395  2C13 8A43 2C57          ADD    NGNEXT    PLUS NEXT STA BIAS
0396  2C14 9A25 2C3A          STA    NXTRUN    ADDRESS FOR RUNTIME
0397  2C15 B322 2C38          LDA    *RUN      GET RUNTIME
0398  2C16 9B23 2C3A          STA    *NXTRUN   STORE FOR NEXT STATION
0399  2C17 B21D 2C35          LDA    ABIT0
0400  2C18 8A3E 2C57          ADD    NGNEXT
0401  2C19 9A1C 2C36          STA    BIT       NEXT STA BIT TABLE ADDRESS
0402  2C1A B31B 2C36          LDA    *BIT
0403  2C1B 5B32 2C4E          STA    *ARBIT    TO RESET NOGO IN BIT
0404  2C1C A7[illegible] 2B50 IOR    *RNFLG    SET RUNTHRU ALARM FLAG BIT
0405  2C[illegible] 9FCD 2B50 STA    *RNFLG
0406  2C[illegible]5 B31C 2C3B LDA    *NOGOFG
0407  2C1F A316 2C36          IOR    *BIT      SET NO DEPART TO ALARM FLAG
0408  2C20 9B1A 2C3B          STA    *NOGOFG
0409  2C21 B212 2C34          LDA    ATLTRN    LATE TRAIN # TABLE ADDRESS
0410  2C22 8A34 2C57          ADD    NGNEXT    PLUS BIAS
0411  2C23 9A2E 2C52          STA    LATE      POINTER
0412  2C24 B32B 2C50          LDA    *LOCADD   TRAIN # IN STATION
0413  2C25 9B2C 2C52          STA    *LATE     STORE IN NEXT STATION
0414  2C26 B22F 2C56  NGX14  LDA    ATLCLK    START TRAIN LATE TIMER
0415  2C27 8A2F 2C57          ADD    NGNEXT    IN NEXT STATION
0416  2C28 9A29 2C52          STA    LATE
0417  2C29 0110               ZAR
0418  2C2A 9B27 2C52          STA    *LATE
0419  2C2B B206 2C32          LDA    XSAV2     GET STATUS
0420  2C2C A062 0062          IOR    BIT0+2    SET COMP FLAG
0421  2C2D 9945 0045          STA    *WORD
0422  2C2E F300 2C2F  NGX2   JMP    *NGX21    EXIT
0423  2C2F 2B4D       NGX21  DATA   ANGRNT    RETURN TO MAIN PROGRAM
```

```
0425                        *
0426                        *       STATION LOGIC CONSTANTS
0427                        *
0428  2C30 F0FF             MSK1    DATA    :F0FF     NT/ST TRAIN LEN OUTPUT BITS
0429  2C31 0000             TEMP    DATA    0
0430  2C32 0000             XSAV2   DATA    0
0431  2C33 0000             REXIT   DATA    0         TEMP EXIT STORAGE
0432  2C34 5200             ATLTRN  DATA    :5200     LATE TRAIN # TABLE
0433                        *
0434  2C35 0050             RBIT0   DATA    :50       BIT TABLE ADDRESS
0435  2C36 0000             BIT     DATA    0         POINTER FOR BIT TABLE
0436  2C37 5210             NGERUN  DATA    :5210     EAST RUNTIME FROM NG
0437  2C38 0000             RUN     DATA    0         ADDRESS FOR NEXT STA RUNTIME
0438  2C39 5230             ARUN    DATA    :5230     RUNTIME TABLE ADDRESS
0439  2C3A 0000             NXTRUN  DATA    0         NEXT STA RUNTIME POINTER
0440  2C3B 5251             NOGOFG  DATA    :5251     NO DEPART TO ALARM FLAG
0441        0045            WORD    EQU     :45       STATION STATUS POINTER
0442                        *
0443        00B7            ENTR    EQU     :B7       ENTRANCE NUMBER
0444        00B8            EXIT    EQU     :B8       EXIT NUMBER
0445        00B9            MAXK    EQU     :B9       TABLE ADDRESS POINTER
0446        004F            KMX     EQU     :4F       # OF ROUTES
0447        00BD            ROUT    EQU     :BD       TABLE ADDRESS POINTER
0448        00BA            MODE    EQU     :BA       MODE FLAG WORD
0449        0021            INROUT  EQU     :21       STATIONS IN ROUTE
0450                        *
0451  2C3C 50D0             AMAXK   DATA    :50D0     MAXK STORAGE TABLE
0452  2C3D 50D8             BMAXK   DATA    :50D8     SG TABLE
0453  2C3E 5B80             AROUT   DATA    :5B80     ROUT ADDRESS TABLE
0454                        *
0455  2C3F 2700             ARTAV   DATA    :2700     ROUTE AVAILABLE ROUTINE
0456  2C40 2800             ARTSEL  DATA    :2800     ROUTE SELECT ROUTINE
0457                        *
0458  2C41 0160             MMSK    DATA    :0160     MODE 30,31,30PP
0459  2C42 0010             MMSK1   DATA    :0010     MODE 32
0460  2C43 0100             NGENT   DATA    :100      ENT #
0461  2C44 0200             SGENT   DATA    :200      ENT #
0462  2C45 0104             NTEXT   DATA    :104      EXIT #
0463  2C46 0204             STEXT   DATA    :204      EXIT #
0464                        *
0465                        *       TABLE ADDRESSES
0466                        *
0467  2C47 50E0             ASTRLC  DATA    :50E0     STATION VS TRLOC
0468  2C48 51C8             BDWCLK  DATA    :51C8     DWELL TIME CLOCK
0469  2C49 51D0             AHDCLK  DATA    :51D0     HEADWAY CLOCKS
0470  2C4A 51D8             BHDCLK  DATA    :51D8
0471  2C4B 5058             BDWTIM  DATA    :5058     DWELL TIME
0472  2C4C 40FF             ATRNO   DATA    :4100-1   TRAIN NUMBER TABLE
0473  2C4D 4110             ATRLEN  DATA    :4110     TRAIN LENGTH TABLE
0474  2C4E 5260             ARBIT   DATA    :5260     NOGO RESET TABLE IN ETC
0475                        *
0476                        *       ADDRESS POINTERS FOR TABLES
0477                        *
0478        00BE            DOG     EQU     :BE       TRAIN NUM ZERO PAGE FOR STA
0479  2C4F 0000             LENGTH  DATA    0         TRAIN LENGTH TABLE
0480  2C50 0000             LOCADD  DATA    0         TRLOC TABLE
0481  2C51 0000             BITLOC  DATA    0         BIT TABLE
0482  2C52 0000             LATE    DATA    0         TRAIN LATE INDIRECT POINTER
0483                        *
0484                        *       I/O WORD ADDRESSES
0485                        *
0486        0080            TKIN    EQU     :80       TK INPUT TABLE
0487        0088            GKIN    EQU     :88       GATE INPUT TABLE
0488        009B            ARTDO   EQU     :9B       PB IN RTDO
0489        009C            AHOLD   EQU     :9C       PB IN HOLD TRAIN
0490        009D            ARCYCL  EQU     :9D       PB RECYCLE DOORS
```

```
0491        009C        PBCLOS EQU    :9C       CLOSE DOOR PB
0492  2C53  5113        BCLOSE DATA   :5113     OUT CLOSE DOORS
0493  2C54  5114        ANTLEN DATA   :5114     OUT NT LENGTH
0494  2C55  5116        ASTLEN DATA   :5116     OUT ST LENGTH
0495  2C56  51E0        ATLCLK DATA   :51E0     TRAIN LATE CLOCKS
0496                    *
0497        000A        A      EQU    10
0498        000B        B      EQU    11
0499        000C        C      EQU    12
0500        000D        D      EQU    13
0501        000E        E      EQU    14
0502        000F        F      EQU    15
0503                    *
0504        0050        BIT0   EQU    :50       BIT TABLE ADDRESS
0505        0060        NBIT0  EQU    :60       NOT BIT TABLE ADDRESS
0506        0098        DRIN   EQU    :98       DOOR OPEN INPUTS
0507        00B0        DIR    EQU    :B0       DIRECTION TABLE
0508        0095        RNTHRU EQU    :95       RUNTHRU PB INPUTS
0509                    *
0510        0048        STORFG EQU    :48       STORE TRAIN FLAG WORD
0511        0049        DISPFG EQU    :49       DISPATCH TRAIN FLAG WORD
0512        0041        STRDFG EQU    :41       TRAIN BEEN STORED FLAG
0513                    *
0514        00BF        HDWAY  EQU    :BF       HEADWAY IN EFFECT
0515  2C57  0000        NGNEXT DATA   0         NEXT STATION
0516                    *
0517  2C58  00F0        NGNT   DATA   :00F0     MASK 3,4,5A,5B TKS
0518  2C59  0010        NGST   DATA   :0010     MASK 3 TK
0519  2C5A  00F0               DATA   :00F0     MASK 28,29,30A,30B TKS
0520  2C5B  00F0        SGST   DATA   :00F0     MASK 28,29,30A,30B TKS
0521  2C5C  00E0        SGNT   DATA   :00E0     MASK 4,5A,5B TKS
0522  2C5D  0030               DATA   :0030     MASK 28,29 TKS
0523                    *
0524  2C5E  50C8        BSTAT  DATA   :50C8     SG STATION STATUS WORD
0525  2C5F  5238        BRUNTM DATA   :5238     SG RUNTIME TABLE ADDRESS
0527                    *
0528                    *
0529                    *       SOUTH BAGGAGE STATION ENTRY ROUTINE
0530                    *
0531                    *       THIS ROUTINE PERFORMS THE FUNCTIONS
0532                    *       REQUIRED TO CHECK A TRAIN INTO THE
0533                    *       STATION OR TO PROVIDE FOR A RUNTHRU
0534                    *       THIS LOGIC IS COMPLETE WHEN A RUN-
0535                    *       THRU IS DETECTED OR THE TRAIN DOORS
0536                    *       OPEN.
0537                    *
0538                    *
0539  2C60  0800        SGELOG ENT
0540  2C61  B603 2C5E         LDA    BSTAT    STATUS WORD TABLE ADD
0541  2C62  9845 0045         STA    WORD     STATUS WORD POINTER
0542  2C63  B145 0045         LDA    *WORD    GET STATUS WORD
0543  2C64  0048              TAX             SAVE
0544  2C65  8050 0050         AND    BIT0+0   COMP FLAG = 1 ?
0545  2C66  312E 2C95         JAN    SGE2     YES, EXIT
0546  2C67  0030        SGE1   TXA
0547  2C68  8053 0053         AND    BIT0+3   STR OCC FLAG = 1 ?
0548  2C69  212D 2C97         JAZ    SGE6     NO
0549  2C6A  0030              TXA             YES, DWELL STARTED ?
0550  2C6B  8056 0056         AND    BIT0+6
0551  2C6C  310E 2C7B         JAN    SGE10    YES
0552  2C6D  B098 0098         LDA    DRIN     NO, DOORS OPEN ?
0553  2C6E  8059 0059         AND    BIT0+9
0554  2C6F  2126 2C96         JAZ    SGE22    NO, EXIT
0555  2C70  B383 2CF4   SGE4   LDA    *BOUTHT  YES
0556  2C71  A059 0059         IOR    BIT0+9   SET HIDO BIT
0557  2C72  9881 2CF4         STA    *BOUTHT  STORE
0558  2C73  0110              ZAR
```

```
2074 9F20 2048          STA    *BDWCLK  START DWELL TIMER
2075 0030               TXA
2076 A054 0054          IOR    BIT0-4   SET HTDO FLAG
2077 A055 0055          IOR    BIT0-5   SET DOOR OPEN FLAG
2078 A056 0056          IOR    BIT0+6   SET DWELL START FLAG
2079 0048               TAX
207A 9945 0045          STA    *WORD    SAVE
207B B041 0041  SGE10   LDA    STRDFG   STORED FLAG SET ?
207C 8058 0058          AND    BIT0+8
207D 210E 208C          JAZ    SGE7     NO. GO SET COMP FLAG
207E B733 204B          LDA    *BDWTIM
207F 2085 2085          JAM    SGE12    MANUAL DWELL
2080 9738 2048          SUB    *BDWCLK  DWELL TIME EXPIRED ?
2081 3094 2096          JAP    SGE22    NO. WAIT
2082 B72F 2053          LDA    *BCLOSE
2083 A059 0059          IOR    BIT0+9   CLOSE DOOR OUTPUT
2084 9F31 2053          STA    *BCLOSE
2085 0030       SGE12   TXA
2086 8064 0064          AND    NBIT0+4  RESET HTDO FLAG
2087 9945 0045          STA    *WORD
2088 0048               TAX             SAVE
2089 B36A 20F4          LDA    *BOUTHT
208A 8069 0069          AND    NBIT0-9  RESET HTDO OUTPUT
208B 9B68 20F4          STA    *BOUTHT
208C 0110       SGE7    ZAR
208D 9F2E 205F          STA    *BRUNTM  RESET RUNTIME
208E B366 20F5          LDA    *RNFLGR
208F 8068 0068          AND    NBIT0+8  RESET RUNTHRU ALARM FLAG
2090 9B64 20F5          STA    *RNFLGR
2091 0030               TXA
2092 A050 0050  SGE5    IOR    BIT0+0   SET ENT COMP FLAG
2093 9945 0045  SGE9    STA    *WORD    STORE NEW STATUS
2094 0048               TAX             SAVE
2095 F218 20AE  SGE2    JMP    SGILOG   NEXT ROUTINE
2096 F216 20AD  SGE22   JMP    ASGENT   RETURN
2097 B08E 008E  SGE6    LDA    TKIN+2
2098 8054 0054          AND    BIT0+4   CHECK E AF TK = 2ST
2099 2106 20A0          JAZ    SGE8     NOT OCC
209A B081 0081          LDA    DIR+1.   OCC. CHECK DIR
209B 8053 0053          AND    BIT0+3   2ST DIR
209C 2103 20A0          JAZ    SGE8     FAST
209D B095 0095          LDA    RNTHRU   WEST. CHECK RUNTHRU
209E 8059 0059          AND    BIT0+9
209F 3153 208C          JAN    SGE7     ON
20A0 B08E 008E  SGE8    LDA    TKIN+2   OFF. CHECK STA OCC
20A1 8053 0053          AND    BIT0+3   2ST
20A2 214C 2096          JAZ    SGE22    NOT OCC
20A3 B09C 009C          LDA    PBCLOS   CLOSE DOOR PB ON ?
20A4 8059 0059          AND    BIT0+9
20A5 2102 20A8          JAZ    SGE81    NO
20A6 0110               ZAR             YES. RESET RUNTIME
20A7 9F48 205F          STA    *BRUNTM
20A8 0030       SGE81   TXA             OCC. GET STATUS
20A9 A053 0053          IOR    BIT0+3   SET STA OCC FLAG
20AA 9945 0045          STA    *WORD
20AB 0048               TAX
20AC F616 2096          JMP    SGE22
                *
20AD F74D 2060  ASGENT  RTN    SGELOG   RETURN TO MAIN PROG
                *
                *
                *       SOUTH BAGGAGE IN STATION ROUTINE
                *
                *        THIS ROUTINE PERFORMS THE FUNCTIONS
                *        REQUIRED TO CLEAR A ROUTE TO THE NEXT
                *        STATION  THESE FUNCTIONS ARE DONE
                *        DURING THE NORMAL DWELL TIME OR WHILE
```

```
0627                    *        THE STATION IS BY NO RUNNING OPERATION
0628                    *        NEXT STATION  AND  ROUTE SELECTION MUST
0629                    *        BE FUNCTIONAL
0630                    *
0631                    *
0632  20AE B09A 009A  SGILOG LDA    MODE
0633  20AF 805F 0059          AND    BIT0+6
0634  20B0 3142 20AD          JAN    ASGENT    NO MODE, RETURN MAIN PROG
0635  20B1 B049 0049          LDA    DISPFG
0636  20B2 8058 0059          AND    BIT0+8    SO DISPATCH FLAG SET ?
0637  20B3 3106 20BA          JAN    SGI3      YES, DO ROUTING
0638  20B4 B041 0041          LDA    STRDFG    NO  CHECK STORED FLAG
0639  20B5 8058 0059          AND    BIT0+8
0640  20B6 2149 20AD          JAN    ASGENT    NO, SETUP NEW STATE
0641  20B7 B021 0021          LDA    TNEXT     SELECTED IN PROG ?
0642  20B8 8058 0059          AND    BIT0+8
0643  20B9 2140 20AD          JAZ    ASGENT    NO, SELECT
0644  20BA 0030          SGI1   TXA             GET STATUS WORD
0645  20BB 8051 0051          AND    BIT0+1    IN COMP FLAG = 1 ?
0646  20BC 3133 20F0          JAN    SGI2      YES  EXIT
0647  20BD 0030          SGI3   TXA             GET STATUS
0648  20BE 8058 0058          AND    BIT0+8    NEXT STA DESTINATION
0649  20BF 3115 20D5          JAN    SGI4      YES
0650  20C0 B0AA 00AA          LDA    MODE      NO, CHECK MODE
0651  20C1 867F 2047          AND    MM9F1     MODE 3F ?
0652  20C2 2104 20C7          JAZ    SGI31     NO, NEXT = 27
0653  20C3 B67E 2045          LDA    NTEXT
0654  20C4 9A2D 20F2          STA    BEXIT     NT = 104
0655  20C5 C001               LAP    1         NOBIAS = 1
0656  20C6 A200 2000          JMP    SGI5-1
0657  20C7 B000 0000  SGI31  LDA    STALK     IS EXIT AVAILABLE ?
0658  20C8 822D 20F6          AND    THREE
0659  20C9 3127 20F1          JAN    SGI22     NO
0660  20CA B684 2046          LDA    STEXT     YES
0661  20CB 9A26 20F2          STA    BEXIT     ST = 204
0662  20CC C004               LAP    4
0663  20CD A000 0000          IOR    STALK
0664  20CE 9800 0000          STA    STALK     SET STA LOCKOUT
0665  20CF C009               LAP    9         STORAS = 9
0666  20D0 9A22 20F3          STA    SGNEXT    = NEXT STATION
0667  20D1 0030          SGI5   TXA             GET STATUS
0668  20D2 A058 0058          IOR    BIT0+8    SET NEXT STA FLAG
0669  20D3 9945 0045          STA    *WORD     STORE NEW STATUS
0670  20D4 0048               TAX              SAVE
0671  20D5 0030          SGI4   TXA             GET STATUS
0672  20D6 8059 0059          AND    BIT0+9    ROUTE BEEN SELECTED ?
0673  20D7 3114 20EC          JAN    SGI6      YES
0674  20D8 B69B 203D          LDA    BMAXK     NO, STORE ROUTE POINTERS
0675  20D9 9889 0089          STA    MAXK      TABLE ADDRESS POINTER
0676  20DA C020               LAP    32        BIAS TIMES 4
0677  20DB 8B9D 203E          ADD    AROUT     TABLE ADDRESS
0678  20DC 9B8D 008D          STA    ROUT      ROUT TABLE POINTER
0679  20DD 0110               ZAR
0680  20DE 984F 004F          STA    KMX
0681  20DF B695 2044          LDA    SGENT     ENT = 200
0682  20E0 9887 0087          STA    ENTR
0683  20E1 B210 20F2          LDA    BEXIT
0684  20E2 9888 0088          STA    EXIT
0685  20E3 B189 0089          LDA    *MAXK     ANY OLD ROUTE ?
0686  20E4 3100 20F1          JAN    SGI22     YES, EXIT
0687  20E5 FFA6 203F          CALL   *ARTAV
0688  20E6 FFA6 2040          CALL   *ARTSEL
0689  20E7 B189 0089          LDA    *MAXK     ANY UNIT ROUTES ?
0690  20E8 2108 20F1          JAZ    SGI22     NO, WAIT
0691  20E9 0030          SGI61  TXA             YES
0692  20EA A059 0059          IOR    BIT0+9    SET ROUTE SELECTED FLAG
```

```
2CEB 0048                TAX                SAVE
2CEC 0030        SGI6    TXA                GET STATUS
2CED A051 0051           IOR     BIT0+1     SET IN COMP FLAG
2CEE 9945 0045           STA     *WORD      STORE
2CEF 0048                TAX                SAVE
2CF0 F206 2CF7   SGI2    JMP     SGXLOG     STATION EXIT LOGIC
2CF1 F644 2CAD   SGI22   JMP     ASGENT     RETURN
                 *
2CF2 0000        BEXIT   DATA    0          TEMP EXIT
2CF3 0000        SGNEXT  DATA    0          NEXT STATION BIAS
2CF4 5112        BOUTHT  DATA    :5112      HTDO OUTPUT
2CF5 5250        RNFLGB  DATA    :5250      RUNTHRU ALARM FLAG WORD
2CF6 0003        THREE   DATA    3          NG+NT BITS
                 *
                 *
                 *
                 *        SOUTH BAGGAGE STATION EXIT ROUTINE
                 *
                 *        THIS ROUTINE PERFORMS THE FUNCTIONS
                 *        REQUIRED TO CHECK A TRAIN OUT OF THE
                 *        STATION. DWELL TIME, HEADWAYS, NEXT
                 *        STATION CLEAR, AND NO MANUAL INT-
                 *        ERVENTION ARE THE CONDITIONS.
                 *
                 *
2CF7 0030        SGXLOG  TXA                GET STATUS WORD
2CF8 8052 0052           AND     BIT0+2     COMP FLAG = 1 ?
2CF9 3133 2D2D           JAN     SGX22      YES, EXIT
2CFA B098 0098   SGX1    LDA     DRIN
2CFB 8059 0059           AND     BIT0+9     DOORS OPEN ?
2CFC 3101 2CFE           JAN     SGX5       YES
2CFD F240 2D3E           JMP     SGX11      NO, BYPASS CHECKS
2CFE B60B 2CF3   SGX5    LDA     SGNEXT     NEXT STATION ?
2CFF 00D0                DAR
2D00 3108 2D09           JAN     SGX53      ST
2D01 B08C 008C           LDA     TKIN+0     NT, CHECK TKS
2D02 86A6 2C5C           AND     SGNT       4,5A,5B
2D03 2101 2D05           JAZ     SGX51
2D04 F285 2D8A   SGX52   JMP     SGX2       NOT CLEAR
2D05 B08E 008E   SGX51   LDA     TKIN+2
2D06 86A9 2C5D           AND     SGNT+1     28,29 TKS
2D07 3143 2D04           JAN     SGX52      NOT CLEAR
2D08 F203 2D0C           JMP     SGX7       ALL CLEAR
2D09 B08E 008E   SGX53   LDA     TKIN+2     ST, CHECK TKS
2D0A 86AF 2C5B           AND     SGST       28,29,30A,30B TKS
2D0B 3147 2D04           JAN     SGX52      NOT CLEAR
2D0C 0030        SGX7    TXA                ALL CLEAR
2D0D 805E 005E           AND     BIT0+E     ROUTE CLEAR FLAG = 1 ?
2D0E 3107 2D16           JAN     SGX3       YES
2D0F B088 0088           LDA     GKIN+0     NO, CHECK GATE X1C
2D10 8052 0052           AND     BIT0+2
2D11 214D 2D04           JAZ     SGX52      X1C NOT CLEAR
2D12 0030                TXA
2D13 A05E 005E           IOR     BIT0+E     SET ROUTE CLEARED FLAG
2D14 9945 0045           STA     *WORD
2D15 0048                TAX                SAVE
2D16 0030        SGX3    TXA                GET STATUS
2D17 805D 005D           AND     BIT0+D     HEADWAY COMP FLAG = 1 ?
2D18 3108 2D21           JAN     SGX23      YES
2D19 B7CF 2C4A           LDA     *BHDCLK
2D1A 90BF 00BF           SUB     HDWAY      HEADWAY ELAPSED ?
2D1B 3081 2D1D           JAP     SGX6       YES
2D1C F26D 2D8A           JMP     SGX2       NO, EXIT
2D1D 0030        SGX6    TXA
2D1E A05D 005D           IOR     BIT0+D     SET HDWAY COMP FLAG
2D1F 9945 0045           STA     *WORD      STORE NEW STATUS
```

```
0760  2D20 0048              TAX              SAVE
0761  2D21 B049 0049  SGX23  LDA    DISPFG
0762  2D22 8058 0058         AND    BIT0+8   DISPATCH FLAG ON ?
0763  2D23 310E 2D32         JAN    SGX8     YES, BYPASS TIMERS
0764  2D24 0030              TXA
0765  2D25 805C 005C         AND    BIT0+C   DWELL COMP FLAG = 1 ?
0766  2D26 310B 2D32         JAN    SGX8     YES
0767  2D27 B7DC 2C4B         LDA    *BDWTIM
0768  2D28 20A8 2D51         JAM    SGX122   MANUAL DWELL
0769  2D29 97E1 2C48         SUB    *BDWCLK  DWELL TIME EXPIRED ?
0770  2D2A 2083 2D2E         JAM    SGX4     YES
0771  2D2B 9375 2DA1         SUB    *BMINDW  MINIMUM DWELL EXPIRED ?
0772  2D2C 2081 2D2E         JAM    SGX4     YES
0773  2D2D F25C 2D8A  SGX22 JMP    SGX2     NO, EXIT
0774  2D2E 0030       SGX4  TXA              GET STATUS
0775  2D2F A05C 005C         IOR    BIT0+C   SET DWELL COMP FLAG
0776  2D30 9945 0045         STA    *WORD    STORE NEW STATUS
0777  2D31 0048              TAX              SAVE
0778  2D32 B09B 009B  SGX8  LDA    AHTDO
0779  2D33 8059 0059         AND    BIT0+9
0780  2D34 3170 2D04         JAN    SGX52    MAN HTDO ON, EXIT
0781  2D35 B093 0093  SGX9  LDA    AHOLD
0782  2D36 8059 0059         AND    BIT0+9
0783  2D37 3173 2D04         JAN    SGX52    MAN HOLD ON, EXIT
0784  2D38 B09D 009D  SGX10 LDA    ARCYCL
0785  2D39 8059 0059         AND    BIT0+9   RECYLE DOORS PB ?
0786  2D3A 3176 2D04         JAN    SGX52    ON, EXIT
0787  2D3B B7E8 2C53  SGX12 LDA    *BCLOSE
0788  2D3C A059 0059         IOR    BIT0+9   CLOSE DOOR BIT
0789  2D3D 9FEA 2C53         STA    *BCLOSE
0790  2D3E 0030       SGX11 TXA
0791  2D3F 8064 0064         AND    NBIT0+4  RESET HTDO FLAG
0792  2D40 9945 0045         STA    *WORD    NEW STATUS
0793  2D41 0048              TAX              SAVE
0794  2D42 B74E 2CF4         LDA    *BOUTHT
0795  2D43 8069 0069         AND    NBIT0+9  RESET HTDO OUTPUT
0796  2D44 9F50 2CF4         STA    *BOUTHT
0797  2D45 0110       SGX121 ZAR
0798  2D46 9FFC 2C4A         STA    *BHDCLK  START HEADWAY TIMER
0799  2D47 B358 2DA0  SGX13 LDA    *BSTRLC  STA VS TRLOC
0800  2D48 9A51 2D9A         STA    LOCAD    TRLOC POINTER
0801  2D49 B254 2D9E         LDA    BTRNO    TRAIN NUMBER TABLE-1
0802  2D4A 98BE 00BE         STA    DOG      ZERO PAGE POINTER
0803  2D4B EA42 2D8E         STX    XSAVE3
0804  2D4C C410              LXP    16
0805  2D4D B34C 2D9A         LDA    *LOCAD
0806  2D4E CDBE              SCM    DOG      FIND TRAIN # IN TABLE
0807  2D4F F208 2D58         JMP    SGX131
0808  2D50 F20C 2D5D         JMP    SGX136
0809  2D51 B75D 2CF4  SGX122 LDA    *BOUTHT  RESET HTDO
0810  2D52 8069 0069         AND    NBIT0+9
0811  2D53 9F5F 2CF4         STA    *BOUTHT
0812  2D54 B098 0098         LDA    DRIN     DOORS OPEN ?
0813  2D55 8059 0059         AND    BIT0+9
0814  2D56 3169 2D2D         JAN    SGX22    YES, WAIT
0815  2D57 F619 2D3A         JMP    SGX11    NO, CHECK OUT
0816  2D58 0030       SGX131 TXA              TABLE POINTER
0817  2D59 8A45 2D9F         ADD    BTRLEN
0818  2D5A 9A42 2D9D         STA    LNGTH
0819  2D5B B341 2D9D         LDA    *LNGTH   TRAIN LENGTH IN A
0820  2D5C 3101 2D5E         JAN    SGX135
0821  2D5D 0350       SGX136 ARP              HOLD TO 1
0822  2D5E 1357       SGX135 LLA    8
0823  2D5F 9A2D 2D8D         STA    TEMP1
0824  2D60 B66D 2CF3  SGX137 LDA    SGNEXT   NEXT STATION =
0825  2D61 0D09              SAI    9
0826  2D62 3105 2D68         JAN    SGX139   NT
```

```
2063 B238 2090          LDA    *FATIEN   GET TRAIN # FROM
2064 8027 2096          AND    MSK2
2065 B027 2080          IOR    TEMP1
2066 9B75 2090          STA    *FATIEN   SET NEW LATE
2067 F204 2060          JMP    SGX123
2068 B232 2098  SGX123  LDA    *BNTLEN   TRAIN LEN OUTER
2069 8027 2096          AND    MSK2
206A A202 2080          IOR    TEMP1
206B 9B2B 2098          STA    *BNTLEN   NT NEW LENGTH
206C B223 2084  SGX134  LDA    BTLTRN    LATE TRAIN # TABLE ADD
206D 8E7A 20F3          ADD    SGNEXT    PLUS NEXT STAT
206E 9A20 208F          STA    LATE2     POINTER
206F B32A 2098          LDA    *LOCAD    TRAIN #
2070 9B1E 208F          STA    *LATE2    STORE IN LITEWP TABLE
2071 B21F 2091          LDA    SGERUN    EAST RUNTIME FROM AB ADDRESS
2072 9A20 2093          STA    RUNP
2073 B220 2094          LDA    BRUN      RUNTIME TABLE ADDRESS
2074 8E81 20F3          ADD    SGNEXT    PLUS NEXT STA BIAS
2075 9A10 2092          STA    NXTRN     ADDRESS FOR NEXT STA RUNTIME
2076 B310 2093          LDA    *RUNP     GET RUNTIME
2077 9B1A 2092          STA    *NXTRN    STORE FOR NEXT STATION
2078 B21D 2096          LDA    BBITO
2079 8E86 20F3          ADD    SGNEXT
207A 9A1A 2095          STA    BITB      NEXT STATION BIT TABLE BIAS
207B B319 2095          LDA    *BITB
207C 9B1B 2098          STA    *BRBIT    TO RESET NOGO IN ETC
207D A788 20F5          IOR    *BNFLGB   SET RUNTIME ALARM FLAG
207E 9F89 20F5          STA    *BNFLGB
207F B317 2097          LDA    *NOGO
2080 A314 2095          IOR    *BITB     SET NO DEPART TO ALARM FLAG
2081 9B15 2097          STA    *NOGO
2082 B216 2099  SGX14   LDA    BTLCLK    START TRAIN LATE TIMER
2083 8E90 20F3          ADD    SGNEXT    IN NEXT STATION
2084 9A0A 208F          STA    LATE2
2085 0110               ZAR
2086 9B08 208F          STA    *LATE2
2087 B206 208E          LDA    XSAVE3    GET STATUS
2088 A052 0052          IOR    BIT0+2    SET COMP FLAG
2089 9945 0045          STA    *WORD
208A F300 208B  SGX2    JMP    *SGX21    EXIT
208B 20AD       SGX21   DATA   RSGENT    RETURN TO MAIN PROGRAM
                *
208C F0FF       MSK2    DATA   :F0FF
208D 0000       TEMP1   DATA   0
208E 0000       XSAVE3  DATA   0
208F 0000       LATE2   DATA   0         TRAIN LATE CLOCK POINTER
                *
2090 5200       BTLTRN  DATA   :5200     LATE TRAIN # TABLE
2091 5218       SGERUN  DATA   :5218     RUNTIME TO THE EAST
2092 0000       NXTRN   DATA   0         NEXT STA RUNTIME POINTER
                *
2093 0000       RUNP    DATA   0         TEMP STORAGE
2094 5220       BRUN    DATA   :5220     RUNTIME TABLE ADDRESS
                *
2095 0000       BITB    DATA   0         POINTER TO BIT TABLE
2096 0050       BBITO   DATA   :50       BIT TABLE ADDRESS
                *
2097 5251       NOGO    DATA   :5251     NO DEPART TO ALARM FLAG
2098 5268       BRBIT   DATA   :5268     NOGO RESET TABLE IN ETC
2099 51E0       BTLCLK  DATA   :51E0     TRAIN LATE CLOCKS
209A 0000       LOCAD   DATA   0         TRLOC POINTER
                *
209B 5114       BNTLEN  DATA   :5114     OUT NT LENGTH
209C 5116       BSTLEN  DATA   :5116     OUT ST LENGTH
209D 0000       LNGTH   DATA   0         POINTER IN LENGTH TABLE
209E 40FF       BTRNO   DATA   :4100-1   TRAIN NUMBER TABLE
209F 4110       BTRLEN  DATA   :4110     TRAIN LENGTH TABLE
```

```
0894  2DA0 50E8        BSTRLC DATA   :50E8    STATION VS TRLOC
0895  2DA1 5278        BMINDW DATA   :5278    MINIMUM DWELL TIME
0896                   *
0897                   *
0898  50E0                     ABS    :50E0
0899                   *        STATION VERSUS TRLOC ADDRESS TABLE
0900                   *
0901                   *
0902  50E0 5003        STRLOC DATA   :5003    NORTH BAG   2T
0903  50E1 5007               DATA   :5007    X     TICK  5BT
0904  50E2 500B               DATA   :500B    X     A     9T
0905  50E3 500E               DATA   :500E    X     B     12T
0906  50E4 5015               DATA   :5015    X     C     18T
0907  50E5 5018               DATA   :5018    X     D     21AT
0908  50E6 5012               DATA   :5012    X     BY    15T
0909  50E7 501B               DATA   :501B    X     STOR  2BT
0910  50E8 5023               DATA   :5023    SOUTH BAG   27T
0911  50E9 5027               DATA   :5027    X     TICK  30BT
0912  50EA 502B               DATA   :502B    X     A     34T
0913  50EB 5032               DATA   :5032    X     B     40T
0914  50EC 5035               DATA   :5035    X     C     43T
0915  50ED 503A               DATA   :503A    X     D     48T
0916  50EE 5030               DATA   :5030    X     BY    38T
0917  50EF 503D               DATA   :503D    X     SPUR  51T
0919                   *
0920                   *
0921                   *        STATION STATUS WORD STORAGE TABLE
0922                   *
0923                   *        THIS TABLE CONTAINS THE STATUS WORDS
0924                   *        FOR EACH OF THE STATIONS.
0925                   *
0926                   *
0927  50C0                     ABS    :50C0
0928  50C0 0000        STATUS DATA   0         NORTH BAG
0929  50C1 0000               DATA   0         X     TICK
0930  50C2 0000               DATA   0         X     A
0931  50C3 0000               DATA   0         X     B
0932  50C4 0000               DATA   0         X     C
0933  50C5 0000               DATA   0         X     D
0934  50C6 0000               DATA   0         X     BY
0935  50C7 0000               DATA   0         X     STOR
0936  50C8 0000               DATA   0         SOUTH BAG
0937  50C9 0000               DATA   0         X     TICK
0938  50CA 0000               DATA   0         X     A
0939  50CB 0000               DATA   0         X     B
0940  50CC 0000               DATA   0         X     C
0941  50CD 0000               DATA   0         X     D
0942  50CE 0000               DATA   0         X     BY
0943  50CF 0000               DATA   0         X     SPUR
0944                   *
0945                   *
0946                   *        MAXK STORAGE TABLE
0947                   *
0948                   *        THIS TABLE CONTAINS THE NUMBER OF
0949                   *        ROUTES TO BE SET UP FOR EACH OF
0950                   *        THE STATIONS.
0951                   *
0952  50D0                     ABS    :50D0
0953  50D0 0000        MAXKT  DATA   0         NORTH BAG
0954  50D1 0000               DATA   0         X     TICK
0955  50D2 0000               DATA   0         X     A
0956  50D3 0000               DATA   0         X     B
0957  50D4 0000               DATA   0         X     C
0958  50D5 0000               DATA   0         X     D
0959  50D6 0000               DATA   0         X     BY
0960  50D7 0000               DATA   0         X     STOR
0961  50D8 0000               DATA   0         SOUTH BAG
```

```
0962  50D9 0000                DATA   0        X     TICK
0963  50DA 0000                DATA   0        X     A
0964  50DB 0000                DATA   0        X     B
0965  50DC 0000                DATA   0        X     C
0966  50DD 0000                DATA   0        X     D
0967  50DE 0000                DATA   0        X     BY
0968  50DF 0000                DATA   0        X     SPUR
0970                     *
0971                     *          ROUTES TO BE SET UP
0972                     *
0973                     *       THESE TABLES CONTAIN THE UNIT ROUTES
0974                     *       TO BE SET UP AT THE GIVEN STATION.
0975                     *       EACH ROUTE ENTRY CONTAINS THE ENTRANCE
0976                     *       FOLLOWED BY THE EXIT.
0977                     *
0978  5B80                       ABS    :5B80
0979  5B80 0000            NGROUT DATA   0        NORTH BAGGAGE
0980  5B81 0000                   DATA   0
0981  5B82 0000                   DATA   0
0982  5B83 0000                   DATA   0
0983  5B84 0000                   DATA   0        NORTH TICKET
0984  5B85 0000                   DATA   0
0985  5B86 0000                   DATA   0
0986  5B87 0000                   DATA   0
0987  5B88 0000                   DATA   0        NORTH A
0988  5B89 0000                   DATA   0
0989  5B8A 0000                   DATA   0
0990  5B8B 0000                   DATA   0
0991  5B8C 0000                   DATA   0        NORTH B
0992  5B8D 0000                   DATA   0
0993  5B8E 0000                   DATA   0
0994  5B8F 0000                   DATA   0
0995  5B90 0000                   DATA   0        NORTH C
0996  5B91 0000                   DATA   0
0997  5B92 0000                   DATA   0
0998  5B93 0000                   DATA   0
0999  5B94 0000                   DATA   0        NORTH D
1000  5B95 0000                   DATA   0
1001  5B96 0000                   DATA   0
1002  5B97 0000                   DATA   0
1003  5B98 0000                   DATA   0        NORTH BY
1004  5B99 0000                   DATA   0
1005  5B9A 0000                   DATA   0
1006  5B9B 0000                   DATA   0
1007  5B9C 0000                   DATA   0        NORTH STOR
1008  5B9D 0000                   DATA   0
1009  5B9E 0000                   DATA   0
1010  5B9F 0000                   DATA   0
1011  5BA0 0000                   DATA   0        SOUTH BAGGAGE
1012  5BA1 0000                   DATA   0
1013  5BA2 0000                   DATA   0
1014  5BA3 0000                   DATA   0
1015  5BA4 0000                   DATA   0        SOUTH TICKET
1016  5BA5 0000                   DATA   0
1017  5BA6 0000                   DATA   0
1018  5BA7 0000                   DATA   0
1019  5BA8 0000                   DATA   0        SOUTH A
1020  5BA9 0000                   DATA   0
1021  5BAA 0000                   DATA   0
1022  5BAB 0000                   DATA   0
1023  5BAC 0000                   DATA   0        SOUTH B
1024  5BAD 0000                   DATA   0
1025  5BAE 0000                   DATA   0
1026  5BAF 0000                   DATA   0
1027  5BB0 0000                   DATA   0        SOUTH C
1028  5BB1 0000                   DATA   0
1029  5BB2 0000                   DATA   0
```

```
1030  5BB3 0000                DATA   0
1031  5BB4 0000                DATA   0          SOUTH D
1032  5BB5 0000                DATA   0
1033  5BB6 0000                DATA   0
1034  5BB7 0000                DATA   0
1035  5BB8 0000                DATA   0          SOUTH BYPASS
1036  5BB9 0000                DATA   0
1037  5BBA 0000                DATA   0
1038  5BBB 0000                DATA   0
1039  5BBC 0000                DATA   0          SOUTH SPUR
1040  5BBD 0000                DATA   0
1041  5BBE 0000                DATA   0
1042  5BBF 0000                DATA   0
1043                     *
1044                     *     MINIMUM DWELL TIMES
1045                     *
1046  5270                     ABS    :5270
1047  5270 000A                DATA   10         NORTH BAG
1048  5271 000A                DATA   10         X      TICK
1049  5272 000A                DATA   10         X      A
1050  5273 000A                DATA   10         X      B
1051  5274 000A                DATA   10         X      C
1052  5275 000A                DATA   10         X      D
1053  5276 000A                DATA   10         X      BYPASS
1054  5277 000A                DATA   10         X      STOR
1055  5278 000A                DATA   10         SOUTH BAG
1056  5279 000A                DATA   10         X      TICK
1057  527A 000A                DATA   10         X      A
1058  527B 000A                DATA   10         X      B
1059  527C 000A                DATA   10         X      C
1060  527D 000A                DATA   10         X      D
1061  527E 000A                DATA   10         X      BYPASS
1062  527F 000A                DATA   10         X      SPUR
1063                     *
1064  5B10                     ABS    :5B10
1065  5B10 2B00                DATA   NGELOG
1066  5B11 2C60                DATA   SGELOG
1067                           END
0002                     *
0003                     *
0004                     *          INPUT TABLE, STATION CANCEL, BYPASS FLAG
0005                     *
0006                     *
0007                     *     ONE PROGRAM READS THE INPUTS FOR TRACK
0008                     *     CIRCUITS, GATES, GATE REQUEST PUSHBUTTONS,
0009                     *     AND SWITCHES. PAST VALUE, CHANGE OF STATE,
0010                     *     WENT TO 1, AND WENT TO 0 TABLES ARE
0011                     *     CONSTRUCTED. A SECOND PORTION OF THIS ROUTINE
0012                     *     HANDLES THE LOCKOUT TABLES.
0013                     *
0014                     *     A SECOND ROUTINE MONITORS STATION TRACK
0015                     *     CIRCUITS AND CANCELS FLAGS AND STATUS WORDS
0016                     *     WHENEVER A STATION BLOCK BECOMES UNOCCUPIED.
0017                     *
0018                     *     BYPASS ROUTING FLAGS ARE SET AND RESET
0019                     *     AS GATES CLEAR AND TK CKTS BECOME OCCUPIED
0020                     *
0021                     *
0022                     *     THE FOLLOWING ROUTINES ARE INCLUDED:
0023                     *
0024                     *      1.  TABLE SETUP LOGIC
0025                     *
0026                     *      2.  LOCKOUT TABLE HANDLER
0027                     *
0028                     *      3.  STATION LOCKOUT RESET
0029                     *
```

```
0030                    *        4. GATE LOCKOUT CANCEL
0031                    *
0032                    *        5. TRIPSTOP LOCKOUT HANDLER
0033                    *
0034                    *        6. TURNBACK LOCKOUT CANCEL
0035                    *
0036                    *        7. STATION CANCEL LOGIC
0037                    *
0038                    *        8. RUNTHRU DETECT SUBROUTINE
0039                    *
0040                    *        9. BYPASS ROUTE FLAG LOGIC
0041                    *
0042                    *
0043                    *      THE FOLLOWING TABLES ARE USED:
0044                    *
0045                    *        1. TKIN    TRACK CIRCUIT INPUTS
0046                    *        2. TKPV                   PAST VALUES
0047                    *        3. TKCHG                  CHANGES
0048                    *        4. TKTO1                  WENT TO 1
0049                    *        5. TKTOZ                  WENT TO 0
0050                    *
0051                    *        1. GKIN    GATE INPUTS
0052                    *        2. GKPV          PAST VALUES
0053                    *        3. GKCHG         CHANGES
0054                    *        4. GKTO1         WENT TO 1
0055                    *        5. GKTOZ         WENT TO 0
0056                    *
0057                    *        1. SWIN    SWITCH POSITION INPUTS
0058                    *        2. SWPV                     PAST VALUES
0059                    *        3. SWCHG                    CHANGES
0060                    *        4. SWTO1                    WENT TO 1
0061                    *        5. SWTOZ                    WENT TO 0
0062                    *
0063                    *        1. GPBIN   GATE REQ PB INPUTS
0064                    *        2. GPBPV                PAST VALUES
0065                    *        3. GPBCHG               CHANGES
0066                    *        4. GPBTO1               WENT TO 1
0067                    *        5. GPBTOZ               WENT TO 0
0068                    *        6. PBSET   MANUAL ROUTE SETUP BITS
0069                    *        7. PBCAN   MANUAL ROUTE CANCEL BITS
0070                    *
0071                    *
0072                    *
0073                    *        1. LK    SOFTWARE LOCKOUT TABLE
0074                    *        2. TLK   TKIN "ORED" WITH LK
0075                    *        3. SWLK SWITCH REQUEST LOCKOUTS
0076                    *        4. TSLK TRIP STOP LOCKOUTS
0077                    *        5. GKLK GATE LOCKOUTS
0078                    *
0079                    *
0080                    *
0081                    *        THIS LISTING ALSO CONTAINS SOME SUB-
0082                    *        ROUTINES AND TABLES THAT ARE USED BY
0083                    *        THE ROUTING PROGRAMS. THE SUBROUTINES
0084                    *        ARE THE FOLLOWING:
0085                    *
0086                    *        1. FETCH  LOC :5900 CHECK IF BIT IS 1
0087                    *        2. PACK1  LOC :5910 PACK BIT IN PAGE 0
0088                    *        3. PACK0  LOC :5920 PACK ZERO IN PAGE 0
0089                    *        4. PACK00 LOC :5930 PACK 0 IN SW OUT
0090                    *
0091                    *
0092                    *        THE TABLES ARE THE ESTRT TABLES
0093                    *
0094                    *        1. ESTRT   LOC :5880 ENT/EXIT
0095                    *        2. ESTKEY  LOC :58A0 KEY/KEY+1
0096                    *        3. ESTTK   LOC :58C0 TK
```

```
0098                        *
0099                        *
0100                        *          TABLE SETUP ROUTINE
0101                        *
0102                        *
0103  2000                          ABS    :2000
0104  2000 0800           ETCENT ENT
0105  2001 0C00                    DIN                DISABLE INTERRUPTS
0106  2002 B286 2089               LDA    ATKIN       SET UP TK POINTERS
0107  2003 9A9A 209E               STA    IN          INPUT
0108  2004 B285 208A               LDA    ATKPV
0109  2005 9A99 209F               STA    PV          PAST VALUES
0110  2006 B284 208B               LDA    ATKCHG
0111  2007 9A98 20A0               STA    CHG         CHANGE
0112  2008 B283 208C               LDA    CTKT01
0113  2009 9A97 20A1               STA    T01         WENT TO 1
0114  200A B2EC 20F7               LDA    ATKT02
0115  200B 9A96 20A2               STA    T02         WENT TO 0
0116  200C C704                    LAM    4           SET UP LOOP, 4 WORDS
0117  200D 9A7A 2088               STA    CNT
0118  200E B38F 209E      TKTAB    LDA    *IN
0119  200F AB8F 209F               XOR    *PV
0120  2010 9B8F 20A0               STA    *CHG        CHANGES
0121  2011 838C 209E               AND    *IN
0122  2012 9B8E 20A1               STA    *T01        WENT TO 1
0123  2013 B38C 20A0               LDA    *CHG
0124  2014 838A 209F               AND    *PV
0125  2015 9B8C 20A2               STA    *T02        WENT TO 0
0126  2016 B387 209E               LDA    *IN
0127  2017 9B87 209F               STA    *PV         NEW PAST VALUE
0128  2018 DA85 209E               IMS    IN          INC POINTERS
0129  2019 DA85 209F               IMS    PV
0130  201A DA85 20A0               IMS    CHG
0131  201B DA85 20A1               IMS    T01
0132  201C DA85 20A2               IMS    T02
0133  201D DA6A 2088               IMS    CNT         FINISHED ?
0134  201E F610 200F               JMP    TKTAB       NO
0135                        *
0136  201F B26D 208D               LDA    AGKIN       YES, SET UP GK POINTERS
0137  2020 9A7D 209E               STA    IN          INPUT
0138  2021 B26C 208E               LDA    AGKPV
0139  2022 9A7C 209F               STA    PV          PAST VALUE
0140  2023 B26B 208F               LDA    AGKCHG
0141  2024 9A7B 20A0               STA    CHG         CHANGE
0142  2025 B26A 2090               LDA    AGKT01
0143  2026 9A7A 20A1               STA    T01         WENT TO 1
0144  2027 B269 2091               LDA    AGKT02
0145  2028 9A79 20A2               STA    T02         WENT TO 0
0146  2029 C702                    LAM    2
0147  202A 9A5D 2088               STA    CNT         SET UP LOOP, 2 WORDS
0148  202B F201 202D               JMP    GKTAB
0149                        *
0150  202C F72C 2000      EXIT     RTN    ETCENT
0151                        *
0152  202D B370 209E      GKTAB    LDA    *IN
0153  202E AB70 209F               XOR    *PV
0154  202F 9B70 20A0               STA    *CHG        CHANGES
0155  2030 836D 209E               AND    *IN
0156  2031 9B6F 20A1               STA    *T01        WENT TO 1
0157  2032 B36D 20A0               LDA    *CHG
0158  2033 836B 209F               AND    *PV
0159  2034 9B6D 20A2               STA    *T02        WENT TO 0
0160  2035 B368 209F               LDA    *IN
0161  2036 9B68 209F               STA    *PV         NEW PAST VALUE
0162  2037 DA66 209E               IMS    IN          INC POINTERS
0163  2038 DA66 209F               IMS    PV
0164  2039 DA66 20A0               IMS    CHG
```

```
0165  203A DA66 20A1          IMS   TO1
0166  203B DA66 20A2          IMS   TO2
0167  203C DA4B 2088          IMS   CNT      FINISHED ?
0168  203D F610 202D          JMP   GKTAB    NO
0169                   *
0170  203E B253 2092          LDA   ASWIN    YES, SET UP SW POINTERS
0171  203F 9A5E 209E          STA   IN       INPUTS
0172  2040 B252 2093          LDA   ASWPV
0173  2041 9A5D 209F          STA   PV       PAST VALUE
0174  2042 B251 2094          LDA   ASWCHG
0175  2043 9A5C 20A0          STA   CHG      CHANGE
0176  2044 B250 2095          LDA   ASWTO1
0177  2045 9A5B 20A1          STA   TO1      WENT TO 1
0178  2046 B24F 2096          LDA   ASWTO2
0179  2047 9A5A 20A2          STA   TO2      WENT TO 0
0180  2048 C702               LAM   2
0181  2049 9A3E 2088          STA   CNT      SET UP LOOP, 2 WORDS
0182  204A B353 209E  SWTAB   LDA   *IN
0183  204B AB53 209F          XOR   *PV
0184  204C 9B53 20A0          STA   *CHG     CHANGES
0185  204D 8350 209E          AND   *IN
0186  204E 9B52 20A1          STA   *TO1     WENT TO 1
0187  204F B350 20A0          LDA   *CHG
0188  2050 834E 209F          AND   *PV
0189  2051 9B50 20A2          STA   *TO2     WENT TO 0
0190  2052 B34B 209E          LDA   *IN
0191  2053 9B4B 209F          STA   *PV      NEW PAST VALUE
0192  2054 DA49 209E          IMS   IN       INC POINTERS
0193  2055 DA49 209F          IMS   PV
0194  2056 DA49 20A0          IMS   CHG
0195  2057 DA49 20A1          IMS   TO1
0196  2058 DA49 20A2          IMS   TO2
0197  2059 DA2E 2088          IMS   CNT      FINISHED ?
0198  205A F610 204A          JMP   SWTAB    NO
0199                   *
0200  205B B23B 2097          LDA   AGPBIN   YES, SET UP GBP POINTERS
0201  205C 9A41 209E          STA   IN       INPUT
0202  205D B23A 2098          LDA   AGPBPV
0203  205E 9A40 209F          STA   PV       PAST VALUE
0204  205F B239 2099          LDA   AGPBCH
0205  2060 9A3F 20A0          STA   CHG      CHANGE
0206  2061 B238 209A          LDA   AGPBT1
0207  2062 9A3E 20A1          STA   TO1      WENT TO 1
0208  2063 B237 209B          LDA   AGPBTZ
0209  2064 9A3D 20A2          STA   TO2      WENT TO 0
0210  2065 B236 209C          LDA   APBCAN
0211  2066 9A3C 20A3          STA   CAN      MAN CAN BITS
0212  2067 B235 209D          LDA   APBSET
0213  2068 9A3B 20A4          STA   SET      MAN SET BITS
0214  2069 B226 2090          LDA   AGKTO1
0215  206A 9A3A 20A5          STA   GK       GATE INPUT
0216  206B C702               LAM   2
0217  206C 9A1B 2088          STA   CNT      SET UP LOOP, 2 WORDS
0218  206D B330 209E  GPBTAB  LDA   *IN
0219  206E AB30 209F          XOR   *PV
0220  206F 9B30 20A0          STA   *CHG     CHANGES
0221  2070 832D 209E          AND   *IN
0222  2071 9B2F 20A1          STA   *TO1     WENT TO 1
0223  2072 B32D 20A0          LDA   *CHG
0224  2073 832B 209F          AND   *PV
0225  2074 9B2D 20A2          STA   *TO2     WENT TO 0
0226  2075 A32D 20A3          IOR   *CAN
0227  2076 9B2C 20A3          STA   *CAN     MANUAL CANCEL
0228  2077 B326 209E          LDA   *IN
0229  2078 9B26 209F          STA   *PV      NEW PAST VALUE
0230  2079 B32B 20A5          LDA   *GK
0231  207A 8323 209E          AND   *IN
```

```
207B 9B28 20A4          STA    *SET      MANUAL SETUP
207C DA21 209E          IMS    IN        INC POINTERS
207D DA21 209F          IMS    PV
207E DA21 20A0          IMS    CHG
207F DA21 20A1          IMS    TO1
2080 DA21 20A2          IMS    TOZ
2081 DA21 20A3          IMS    CAN
2082 DA21 20A4          IMS    SET
2083 DA21 20A5          IMS    GK
2084 DA03 2088          IMS    CNT       FINISHED ?
2085 F618 206D          JMP    GPBTAB    NO
2086 0A00               EIN              YES, ENABLE INTERRUPTS
2087 F21E 20A6          JMP    LKOUT
2088 0000        CNT    DATA   0         LOOP COUNTER
                 *
                 *      TRACK CIRCUIT ADDRESS POINTERS
                 *
2089 008C        ATKIN  DATA   :8C       INPUT ADDRESS
208A 5070        ATKPV  DATA   :5070     PAST VALUE ADDRESS
208B 5074        ATKCHG DATA   :5074     CHANGE ADDRESS
208C 5078        CTKTO1 DATA   :5078     WENT TO 1 ADDRESS
                 *
                 *      GATE INDICATION ADDRESS POINTERS
                 *
208D 0088        AGKIN  DATA   :88       INPUT
208E 5060        AGKPV  DATA   :5060     PAST VALUES
208F 5062        AGKCHG DATA   :5062     CHANGE
2090 5064        AGKTO1 DATA   :5064     WENT TO 1
2091 5066        AGKTOZ DATA   :5066     WENT TO 2
                 *
                 *      SWITCH POSITION ADDRESS POINTERS
                 *
2092 008A        ASWIN  DATA   :8A       INPUT
2093 5068        ASWPV  DATA   :5068     PAST VALUE
2094 506A        ASWCHG DATA   :506A     CHANGE
2095 506C        ASWTO1 DATA   :506C     WENT TO 1
2096 506E        ASWTOZ DATA   :506E     WENT TO 0
                 *
                 *      GATE REQUEST PUSH BUTTON ADDRESS POINTERS
                 *
2097 0084        AGPBIN DATA   :84       INPUT
2098 5040        AGPBPV DATA   :5040     PAST VALUE
2099 5042        AGPBCH DATA   :5042     CHANGE
209A 5044        AGPBT1 DATA   :5044     WENT TO 1
209B 5046        AGPBTZ DATA   :5046     WENT TO 0
209C 504A        APBCAN DATA   :504A     MAN CAN BITS
209D 5048        APBSET DATA   :5048     MAN SETUP BITS
                 *
                 *      WORKING TABLE ADDRESS POINTERS
                 *
209E 0000        IN     DATA   0         INPUTS
209F 0000        PV     DATA   0         PAST VALUES
20A0 0000        CHG    DATA   0         CHANGES
20A1 0000        TO1    DATA   0         WENT TO 1
20A2 0000        TOZ    DATA   0         WENT TO 0
20A3 0000        CAN    DATA   0         MAN CAN
20A4 0000        SET    DATA   0         MAN SETUP
20A5 0000        GK     DATA   0         GATE INPUTS
                 *
                 *
                 *     LOCKOUT TABLE HANDLING ROUTINE
                 *
                 *     THREE TABLES ARE USED FOR THE SOFTWARE
                 *     INTERLOCKING CHECKS.
                 *
                 *      1.  TK   TRACK CIRCUIT INDICATIONS
                 *      2.  LK   SOFTWARE LOCKOUTS
```

```
0301                    *       3.  TLK  TK "ORED" WITH LK
0302                    *
0303                    *       THE TK TABLE IS USED TO RESET BITS IN
0304                    *       THE LK TABLE.  THEN TK AND LK ARE
0305                    *       "ORED" TOGETHER TO FORM THE TLK TABLE.
0306                    *       TLK IS USED FOR ROUTE AVAILABLE CHECKS.
0307                    *
0308                    *
0309  20A6 C704         LKOUT   LAM     4           SET UP LOOP
0310  20A7 9E1F 2088            STA     CNT
0311  20A8 0108                 ZXR                 X = 0
0312  20A9 B29F 2149            LDA     ALK
0313  20AA 9E06 20A4            STA     SET         POINTER TO LK
0314  20AB B48C 008C  LK1       LDA     @TKIN       TK INPUTS
0315  20AC 0210                 CAR                 NOT TK INPUTS
0316  20AD 8709 20A4            AND     *SET        LK TABLE
0317  20AE 9F0A 20A4            STA     *SET        NEW LK TABLE
0318  20AF A48C 008C            IOR     @TKIN       TK "OR" LK
0319  20B0 9CB2 00B2            STA     @TKLK       TLK TABLE
0320  20B1 DE0D 20A4            IMS     SET
0321  20B2 0128                 IXR
0322  20B3 DE2B 2088            IMS     CNT         DONE ?
0323  20B4 F609 20AB            JMP     LK1         NO
0324  20B5 F200 20B6            JMP     STALK       YES
0325                    *
0326        008C        TKIN    EQU     :8C
0327        00B2        TKLK    EQU     :B2
0328                    *
0329                    *
0330                    *       STATION LOCKOUT RESET
0331                    *
0332                    *       THESE LOCKOUTS ARE SET IN THE STATION
0333                    *       LOGIC ROUTINES AND ARE RESET BY GATES
0334                    *       CLEARING.
0335                    *
0336  20B6 B088 0088    STALK   LDA     GK1         GET GATE INPUT 1
0337  20B7 A084 0084            IOR     GKPB        GATE PB
0338  20B8 0210                 CAR                 COMP
0339  20B9 80C0 00C0            AND     STALK1      AND WITH LOCKOUT 1
0340  20BA 98C0 00C0            STA     STALK1      STORE NEW LOCKOUT
0341  20BB B089 0089            LDA     GK1+1       GET GATE INPUT 2
0342  20BC A085 0085            IOR     GKPB+1      GATE PB
0343  20BD 0210                 CAR                 COMP
0344  20BE 80C1 00C1            AND     STALK1+1    AND WITH LOCKOUT 2
0345  20BF 98C1 00C1            STA     STALK1+1    STORE NEW LOCKOUT
0346  20C0 F200 20C1            JMP     GKLKON
0347                    *
0348        0088        GK1     EQU     :88
0349        00C0        STALK1  EQU     :C0
0350        0084        GKPB    EQU     :84
0351                    *
0352                    *
0353                    *       GATE LOCKOUT CANCEL
0354                    *
0355  20C1 B630 2091    GKLKON  LDA     AGKTOZ      GK WENT TO 0 ADDERESS
0356  20C2 9E20 20A2            STA     TOZ
0357  20C3 B22D 20F1            LDA     AGKLKS      GATE LK ADDRESS
0358  20C4 9E26 209E            STA     IN
0359  20C5 B727 209E            LDA     *IN         GET SETUP GKLK
0360  20C6 A0C4 00C4            IOR     GKLK        PUT IN GKLK TABLE
0361  20C7 98C4 00C4            STA     GKLK
0362  20C8 0110                 ZAR
0363  20C9 9F2B 209E            STA     *IN         ZERO SETUP LKS
0364  20CA DE2C 209E            IMS     IN
0365  20CB B72D 209E            LDA     *IN         DO SECOND WORD
0366  20CC A0C5 00C5            IOR     GKLK+1
0367  20CD 98C5 00C5            STA     GKLK+1
```

```
20CE 0110                ZAR
20CF 9F31 209E           STA     *IN
20D0 DE32 209E           IMS     IN
20D1 B733 209E           LDA     *IN       DO THIRD WORD
20D2 A0C6 00C6           IOR     GKLK+2
20D3 98C6 00C6           STA     GKLK+2
20D4 0110                ZAR
20D5 9F37 209E           STA     *IN
20D6 DE38 209E           IMS     IN
20D7 B739 209E           LDA     *IN       DO FOURTH WORD
20D8 A0C7 00C7           IOR     GKLK+3
20D9 98C7 00C7           STA     GKLK+3
20DA 0110                ZAR
20DB 9F3D 209E           STA     *IN
20DC B73A 20A2           LDA     *TOZ      GATE TO ZERO
20DD A8C4 00C4           XOR     GKLK      LOCKOUTS
20DE 80C4 00C4           AND     GKLK
20DF 98C4 00C4           STA     GKLK      STORE FIRST WORD
20E0 DE3E 20A2           IMS     TOZ       INC POINTER
20E1 B73F 20A2           LDA     *TOZ      GATE TO ZERO
20E2 A8C5 00C5           XOR     GKLK+1    LOCKOUTS
20E3 80C5 00C5           AND     GKLK+1
20E4 98C5 00C5           STA     GKLK+1    STORE SECOND WORD
20E5 B654 2091           LDA     AGKTOZ    RESET POINTER
20E6 9E44 20A2           STA     TOZ
20E7 B745 20A2           LDA     *TOZ      DO THIRD WORD
20E8 A8C6 00C6           XOR     GKLK+2
20E9 80C6 00C6           AND     GKLK+2
20EA 98C6 00C6           STA     GKLK+2
20EB DE49 20A2           IMS     TOZ
20EC B74A 20A2           LDA     *TOZ      DO FOURTH WORD
20ED A8C7 00C7           XOR     GKLK+3
20EE 80C7 00C7           AND     GKLK+3
20EF 98C7 00C7           STA     GKLK+3
20F0 F201 20F2           JMP     TSPLK
                 *
     00C4        GKLK    EQU     :C4
20F1 5177        AGKLKS  DATA    GKLKS
                 *
                 *       TRIP STOP LOCKOUTS
                 *
20F2 B0A3 00A3   TSPLK   LDA     TSIN      TRIP STOP INPUTS
20F3 AA02 20F6           XOR     MASK
20F4 98C2 00C2           STA     TSLK      TRIP STOP LOCKOUTS
20F5 F205 20FB   TS1     JMP     LKCAN
                 *
     00A3        TSIN    EQU     :A3       TRIP STOP INPUTS
     00C2        TSLK    EQU     :C2       TRIP STOP LOCKOUTS
     0040        TBIN    EQU     :40       TURNBACK PB "ORED" WITH COMP TB
     0095        PBRUN   EQU     :95       RUNTHRU PB INPUTS
20F6 000A        MASK    DATA    :000A     MASK FOR TRIP STOPS
                 *
20F7 507C        ATKTOZ  DATA    :507C     WENT TO 0 ADDRESS
20F8 507D                DATA    :507D
20F9 507E                DATA    :507E
20FA 507F                DATA    :507F
                 *
                 *
                 *       LOCKOUT CANCEL WHEN TURNBACK IS MADE
                 *
                 *       IF THE TURNBACK PB OR COMPUTER OUTPUT
                 *       REQUEST IS ON WHEN CERTAIN STATION TRACK
                 *       CIRCUITS BECOME OCCUPIED, THE LOCKOUTS FOR
                 *       THAT ROUTE BEYOND THE STATION ARE RESET.
                 *
                 *
20FB B35C 2158   LKCAN  LDA     *TBOUT    GET TB OUTPUTS
```

```
0436  20FC A094 0094          IOR   TRNBK    "OR" WITH PB INPUTS
0437  20FD 9840 0040          STA   TRNBAK   STORE
0438  20FE B095 0095          LDA   PBRUN    CANCEL TURNBACK
0439  20FF 0210               CAR
0440  2100 8040 0040          AND   TRNBAK   IF RUNTHRU
0441  2101 9840 0040          STA   TRNBAK   PB IS ON
0442  2102 B34A 214D          LDA   *BTKTO1  CHECK STA BECAME OCC
0443  2103 805B 005B          AND   BIT0+B   9 TK
0444  2104 3113 2118          JAN   LKNA     NA
0445  2105 B348 214E  LK2     LDA   *BTKTO1+1
0446  2106 8055 0055          AND   BIT0+5   18 TK
0447  2107 3117 211F          JAN   LKNC     NC
0448  2108 B345 214E  LK3     LDA   *BTKTO1+1
0449  2109 8058 0058          AND   BIT0+8   21A TK
0450  210A 311B 2126          JAN   LKND     ND
0451  210B B343 214F  LK4     LDA   *BTKTO1+2
0452  210C 8057 0057          AND   BIT0+7   30B TK
0453  210D 311F 212D          JAN   LKST     ST
0454  210E B340 214F  LK5     LDA   *BTKTO1+2
0455  210F 805B 005B          AND   BIT0+B   34 TK
0456  2110 3123 2134          JAN   LKSA     SA
0457  2111 B33E 2150  LK6     LDA   *BTKTO1+3
0458  2112 8055 0055          AND   BIT0+5   43 TK
0459  2113 3127 213B          JAN   LKSC     SC
0460  2114 B33B 2150  LK7     LDA   *BTKTO1+3
0461  2115 805A 005A          AND   BIT0+A   48 TK
0462  2116 312B 2142          JAN   LKSD     SD
0463  2117 F241 2159  LK8     JMP   STACAN
0464  2118 B040 0040  LKNA    LDA   TRNBAK   CHECK NA TURNBACKS
0465  2119 8053 0053          AND   BIT0+3
0466  211A 2155 2105          JAZ   LK2      OFF
0467  211B B32D 2149          LDA   *ALK     ON, RESET LOCKOUTS
0468  211C 8234 2151          AND   NAMSK    10, 11, 12 LKS
0469  211D 982B 2149          STA   *ALK
0470  211E F619 2105          JMP   LK2
0471  211F B040 0040  LKNC    LDA   TRNBAK   CHECK NC TURNBACKS
0472  2120 8055 0055          AND   BIT0+5
0473  2121 2159 2108          JAZ   LK3      OFF
0474  2122 B327 214A          LDA   *ALK+1   ON, RESET LOCKOUTS
0475  2123 822E 2152          AND   NCMSK    19, 20, 21A, 21B LKS
0476  2124 9825 214A          STA   *ALK+1
0477  2125 F61D 2108          JMP   LK3
0478  2126 B040 0040  LKND    LDA   TRNBAK   CHECK ND TURNBACKS
0479  2127 8056 0056          AND   BIT0+6
0480  2128 215D 210B          JAZ   LK4      OFF
0481  2129 B320 214A          LDA   *ALK+1   ON, RESET LOCKOUTS
0482  212A 8228 2153          AND   NDMSK    21B LK
0483  212B 981E 214A          STA   *ALK+1
0484  212C F621 210B          JMP   LK4
0485  212D B040 0040  LKST    LDA   TRNBAK   CHECK ST TURNBACKS
0486  212E 805A 005A          AND   BIT0+A
0487  212F 2161 210E          JAZ   LK5      OFF
0488  2130 B31A 214B          LDA   *ALK+2   ON, RESET LOCKOUTS
0489  2131 8222 2154          AND   STMSK    30A LK
0490  2132 9818 214B          STA   *ALK+2
0491  2133 F625 210E          JMP   LK5
0492  2134 B040 0040  LKSA    LDA   TRNBAK   CHECK SA TURNBACKS
0493  2135 805B 005B          AND   BIT0+B
0494  2136 2166 2111          JAZ   LK6      OFF
0495  2137 B313 214B          LDA   *ALK+2   ON, RESET LOCKOUTS
0496  2138 821C 2155          AND   SAMSK    30A, 30B, 31, 32, 33 LKS
0497  2139 9811 214B          STA   *ALK+2
0498  213A F629 2111          JMP   LK6
0499  213B B040 0040  LKSC    LDA   TRNBAK   CHECK SC TURNBACK
0500  213C 805D 005D          AND   BIT0+D
0501  213D 2169 2114          JAZ   LK7      OFF
0502  213E B30D 214C          LDA   *ALK+3   ON, RESET LOCKOUTS
```

```
0503  213F 8216 2156          AND    SCMSK    40, 41, 42 LKS
0504  2140 9B0B 214C          STA    *ALK+3
0505  2141 F62D 2114          JMP    LK7
0506  2142 B040 0040  LKSD    LDA    TRNBAK   CHECK SD LOCKOUTS
0507  2143 805E 005E          AND    BIT0+E
0508  2144 216D 2117          JAZ    LK8      OFF
0509  2145 B306 214C          LDA    *ALK+3   ON, RESET LOCKOUTS
0510  2146 8210 2157          AND    SDMSK    49 LK
0511  2147 9B04 214C          STA    *ALK+3
0512  2148 F631 2117          JMP    LK8
0513                  *
0514                  *
0515  2149 5156       ALK     DATA   :5156    LK TABLE ADDRESS
0516  214A 5157               DATA   :5157
0517  214B 5158               DATA   :5158
0518  214C 5159               DATA   :5159
0519  214D 5078       BTKT01  DATA   :5078    TKT01 TABLE ADDRESS
0520  214E 5079               DATA   :5079
0521  214F 507A               DATA   :507A
0522  2150 507B               DATA   :507B
0523                  *
0524                  *
0525  2151 8FFF       NAMSK   DATA   :8FFF    10, 11, 12 LKS
0526  2152 FC3F       NCMSK   DATA   :FC3F    19, 20, 21A, 21B LKS
0527  2153 FDFF       NDMSK   DATA   :FDFF    21B LKS
0528  2154 FFBF       STMSK   DATA   :FFBF    30A LK
0529  2155 F83F       SAMSK   DATA   :F83F    30A, 30B, 31, 32, 33 LKS
0530  2156 FFE3       SCMSK   DATA   :FFE3    40, 41, 42 LKS
0531  2157 F7FF       SDMSK   DATA   :F7FF    49 LK
0532                  *
0533        0040      TRNBAK  EQU    :40      "ORED" WORDS
0534  2158 5111       TBOUT   DATA   :5111    TB OUTPUT WORD
0535        0094      TRNBK   EQU    :94      TB PB INPUT WORD
0536                  *
0537        0095      RUNTH   EQU    :95      RUNTHRU PB INPUTS
0538        00B0      DIR     EQU    :B0      DIRECTION TABLE
0540                  *
0541                  *
0542                  *        STATION CANCEL ROUTINE
0543                  *
0544                  *      THIS ROUTINE PERFORMS THOSE FUNCTIONS
0545                  *      REQUIRED WHENEVER A STATION TRACK CIRCUIT
0546                  *      BECOMES UNOCCUPIED.  EACH OF THE STATIONS
0547                  *      HAS ONE OR MORE OF THESE FUNCTIONS.  THE
0548                  *      FUNCTIONS ARE:
0549                  *
0550                  *        1. RESET STATION STATUS WORD
0551                  *        2. RESET STRDFG BIT
0552                  *        3. RESET DISPFG BIT
0553                  *        4. RESET CLOSE DOOR OUTPUT BIT
0554                  *        5. RESET RUNTHRU ALARM FLAG
0555                  *        6. RESET NO DEPART TO ALARM FLAG
0556                  *
0557                  *
0558  2159 B762 20F7  STACAN LDA    *ATKTOZ+0
0559  215A 8053 0053          AND    BIT0+3   ZT NG BECAME UNOCC ?
0560  215B 2101 215D          JAZ    STA1
0561  215C F265 21C2          JMP    NGCAN    YES
0562  215D B764 20F9  STA1    LDA    *ATKTOZ+2 NO
0563  215E 8053 0053          AND    BIT0+3   ZT SG BECAME UNOCC ?
0564  215F 2101 2161          JAZ    STA21
0565  2160 F26F 21D0          JMP    SGCAN    YES
0566  2161 B095 0095  STA21   LDA    RUNTH    NT RUNTHRU ON?
0567  2162 8052 0052          AND    BIT0+2
0568  2163 2107 216B          JAZ    STA2     NO
0569  2164 B0B0 00B0          LDA    DIR+0    YES, SAT DIR = WEST?
0570  2165 8054 0054          AND    BIT0+4
```

```
0571  2166 2104 216B        JAZ    STA2      NO
0572  2167 B770 20F7        LDA    *ATKTOZ+0 YES, SAT BECAME UNOCC?
0573  2168 8056 0056        AND    BIT0+6
0574  2169 2105 216F        JAZ    STA3      NO
0575  216A F273 21DE        JMP    NTCAN     YES, CANCEL NT
0576  216B B774 20F7  STA2  LDA    *ATKTOZ+0 NO
0577  216C 8057 0057        AND    BIT0+7    SBT  NT BECAME UNOCC ?
0578  216D 2101 216F        JAZ    STA3
0579  216E F26F 21DE        JMP    NTCAN     YES
0580  216F B776 20F9  STA3  LDA    *ATKTOZ+2 NO
0581  2170 8057 0057        AND    BIT0+7    30BT ST BECAME UNOCC ?
0582  2171 2101 2173        JAZ    STA4
0583  2172 F273 21E6        JMP    STCAN     YES
0584  2173 B77C 20F7  STA4  LDA    *ATKTOZ+0 NO
0585  2174 805B 005B        AND    BIT0+B    9T NA BECAME UNOCC ?
0586  2175 2101 2177        JAZ    STA51
0587  2176 F277 21EE        JMP    NACAN     YES
0588  2177 B095 0095  STA51 LDA    RUNTH     SA RUNTHRU ON?
0589  2178 805B 005B        AND    BIT0+B
0590  2179 2107 2181        JAZ    STA5      NO
0591  217A B081 0081        LDA    DIR+1     YES, 35T DIR = EAST?
0592  217B 8054 0054        AND    BIT0+4
0593  217C 2104 2181        JAN    STA5      NO
0594  217D B784 20F9        LDA    *ATKTOZ+2 YES, 35T BECAME UNOCC?
0595  217E 805C 005C        AND    BIT0+C
0596  217F 2105 2185        JAZ    STA6      NO
0597  2180 F275 21F6        JMP    SACAN     YES, CANCEL SA
0598  2181 B789 20FB  STA5  LDA    *ATKTOZ+2 NO
0599  2182 805B 005B        AND    BIT0+B    34T  SA BECAME UNOCC ?
0600  2183 2101 2185        JAZ    STA6
0601  2184 F271 21F6        JMP    SACAN     YES
0602  2185 B78E 20F7  STA6  LDA    *ATKTOZ+0 NO
0603  2186 805E 005E        AND    BIT0+E    12T NA BECAME UNOCC ?
0604  2187 2101 2189        JAZ    STA7
0605  2188 F275 21FE        JMP    NBCAN     YES
0606  2189 B78F 20FA  STA7  LDA    *ATKTOZ+3 NO
0607  218A 8052 0052        AND    BIT0+2    40T SB BECAME UNOCC ?
0608  218B 2101 218D        JAZ    STA81
0609  218C F279 2206        JMP    SBCAN     YES
0610  218D B095 0095  STA81 LDA    RUNTH     NO RUNTHRU ON?
0611  218E 8055 0055        AND    BIT0+5
0612  218F 2107 2197        JAZ    STA8      NO
0613  2190 B080 0080        LDA    DIR+0     YES, 17T DIR = WEST?
0614  2191 8059 0059        AND    BIT0+9
0615  2192 2104 2197        JAZ    STA8      NO
0616  2193 B79B 20F8        LDA    *ATKTOZ+1 YES, 17T BECAME UNOCC?
0617  2194 8054 0054        AND    BIT0+4
0618  2195 2105 219B        JAZ    STA9      NO
0619  2196 F277 220E        JMP    NCCAN     YES, CANCEL NC
0620  2197 B79F 20F8  STA8  LDA    *ATKTOZ+1 NO
0621  2198 8055 0055        AND    BIT0+5    12T NC BECAME UNOCC ?
0622  2199 2101 219B        JAZ    STA9
0623  219A F273 220E        JMP    NCCAN     YES
0624  219B B7A1 20FA  STA9  LDA    *ATKTOZ+3 NO
0625  219C 8055 0055        AND    BIT0+5    43T SC BECAME UNOCC ?
0626  219D 2101 219F        JAZ    STA10
0627  219E F277 2216        JMP    SCCAN     YES
0628  219F B7A7 20F8  STA10 LDA    *ATKTOZ+1 NO
0629  21A0 8058 0058        AND    BIT0+8    21AT ND BECAME UNOCC ?
0630  21A1 2101 21A3        JAZ    STA111
0631  21A2 F27B 2215        JMP    NDCAN     YES
0632  21A3 B095 0095  STA111 LDA    RUNTH     SD RUNTHRU ON?
0633  21A4 805E 005E        AND    BIT0+E
0634  21A5 2107 21AD        JAZ    STA11     NO
0635  21A6 B081 0081        LDA    DIR+1     YES, 49T DIR = EAST?
0636  21A7 805B 005B        AND    BIT0+B
0637  21A8 2104 21AD        JAN    STA11     NO
```

```
0638  21A9 B7AF 20FA        LDA   *ATKTOZ+3 YES. 49T BECAME UNOCC?
0639  21AA 805B 005B        AND   BIT0+B
0640  21AB 2105 21B1        JAZ   STA12     NO
0641  21AC F279 2226        JMP   SDCAN     YES: CANCEL SD
0642  21AD B7B3 20FA  STA11 LDA   *ATKTOZ+3 NO
0643  21AE 805A 005A        AND   BIT0+A    48T SD BECAME UNOCC UNOCC ?
0644  21AF 2101 21B1        JAZ   STA12
0645  21B0 F275 2226        JMP   SDCAN     YES
0646  21B1 B7B9 20F8  STA12 LDA   *ATKTOZ+1 NO
0647  21B2 8052 0052        AND   BIT0+2    15T NY BECAME UNOCC ?
0648  21B3 2101 21B5        JAZ   STA13
0649  21B4 F279 222E        JMP   NYCAN     YES
0650  21B5 B7B8 20FA  STA13 LDA   *ATKTOZ+3 NO
0651  21B6 8050 0050        AND   BIT0+A    29T SY BECAME UNOCC ?
0652  21B7 2101 21B9        JAZ   STA14
0653  21B8 F280 2239        JMP   SYCAN     YES
0654  21B9 B7C1 20F8  STA14 LDA   *ATKTOZ+1 NO
0655  21BA 805B 005B        AND   BIT0+B    23T NS BECAME UNOCC ?
0656  21BB 2101 21BD        JAZ   STA15
0657  21BC F287 2244        JMP   NSCAN     YES
0658  21BD B7C3 20FA  STA15 LDA   *ATKTOZ+3 NO
0659  21BE 805D 005D        AND   BIT0+D    51T SR BECAME UNOCC ?
0660  21BF 2101 21C1        JAZ   STA16
0661  21C0 F28E 224F        JMP   SSCAN     YES
0662  21C1 F297 2259  STA16 JMP   STAEND    COMPLETE. EXIT
0663  21C2 0110        NGCAN ZAR
0664  21C3 9BA8 226C        STA   *NGSTAT   RESET STATUS WORD
0665  21C4 B041 0041        LDA   STRDFG
0666  21C5 8060 0060        AND   NBIT0+0   RESET STORED FLAG
0667  21C6 9841 0041        STA   STRDFG
0668  21C7 B049 0049        LDA   DISPFG
0669  21C8 8060 0060        AND   NBIT0+0   RESET DISPATCH FLAG
0670  21C9 9849 0049        STA   DISPFG
0671  21CA B3B1 227C        LDA   *DROUT
0672  21CB 8061 0061        AND   NBIT0-1   RESET CLOSE DOOR BIT
0673  21CC 9BAF 227C        STA   *DROUT
0674  21CD C400             LXP   0
0675  21CE FA8B 225A        CALL  ALR
0676  21CF F672 215D        JMP   STA1
0677  21D0 0110        SGCAN ZAR
0678  21D1 9BA2 2274        STA   *SGSTAT   RESET STATUS WORD
0679  21D2 B041 0041        LDA   STRDFG
0680  21D3 8068 0068        AND   NBIT0+8   RESET STORED FLAG
0681  21D4 9841 0041        STA   STRDFG
0682  21D5 B049 0049        LDA   DISPFG
0683  21D6 8068 0068        AND   NBIT0+8   RESET DISPATCH FLAG
0684  21D7 9849 0049        STA   DISPFG
0685  21D8 B3A3 227C        LDA   *DROUT
0686  21D9 8069 0069        AND   NBIT0+9   RESET CLOSE DOOR OUTPUT
0687  21DA 9BA1 227C        STA   *DROUT
0688  21DB C408             LXP   8
0689  21DC FA7D 225A        CALL  ALR
0690  21DD F672 216B        JMP   STA2
0691  21DE 0110        NTCAN ZAR
0692  21DF 9B8D 226D        STA   *NTSTAT   RESET STATUS WORD
0693  21E0 B39B 227C        LDA   *DROUT
0694  21E1 8062 0062        AND   NBIT0-2   RESET CLOSE DOOR OUTPUT
0695  21E2 9B99 227C        STA   *DROUT
0696  21E3 C401             LXP   1
0697  21E4 FA75 225A        CALL  ALR
0698  21E5 F676 216F        JMP   STA3
0699  21E6 0110        STCAN ZAR
0700  21E7 9B8D 2275        STA   *STSTAT   RESET STATUS WORD
0701  21E8 B393 227C        LDA   *DROUT
0702  21E9 806A 006A        AND   NBIT0-A   RESET CLOSE DOOR OUTPUT
0703  21EA 9B91 227C        STA   *DROUT
0704  21EB C409             LXP   9
```

```
0705  21EC FA6D 223A          CALL   ALR
0706  21ED F67A 2173          JMP    STA4
0707  21EE 0110        NACAN  ZAR
0708  21EF 9B7E 226E          STA    *NASTAT  RESET STATUS WORD
0709  21F0 B38B 227C          LDA    *DROUT
0710  21F1 8063 0063          AND    NBIT0+3  RESET CLOSE DOOR OUTPUT
0711  21F2 9B89 227C          STA    *DROUT
0712  21F3 C402               LXP    2
0713  21F4 FA65 225A          CALL   ALR
0714  21F5 F674 2181          JMP    STA5
0715  21F6 0110        SACAN  ZAR
0716  21F7 9B7E 2276          STA    *SASTAT  RESET STATUS WORD
0717  21F8 B383 227C          LDA    *DROUT
0718  21F9 806B 006B          AND    NBIT0+8  RESET CLOSE DOOR OUTPUT
0719  21FA 9B81 227C          STA    *DROUT
0720  21FB C40A               LXP    10
0721  21FC FA5D 225A          CALL   ALR
0722  21FD F678 2185          JMP    STA6
0723  21FE 0110        NBCAN  ZAR
0724  21FF 9B6F 226F          STA    *NBSTAT  RESET STATUS WORD
0725  2200 B37B 227C          LDA    *DROUT
0726  2201 8064 0064          AND    NBIT0+4  RESET CLOSE DOOR OUTPUT
0727  2202 9B79 227C          STA    *DROUT
0728  2203 C403               LXP    3
0729  2204 FA55 225A          CALL   ALR
0730  2205 F67C 2189          JMP    STA7
0731  2206 0110        SBCAN  ZAR
0732  2207 9B6F 2277          STA    *SBSTAT  RESET STATUS WORD
0733  2208 B373 227C          LDA    *DROUT
0734  2209 806C 006C          AND    NBIT0+C  RESET CLOSE DOOR OUTPUT
0735  220A 9B71 227C          STA    *DROUT
0736  220B C40B               LXP    11
0737  220C FA4D 225A          CALL   ALR
0738  220D F676 2197          JMP    STA8
0739  220E 0110        NCCAN  ZAR
0740  220F 9B60 2270          STA    *NCSTAT  RESET STATUS WORD
0741  2210 B36B 227C          LDA    *DROUT
0742  2211 8065 0065          AND    NBIT0+5  RESET CLOSE DOOR OUTPUT
0743  2212 9B69 227C          STA    *DROUT
0744  2213 C404               LXP    4
0745  2214 FA45 225A          CALL   ALR
0746  2215 F67A 219B          JMP    STA9
0747  2216 0110        SCCAN  ZAR
0748  2217 9B60 2278          STA    *SCSTAT  RESET STATUS WORD
0749  2218 B363 227C          LDA    *DROUT
0750  2219 806D 006D          AND    NBIT0+D  RESET CLOSE DOOR OUTPUT
0751  221A 9B61 227C          STA    *DROUT
0752  221B C40C               LXP    12
0753  221C FA3D 225A          CALL   ALR
0754  221D F67E 219F          JMP    STA10
0755  221E 0110        NDCAN  ZAR
0756  221F 9B51 2271          STA    *NDSTAT  RESET STATUS WORD
0757  2220 B35B 227C          LDA    *DROUT
0758  2221 8066 0066          AND    NBIT0+6  RESET CLOSE DOOR OUTPUT
0759  2222 9B59 227C          STA    *DROUT
0760  2223 C405               LXP    5
0761  2224 FA35 225A          CALL   ALR
0762  2225 F678 21AD          JMP    STA11
0763  2226 0110        SDCAN  ZAR
0764  2227 9B51 2279          STA    *SDSTAT  RESET STATUS WORD
0765  2228 B353 227C          LDA    *DROUT
0766  2229 806E 006E          AND    NBIT0+E  RESET CLOSE DOOR OUTPUT
0767  222A 9B51 227C          STA    *DROUT
0768  222B C40D               LXP    13
0769  222C FA2D 225A          CALL   ALR
0770  222D F67C 21B1          JMP    STA12
0771  222E 0110        NYCAN  ZAR
```

```
0772  222F 9842 2272          STA    *NYSTAT  RESET STATUS WORD
0773  2230 B041 0041          LDA    STRDFG
0774  2231 8066 0066          AND    NBIT0+6  RESET STORED FLAG
0775  2232 9841 0041          STA    STRDFG
0776  2233 B049 0049          LDA    DISPFG
0777  2234 8066 0066          AND    NBIT0+6  RESET DISPATCH FLAG
0778  2235 9849 0049          STA    DISPFG
0779  2236 C406               LXP    6
0780  2237 FA22 225A          CALL   ALR
0781  2238 F683 21B5          JMP    STA13
0782  2239 0110        SYCAN  ZAR
0783  223A 983F 227A          STA    *SYSTAT  RESET STATUS WORD
0784  223B B041 0041          LDA    STRDFG
0785  223C 806E 006E          AND    NBIT0+E  RESET STORED FLAG
0786  223D 9841 0041          STA    STRDFG
0787  223E B049 0049          LDA    DISPFG
0788  223F 806E 006E          AND    NBIT0+E  RESET DISPATCH FLAG
0789  2240 9849 0049          STA    DISPFG
0790  2241 C40E               LXP    14
0791  2242 FA17 225A          CALL   ALR
0792  2243 F68A 21B9          JMP    STA14
0793  2244 0110        NSCAN  ZAR
0794  2245 982D 2273          STA    *NSSTAT  RESET STATUS WORD
0795  2246 B041 0041          LDA    STRDFG
0796  2247 8067 0067          AND    NBIT0+7  RESET STORED FLAG
0797  2248 9841 0041          STA    STRDFG
0798  2249 B049 0049          LDA    DISPFG
0799  224A 8067 0067          AND    NBIT0+7  RESET DISPATCH FLAG
0800  224B 9849 0049          STA    DISPFG
0801  224C C407               LXP    7
0802  224D FA0C 225A          CALL   ALR
0803  224E F691 21BD          JMP    STA15
0804  224F 0110        SSCAN  ZAR
0805  2250 982A 227B          STA    *SSSTAT  RESET STATUS WORD
0806  2251 B041 0041          LDA    STRDFG
0807  2252 806F 006F          AND    NBIT0+F  RESET STORED FLAG
0808  2253 9841 0041          STA    STRDFG
0809  2254 B049 0049          LDA    DISPFG
0810  2255 806F 006F          AND    NBIT0+F  RESET DISPATCH FLAG
0811  2256 9849 0049          STA    DISPFG
0812  2257 C40F               LXP    15
0813  2258 FA01 225A          CALL   ALR
0814  2259 F227 2281  STREND JMP    BYFLG    FINISHED, GO DO BYPASS FLAGS
0816                 *
0817                 *
0818                 *      RUNTHRU DETECT SUBROUTINE
0819                 *
0820                 *
0821                 *      THIS SUBROUTINE DETECTS WHETHER A STATION
0822                 *      RUNTHRU HAS OCCURED  IF IT HAS, THE RUNTHRU
0823                 *      ALARM BIT IS SET AND THE FLAG BIT RESET.
0824                 *      THE  NO DEPART TO  FLAG BIT IS ALSO RESET
0825                 *
0826                 *      ENTER WITH STATION BIAS # IN N REGISTER
0827                 *
0828                 *
0829  225A 0290      ALR    ENT
0830  225B B30D 2269          LDA    *RNFLG
0831  225C 8450 0050          AND    @BIT0    CHECK RUNTHRU ALARM FLAG
0832  225D 2106 2264          JAZ    ALR1     OFF
0833  225E B30C 226B          LDA    *RNALR   ON
0834  225F A450 0050          IOR    @BIT0    SET RUNTHRU ALARM
0835  2260 980A 226B          STA    *RNALR
0836  2261 B307 2269          LDA    *RNFLG
0837  2262 8460 0060          AND    @NBIT0   RESET RUNTHRU FLAG
0838  2263 9805 2269          STA    *RNFLG
```

```
2264 B5C3 00C3  ALR1    LDA     +0BIT
2265 0210               CAR
2266 8303 226A          AND     +NOGOFG   RESET NO DEPART TO FLAG
2267 9802 226A          STA     +NOGOFG
2268 F70E 225A  ENDRUT  RTN     ALR
                        *
                        *
                        *
2269 5250       RNFLG   DATA    :5250     RUNTHRU FLAG WORD
226A 5251       NOGOFG  DATA    :5251     NO DEPART TO  FLAG WORD
226B 5871       RNALR   DATA    :5871     RUNTHRU ALARM WORD
     0003       BIT     EQU     :C3       POINTER TO RESET BIT TABLE
                        *
                        *       STATUS WORD ADDRESS POINTERS
                        *
226C 50C0       NGSTAT  DATA    :50C0     N BAD
226D 50C1       NTSTAT  DATA    :50C1     N TICK
226E 50C2       NASTAT  DATA    :50C2     N A
226F 50C3       NBSTAT  DATA    :50C3     N B
2270 50C4       NCSTAT  DATA    :50C4     N C
2271 50C5       NDSTAT  DATA    :50C5     N D
2272 50C6       NYSTAT  DATA    :50C6     N BY
2273 50C7       NSSTAT  DATA    :50C7     N STOP
2274 50C8       SGSTAT  DATA    :50C8     S BAD
2275 50C9       STSTAT  DATA    :50C9     S TICK
2276 50CA       SASTAT  DATA    :50CA     S A
2277 50CB       SBSTAT  DATA    :50CB     S B
2278 50CC       SCSTAT  DATA    :50CC     S C
2279 50CD       SDSTAT  DATA    :50CD     S D
227A 50CE       SYSTAT  DATA    :50CE     S BY
227B 50CF       SSSTAT  DATA    :50CF     S SPUR
                        *
                        *
     0041       STRDFG  EQU     :41       STORED TRAIN FLAG WORD
     0049       DISPFG  EQU     :49       DISPATCH TRAIN FLAG WORD
227C 5113       DROUT   DATA    :5113     CLOSE DOOR OUTPUT WORD
                        *
     000A       A       EQU     10
     000B       B       EQU     11
     000C       C       EQU     12
     000D       D       EQU     13
     000E       E       EQU     14
     000F       F       EQU     15
                        *
     0050       BIT0    EQU     :50
     0060       NBIT0   EQU     :60
227D 5078       ATKT01  DATA    :5078     WENT TO 1 ADDRESS
227E 5079               DATA    :5079
227F 507A               DATA    :507A
2280 507B               DATA    :507B
                        *
                        *
                        *        BYPASS FLAG HANDLER
                        *
                        *       THIS ROUTINE SETS AND RESETS THE BYPASS
                        *       FLAGS WHICH ALLOW THE SHUTTLING MODE.
                        *
                        *       THE FLAGS ARE RESET BY OCCUPANCY OF THE
                        *       BYPASS FLAG TRACK CIRCUITS.
                        *
                        *       THE FLAGS ARE SET BY LACK OF OCCUPANCY
                        *       WHEN IN ONE OF THE BYPASS MODES.
                        *
                        *
2281 B0BA 00BA  BYFLG   LDA     MODE      N TRACK IN BYPASS MODE ?
2282 822E 22B1          AND     NBYMSK
```

```
0907  2283 2114 2298          JAZ    SOUTH     NO, CHECK SOUTH TRACK
0908  2284 B08D 008D          LDA    TKIN+1    1ST, NBY TRACK OCC ?
0909  2285 8052 0052          AND    BIT0+2
0910  2286 310A 2291          JAN    RSTNBY    YES, RESET NBY
0911  2287 B0BB 00BB          LDA    BYFLAG    NO, SET NBY FLAG
0912  2288 A050 0050          IOR    BIT0+0
0913  2289 98BB 00BB          STA    BYFLAG
0914  228A B08D 008D  BY1     LDA    TKIN+1
0915  228B 8051 0051          AND    BIT0+1    14T, NST TK OCC ?
0916  228C 3108 2295          JAN    RSTNST    YES, RESET NST
0917  228D B0BB 00BB          LDA    BYFLAG    NO, SET NST FLAG
0918  228E A052 0052          IOR    BIT0+2
0919  228F 98BB 00BB          STA    BYFLAG
0920  2290 F207 2298          JMP    SOUTH     GO CHECK SOUTH TRACK
0921  2291 B0BB 00BB  RSTNBY  LDA    BYFLAG    RESET NBY FLAG
0922  2292 8060 0060          AND    NBIT0+0
0923  2293 98BB 00BB          STA    BYFLAG
0924  2294 F60A 228A          JMP    BY1       GO CHECK NST
0925  2295 B0BB 00BB  RSTNST  LDA    BYFLAG    RESET NST FLAG
0926  2296 8062 0062          AND    NBIT0+2
0927  2297 98BB 00BB          STA    BYFLAG
0928  2298 B0BA 00BA  SOUTH   LDA    MODE      S TRACK IN BYPASS MODE ?
0929  2299 8218 22B2          AND    SBYMSK
0930  229A 2114 22AF          JAZ    BYEND
0931  229B B08F 008F          LDA    TKIN+3
0932  229C 8050 0050          AND    BIT0+0    38T, SBY TK OCC ?
0933  229D 310A 22A8          JAN    RSTSBY    YES, RESET SBY
0934  229E B0BB 00BB          LDA    BYFLAG    NO, SET SBY FLAG
0935  229F A051 0051          IOR    BIT0+1
0936  22A0 98BB 00BB          STA    BYFLAG
0937  22A1 B08E 008E  BY2     LDA    TKIN+2
0938  22A2 805E 005E          AND    BIT0+E    37T, SST TK OCC ?
0939  22A3 3108 22AC          JAN    RSTSST    YES, RESET SST
0940  22A4 B0BB 00BB          LDA    BYFLAG    NO, SET SST FLAG
0941  22A5 A053 0053          IOR    BIT0+3
0942  22A6 98BB 00BB          STA    BYFLAG
0943  22A7 F207 22AF          JMP    BYEND
0944  22A8 B0BB 00BB  RSTSBY  LDA    BYFLAG    RESET SST FLAG
0945  22A9 8061 0061          AND    NBIT0+1
0946  22AA 98BB 00BB          STA    BYFLAG
0947  22AB F60A 22A1          JMP    BY2
0948  22AC B0BB 00BB  RSTSST  LDA    BYFLAG    RESET SST FLAG
0949  22AD 8063 0063          AND    NBIT0+3
0950  22AE 98BB 00BB          STA    BYFLAG
0951  22AF F300 22B0  BYEND   JMP    *RETURN
0952  22B0 202C       RETURN DATA   EXIT      RETURN TO MAIN PROGRAM
0953                  *
0954                  *
0955       00BB       BYFLAG EQU    :BB       BYPASS FLAG WORD
0956       00BA       MODE   EQU    :BA       MODE FLAG WORD
0957                  *
0958  22B1 0418       NBYMSK DATA   :0418     NBY MODES, 20,32,33
0959  22B2 0024       SBYMSK DATA   :0024     SBY MODES, 10,31
0961                  *
0962                  *
0963                  *      WORKING TABLES FOR TRAIN CONTROL
0964                  *
0965                  *
0966  5040                     ABS    :5040
0967                  *
0968                  *       GATE REQUEST PUSH BUTTONS
0969                  *
0970  5040 0000       GPBPV  DATA   0         PAST VALUE
0971  5041 0000              DATA   0
0972  5042 0000       GPBCHG DATA   0         CHANGE
0973  5043 0000              DATA   0
```

```
0974  5044 0000        GPBTO1 DATA   0        WENT TO 1
0975  5045 0000               DATA   0
0976  5046 0000        GPBTOZ DATA   0        WENT TO 0
0977  5047 0000               DATA   0
0978  5048 0000        PBSET  DATA   0        MAN SET
0979  5049 0000               DATA   0
0980  504A 0000        PBCAN  DATA   0        MAN CAN
0981  504B 0000               DATA   0
0982                   *
0983                   *      GATE INDICATIONS
0984                   *
0985  5060                     ABS    :5060
0986  5060 0000        GKPV   DATA   0        PAST VALUE
0987  5061 0000               DATA   0
0988  5062 0000        GKCHG  DATA   0        CHANGE
0989  5063 0000               DATA   0
0990  5064 0000        GKTO1  DATA   0        WENT TO 1
0991  5065 0000               DATA   0
0992  5066 0000        GKTOZ  DATA   0        WENT TO 0
0993  5067 0000               DATA   0
0994                   *
0995                   *      SWITCH POSITION INDICATIONS
0996                   *
0997  5068 0000        SWPV   DATA   0        PAST VALUE
0998  5069 0000               DATA   0
0999  506A 0000        SWCHG  DATA   0        CHANGE
1000  506B 0000               DATA   0
1001  506C 0000        SWTO1  DATA   0        WENT TO 1
1002  506D 0000               DATA   0
1003  506E 0000        SWTOZ  DATA   0        WENT TO 0
1004  506F 0000               DATA   0
1005                   *
1006                   *      TRACK CIRCUIT INDICATIONS
1007                   *
1008  5070 0000        TKPV   DATA   0        PAST VALUE
1009  5071 0000               DATA   0
1010  5072 0000               DATA   0
1011  5073 0000               DATA   0
1012  5074 0000        TKCHG  DATA   0        CHANGE
1013  5075 0000               DATA   0
1014  5076 0000               DATA   0
1015  5077 0000               DATA   0
1016  5078 0000        TKTO1  DATA   0        WENT TO 1
1017  5079 0000               DATA   0
1018  507A 0000               DATA   0
1019  507B 0000               DATA   0
1020  507C 0000        TKTOZ  DATA   0        WENT TO 0
1021  507D 0000               DATA   0
1022  507E 0000               DATA   0
1023  507F 0000               DATA   0
1024                   *
1025                   *      SOFTWARE LOCKOUT TABLE
1026                   *
1027  5156                     ABS    :5156
1028  5156 0000        LK     DATA   0        LOCKOUT BITS SET
1029  5157 0000               DATA   0        BY ROUTE SETUP
1030  5158 0000               DATA   0
1031  5159 0000               DATA   0
1032                   *
1033                   *      LOCKOUT TABLE
1034                   *      ABS *82
1035                   *      TLK DATA 0 LOCKOUT BITS
1036                   *      DATA 0 TK "ORED" WIT LK
1037                   *      DATA 0
1038                   *      DATA 0
1039                   *
1040                   *
```

```
                    *      TRACK CIRCUIT PAST PAST VALUES
                    *
5280                        ABS     :5280
5280 0000           TKPVV   DATA    0          TRACK CIRCUIT
5281 0000                   DATA    0          PAST PAST VALUES
5282 0000                   DATA    0
5283 0000                   DATA    0
5177                        ABS     :5177
                    *
                    *      GATE LOCKOUT TABLE
                    *
5177 0000           GKLKS   DATA    0          SET IN RSTUP
5178 0000                   DATA    0
5179 0000                   DATA    0
517A 0000                   DATA    0
                    *
                    *      NO DEPART TO RESET BIT TABLE
                    *
5260                        ABS     :5260
5260 0000           RBIT    DATA    0          NG
5261 0000                   DATA    0          NT
5262 0000                   DATA    0          NA
5263 0000                   DATA    0          NB
5264 0000                   DATA    0          NC
5265 0000                   DATA    0          ND
5266 0000                   DATA    0          NY
5267 0000                   DATA    0          NS
5268 0000                   DATA    0          SG
5269 0000                   DATA    0          ST
526A 0000                   DATA    0          SA
526B 0000                   DATA    0          SB
526C 0000                   DATA    0          SC
526D 0000                   DATA    0          SD
526E 0000                   DATA    0          SY
526F 0000                   DATA    0          SS
                    *
                    *
                    *
                    *                 ESTABLISHED ROUTE TABLE
                    *
                    *
                    *          THIS TABLE CONTAINS FIVE WORDS OF
                    *          INFORMATION ABOUT EACH ESTABLISHED
                    *          UNIT ROUTE. THIS TABLE IS USED BY
                    *          THE SETUP ROUTINE.
                    *
                    *
                    *          ESTRT       ENTRANCE
                    *          ESTRT+1     EXIT
                    *
                    *          ESTKEY      INFO LOCATION
                    *          ESTKEY+1    # OF WORDS
                    *
                    *          ESTTK       EXIT TRACK CIRCUIT
                    *
                    *
5880                        ABS     :5880
                    *
                    *
                    *
5880 0000           ESTRT   DATA    0          ENTRANCE
5881 0000                   DATA    0          EXIT
5882 0000                   DATA    0
5883 0000                   DATA    0
5884 0000                   DATA    0
5885 0000                   DATA    0
5886 0000                   DATA    0
```

```
5887 0000                DATA   0
5888 0000                DATA   0
5889 0000                DATA   0
588A 0000                DATA   0          ENTRANCE
588B 0000                DATA   0          EXIT
588C 0000                DATA   0
588D 0000                DATA   0
588E 0000                DATA   0
588F 0000                DATA   0
5890 0000                DATA   0
5891 0000                DATA   0
5892 0000                DATA   0
5893 0000                DATA   0
5894 0000                DATA   0          ENTRANCE
5895 0000                DATA   0          EXIT
5896 0000                DATA   0
5897 0000                DATA   0
5898 0000                DATA   0
5899 0000                DATA   0
589A 0000                DATA   0
589B 0000                DATA   0
589C 0000                DATA   0
589D 0000                DATA   0
589E 0000                DATA   0          ENTRANCE
589F 0000                DATA   0          EXIT
                    *
                    *
                    *
                    *
58A0 0000           ESTKEY DATA   0        KEY
58A1 0000                  DATA   0        KEY+1
58A2 0000                  DATA   0
58A3 0000                  DATA   0
58A4 0000                  DATA   0
58A5 0000                  DATA   0
58A6 0000                  DATA   0
58A7 0000                  DATA   0
58A8 0000                  DATA   0
58A9 0000                  DATA   0
58AA 0000                  DATA   0        KEY
58AB 0000                  DATA   0        KEY+1
58AC 0000                  DATA   0
58AD 0000                  DATA   0
58AE 0000                  DATA   0
58AF 0000                  DATA   0
58B0 0000                  DATA   0
58B1 0000                  DATA   0
58B2 0000                  DATA   0
58B3 0000                  DATA   0
58B4 0000                  DATA   0        KEY
58B5 0000                  DATA   0        KEY+1
58B6 0000                  DATA   0
58B7 0000                  DATA   0
58B8 0000                  DATA   0
58B9 0000                  DATA   0
58BA 0000                  DATA   0
58BB 0000                  DATA   0
58BC 0000                  DATA   0
58BD 0000                  DATA   0
58BE 0000                  DATA   0        KEY
58BF 0000                  DATA   0        KEY+1
                    *
                    *
                    *
                    *
58C0 0000           ESTTK  DATA   0        TKK
58C1 0000                  DATA   0        SPARE
```

```
1177  58C2 0000                DATA   0
1178  58C3 0000                DATA   0
1179  58C4 0000                DATA   0
1180  58C5 0000                DATA   0
1181  58C6 0000                DATA   0
1182  58C7 0000                DATA   0
1183  58C8 0000                DATA   0
1184  58C9 0000                DATA   0
1185  58CA 0000                DATA   0         TK
1186  58CB 0000                DATA   0         SPARE
1187  58CC 0000                DATA   0
1188  58CD 0000                DATA   0
1189  58CE 0000                DATA   0
1190  58CF 0000                DATA   0
1191  58D0 0000                DATA   0
1192  58D1 0000                DATA   0
1193  58D2 0000                DATA   0
1194  58D3 0000                DATA   0
1195  58D4 0000                DATA   0         TK
1196  58D5 0000                DATA   0         SPARE
1197  58D6 0000                DATA   0
1198  58D7 0000                DATA   0
1199  58D8 0000                DATA   0
1200  58D9 0000                DATA   0
1201  58DA 0000                DATA   0
1202  58DB 0000                DATA   0
1203  58DC 0000                DATA   0
1204  58DD 0000                DATA   0
1205  58DE 0000                DATA   0         TK
1206  58DF 0000                DATA   0         SPARE
1208                     *
1209                     *
1210                     *                FETCH SUBROUTINE
1211                     *
1212                     *
1213                     *          ENTER WITH WORD/BIT INFO IN A
1214                     *          RETURNS WITH A CONTAINING BIT
1215                     *
1216  5900                       ABS    :5900
1217  5900 0800          FETCH   ENT
1218  5901 EA0A 590C             STX    XSV       SAVE X REG
1219  5902 0048                  TAX
1220  5903 820B 590F             AND    NIBU      GET BIT NO.
1221  5904 0428                  EAX              PUT IN X
1222  5905 8208 590E             AND    WRDMSK    7FF0
1223  5906 10D3                  ARA    4
1224  5907 9A05 590D             STA    GWORD     INFO ADDRESS
1225  5908 B304 590D             LDA    *GWORD    GET INFO WORD
1226  5909 8450 0050             AND    @BIT0     MASK OUT BIT
1227  590A E201 590C             LDX    XSV       RESTORE X
1228  590B F70B 5900             JMP    *FETCH
1229                     *
1230  590C 0000          XSV     DATA   0         TEMP STORE
1231  590D 0000          GWORD   DATA   0         TEMP STORE
1232  590E 7FF0          WRDMSK  DATA   :7FF0     ADDRESS MASK
1233  590F 000F          NIBU    DATA   :000F
1234                     *
1235                     *
1236                     *                PACK1 SUBROUTINE
1237                     *
1238                     *          ENTER WITH WORD/BIT INFO IN A
1239                     *          PACKS BIT IN LOC SPECIFIED + 5000
1240                     *
1241                     *
1242  5910 0800          PACK1   ENT
1243  5911 EE05 590C             STX    XSV       SAVE X REG
```

```
5912 0048                TAX
5913 8604 590F           AND    NIBU      GET BIT NO.
5914 0428                EAX              PUT IN X
5915 8607 590E           AND    WRDMSK    7FF0
5916 10D3                ARA    4
5917 8A06 591E           ADD    FIVE1     5100 BIAS
5918 9E0B 590D           STA    GWORD     INFO ADDRESS
5919 B70C 590D           LDA    *GWORD    GET INFO WORD
591A A450 0050           IOR    @BIT0     PUT BIT IN
591B 9F0E 590D           STA    *GWORD    STORE
591C E610 590C           LDX    XSV       RESTORE X
591D F70D 5910           JMP    *PACK1
                *
591E 5100       FIVE1    DATA   :5100
591F 510E       NORSW    DATA   :510E
                *              PACK0 SUBROUTINE
                *
                *        ENTER WITH WORD/BIT INFO IN A
                *        PACKS 0 IN BIT SPECIFIED IN THE
                *        ADDRESS + 5100
                *
5920 0800       PACK0    ENT
5921 EE15 590C           STX    XSV       SAVE XREG
5922 0048                TAX
5923 8614 590F           AND    NIBU      GET BIT NO.
5924 0428                EAX              PUT IN X
5925 8617 590E           AND    WRDMSK    7FF0
5926 10D3                ARA    4
5927 8E09 591E           ADD    FIVE1     BIAS
5928 9E1B 590D           STA    GWORD     INFO ADDRESS
5929 B71C 590D           LDA    *GWORD    GET INFO WORD
592A 8460 0060           AND    @NBIT0    ZERO OUT BIT
592B 9F1E 590D           STA    *GWORD    STORE
592C E620 590C           LDX    XSV       RESTORE X
592D F70D 5920           RTN    *PACK0
592E 0000                NOP
592F 0000                NOP
                *
                *              PACK00 SUBROUTINE
                *
                *        ENTER WITH WORD/BIT INFO IN A
                *        PACKS 0 IN BIT SPECIFIED IN
                *        SWITCH REQUEST WORDS.
                *
5930 0800       PACK00   ENT
5931 EE25 590C           STX    XSV       SAVE XREG
5932 8623 590F           AND    NIBU      GET BIT NO.
5933 0048                TAX              PUT IN X
5934 B615 591F           LDA    NORSW     SW NOR REQ ADDRESS
5935 9E28 590D           STA    GWORD     POINTER
5936 B729 590D           LDA    *GWORD    GET INFO WORD
5937 8460 0060           AND    @NBIT0
5938 9F2B 590D           STA    *GWORD    STORE
5939 DE2C 590D           IMS    GWORD     2ND WORD ADDRESS
593A B72D 590D           LDA    *GWORD    GET INFO WORD
593B 8460 0060           AND    @NBIT0    ZERO BIT
593C 9F2F 590D           STA    *GWORD    STORE
593D E631 590C           LDX    XSV       RESTORE X
593E F70E 5930           RTN    *PACK00
                *
580C                     ABS    :580C     SUBROUTINE CALL FOR EXCIA
580C 2000                DATA   ETCENT    ETC ROUTINE
                         END

0000  ERRORS
0000  WARNING
```

| | | | | | | | | | |
|---|---|---|---|---|---|---|---|---|---|
| 0877 | A | 0461 | 0486 | 0643 | 0702 | | | | |
| 0259 | AGKCHG | 0140 | | | | | | | |
| 0257 | AGKIN | 0136 | | | | | | | |
| 0405 | AGKLKS | 0357 | | | | | | | |
| 0258 | AGKPV | 0138 | | | | | | | |
| 0260 | AGKTO1 | 0142 | 0214 | | | | | | |
| 0261 | AGKTOZ | 0144 | 0355 | 0391 | | | | | |
| 0275 | AGPBCH | 0204 | | | | | | | |
| 0273 | AGPBIN | 0200 | | | | | | | |
| 0274 | AGPBPV | 0202 | | | | | | | |
| 0276 | AGPBT1 | 0206 | | | | | | | |
| 0277 | AGPBTZ | 0208 | | | | | | | |
| 0515 | ALK | 0312 | 0467 | 0469* | 0474 | 0476* | 0481 | 0483* | 0488 |
| | | 0490* | 0495 | 0497* | 0502 | 0504* | 0509 | 0511* | |
| 0829 | ALR | 0675 | 0689 | 0697 | 0705 | 0713 | 0721 | 0729 | 0737 |
| | | 0745 | 0753 | 0761 | 0769 | 0780 | 0791 | 0802 | 0813 |
| | | 0843 | | | | | | | |
| 0839 | ALR1 | 0832 | | | | | | | |
| 0278 | APBCAN | 0210 | | | | | | | |
| 0279 | APBSET | 0212 | | | | | | | |
| 0267 | ASWCHG | 0174 | | | | | | | |
| 0265 | ASWIN | 0170 | | | | | | | |
| 0266 | ASWPV | 0172 | | | | | | | |
| 0268 | ASWTO1 | 0176 | | | | | | | |
| 0269 | ASWTOZ | 0178 | | | | | | | |
| 0252 | ATKCHG | 0110 | | | | | | | |
| 0250 | ATKIN | 0106 | | | | | | | |
| 0251 | ATKPV | 0108 | | | | | | | |
| 0886 | ATKTO1 | | | | | | | | |
| 0420 | ATKTOZ | 0114 | 0558 | 0562 | 0572 | 0576 | 0580 | 0584 | 0594 |
| | | 0598 | 0602 | 0606 | 0616 | 0620 | 0624 | 0628 | 0638 |
| | | 0642 | 0646 | 0650 | 0654 | 0658 | | | |
| 0878 | B | 0443 | 0455 | 0493 | 0585 | 0589 | 0599 | 0636 | 0639 |
| | | 0655 | 0718 | | | | | | |
| 0850 | BIT | 0839 | | | | | | | |
| 0884 | BIT0 | 0443 | 0446 | 0449 | 0452 | 0455 | 0458 | 0461 | 0465 |
| | | 0472 | 0479 | 0486 | 0493 | 0500 | 0507 | 0559 | 0563 |
| | | 0567 | 0570 | 0573 | 0577 | 0581 | 0585 | 0589 | 0592 |
| | | 0595 | 0599 | 0603 | 0607 | 0611 | 0614 | 0617 | 0621 |
| | | 0625 | 0629 | 0633 | 0636 | 0639 | 0643 | 0647 | 0651 |
| | | 0655 | 0659 | 0831 | 0834 | 0909 | 0912 | 0915 | 0918 |
| | | 0932 | 0935 | 0938 | 0941 | 1226 | 1252 | | |
| 0519 | BTKTO1 | 0442 | 0445 | 0448 | 0451 | 0454 | 0457 | 0460 | |
| 0914 | BY1 | 0924 | | | | | | | |
| 0937 | BY2 | 0947 | | | | | | | |
| 0951 | BYEND | 0930 | 0943 | | | | | | |
| 0955 | BYFLAG | 0911 | 0913* | 0917 | 0919* | 0921 | 0923* | 0925 | 0927* |
| | | 0934 | 0936* | 0940 | 0942* | 0944 | 0946* | 0948 | 0950* |
| 0905 | BYFLG | 0814 | | | | | | | |
| 0879 | C | 0595 | 0734 | | | | | | |
| 0288 | CAN | 0211* | 0226 | 0227* | 0238* | | | | |
| 0285 | CHG | 0111* | 0120* | 0123 | 0130* | 0141* | 0154* | 0157 | 0164* |
| | | 0175* | 0184* | 0187 | 0194* | 0205* | 0220* | [illegible] | [illegible] |
| 0246 | CNT | 0117* | 0133* | 0147* | 0167* | 0181* | 0197* | 0217* | [illegible] |
| | | 0310* | 0322* | | | | | | |
| 0253 | CTKTO1 | 0112 | | | | | | | |
| 0880 | D | 0500 | 0659 | 0750 | | | | | |
| 0538 | DIR | 0569 | 0591 | 0613 | 0635 | | | | |
| 0874 | DISPFG | 0668 | 0670* | 0682 | 0684* | 0776 | 0778* | 0787 | 0789* |
| | | 0798 | 0800* | 0809 | 0811* | | | | |
| 0875 | DROUT | 0671 | 0673* | 0685 | 0687* | 0693 | 0695* | 0701 | 0703* |
| | | 0709 | 0711* | 0717 | 0719* | 0725 | 0727* | 0733 | 0735* |
| | | 0741 | 0743* | 0749 | 0751* | 0757 | 0759* | 0765 | 0767* |
| 0881 | E | 0507 | 0603 | 0633 | 0766 | 0785 | 0788 | 0836 | |

```
0040  ENDPUT
1138  ESTKEY
1102  ESTRT
1175  ESTTK
0104  ETCRNT    0150  1306
0150  EXIT      0952
0882  F         0807  0810
1217  FETCH     1228
1257  FIVE1     1249  1273
0230  GK        0215* 0230  0240*
0349  GK1       0336  0341
0988  GKCHG
0404  GKLK      0360  0361* 0366  0367* 0372  0373* 0378  0379*
                0382  0384  0385* 0388  0389  0390* 0394  0395
                0396* 0399  0400  0401*
0156  GKLKON    0346
1052  GKLKS     0405
0350  GKPB      0337  0342
0986  GKPV
0152  GKTAB     0148  0168
0990  GKT01
0992  GKT02
0972  GPBCHG
0970  GPBPV
0218  GPBTAB    0242
0974  GPBT01
0976  GPBT02
1231  GWORD     1224* 1225  1250* 1251  1253* 1274* 1275  1277*
                1294* 1295  1297* 1298* 1299  1301*
0283  IN        0107* 0118  0121  0126  0128* 0137* 0152  0155
                0160  0162* 0171* 0182  0185  0190  0192* 0201*
                0218  0221  0228  0231  0233* 0358* 0359  0363*
                0364* 0365  0369* 0370* 0371  0375* 0376* 0377
                0381*
1028  LK
0314  LK1       0323
0445  LK2       0466  0470
0448  LK3       0473  0477
0451  LK4       0480  0484
0454  LK5       0487  0491
0457  LK6       0494  0498
0460  LK7       0501  0505
0463  LK8       0508  0512
0435  LKCAN     0412
0464  LKNA      0444
0471  LKNC      0447
0478  LKND      0450
0309  LKOUT     0244
0492  LKSA      0456
0499  LKSC      0459
0506  LKSD      0462
0485  LKST      0453
0418  MASK      0410
0956  MODE      0905  0928
0707  NACAN     0587
0525  NAMSK     0468
0857  NASTAT    0708*
0723  NBCAN     0605
0885  NBIT0     0666  0669  0672  0680  0683  0686  0694  0702
                0710  0718  0726  0734  0742  0750  0758  0766
                0774  0777  0785  0788  0796  0799  0807  0810
                0837  0922  0926  0945  0949  1276  1296  1300
0858  NBSTAT    0724*
0956  NBYMSK    0906
0739  NCCAN     0619  0623
```

```
0526  NCMSK     0475
0859  NCSTAT    0740*
0755  NDCAN     0631
0527  NDMSK     0482
0860  NDSTAT    0756*
0663  NGCAN     0561
0855  NGSTAT    0664*
1233  NIBU      1220  1245  1269  1291
0848  NOGOFG    0841  0842*
1258  NOPSW     1293
0793  NSCAN     0657
0862  NSSTAT    0794*
0691  NTCAN     0575  0579
0856  NTSTAT    0692*
0771  NYCAN     0649
0861  NYSTAT    0772*
1266  PACK0     1279
1289  PACK00    1303
1242  PACK1     1255
0980  PBCAN
0417  PBRUN     0438
0978  PBSET
0284  PV        0109* 0119  0124  0127* 0129* 0139* 0153  0158
                0161* 0163* 0173* 0183  0188  0191* 0193* 0203*
                0219  0224  0229* 0234*
1060  RBIT
0952  RETURN    0951
0849  RNALR     0833  0835*
0847  RNFLG     0830  0836  0838*
0921  RSTNBY    0910
0925  RSTNST    0916
0944  RSTSBY    0933
0948  RSTSST    0939
0537  RUNTH     0566  0588  0610  0632
0715  SACAN     0597  0601
0529  SAMSK     0496
0865  SASTAT    0716*
0731  SBCAN     0609
0866  SBSTAT    0732*
0959  SBYMSK    0929
0747  SCCAN     0627
0530  SCMSK     0503
0867  SCSTAT    0748*
0763  SDCAN     0641  0645
0531  SDMSK     0510
0868  SDSTAT    0764*
0289  SET       0213* 0232* 0239* 0313* 0316  0317* 0320*
0677  SGCAN     0565
0863  SGSTAT    0678*
0928  SOUTH     0907  0920
0804  SSCAN     0661
0870  SSSTAT    0805*
0562  STA1      0560  0676
0628  STA10     0626  0754
0642  STA11     0634  0637  0762
0632  STA111    0630
0646  STA12     0640  0644  0770
0650  STA13     0648  0781
0654  STA14     0652  0792
0658  STA15     0656  0803
0662  STA16     0660
0576  STA2      0568  0571  0690
0566  STA21     0564
0580  STA3      0574  0578  0698
```

```
0584  STA4      0582  0706
0598  STA5      0590  0593  0714
0588  STA51     0586
0602  STA6      0596  0600  0722
0606  STA7      0604  0730
0620  STA8      0612  0615  0738
0610  STA81     0608
0624  STA9      0618  0622  0746
0558  STACAN    0463
0814  STAEND    0662
0336  STALK     0324
0349  STALK1    0339  0340* 0344  0345*
0699  STCAN     0583
0528  STMSK     0489
0873  STRDFG    0665  0667* 0679  0681* 0773  0775* 0784  0786*
                0795  0797* 0806  0808*
0864  STSTAT    0700*
0999  SWCHG
0997  SWPV
0188  SWTAB     0198
1001  SWT01
1003  SWT02
0782  SYCAN     0653
0869  SYSTAT    0783*
0416  TBIN
0534  TBOUT     0425
1012  TKCHG
0326  TKIN      0314  0318  0908  0914  0931  0937
0327  TKLK      0319*
1008  TKPV
1044  TKPVV
0118  TKTAB     0134
1016  TKT01
1020  TKT02
0286  T01       0113* 0122* 0131* 0143* 0156* 0165* 0177* 0186*
                0195* 0207* 0222* 0236*
0287  T02       0115* 0125* 0132* 0145* 0159* 0166* 0179* 0189*
                0196* 0209* 0225* 0237* 0356* 0382  0386* 0387
                0392* 0391  0397* 0398
0533  TRNBAK    0437* 0440  0441* 0464  0471  0478  0485  0492
                0499  0506
0535  TRNBK     0436
0412  TS1
0414  TSIN      0409
0415  TSLK      0411*
0409  TSPLK     0402
1232  WRDMSK    1222  1247  1271
1230  XSV       1218* 1227  1243* 1254  1267* 1278  1290* 1302
1307 SOURCE LINES
```

I claim:

1. In apparatus for determining the route of a train including at least one vehicle moving along a roadway track having a known track plan, with said track including a plurality of stations and including at least one switch having a signal gate operative in response to movement of said train through one of said stations, the combination of first means responsive to the train's being positioned at a predetermined location ahead of said one station and established by the movement time of said train to said one station, second means storing available routes determined in accordance with said track plan for said train to move to said one station from a second station positioned ahead of said one station, third means coupled with said first means and coupled with said second means for selecting one of the available routes to said one station and for clearing said one route including the signal gate such that the movement of the train to said one station along said one route from said second station is permitted by said gate.

2. The route determining apparatus of claim 1, operative with a train having a known maximum speed of approach to said one station, with said location being selected with regard to the time required for the train to travel to said signal gate when moving at said maximum speed.

3. The apparatus of claim 1, operative with a train having a length and a number, and including, fourth means coupled with the train responsive first means to establish that a train run-through of said one station is desired for sending at least one of the train length and the train number to the next station after said one station.

4. The apparatus of claim 3, with said run-through establishing fourth means determining the run time from the second station of the train to said one station.

5. The apparatus of claim 1 operative with a train having a desired direction of movement, and including means responsive to the train's stopping at said second station to determine if said one station is the desired next station for the train in relation to the desired direction of movement.

6. The apparatus of claim 1 with said roadway track having hardware interlocking equipment, with said third means being coupled with said interlocking equipment for clearing the signal gate.

7. The apparatus of claim 1, with said predetermined location being the second station, and with the third means selecting one of the available routes to said one station during the time period that the train is positioned in the second station.

8. The apparatus of claim 1, with the third means determining how long the train has been positioned at said predetermined location to release the train to move to said one station after a predetermined time period at said location.

9. The apparatus of claim 1, with the third means storing the available routes in a route table including entrance signal gates and exit signal gates to said one station.

10. The apparatus of claim 1, with said one vehicle having doors, and including said third means being responsive to the opening of the vehicle doors before selecting one of the available route and clearing the signal gate.

11. The apparatus of claim 1, with said third means being operative when the train occupies the second station to provide a predetermined station entry logic operation, then a predetermined in station logic operation, followed by a predetermined station exit logic operation before the one vehicle moves to said one station.

12. The apparatus of claim 1, with said third means clearing said one route during one of the time period of the train in the second station or while the second station is being run through.

13. In a method of controlling the movement of a train including at least one vehicle along a track having a known track plan, and which track includes at least two stations and a signal gate, the steps of determining available routes from a first to a second of said stations in relation to said track plan, responding to the train's arriving at a predetermined location ahead of the second station such that a desired time period is available at that location to clear a route to the second station before the train will have to slow down or stop in front of said signal gate when the train is moving at a known maximum permitted speed, selecting one of the available routes to the second station for the train to move to said second station, and clearing said one available route including said signal gate to the second station.

14. The method of claim 13, with the step of clearing said one available route being operative during either the time period of the train's remaining in said first station when that train stops in the first station or while the first station is being run through.

15. The method of claim 13, with the desired time period being selected with regard to the time required for the train to move from the first station to the second station when moving at that maximum permitted speed.

16. The method of claim 13, with the vehicle having a known direction of movement, and with said selecting one of the available routes being in relation to the known direction of movement from the first station to the second station.

* * * * *